US006020906A

United States Patent [19]

Adams et al.

[11] Patent Number: 6,020,906

[45] Date of Patent: Feb. 1, 2000

[54] RIBBON DRIVE SYSTEM FOR A THERMAL DEMAND PRINTER

[75] Inventors: Vincent C. Adams, Buffalo Grove; Jeffrey R. Kaufman, Waukegan; Dan E. Monnier, Arlington Heights; Michael K. Platt, Mt. Prospect; David L. Poole, Libertyville; David A. West, Streamwood; David S. Zubriski, Addison; Thomas P. Zwier, Buffalo Grove; Daniel F. Donato, Mundelein; James W. Ensinger, Palatine; William J. Hamman, Justice; Kenneth V. Naegele, Vernon Hills, all of Ill.

[73] Assignee: Zebra Technologies Corporation, Vernon Hills, Ill.

[21] Appl. No.: 09/288,131

[22] Filed: Apr. 7, 1999

Related U.S. Application Data

[62] Division of application No. 08/789,166, Jan. 24, 1997, which is a division of application No. 07/957,262, Oct. 2, 1992, Pat. No. 5,657,066.

[51] Int. Cl.[7] ..... B65H 75/22; B41J 33/14

[52] U.S. Cl. ..... 347/217; 242/571; 242/571.4; 242/571.5; 242/573.9

[58] Field of Search ..... 242/571, 571.4, 242/571.5, 573.9; 347/217

[56] References Cited

U.S. PATENT DOCUMENTS

| | | |
|---|---|---|
| 1,466,121 | 8/1923 | Dallas . |
| 2,345,246 | 3/1944 | Elka . |
| 2,655,322 | 10/1953 | Longfellow . |
| 3,058,686 | 10/1962 | Field . |
| 3,684,207 | 8/1972 | Kawamura . |
| 4,142,690 | 3/1979 | Karle et al. . |
| 4,699,531 | 10/1987 | Ulinski, Sr. et al. . |
| 4,944,468 | 7/1990 | Damour . |
| 5,015,324 | 5/1991 | Goodwin et al. . |
| 5,028,155 | 7/1991 | Sugiura et al. . |

FOREIGN PATENT DOCUMENTS

| | | |
|---|---|---|
| 0345764 | 12/1989 | European Pat. Off. . |
| 1140428 | 11/1962 | Germany . |
| 2137754 | 2/1973 | Germany . |
| 6144712 | 5/1994 | Japan . |
| 1352546 | 5/1974 | United Kingdom . |

OTHER PUBLICATIONS

Patent Abstracts of Japan, vol. 013, No. 143(M–811), Apr. 7, 1989 and JP 63 306147 A(Sony Corp.), Dec. 14, 1988.

*Primary Examiner*—Huan Tran
*Attorney, Agent, or Firm*—Trexler, Bushnell, Giangiorgi & Blackstone, Ltd.

[57] ABSTRACT

A demand printer for printing on media includes a ribbon take-up spindle for accumulating spent printing ribbon and facilitating removal of the spent ribbon from the spindle. The spindle has a surface with a protrusion bore formed therethrough. At least one protruding segment extends through the protrusion bore. The protruding segment controllably projects away from the spindle surface for maintaining a space between a portion of the spindle surface and the spent ribbon accumulated on the spindle. A biasing structure is operatively associated with the spindle and the protruding segment for controllably biasedly directing the protruding segment through the protrusion bore in the spindle. A retracting structure is provided for controllably compressing and expanding the biasing means to controllably move the protruding segment through the protrusion bore.

2 Claims, 111 Drawing Sheets

LEDDAT
LEDCLK
MROMCS*
DRAMCS*
DIPDAT
DIPCLK
DIPS/L
<5C8>
<5B8>
<4C8>
<3A8>
<5A8>
<5A8>
<5A8>
VCC
D13
1N4148
R72
68K
C48
.22uF
R69
4.7K
R62
10K
R71 470K
U22A
LM339
R70
1K
R51
1K
R61
4.7K
RESET*

| | | |
|---|---|---|
| FIG. 37A | FIG. 37B | FIG. 37C |
| FIG. 37D | FIG. 37E | FIG. 37F |
| FIG. 37G | FIG. 37H | FIG. 37I |

| | | |
|---|---|---|
| FIG. 38A | FIG. 38B | FIG. 38C |
| FIG. 38D | FIG. 38E | FIG. 38F |
| | | FIG. 38G |

Software Note:

If 27C010 or 27C020 parts are used for U15 or U16, they must be addressed so that A19 (pin 1) is always high (1).

| | | |
|---|---|---|
| FIG. 39A | FIG. 39B | FIG. 39C |
| FIG. 39D | FIG. 39E | FIG. 39F |
| FIG. 39G | FIG. 39H | |

| | | |
|---|---|---|
| FIG. 40A | FIG. 40B | FIG.40C |
| FIG. 40D | FIG. 40E | FIG. 40F |
| FIG. 40G | FIG. 40H | |

| FIG. 41A | FIG. 41B |
|---|---|

| | |
|---|---|
| FIG. 42A | FIG. 42B |
| FIG. 42C | FIG. 42D |

| | |
|---|---|
| FIG. 43A | FIG. 43B |
| FIG. 43C | FIG. 43D |

J8
1
2
CONNECT 2
REWIND FULL SW
J6
1 2 3 4 5 6 7 8
CONNECT 8
MEDIA/RIBBON SENSORS
VCC
R104
4.7K
+12
+5F
R105
4.7K
RWNDFUL*
RIRED
MIRED
MPT
RPT
<9B1>
<8B1>
<8C8>
<9C8>
<2B8>
J11
1 2 3 4
CONNECT 4
SENSOR ADJUST
+5F
TP7
TP6
<9B1>
<8B1>

| FIG. 47A | FIG.47B |
|---|---|

MOTOR PHASE TABLE

| QC | QB | QA | PH1 | PH2 | PH3 | PH4 |
|---|---|---|---|---|---|---|
| 0 | 0 | 0 | 0 | 0 | 0 | 1 |
| 0 | 0 | 1 | 1 | 0 | 0 | 1 |
| 0 | 1 | 0 | 1 | 0 | 0 | 0 |
| 0 | 1 | 1 | 1 | 0 | 1 | 0 |
| 1 | 0 | 0 | 0 | 0 | 1 | 0 |
| 1 | 0 | 1 | 0 | 1 | 1 | 0 |
| 1 | 1 | 0 | 0 | 1 | 0 | 0 |
| 1 | 1 | 1 | 0 | 1 | 0 | 1 |

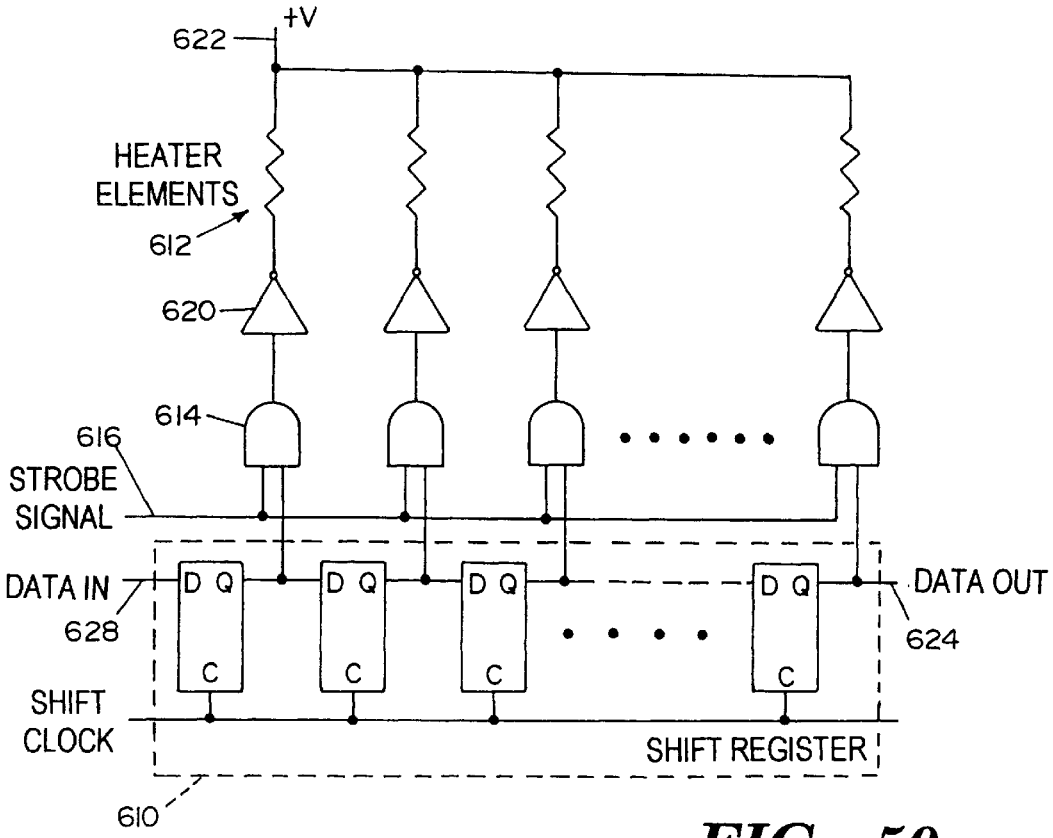
*FIG. 50*
*FIG. 51*
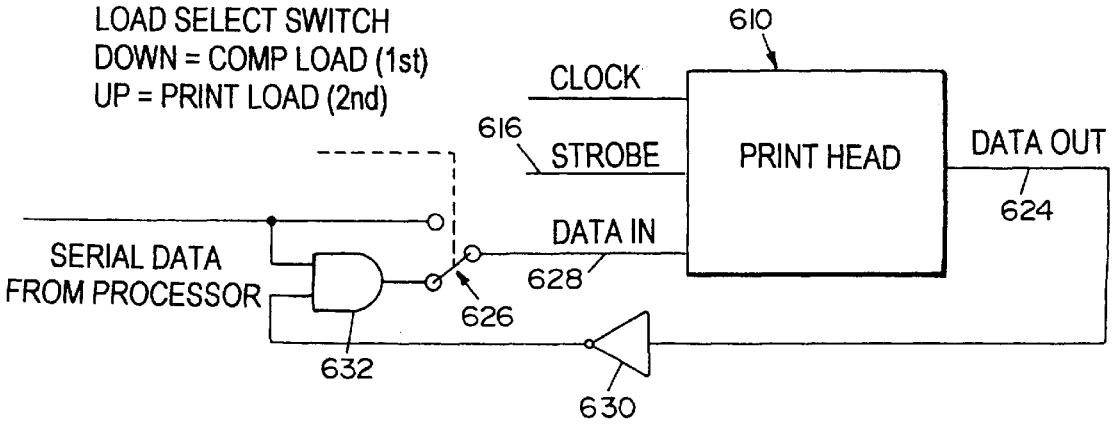

RIBBON DRIVE SYSTEM FOR A THERMAL DEMAND PRINTER

This is a division of copending application Ser. No. 08/789,166, filed on Jan. 24, 1997 which is a divisional of Ser. No. 07/957,262 filed on Oct. 2, 1992, now U.S. Pat. No. 5,657,066.

BACKGROUND OF THE INVENTION

The present invention relates to direct thermal and thermal transfer demand printers and specifically to direct thermal and thermal transfer printers for printing on tickets, tags, and pressure-sensitive labels. Some aspects of the invention also relate to printers using other printing techniques such as laser printing, LED printing, etc.

Direct thermal and thermal transfer printers are well known in the prior art. For thermal transfer printing on nonsensitized materials such as paper or plastics, a transfer ribbon coated on one side with a heat-transferrable ink layer is interposed between the media to be printed and a thermal printhead having a line of very small heater elements. When an electrical pulse is applied to a selected subset of the heater elements, localized melting and transfer of the ink to the paper occurs underneath the selected elements, resulting in a corresponding line of dots being transferred to the media surface.

For direct thermal printing on sensitized materials, no transfer ribbon is used and the heater elements act directly to produce chemical or physical change in a dye coating on the surface of the material. The balance of this disclosure discusses thermal transfer printing, but it should be clear that many aspects of the present invention apply equally to direct thermal printing, laser printing, LED printing, and perhaps others as well.

After each line of dots is printed, the material or printhead is repositioned to locate the printhead over an adjacent location, the transfer ribbon is repositioned to provide a replenished ink coating, and the selecting and heating process is repeated to print an adjacent line of dots. Depending upon the number and pattern of heaters and the directions of motion of the head and paper, arrays of dots can produce individual characters or, as in the preferred embodiment, successive rows of dots are combined to form complete printed lines of text, bar codes, or graphics.

Applications of such printers include the printing of individual labels, typically pressure-sensitive labels, tickets, and tags. Pressure-sensitive labels are commonly presented on a continuous web of release material (e.g., waxed paper backing) with a gap between successive labels. Tickets and tags may likewise be presented as a continuous web with individual tickets or tags defined by a printed mark or by holes or notches punched therein. Tickets and tags also may likewise be presented on a continuous web with individual tickets or tags defined by a printed mark or by holes, slits, or gaps punched therein.

An optical sensor may be used for the alignment of the printed image with the leading edge of each label. The optical sensor comprises an illumination source such as a light-emitting diode ("LED") or incandescent lamp, and a photo-detector such as a photo resistor, photo transistor, or photo diode. The illumination source and the photo detector typically, but without limitation, function at an infrared wavelength. In the preferred embodiment(s), the sensor is disposed through the, web so as to respond to the change in relative opacity of the backing and label materials, or to a hole or notch punched in the web. In other embodiments, the sensor reflects light off the back side of the web and responds to a printed mark thereon.

Such printers also may be adapted to permit the removal of individual labels as they are printed. The construction of the printhead may be such that the web and ribbon are advanced by the length of the inter-label gap plus a significant fraction of an inch after printing of each label and before stopping for removal of the label, in which case the web and ribbon must be backfed an equal distance before printing the next label to avoid leaving an unprintable area of the label.

The power flow to each heater element during energization is relatively constant, being determined by the supply voltage and the electrical resistance of the heater. The energy per printed dot for uniform ink transfer is a function of the web speed and the average printhead temperature. When printing individual labels, the web speed may not be constant, but may be smoothly accelerated and decelerated to allow for inertia of the mechanism. This requires changes in the energization to maintain uniform print quality across the areas printed during speed changes.

Such printers should complete the individual labels as rapidly as practical upon receipt of data therefor. Printing of a label requires three steps: receipt by the controller of a label description in a terse label-description language describing the known objects to be printed, such as text and bar codes but not the dot patterns from which they are formed; formation of the label image in a bit-map memory by the controller, where bits in the map correspond to physical dots in the image; and transfer of the dots forming the label image from bit-map to the printhead, energization of the printhead, and feeding of the web and transfer ribbon as described above.

The thermal transfer ribbon may be fed from a supply roll before printing and then taken up on a take-up spindle after use. Some prior art thermal printers use a slip clutch to maintain a tension on the ribbon take-up spindle. The slip clutch creates a constant torque output on the ribbon take-up spindle. Thus, the slip clutch does not compensate for the decrease in tension due to the increasing radius of the take-up spindle. Further disadvantages result from the use of a clutch. The clutch puts an additional load on the stepper motor, and as a result, the stepper motor must be larger and its drive circuitry must operate at higher power levels. Also, the ribbon tension is not easy to adjust using a slip clutch. Finally, changes in tension occur due to clutch wear from use unless the clutch is calibrated periodically readjusted.

Prior art printers typically have been housed in case structures which have not accounted for ease of assembly, ease of repair, and reduction in manufacturing costs. Additionally, the case structures for prior art thermal printers has not been designed optimally to accommodate typical operating environments and conditions.

For example, studies of thermal printers in the work place have disclosed that often the thermal printers are operated with a main cover in an open position in order to provide ease of access in loading and changing media as well as ribbon stock. As a result of operating the thermal printer with the main panel in the open position, the cover often may become damaged or broken off of the printer body. As such, it would be preferable to provide a case structure for a thermal printer which allows for easy removal of the main cover.

Prior art thermal printer case structures involve numerous fasteners and body members in their assembly. These case structures often were formed of stamped and formed sheet metal plates. The numerous fasteners and components in the case structure required additional time in the initial assembly as well as additional time when repairing the thermal printer. As such, it is desirable to provide a thermal printer case structure which can be quickly and easily assembled with as few fasteners as possible and conveniently disassembled when necessary.

Prior art thermal printers have another problem with regard to assembly and disassembly of subassemblies. The various components or subassemblies often were interrelated and interconnected. As such, when the prior art thermal printer was being assembled or repaired, additional assembly or disassembly time was required. Additionally, the prior art printers were difficult to reconfigure for a variety of printing operations due to the interconnection and interrelation of the subassemblies.

Prior art printers also have another problem with regard to the platen roller used in the device. In a printer, a platen usually includes a platen shank which defines a cylindrical platen surface. The platen shank has shaft portions projecting from either end which are typically engaged in some form of ball bearing roller assembly. The roller assembly and platen roller are attached to a frame portion of the case structure to retain the platen roller in a desired position. Because a high degree of precision is required in the position of the platen, complex snap ring washers and roller assemblies were devised to mount the platen roller in the case structure. However, such complex assemblies create difficulties in manufacturing, and repair of the printer. As such, it is desirable to provide a platen roller which simplifies the mounting of the platen roller in the case structure.

As discussed above, the prior art thermal printing devices may be quite complex and burdensome in the assembly and disassembly process. The printhead assembly of the prior art thermal printers can also be quite complex and require substantial effort to assemble or repair. One form of prior art printer employs a printhead assembly which pivots about an axis which lies between the platen frame and the case structure. This arrangement provides only a single degree of freedom and hence a high precision adjustment of the printhead relative to the platen and the print medium is difficult if not impossible to achieve. In other words, the frame structure which supports the platen roller is mounted to the case structure and provides a foundation for the printhead assembly. This arrangement of the printhead limits movement of the printhead to only a pitching movement towards and away from the platen. Because the printhead's assembly is limited to one of the three degrees of motion, high precision fine adjustment of the printhead relative to the print medium can be difficult if not impossible to achieve.

Additionally, the arrangement of the printhead assembly as discussed resulted in adjustment portions of the printhead assembly being difficult to access during a printing operation. As such, adjustments to the printhead assembly must be carried out by numerous iterations of printing a desired label and stopping the machine for adjustment. Such an iterative procedure for adjustment can be quite time consuming and therefore inefficient.

Having reviewed the problems with the case structure, platen roller and printhead assembly of the prior art thermal printers, we now turn to the media delivery system or assembly and the problems found therein in prior art thermal printers. While such media delivery assemblies achieved their purpose, there are several with problems which would be desirable to overcome. The unaided removal of spent transfer ribbon from the take-up spindle is difficult, in that the ribbon is typically a very thin plastic material with a printing substance applied thereto. As the take-up spindle winds up the spent printing ribbon, the ribbon tends to wind rather tightly around the outside surface of the spindle. Additionally, the thin plastic material tends to be somewhat slippery and difficult to grip when trying to remove it from the spindle for disposal.

One prior art printer uses an empty ribbon core attached to the spindle to accumulate the spent printing ribbon. An empty core is attached to the take up spindle and the spent ribbon is wound around the empty core. When disposing of the spent ribbon, the core is slipped off of the spindle and the empty core, with the spent ribbon wound there around is disposed of. This method is problematic in that an empty core must be made available every time spent ribbon is to be accumulated. If a core is not available, ribbon could be wound around the spindle without the core, however, removal of the spent ribbon from the spindle without the core is a very difficult task.

Another way of overcoming the problem of disposing of spent ribbon is to provide a spindle which has a wire form to provide a space between the spent ribbon and the outer surface of the spindle. In this regard, a U-shaped wire form is positioned on the spindle with one leg of the U-shaped wire form extending into the spindle generally parallel with a central spindle axis and a second leg of the wire form placed on the surface of the spindle or slightly above the surface of the spindle. As ribbon is wound around the wire form on the spindle a space is created between the spent ribbon and the spindle surface-. When the spent ribbon is to be disposed of, the wire form is removed from the spindle and the spent ribbon is axially slipped off of the spindle. This form of take-up spindle, however, can be problematic in that it employs loose parts and still requires the removal of a component relative to the spent ribbon. For example, the U-shaped wire form could be lost which would create the problem of winding spent ribbon around a bare spindle or replacement of the wire form. Additionally, removal of the wire form from beneath the tightly wrapped spent ribbon can be somewhat difficult and is comparable to removal of spent ribbon from a spindle without the wire form.

A problem arises in prior art printers with the consistency of back tension on the transfer ribbon. printing ribbon. This back tension is critical to the smooth flow of transfer ribbon through the media path during the printing operation. This requires that a relatively constant back tension be maintained on the ribbon supply roll during both forward feed during printing and during the back feed operation discussed above. If sufficient tension is not retained in the ribbon, or if a slack develops during back feed, the ribbon may tend to smear or mark the media adjacent to it. In this regard, some prior art printers have devised clutch mechanisms to provide back tension on the printing ribbon. However, many clutch mechanisms were rather complex requiring numerous parts for proper operation. Accordingly, numerous parts resulted in additional costs as well as assembly and repair time and effort. As such, it would be desirable to provide a simplified clutch mechanism for use with a thermal printer.

Printers are often shipped overseas, which requires that they be able to operate from 240 volt power sources. One prior art way of accommodating both 120 and 240 volt operation in the same power supply design is by use of a jumper to select the desired operating voltage. It is further desirable to build and keep printers in semi-finished form and then adapt the semi-finished unit to either 120 volt or 240 volt operation just before shipment.

SUMMARY OF THE INVENTION

It is an object of the invention to provide a new and improved printer for printing various indicia on tickets, tags, pressure-sensitive labels and other media.

A general object of the present invention is to provide a relatively constant tension on the transfer ribbon during operations.

Another object of the present invention is to provide a ribbon-tension system that is self-correcting.

It is a further object of the present invention to provide a PWM regulator circuit to provide constant ribbon take-up tension independent of the motor supply voltage.

It is a specific object of the present invention to provide the printer with constant ribbon supply and take-up tension during backfeeding.

It is another objective of the present invention to provide a demand printer having a media sensor which automatically compensates for web opacity and reflectivity variations.

It is a related objective to provide a demand printer having a media sensor which operates independently of ambient light, and which is immune to changes in radiating efficiencies of the illumination source and photo detector operating point due to temperature changes or component aging.

It is an object of this invention to provide a low cost, inherently safe method for converting semi-finished units from one voltage setting to the other without a requirement for tools, and to provide a structure which is inherently safe after the voltage setting operation has been performed.

Briefly, and in accordance with the foregoing, the present invention comprises a thermal demand printer of the type used for printing on tickets, tags, pressure-sensitive labels and other media. The thermal demand printer of the present invention is a novel and non-obvious system including various components novel and non-obvious. The printer includes a case structure including a hinged cover panel, easily removable guide structures and media hanger, and a single central support wall to which the various components are attached. The printer includes a power supply circuit for receiving power from an external source and conditioning it for operation of the printer. An input device is provided for receiving command signals related to the operation of the printer. A control circuit is mounted in the case structure and coupled to the input device and the power supply circuit for processing the command signals and generating corresponding control signals for controlling the operation of the printer. A printhead assembly is mounted in the case structure and coupled to the input device and the power supply circuit for processing the control signals and generating corresponding control signals for controlling the operation of the printer. The printhead assembly includes a printhead support structure which allows precise, controlled pitch, roll, and yaw movement of the printhead. A ribbon take-up spindle, method of operating the take-up spindle using a PMDC motor, and a spring wrap clutch device help to control the tension in the transfer ribbon used in the printer. The printer also includes a media sensor and a method of sensing media by way of detecting the opacity of the media passing through the sensor. Additionally, the printer includes a method of simplified printhead control using double data loading and a method of accelerating and decelerating media relative to the printhead using pulse width modulation.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following detailed description taken in conjunction with the accompanying drawings in which like reference numerals identify like elements, and in which:

FIGS. 35 through 51 are electrical schematic diagrams of various circuits utilized by the demand printer. The component values shown thereon are by way of example only.

DESCRIPTION OF THE PREFERRED EMBODIMENTS

Figure 1:
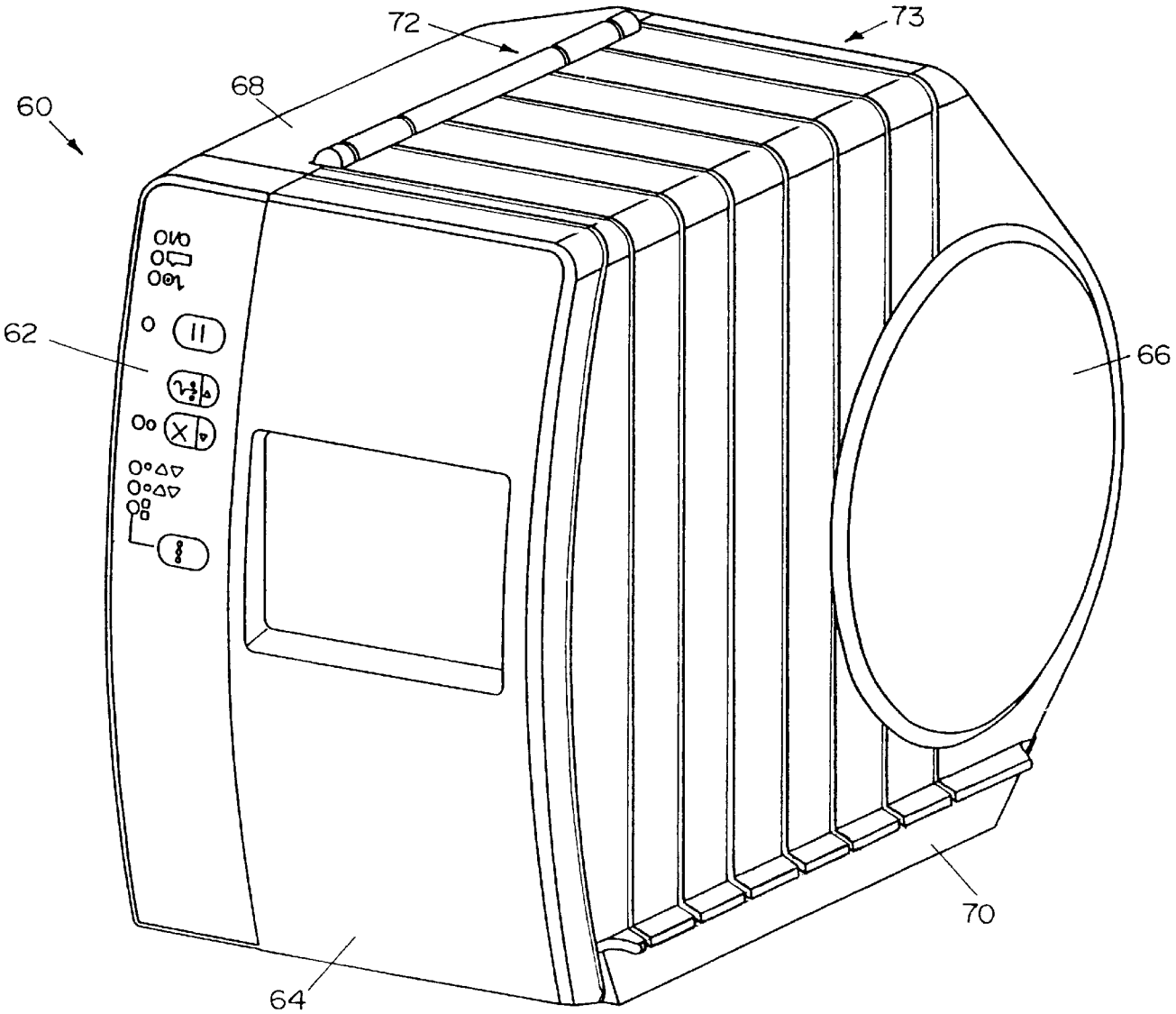
FIG. 1 is a perspective view of a preferred embodiment of a demand printer in accordance with the present invention.

A demand printer 60 is shown in the perspective view of FIG. 1. As shown in FIG. 1, the printer 60 is shown with several cover components in position to house the various operating components of the printer 60. The cover components include a control cover panel 62, a front panel 64, a hinged side panel 66, a fixed side panel 68, and a portion of a base segment 70. Also shown in FIG. 1 is a hinge 72 which will be discussed in further detail hereinbelow. The hinge 72 facilitates movement of the hinged side panel 66 upwardly away from the base segment 70 in order to access various operating components of the printer 60.

Figure 2:
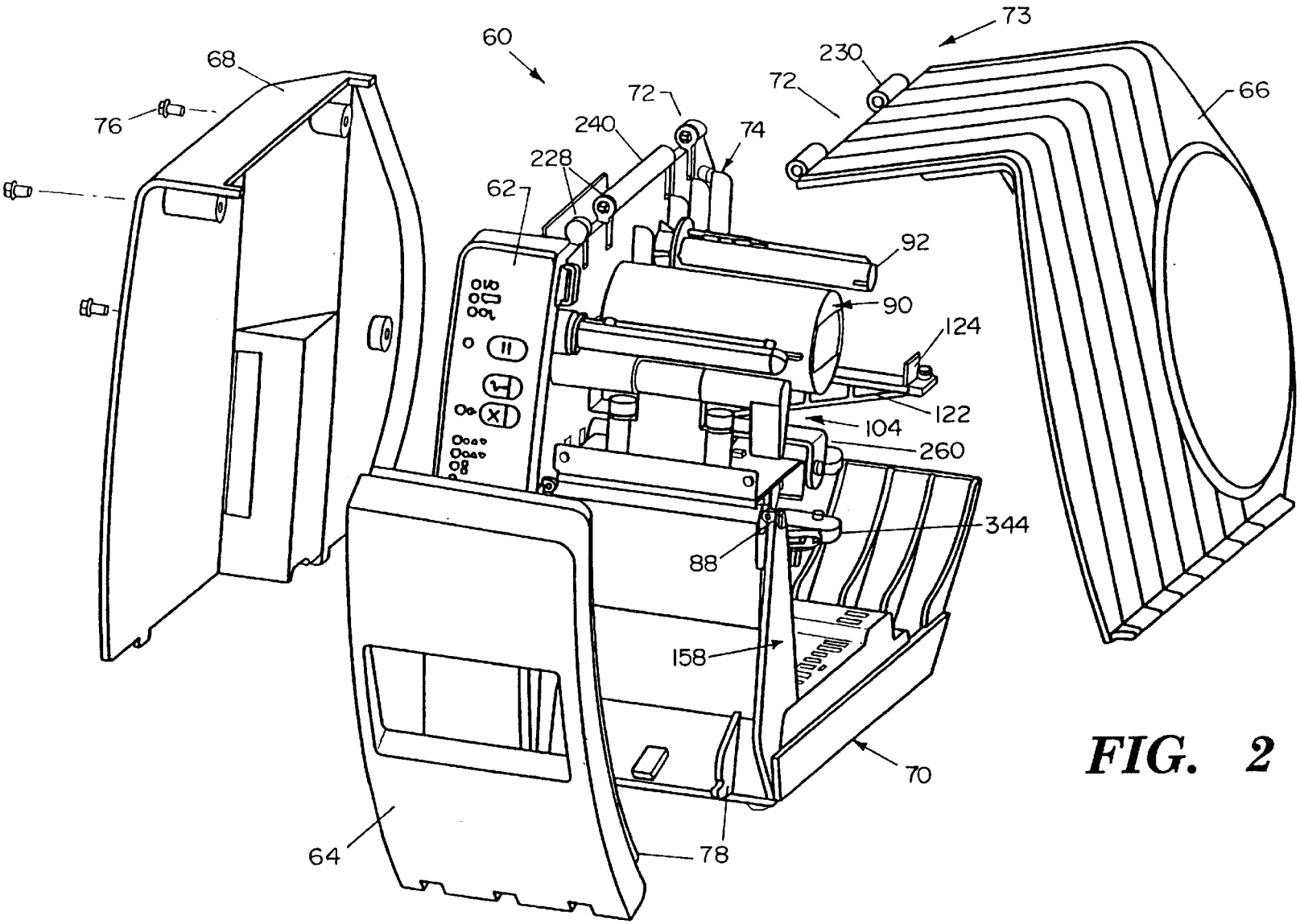
FIG. 2 is an exploded perspective of the demand printer illustrating some of the cover components removed.

FIG. 2 provides a view of the printer 60 in which the panels 64, 66, 68 have been exploded away from the printer 60. The exploded view of FIG. 2 provides a perspective view from the front of the printer 60 to show components housed under the various panels. As will be shown with greater detail in following figures, a central support wall 74 is attached to the base segment 70. A central support wall provides structural support and a mounting area for various components of the printer 60. The hinged side panel 66 is removed from the central support wall 74 by disengaging components of the hinge 72. The fixed side panel 68 is removed from the central support wall by way of removing several fasteners 76 which mount the fixed side panel 68 to the central support wall 74. The front panel 64 attaches to the base segment 70 by way of a front panel hinge 78 which will be disclosed in greater detail hereinbelow.

Figure 3:
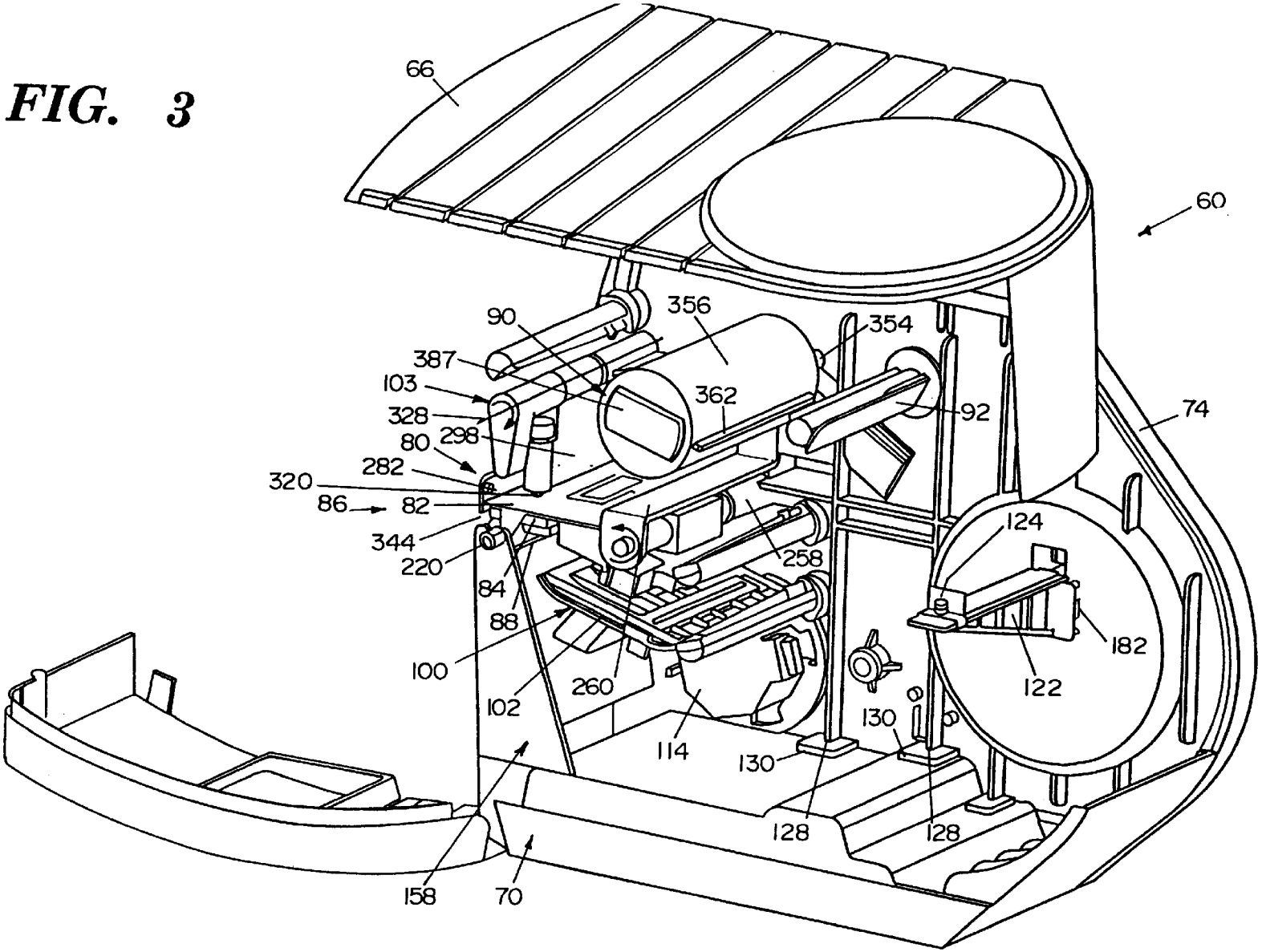
FIG. 3 is a perspective view of the demand printer from another angle showing some of the covers in an open position.

Turning now to FIG. 3, the printer 60 is viewed from a rearwardly oriented perspective showing the area covered by the hinged side panel 66. With the hinged side panel 66 raised away from the base segment 70 several sub-assemblies and many components of the printer 60 are readily visible. A printhead assembly 80 is shown and includes a printhead support 82 which is pivotally attached to the central support wall 74, and a printhead means 84 attached to the printhead support 82. Media delivery means 86 includes a platen roller 88, a ribbon take-up spindle 90 and a ribbon supply spindle 92. The media delivery means 86 includes additional components as will be discussed hereinbelow. With reference to FIGS. 8A, 8B, and 8C, media on which indicia are to be printed is fed into a media supply stream 94 under the influence of the positively-driven platen roller 88. Transfer ribbon 96 is attached to the ribbon supply spindle 92 and is fed into a ribbon supply stream 98 which generally follows the media supply stream 94. Transfer ribbon 96 is advanced through the printer 60 under the influence of friction between transfer ribbon 96 and media supply stream 94 and secondarily the influence of the ribbon take-up spindle 90. The ribbon take-up spindle 90 and the novel means for driving the spindle 90 will be discussed in further detail hereinbelow.

With reference once again to FIG. 3, a media sensor 100 is positioned in the media supply stream 94 to sense the position of the media flowing through the media supply stream 94. A media guide 102 is provided with the media sensor 100 in order to properly position the media passing through the media supply stream 94 for proper sensing. Operation of the media sensor sub-assembly 100 of the present invention and the novel features thereof is discussed in further detail hereinbelow.

Toggle means 104 is provided to position the printhead means 84 proximate to the platen roller 88 for thermally printing indicia on the media passing thereunder. Additional novel features of the toggle means 104 and operation of the toggle means 104 with the printhead support 82 is described in further detail hereinbelow.

Figure 4:
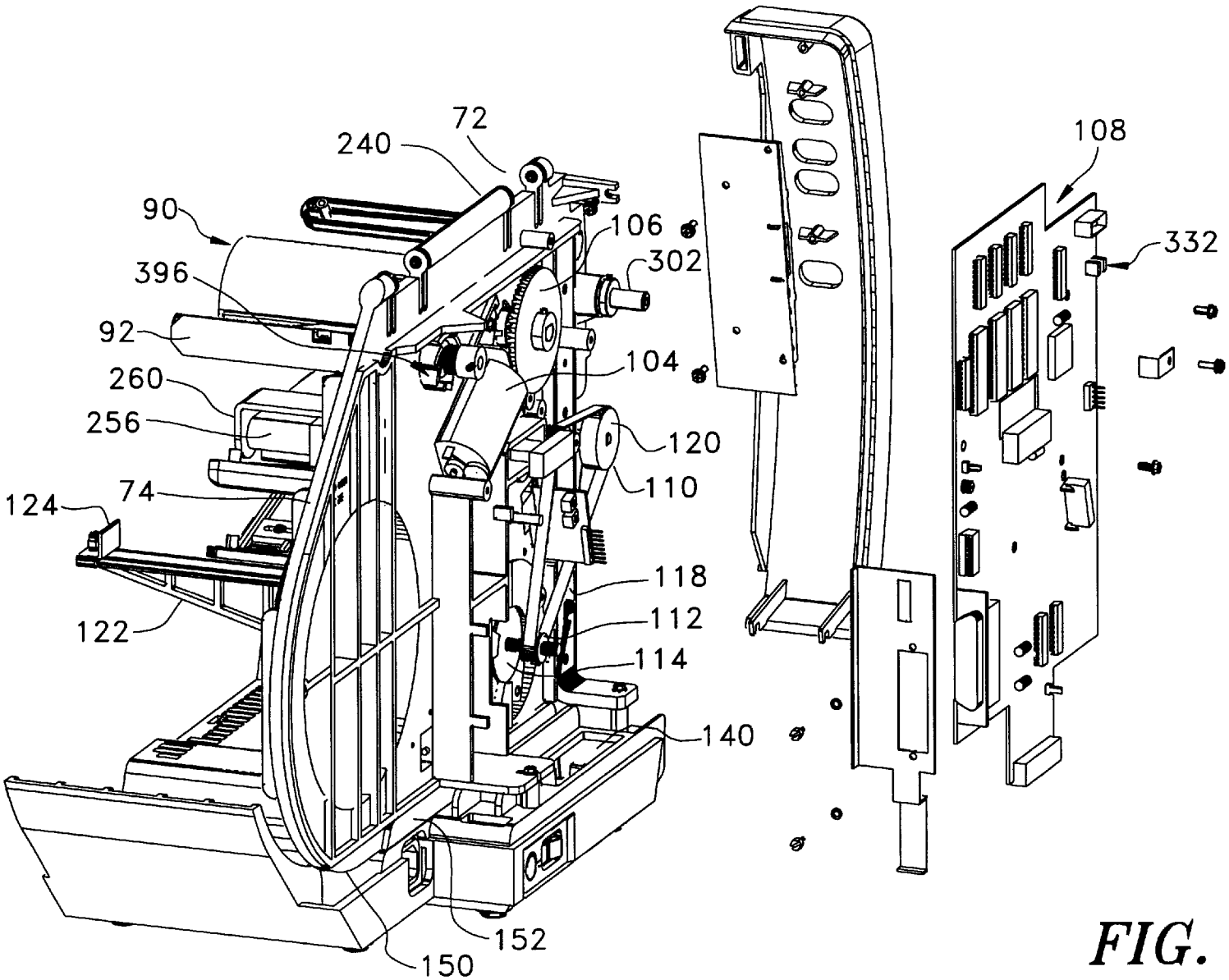
FIG. 4 is another exploded perspective of the demand printer illustrating various components.

FIG. 4 provides a rear-perspective view of the printer with the hinged side panel 66 and the fixed side panel 68 removed from the central support wall 74. FIG. 4 provides a view of the opposite side of the wall as shown in FIGS. 2 and 3. While FIGS. 2 and 3 show components which are utilized in the actual transfer of indicia to media, the other side of the wall as shown in FIG. 4 provides drive means and circuit means for driving and controlling the printing components as shown in FIGS. 2 and 3. A PMDC motor 104 is mounted to the central support wall 74 and drives the ribbon take-up spindle 90 by way of a gear arrangement 106. The PMDC motor 104 is coupled to control circuit means 108. The PMDC motor is shown in the exploded view of FIG. 5 as well as FIGS. 9 and 29. Additional details of the operation of the PMDC motor 104 coupled to the control circuit means 108 is provided hereinbelow.

A drive gear and belt arrangement 110 is shown in FIG. 4. A drive gear 112 is connected to a stepper motor 114 (see FIGS. 8, 9, and 23) by way of an idle shaft 116. Driving motion created by the stepper motor 114 and transferred to the drive gear 112 drives the belt 118 to also drive a platen gear 120 operatively associated with the platen roller 88.

Figure 5:
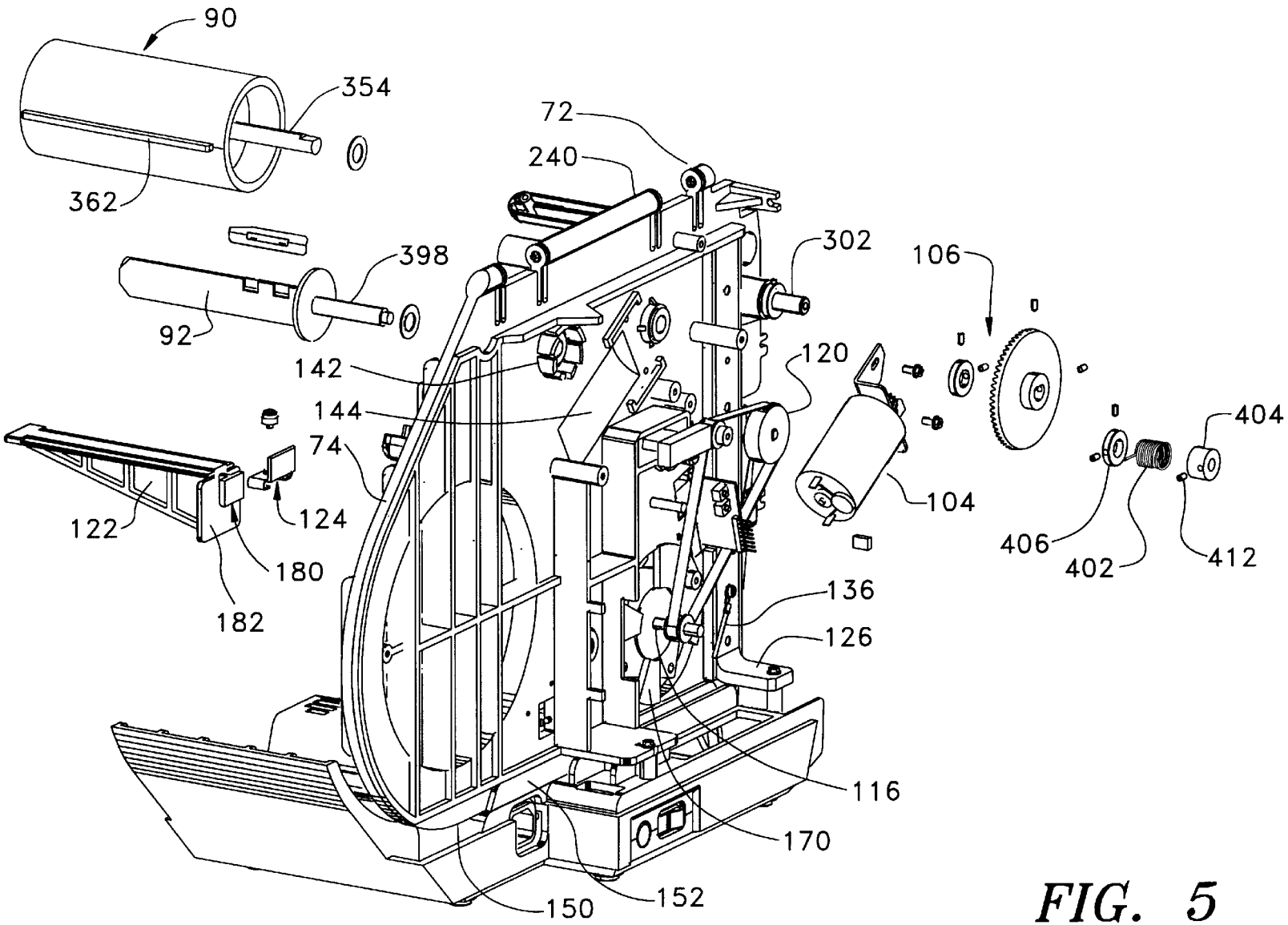
FIG. 5 is still another exploded perspective view of the demand printer illustrating various components thereof.

FIG. 5 provides an exploded view of the view as shown in FIG. 4. FIG. 5 provides a view of the location of bosses or supports which are provided through the central support wall 74 through which support shafts or drive shafts extend for supporting and operating components on either side of the central support wall 74. For example, a media hanger 122 and a stop clamp 124 attachable to the media hanger are shown removed from the central support wall 74. Additional details and novel features of the media hanger will be disclosed in further detail hereinbelow.

Figure 6:
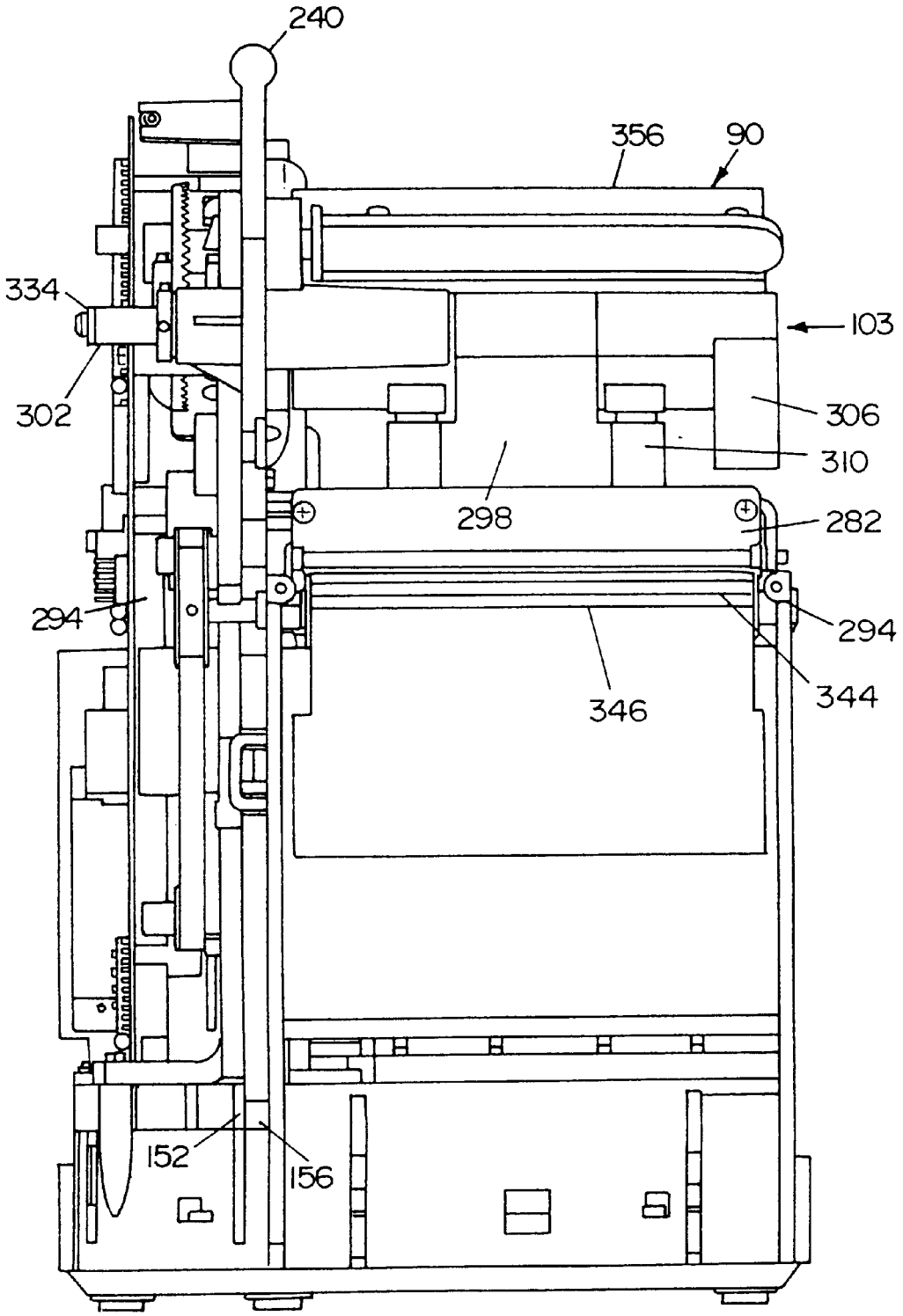
FIG. 6 is a front elevational view of the demand printer without certain cover components in place.
Figure 7:
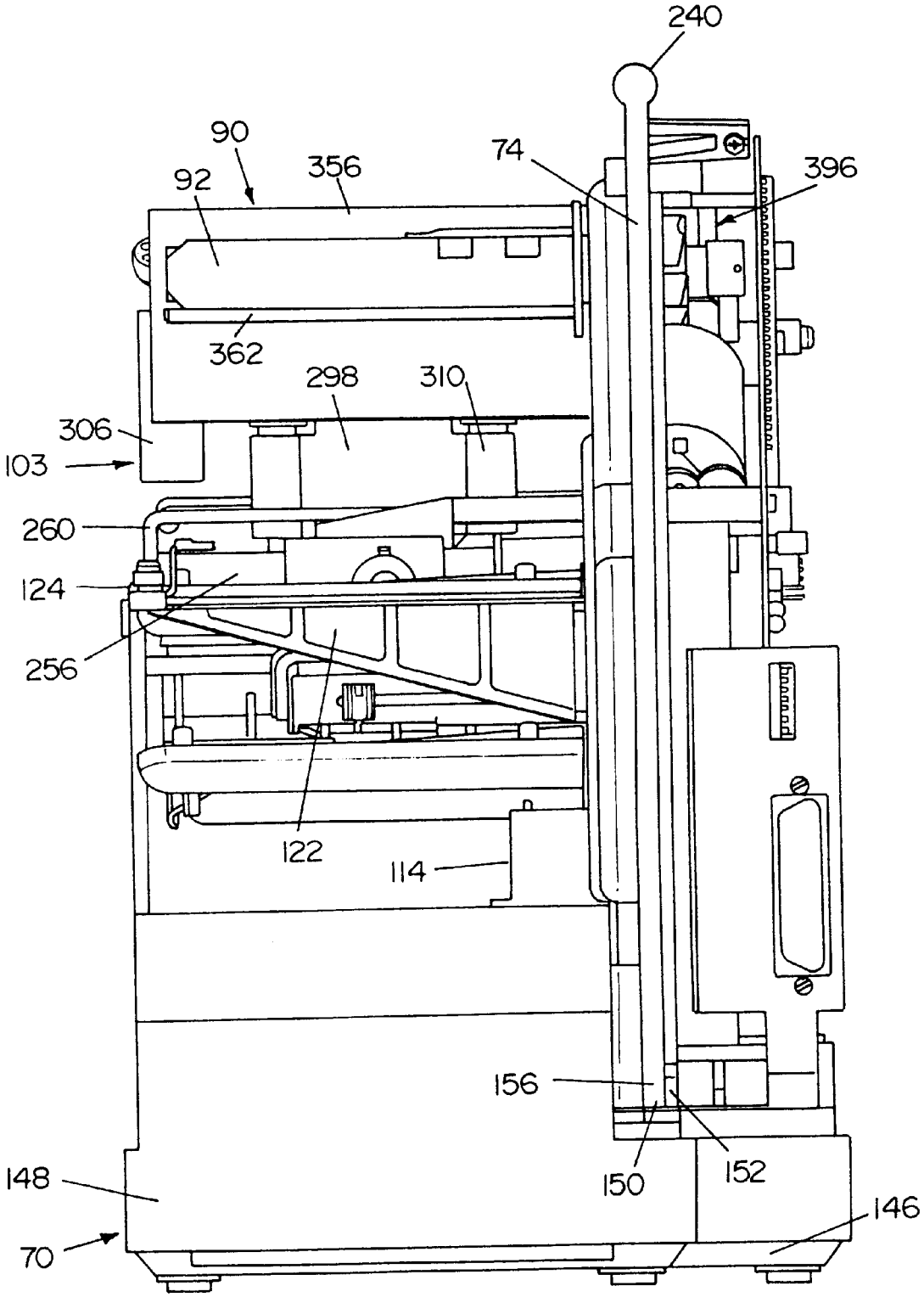
FIG. 7 is a rear elevation view of the demand printer without certain cover components in place.

FIGS. 6 and 7 provide front and rear elevational views of the printer 60 as shown in FIG. 4 (with the addition of the control circuit means 108 being attached for operation).

Figure 8:
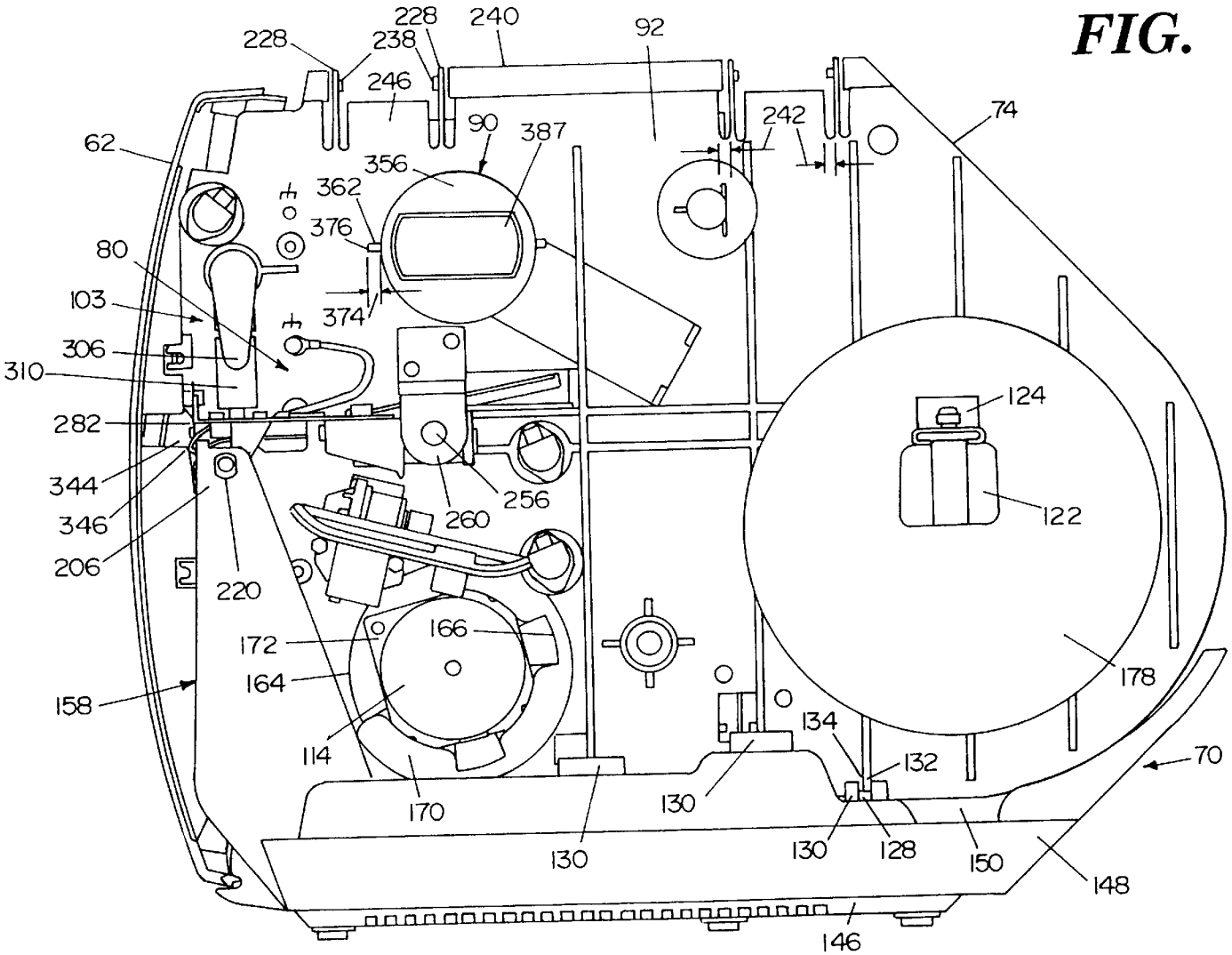
FIG. 8 is a right-side elevational view of the demand printer with certain cover components removed.
Figure 8A:
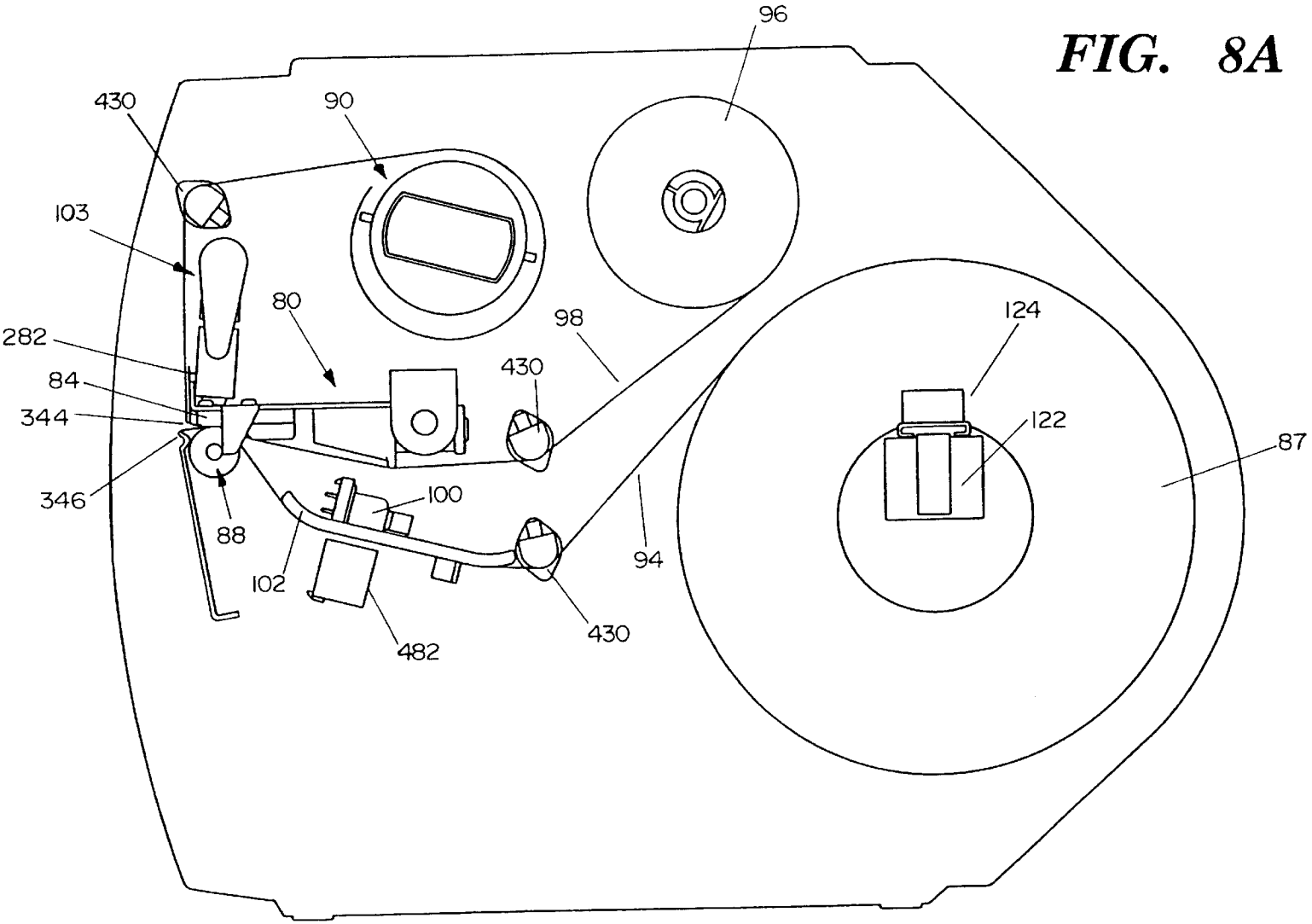
FIG. 8A is a partial right-side elevational view showing threaded transfer ribbon and roll supply media.
Figure 8B:
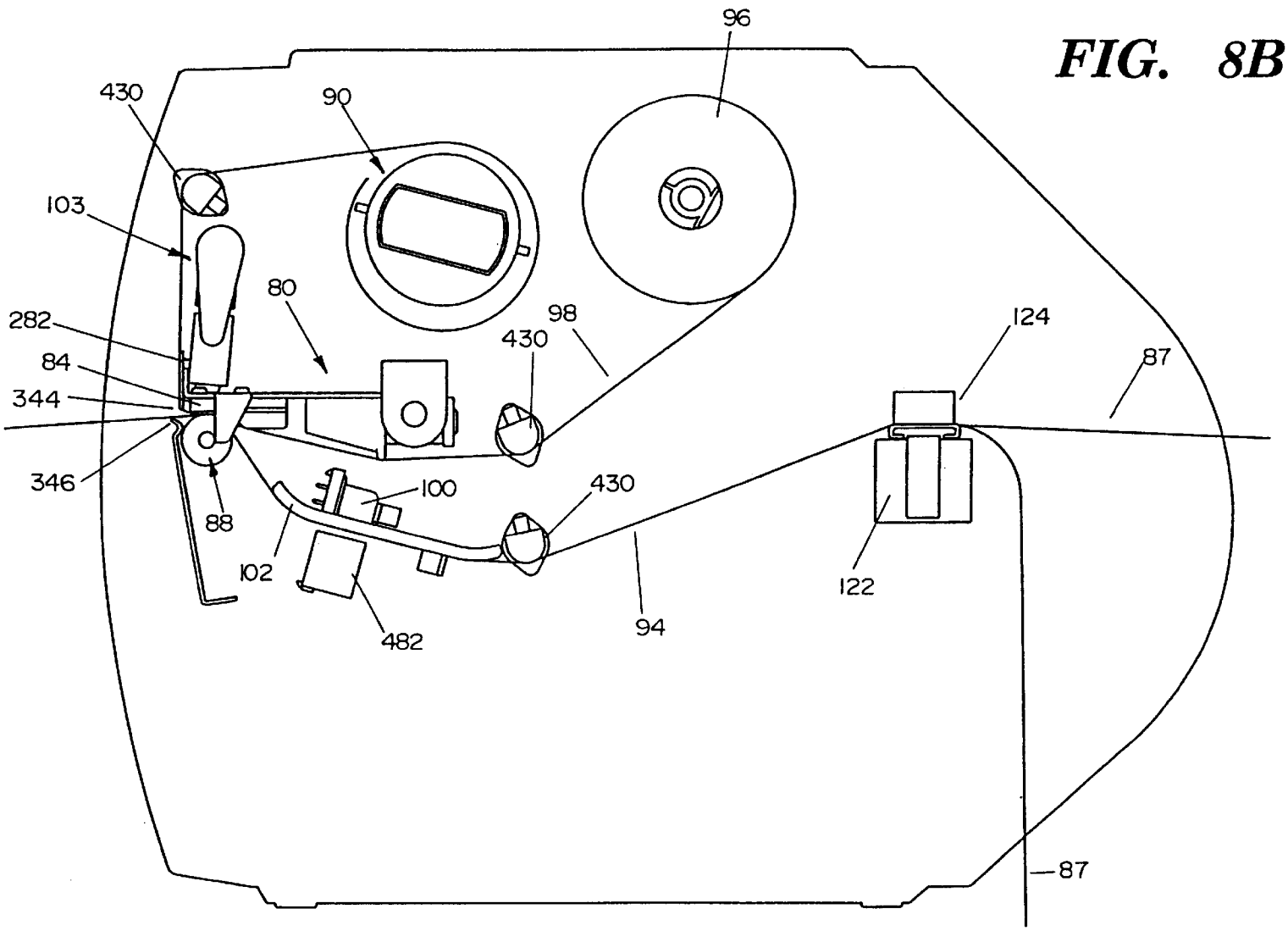
FIG. 8B is a view similar to FIG. 8A showing threaded media in the demand printer utilizing rear-loaded or bottom-loaded fanfold media.
Figure 8C:
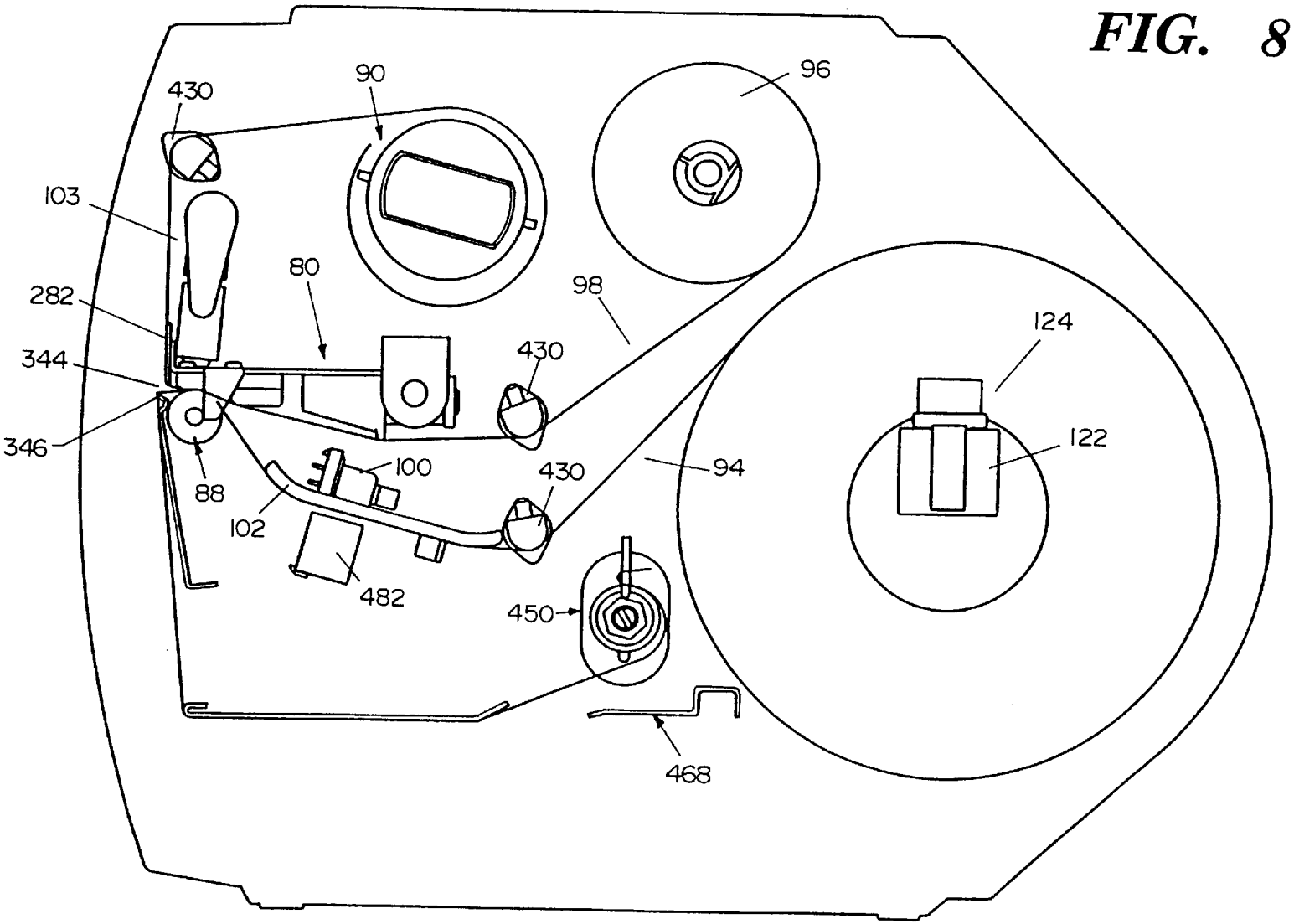
FIG. 8C is a view similar to FIG. 8A including an optional media rewind device.
Figure 9:
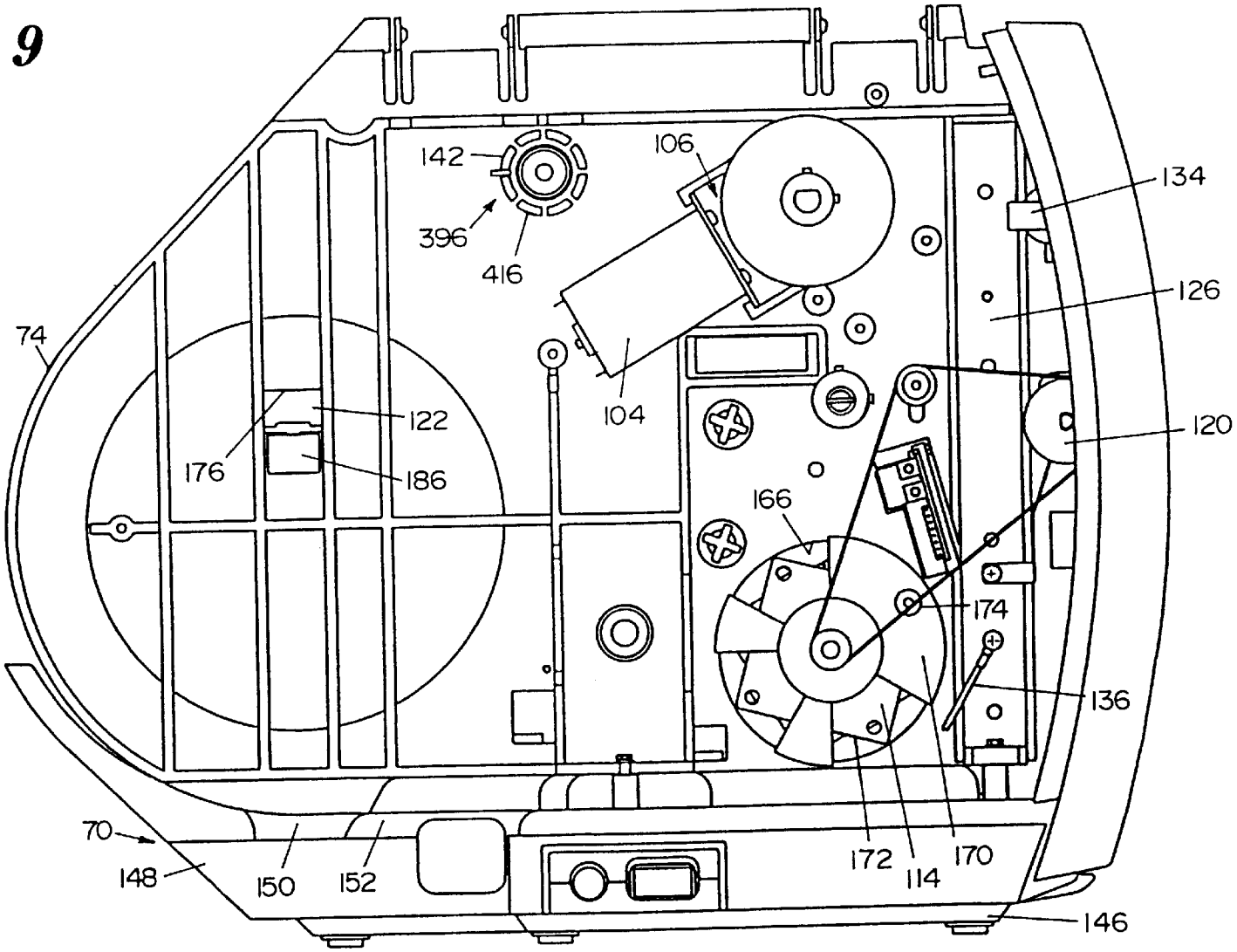
FIG. 9 is a left-side elevational view of the demand printer with certain cover components removed and without a printed circuit board in place.
Figure 10:
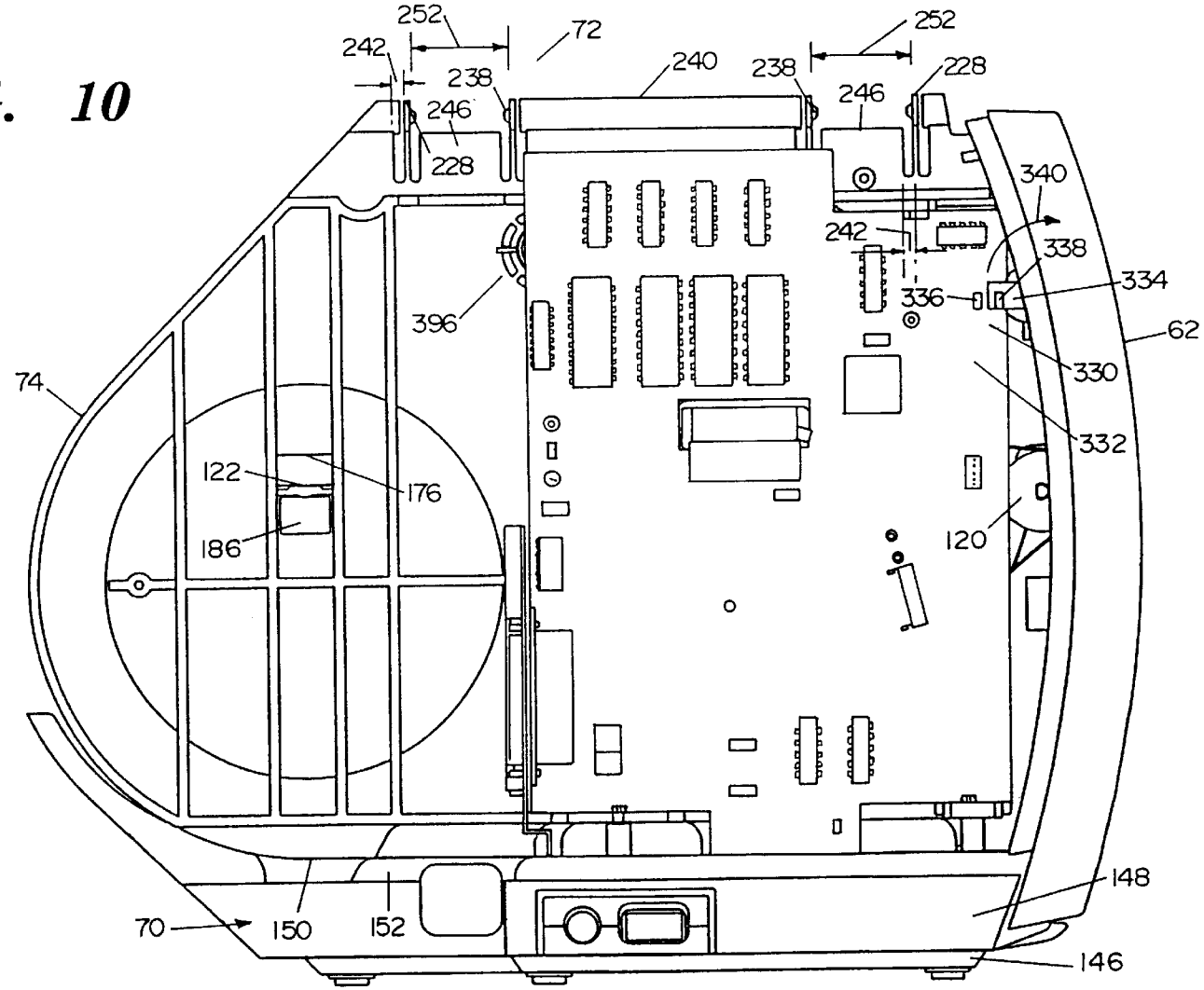
FIG. 10 is a left-side elevational view of the demand printer similar to FIG. 9, but with a printed circuit board in place.

FIG. 8, FIG. 9, and FIG. 10 provide side elevational views of the printer with the side covers 66, 68 removed from the central support wall 74. FIGS. 8A, 8B, and 8C provide various details regarding the delivery of transfer ribbon 96 and media 87 through the printer 60.

Figure 11:
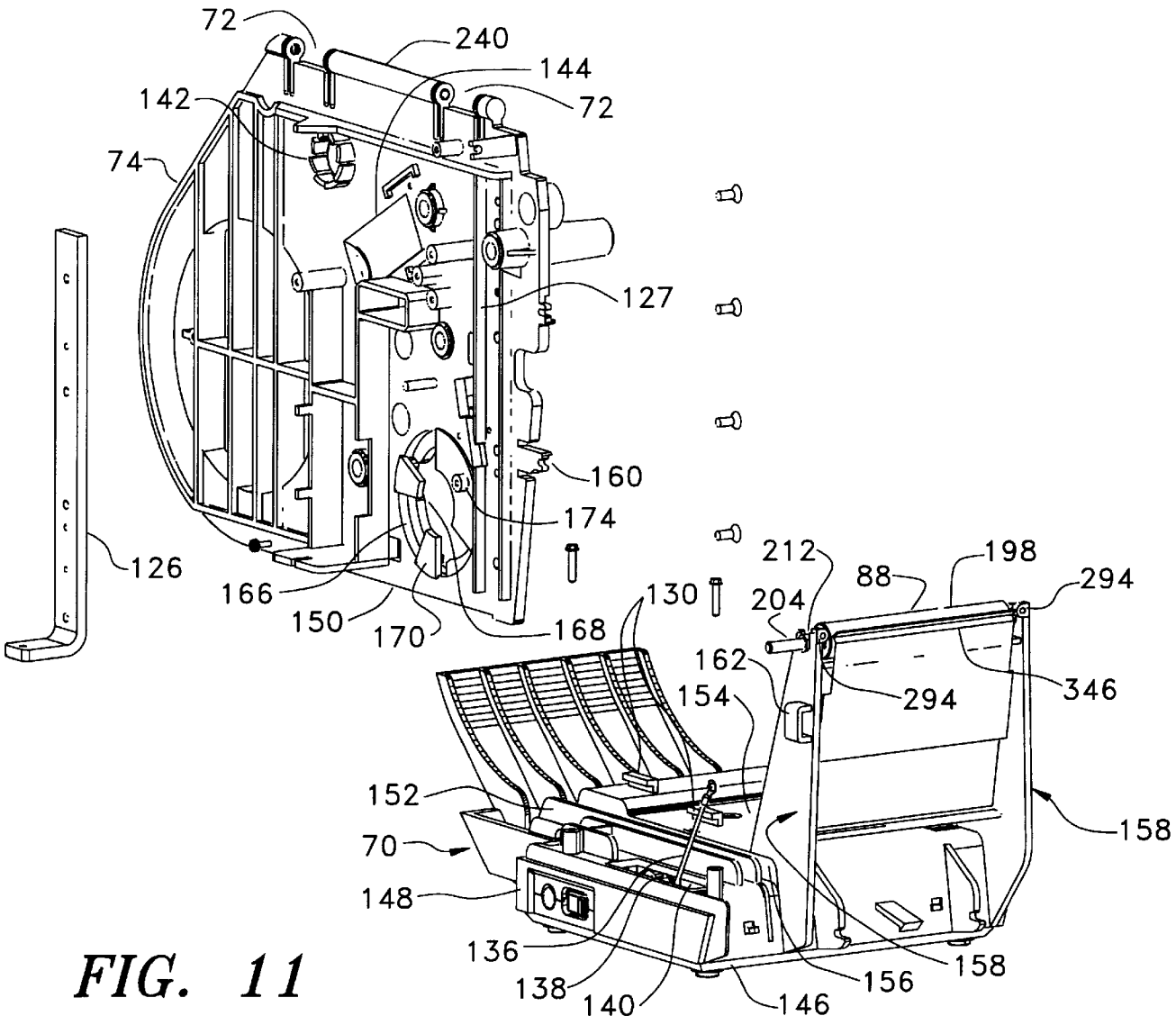
FIG. 11 is a partial exploded perspective view of certain components of the invention.

Turning now to FIG. 11, the components as shown in the perspective views of FIGS. 2–4 have been removed from the printer 60 leaving essentially the central support wall 74, and the base segment 70. The components shown in FIGS. 2–4 are suspended from the central support wall 74. A single reinforcing segment 126 is attached to a forward section 127 of the central support wall 74. The reinforcing segment 126 provides additional structural support to minimize movement of the central support wall 74. The central support wall 74 attaches to the base segment 70 by means of foundation feet 128 (see FIGS. 3 and 22) engaged underneath foundation flanges 130.

As shown in FIG. 8, one of the foundation flanges 130 has a slot 132 formed therethrough for receiving an upstanding pin 134 on the corresponding foundation foot 128. Engagement of the pin 134 with the slot 132 prevents forward/backward movement of the central support wall 74 relative to the base 170. Engagement of the foundation feet 128 with the foundation flanges 130 provides quick and convenient engagement of the central support wall 74 with the base segment 70. The reinforcing segment attaches to the central support wall 74 and the base 70 and also acts as a grounding bar for the entire printer. As such, the reinforcing segment 126 is a metallic body to which grounding straps are attached. A grounding strap 136 connects the reinforcing segment 126 to a power supply circuit 138 contained in the base cavity 140. The grounding connection of the reinforcing segment 126 to the grounding strap 136 is through power supply circuit 138 to the power cable.

Figure 12:
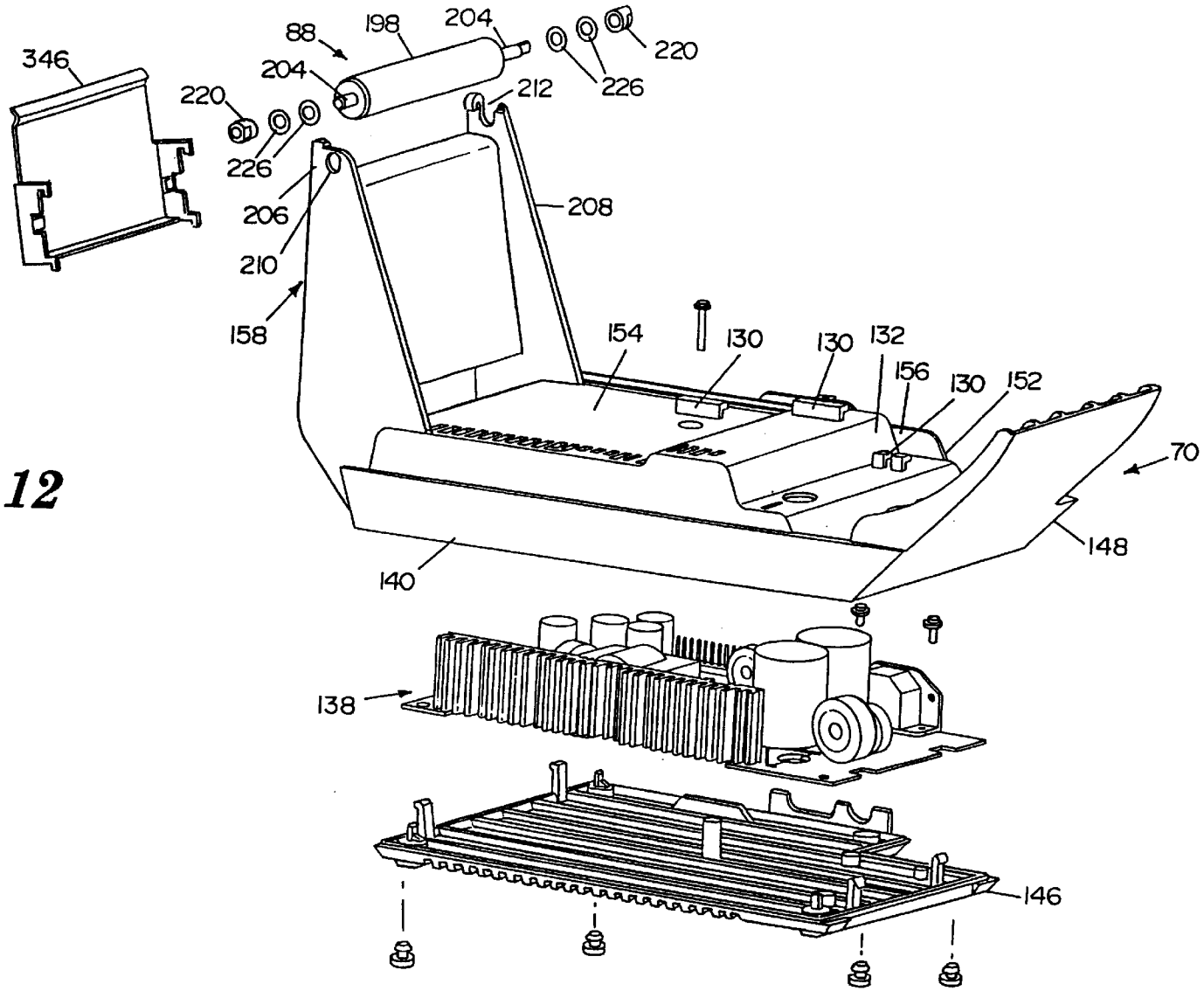
FIG. 12 is another partial exploded perspective view of certain components of the invention.

Numerous structural supports and features have been provided by directly molding such features into the central support wall to minimize the number of additional parts and to minimize the space utilized in the printer 60. For example, ramped teeth 142 for use with a slip clutch, the details of which will be provided hereinbelow, are molded to extend from the central support wall 74. similarly, in order to maximize the use of space within the volume defined by the case structure 73, a cove 144 has been formed in the central support wall for receiving a portion of the PMDC motor 104 used to drive the take-up spindle 90. Additionally, bosses and other support structure have been directly formed on both sides of the central support wall 74. The previously mentioned base cavity 140 is more clearly shown in FIG. 12 such that a bottom cover 146 is removed to reveal the power supply circuit 138 which fits into the base cavity 140 underneath a base foundation portion 148 of the base segment 70.

A bottom rib 150 of the central support wall 74 fits between a lip 152 extending upwardly from the base foundation 148 and a deck portion 154 of the base foundation 148. The lip 152 and the deck 154 form a channel 156. A surface of the forward portion 127 abuts one arm of a platen frame 158. With the bottom rib 150 positioned in the channel 156 and the foundation feet 128 engaged with the foundation flanges 130 a post 160 extending from the forward portion 127 engages a post receptacle 162. As such, engagement of the central support walls 74 with the base segment 70 is essentially a snap-in, fastener free operation. The exception to the fastener free assembly is the use of two fasteners on the drive side of the central support wall 74.

Figure 23:
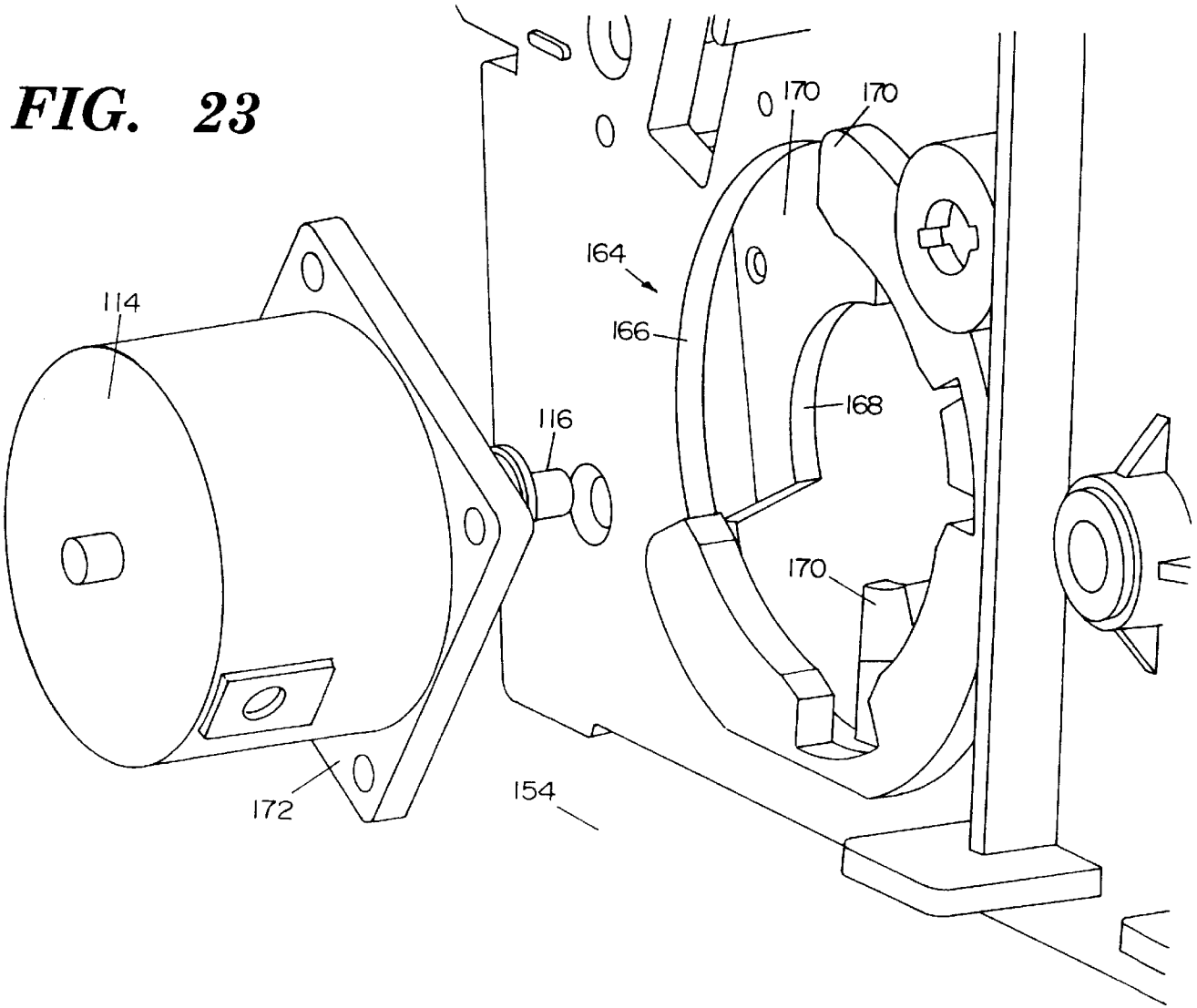
FIG. 23 is an exploded perspective view of a stepper motor component of the invention.

With reference to FIG. 23, the stepper motor 114 as mentioned hereinabove is mounted to the central support wall 74 by means of a motor mounting receptacle 164. The motor mounting receptacle has a recessed area 166 defining an aperture 168 through which the drive shaft 116 extends. Wall flanges 170 project from the central support wall 174 into the recessed area 166. Motor flanges 172 on the stepper motor 114 engage the cooperatively positioned wall flanges 170 so that a rotary twist of the stepper motor 114 engages the stepper motor 114 with the motor mounting receptacle 164. While FIG. 23 provides an exploded view of the stepper motor 114 with relation to the motor mounting receptacle 164, further views of the motor 114 mounted in the motor receptacle 164 can be found in FIGS. 3 and 9 and a view of the motor mounting receptacle 164 without a motor positioned therein can be found in FIG. 11. FIGS. 9 and 11 show a nut post 174 which has been formed in one of the wall flanges 170. The nut post receives a screw or other fastener therethrough for providing additional securing in holding the motor 114 in the motor mounting receptacle 164.

Figure 16:
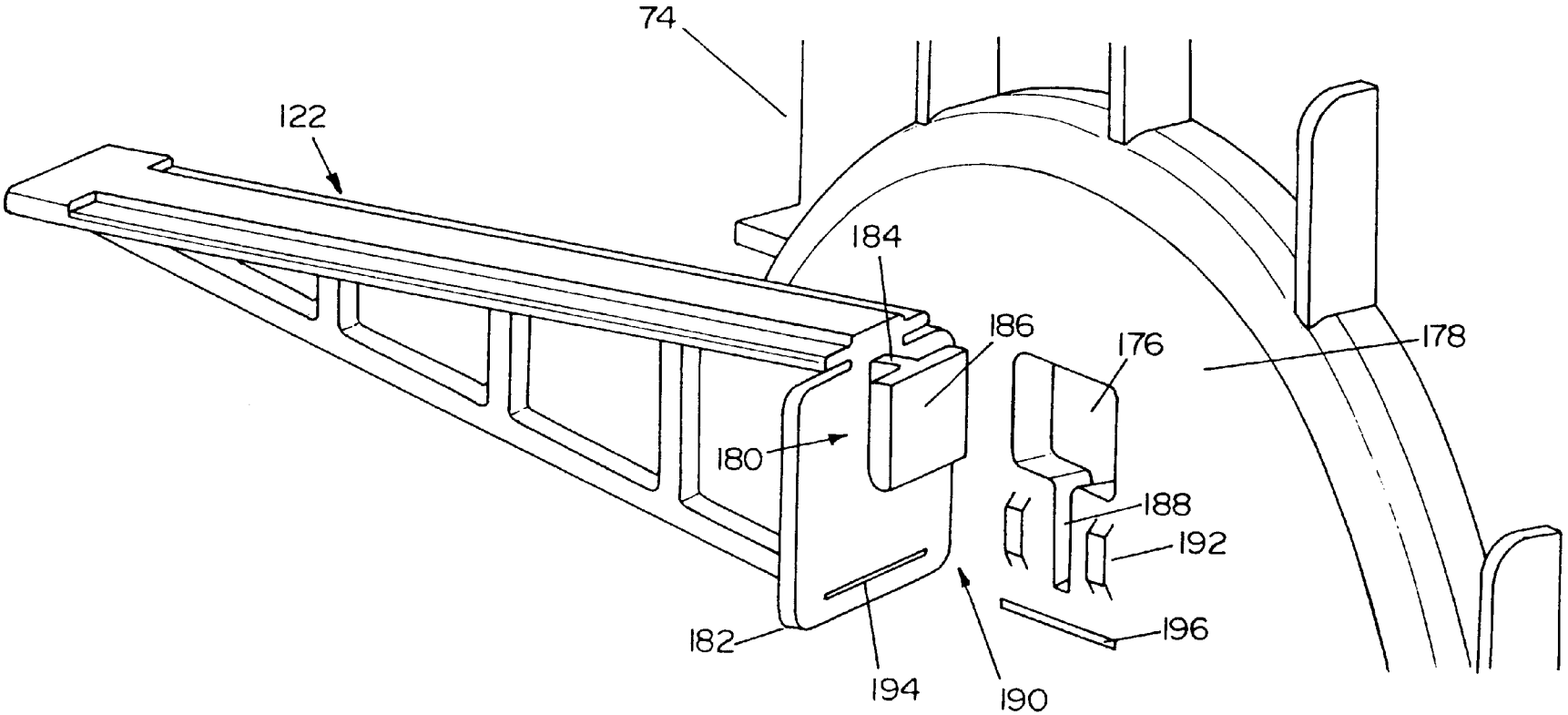
FIG. 16 is an exploded perspective view of a media component of the invention.

An additional feature that has been provided in the central support wall 74 is the ability to quickly engage and disengage the media hanger 122. As shown in the enlarged exploded perspective detail view of FIG. 16, the media hanger 122 conveniently engages an aperture 176 formed in a surface of the central support wall 74. A key segment 180 is formed on a mating end 182 of the media hanger 122. The key segment 180 includes a stem portion 184 which extends a distance away from the mating end 182 and an enlarged portion 186 generally extending perpendicularly away from the stem portion 184. The aperture 176 is sized and dimensioned in order to receive the enlarged portion 186. A vertically oriented notch 188 is formed through the surface 178 in communication with the aperture 176. The vertically oriented notch 188 is sized and dimensioned for receiving the key segment once the enlarged portion 188 is inserted through the aperture. Downward movement of the media hanger 122 engages the stem 184 with the vertically oriented notch 188. Further engagement is provided by interference fit means 190 formed on either the mating end 182 of the media hanger 122 or the surface 178 surrounding the aperture 176. As shown in FIG. 16, the interference fit means 190 include interference protrusions 192 formed on the surface 178 and a mating rib 194 formed on the mating end 182. A mating groove 196 is provided on the surface 178 for receiving and engaging the rib 194. Engagement of the stem 184 with the notch 188 positions the rib 194 for engagement with the mating groove 196. The interference protrusions 192 provide an interference fit to further secure the media hanger 122 on the central support wall 74.

Figure 13:
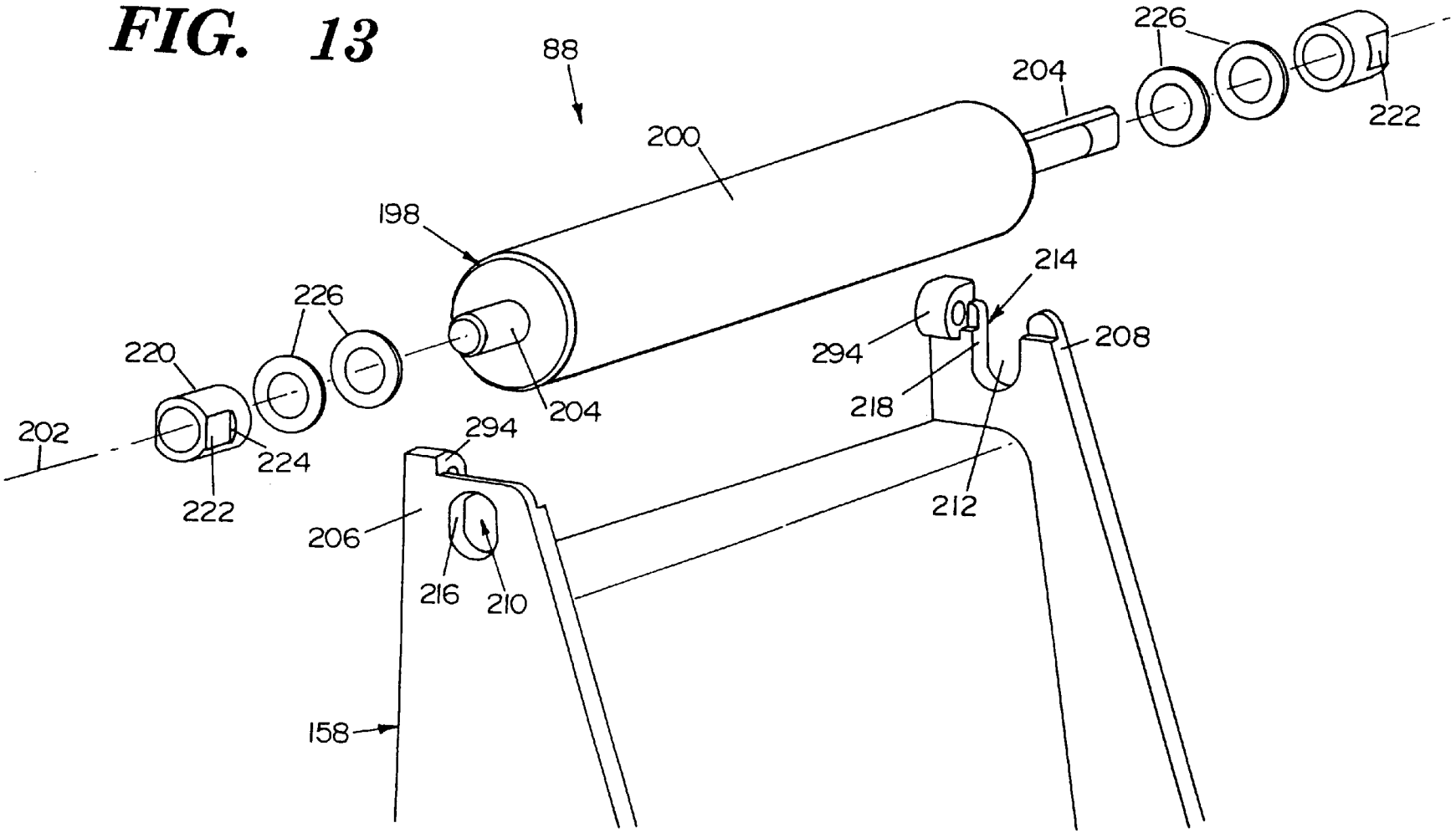
FIG. 13 is an exploded view of a platen means component of the invention.

Turning to FIG. 13, an enlarged, detailed, exploded, perspective view of the platen roller 88 is provided. The platen roller 88 includes a platen shank 198 which defines a cylindrical platen surface 200. The platen shank is typically formed of a resilient elastomeric material. Additionally, the material used in forming the platen shank should provide a friction force against media which is pressed between the platen roller 88 and the printhead assembly 80 (see FIG. 3). A central axis 202 longitudinally extends through the platen roller 88. Shaft portions 204 extend from each end of the platen shank 198. The platen frame 158 extends upwardly from the deck 154 of the base foundation 148. The platen frame includes a first support arm 206 and second support arm 208, a bore 210 is formed through the first support arm 206 and a notch 212 is formed through the second support arm 208. Generally, the bore 210 and the notch 212 have approximately the same dimensions. The notch 212, however, has an open end 214. Both the bore 210 and the notch 212 have similarly formed keyed surfaces referred to herein as the bore keyed surface 216, and the notch keyed surface 218.

Each of the shaft portions 204 mates with a platen bushing 220. The platen bushings 220 provide smooth rotating surfaces for the shaft portions 204. The bushings eliminate the need for ball bearing assemblies which complicate the parts and assembly of the printer 60. Bushing keyed surfaces 222 are formed on an outside surface of the platen bushings 220. The bushing keyed surfaces 222 cooperatively mate with the board keyed surface 216 and the notch keyed surface 218 to prevent the platen bushings 220 from rotating in the bore 210 and the notch 212. The keyed surfaces 222 and the bushings 220 also have a stop surface 224 which limit the depth of engagement of the bushing through the bore 210 and the notch 212. Washers 226 are provided between the platen bushings 220 and the abutting ends of the platen shank 198.

Figure 14:
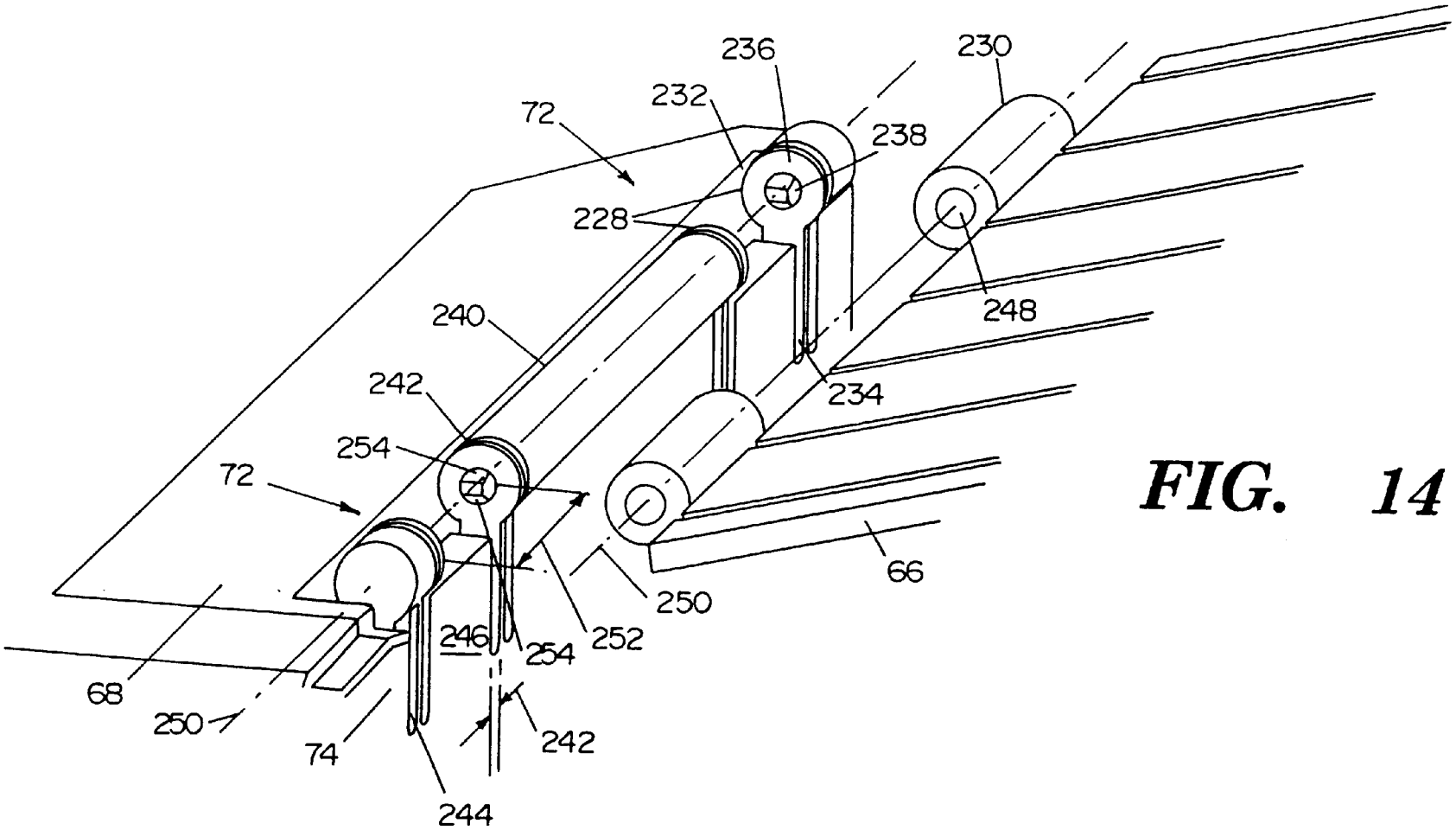
FIG. 14 is an exploded view of a hinge means component of the invention illustrated in an disengaged position.
Figure 15:
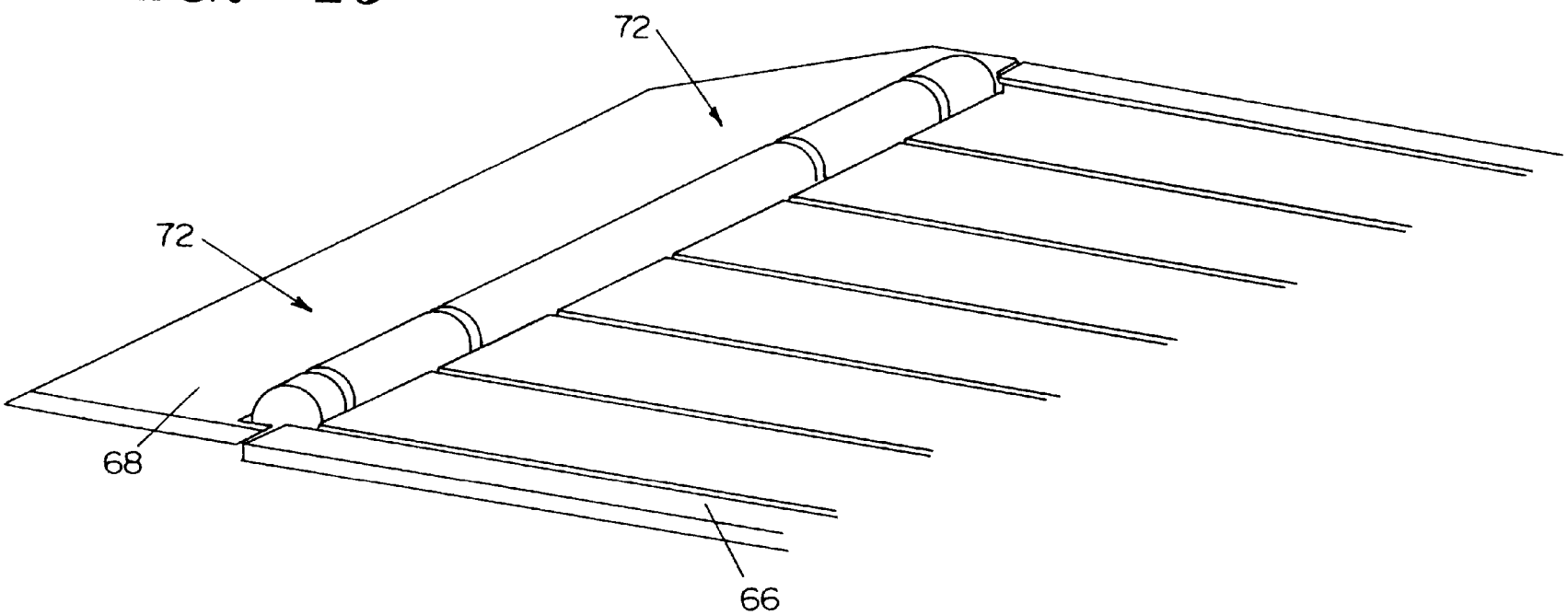
FIG. 15 is an exploded view of a hinge means component of the invention illustrated in an engaged position.

Assembly of the platen roller 88 with the platen frame 58 eliminates the need for any fasteners to retain the platen roller 88 in the platen frame 158. To assemble the platen roller 88 with the platen frame 158, the washers 126 and bushings 120 are inserted over the shaft portion 204. One end of the platen shank 198 is positioned to insert the corresponding bushing 220 through the bore 210 with the bushing keyed surfaces 222 aligned with the bore keyed surfaces 216. Next, the opposite end of the platen shank 198 is positioned with the bushing keyed surfaces 222 aligned with the notched keyed surfaces 218. The platen bushing 220 is downwardly inserted into the notch 212. FIGS. 14 and 15 provide enlarged detailed view of the hinge 72 as introduced hereinabove. The hinge 72 includes a pair of flexible arms 228 and a barrel structure 230. As shown in FIG. 14, the pair of flexible arms in each hinge is attached to the central support wall 74 and the barrel structure 230 is attached to the side hinged panel 66. Each of the flexible arms 228 includes a head 232 mounted on top of a stem 234 each of the heads and the pair of flexible arms 228 has a facing surface 236. A protrusion 238 extends from each of the facing surfaces 236 of the pair of flexible arms 228. The pair of flexible arms 228 of each hinge 72 are formed along a top ridge 240 of the central support wall 74. The arms are formed with a small gap 242 between a backside of each arm 244 and the ridge 240. The dimension of the gap 242 determines how far the arms 228 can flex outwardly from each other. Additionally, a stop block 246 is formed between each pair of flexible arms 228 to limit the degree of inward movement of each arm. The gap 242 between the stem 234 and the stop lock 246 determines the degree of inward movement of the arms 228.

The barrel structure 230 is attached to the pair of flexible arms 228 by positioning a barrel bore 248 in position to engage a corresponding protrusion 238 formed on the surface 236 of the head portion 232. When the barrel bore 248 is engaged with the corresponding protrusion 238 pressure is applied to a central hinge axis 250 thereby urging the engaged flexible arm 228 away from the second flexible arm 228 of the pair. By urging the first flexible arm 228 away from the second flexible arm the dimension 252 between the arms 228 is increased. Next a second end of the barrel structure 230 is positioned against the protrusion 238 opposite the engaged protrusion 238. A downward force is applied to the cover 66 to engage the protrusion 238 with the corresponding barrel bore 248.

The hinges can be used as a single set or in pairs as shown in FIG. 14. An additional feature of the hinge is the directional facets 254 formed on the protrusions 238. When the barrel structure 230 is engaged with the pair of flexible arms 228 the assembled hinge 72 rotates about the central hinge axis 250. When an excessive force is applied to the hinge the directional facets 254 facilitate the disengagement of the barrel structure 230 from the protrusions 238. The directional protrusions can either be a sloped surface or a planar surface. As shown in FIG. 14, the directional facets 254 are angled inwardly towards the central hinge axis. A top directional facet facilitates engagement of a corresponding barrel bore 248 with the protrusion 238. The lower directional facet 254 facilitates the disengagement of the barrel bore 248 when opposite forces are applied to the cover 66. Forces required to engage the barrel structure 230 with the protrusion 238 define a working direction. Excessive or overload forces applied opposite the working direction will result in the hinge popping apart. The ability to pop the hinge apart upon application of excessive forces substantially prevents damage and the possibility of parts breakage. Additionally, since thermal printers are often operated with the side hinge panel 66 removed for easy access to the media 87 and the transfer ribbon 96 the hinges allow easy removal of the panel 66 from the case structure 73.

Figure 25:
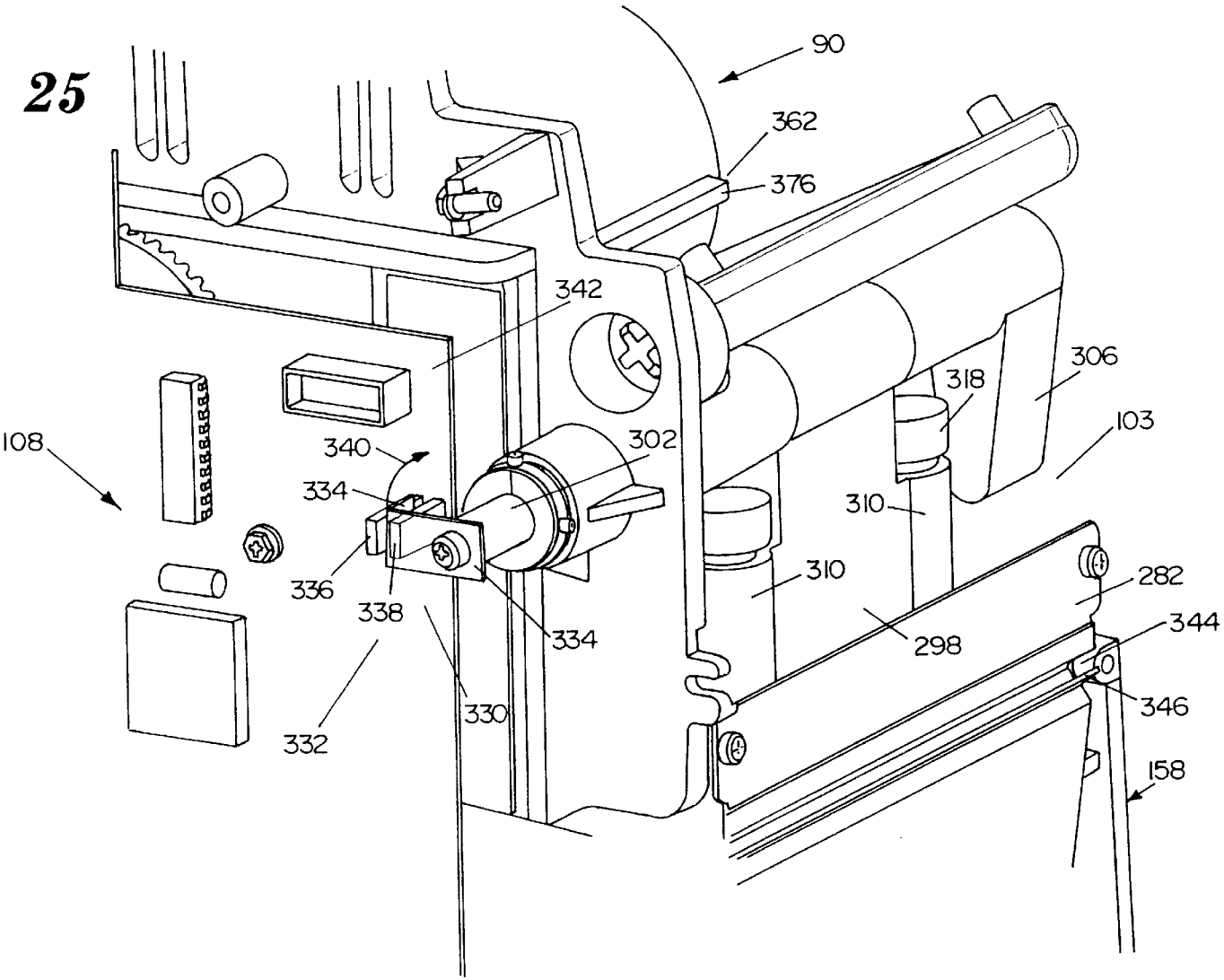
FIG. 25 is a perspective view of a printhead assembly utilized in the demand printer.
Figure 26:
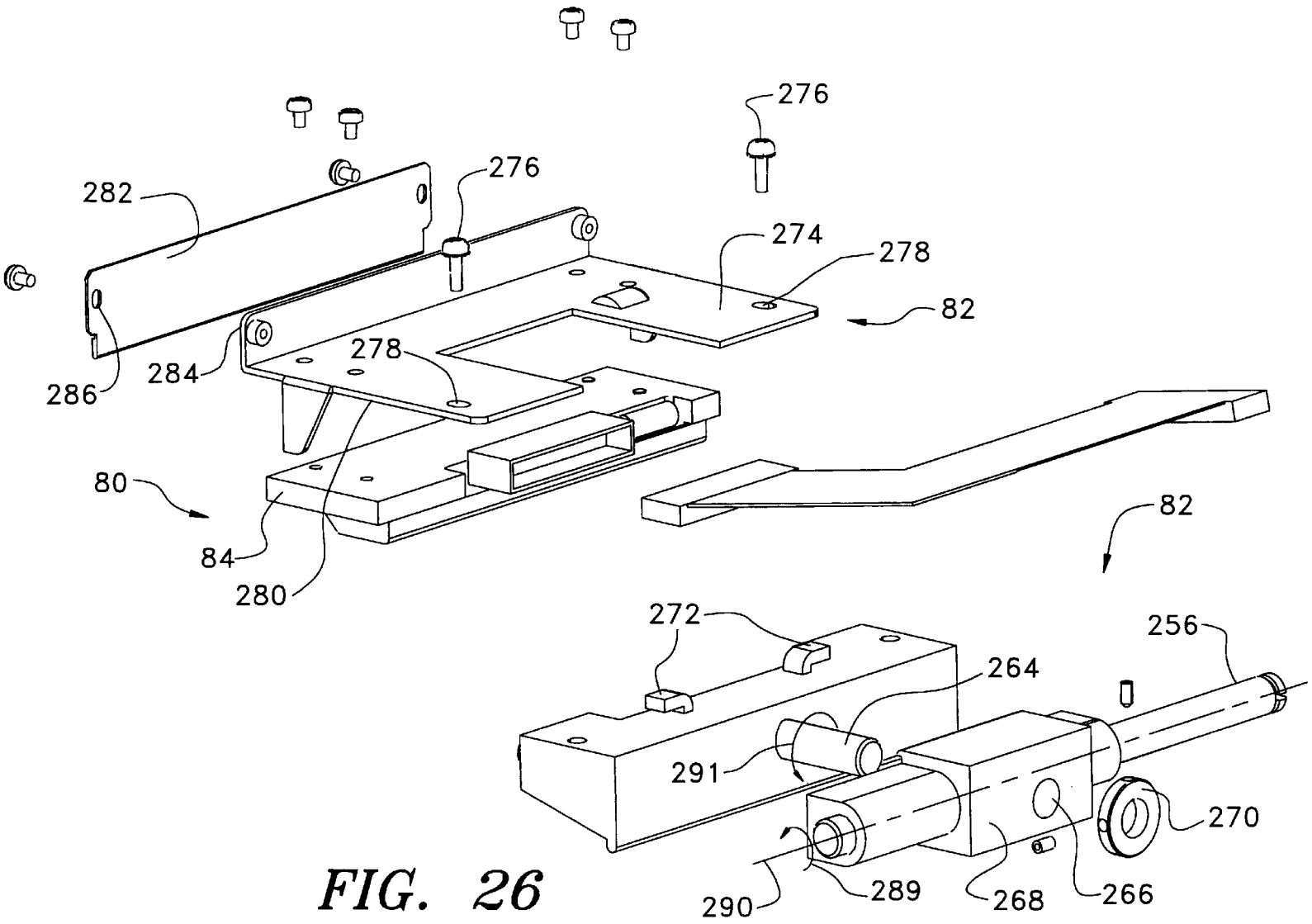
FIG. 26 is an exploded perspective view of the printhead assembly.

Turning now to the printhead assembly 80 as mentioned hereinabove, is described in further detail with reference to FIGS. 3 and 24–27. The printhead assembly 80 as shown in FIG. 3 has been exploded in the enlarged detailed perspective view as shown in FIG. 26. As shown in FIG. 3 a pivot shaft 256 mounts into a corresponding boss 258 formed on the central support wall 74. A pivot shaft bracket 260 is attached to and extends away from the central support wall 74. A free end 262 of the pivot support bracket 260 supports a cooperatively positioned end of the pivot shaft 256.

As better shown in FIG. 26, a roll shaft 264 is operatively associated with the pivot shaft by way of a bore extending through a common universal block 268 and a collar 270 which retains the roll shaft 264 in the bore 266. Retention members 272 are associated with the roll shaft for engaging a printhead bracket 274. While the printhead bracket 274 is retained under the retention members 272, adjustment fasteners extending through elongated holes 278 allow the bracket 274 to be adjusted relative to the retention members 272. The printhead means 84 is attached to a bottom side 280 of the printhead mounting bracket 274. As shown in FIG. 26 a ribbon strip plate 282 is attached to a front side 284 of the printhead mounting bracket 274. The ribbon strip plate 282 is attached by means of fasteners extending through elongated holes 286 formed in the strip plate. The elongated holes allow the strip plate to be adjusted up and down relative to the printhead mounting bracket 274.

Figure 24:
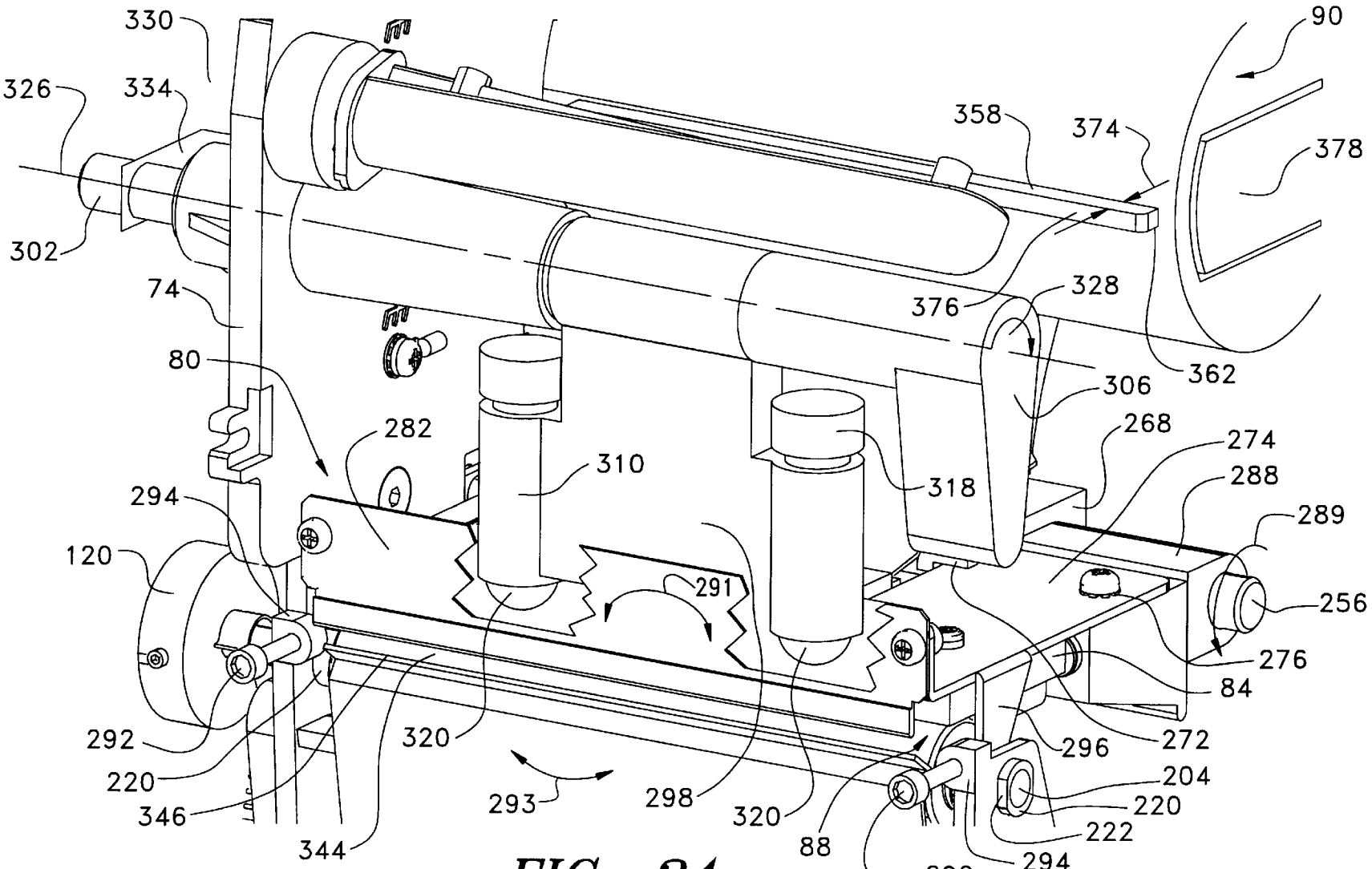
FIG. 24 is a perspective view of a printhead assembly utilized in the demand printer.

With reference to FIG. 24, the pivot shaft 256, roll shaft 264, printhead bracket 274, and the included features collectively define a printhead support 288. The printhead support 288 controllably positions the printhead 84 attached thereto adjacent to the media 87. The printhead support 288 allows pitch, roll, and yaw movement (as indicated by arrows 289, 291, 293, respectively) of the printhead 84. By providing pitch, roll, and yaw movement 289, 291, 293, the printhead support 288 effectively provides a floating adjustment for the printhead 84. Floating adjustment of the printhead 84 assures that the printhead 84 may be precisely adjusted. The pitch and roll 289, 291 movement of the printhead are constantly floating while yaw movement is typically adjusted and then secured. Pitch movement 289 of the printhead 84 is achieved by rotation of the pivot shaft 256 along a pivot shaft access 290. The pitch movement 289 effectively moves the printhead 84 parallely towards and away from the platen roller 88. Roll movement 291 of the printhead 84 is achieved by rotation of the roll shaft 264 in the bore 266. Yaw movement 293 is achieved by loosening the adjustment fasteners 276 and adjusting the printhead mounting bracket 274 accordingly. Additionally, since the printhead assembly 80 is supported from the central support wall 74 ribbon and media can be loaded or removed from the side of the printhead assembly 80. For example, media can be inserted underneath the media guide 102 in between the platen and printhead 88, 84 for loading. Similarly, if a jam occurs, access to the printhead assembly from the side is available for easily removing the jam.

The printhead assembly 80 as discussed hereinabove is also removable from the printer 60 as a complete sub-assembly unit.

Yaw movement 293 of the printhead 84 allows the printhead to be adjusted and fine tuned to achieve optimum print quality. The yaw movement 293 assures that the printhead and the line of elements used in the printing operation will be aligned parallel to the platen roller 88. Adjustment screws 292 are provided in the front of the printer 60. The adjustment screws project through an adjusting boss 294 and contact an extending adjustment tab 296 which extends downwardly from the printhead bracket 274. The adjustment screws 292 are tightened in the adjustment bosses 294 and press against the extending adjustment tabs 296 to selectively and controllably fine tune the side-to-side movement or yaw movement 293 of the printhead.

An important feature of the present invention is that the yaw movement 293 adjustment of the printhead 84 can be achieved during the printing operation. In this regard, the printhead position provides instantaneous results and feedback as to the effect of the adjustment. This instantaneous feedback eliminates the need for iterative steps as is common with prior art printers.

To adjust the printhead 84 the adjustment fasteners 276 are slightly loosened so as to permit a small degree of movement between the adjustment fasteners 276 and the elongated holes 278 in the printhead mounting bracket 274. A print operation is started and the print alignment is checked. An appropriate one of the two adjustment screws 292 is moved so as to move the extending adjustment tab and therefore move the respective side of the printhead mounting bracket 274. When a desired printhead 84 alignment is achieved the operation is stopped and the adjustment fasteners 276 are tightened securely to prevent further adjustment. The adjustment screws 292 are then removed from the adjustment bosses 294 and stored in a compartment in the case structure to prevent further undesired adjustment.

Figure 27:
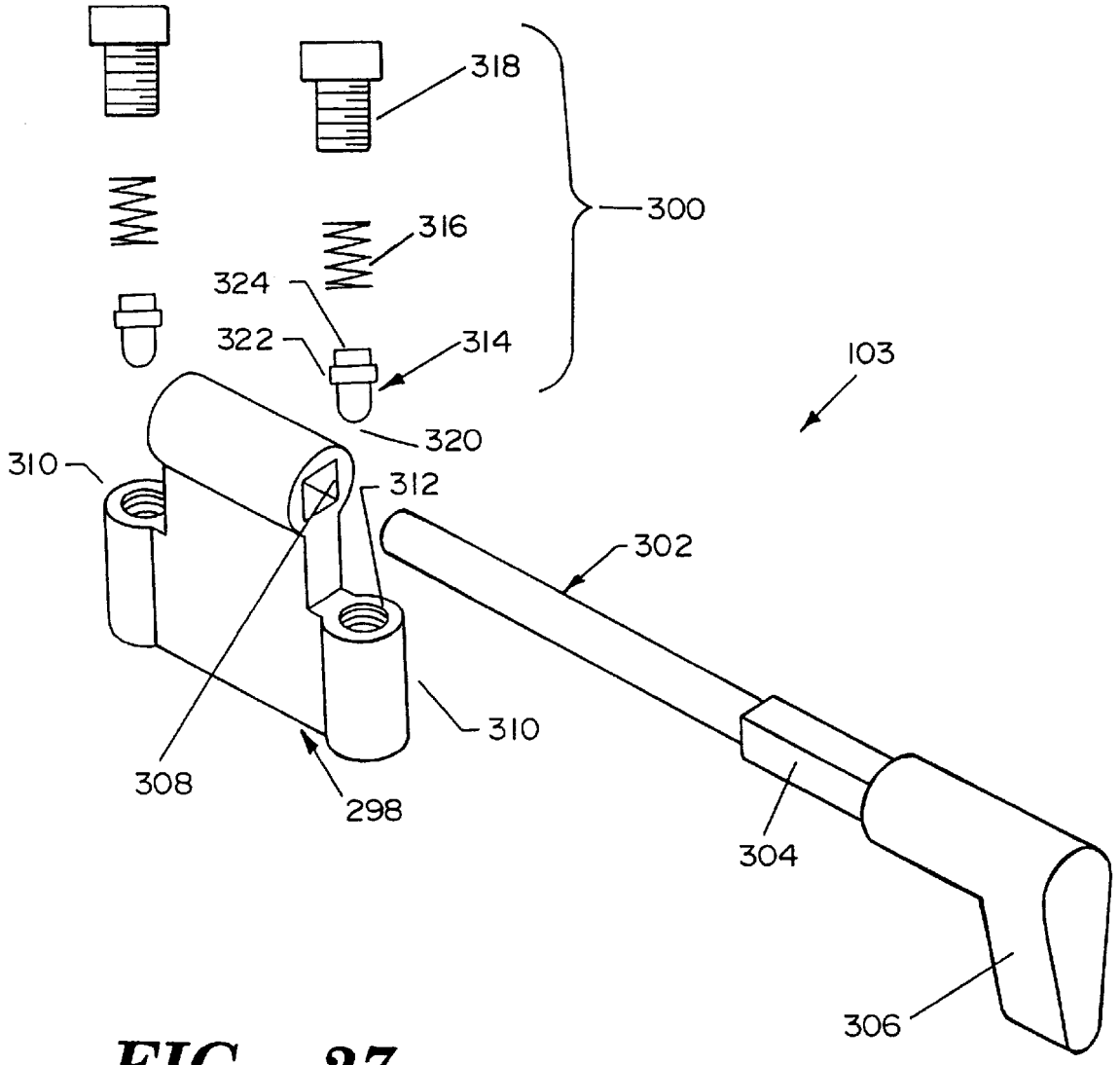
FIG. 27 is an exploded perspective view of a printhead pressure mechanism of the demand printer.

The toggle means 103 has been mentioned and shown in FIG. 3. Further detailed description of the toggle means 103 is provided with additional reference to FIGS. 24, 25, and 27. FIG. 27 provides an exploded perspective view of the components which comprise the toggle means 103. The toggle means engages and disengages the printhead 84 and the media 87 by applying a force to the printhead mounting bracket 274 to pitch the printhead 84 towards the platen roller 88. The toggle means includes a toggle arm 298 and a biasing plunger assembly 300. The toggle arm 298 also includes a shaft assembly 302 which has a keyed portion 304 and a knob 306. The shaft assembly 302 is inserted through a bore 308 in the toggle arm 298 and the keyed portion 304 positively engages a correspondingly formed portion in the bore 308. The knob 306 is formed to provide additional ease of operation and transfer of mechanical force when operating the toggle means 103. One end of the shaft assembly 302 attaches to the central support wall 74 generally parallel to the printhead 84.

A pair of plunger sleeves 310 are provided at spaced-apart locations on the toggle arm 298 and are oriented generally perpendicular to the shaft assembly 302. The biasing plunger assembly 300 is retained in a cavity 312 of the plunger sleeve 310. The biasing plunger assembly 300 includes a plunger head 314 biasing means 316 and an adjustment portion 318. The plunger head 314 is retained in the plunger sleeve 310 so that a rounded tip portion 320 extends from a bottom portion of the plunger sleeve 310. The opening to the cavity 310 of the bottom of the plunger sleeve has a dimension which is approximately equal to the diameter of the plunger head and less than a retaining collar 322 formed on the head spaced away from the rounded tip portion 320. The biasing means 316 presses against a tail end 324 of the plunger 314. The adjustment portion 318 is essentially a threaded thumb screw which engages in upper portion of the cavity 312 of the plunger sleeve 310. The adjustment portion 318 is rotated in order to increase or decrease the biasing forces against the plunger head 314.

With reference to FIGS. 24 and 27 the toggle means 103 is shown in use with the printer 60. When a user engages the toggle means 103 to engage the printhead 84 with the media 87 the user grasps the knob 306 and rotates it along a toggle axis 326 (as shown by arrow 328) to move the rounded tip portion 320 into engagement with the printhead support bracket 274. Rotation of the toggle arm 298 by rotating the shaft assembly 302 sweeps the toggle arm in an arch which eventually presses the rounded tip portions 320 of the plunger heads 314 into engagement with the printhead support bracket 274. Since the plunger heads 314 are biasedly retained in the plunger sleeve 310 the sweeping engagement against the printhead support bracket 274 forces the plunger head 314 upwardly into the plunger sleeve 310 against the forces applied thereto by the biasing means 316. The compressive forces applied by the toggle means 103 on the printhead assembly maintain a desired force on the printhead 84 pressing against the platen roller 88. The desired force mentioned above can be adjusted by adjusting the adjustment portion 318 to increase or decrease the biasing force of the biasing means 316 against the plunger head 314.

The present invention also includes a sensing device 330 for indicating whether the printhead 84 is engaged or disengaged with the media or platen 87, 88. The engagement of the printhead 84 is directly dependent upon the position of the toggle means 103 since it is the toggle means which engages or disengages the printhead 84. As such, the rotary position of the shaft assembly 302 is used to indicate the condition of the printhead 84. With reference to FIG. 25 the sensing device 330 includes an optical sensor 332 and a sensor linkage 334 directly connected to the shaft assembly 302 of the toggle means. 103. The optical sensor 332 includes an optical transmitter 336 and an optical receiver 338. The optical transmitter 336 emits a beam of light which is received at the optical receiver 338. The linkage 334 extends from the shaft 302 and rotates through a path 340 which travels between the optical transmitter and receiver 336, 338. It should be noted, that sensors other than purely optical sensors could be used in this configuration.

In use of this particular embodiment of the invention, the linkage 334 is adjusted to break the beam path between the optical transmitter and receiver 336, 338 when the toggle means 103 is engaged with the printhead 84. When the toggle means is rotated out of engagement, the linkage 334 rotates upwardly along the path 340 out of the beam path thereby allowing the optical circuit to be completed. Of course, the signals could be reversed such that the beam between the transmitter and receiver 336, 338 is open when the toggle means 103 is engaged with the printhead and the beam is broken when the toggle means 103 is engaged with the printhead means 84. As the optical sensor 332 is directly coupled to a printed circuit board 342 including the control circuit means 108 additional cabling in connections or linkages are not required. Signals from the optical sensor 332 are received and processed by the control circuit means 108 and may be used to prevent further operation until a preselected printhead condition is achieved.

Figure 28:
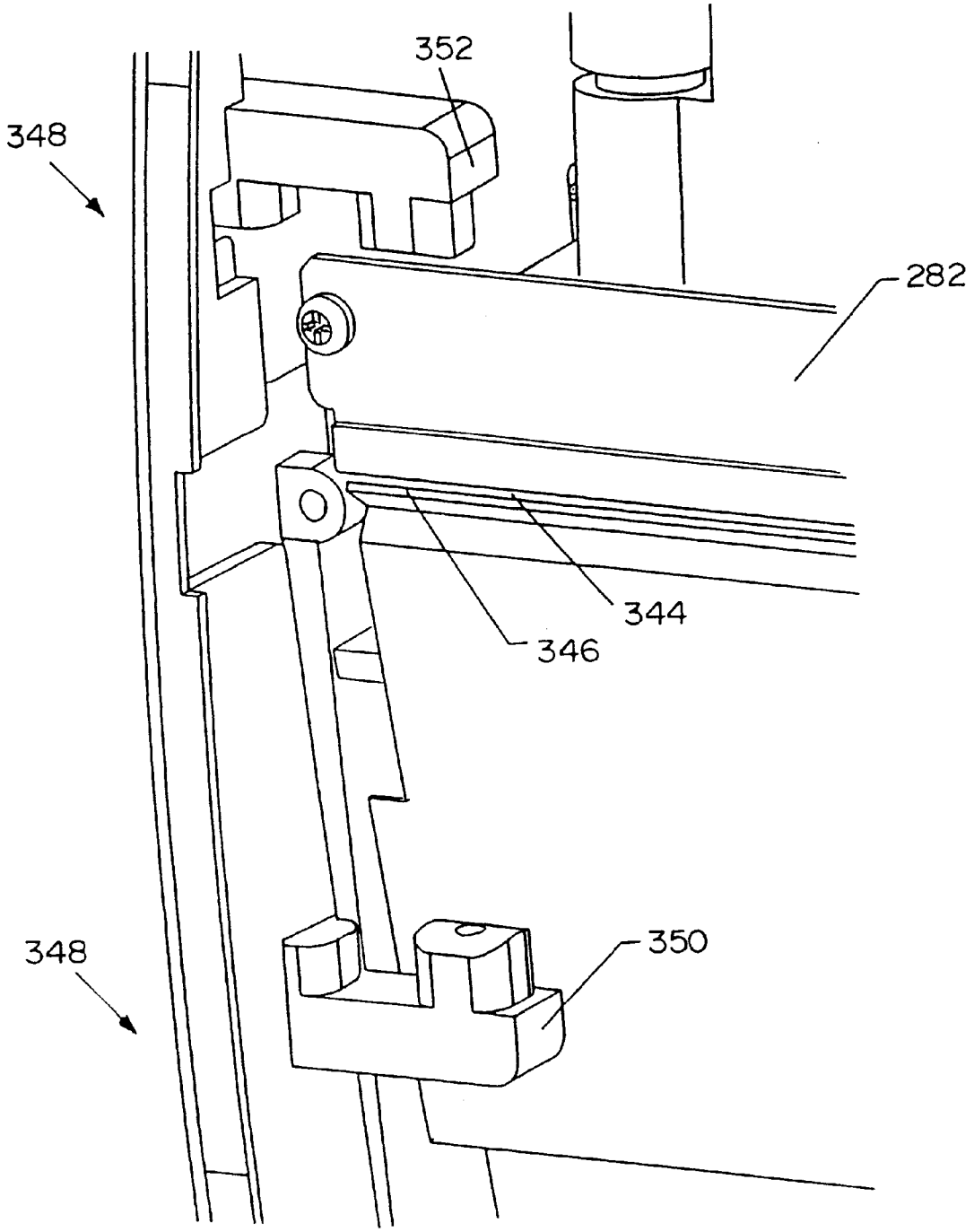
FIG. 28 is a perspective view of a take label sensor component of the invention.

FIG. 28 provides an enlarged perspective view of the front of the printer showing a mouth 344 defined between the ribbon strip plate 282 and a serrated tearing edge 346. In the view as shown in FIG. 28 the media and ribbon have been removed for clarity in describing the components shown therein. If media and ribbon 87, 96 were shown, the media and ribbon 87, 96 would pass through the mouth 344. The ribbon would pass upwardly over the ribbon strip plate 282 and then wind around the ribbon take-up spindle 90. The media 87 would project from the mouth outwardly and pass through a path defined by a take-label sensor 348. The take-label sensor 348 includes a transmitter portion 350 and a receiver portion 352. The transmitting portion 350 transmits a signal to the receiving portion 352 creating a sensing barrier therebetween. When media passes from the mouth 344 it projects outwardly and intersects the sensing barrier. Upon intersection the sensing barrier the take-label sensor 348 senses the presence of the media and relays an appropriate signal to the control circuit means 108. Once a portion of media 87 is removed the sensory barrier is no longer intercepted and another signal is relayed to the control circuit means 108. The take-label sensor 348 and the control signals produced thereby are coupled to the media delivery means 86 to facilitate controlled movement of media 87 and ribbon 96 relative to the printhead 84.

Movement of the transfer ribbon 96 is achieved by positively driving the ribbon take-up spindle 90 with the PMDC motor 104. The novel features of the design and function of the PMDC motor are provided in greater detail in a separate portion of this detailed description. The PMDC motor does, however, provide the positive drive forces by way of the bevel gear arrangement 106. A shaft 354 engaged with the bevel gear arrangement drives the ribbon take-up spindle 90. The perspective view of the ribbon take-up spindle 90 and the PMDC motor are illustrated with the central support wall 74 removed for clarity of description. FIGS. 2–5 are referred to to show the location and mounting of the ribbon take-up spindle 90 and the PMDC motor in the printer 60.

Figure 29:
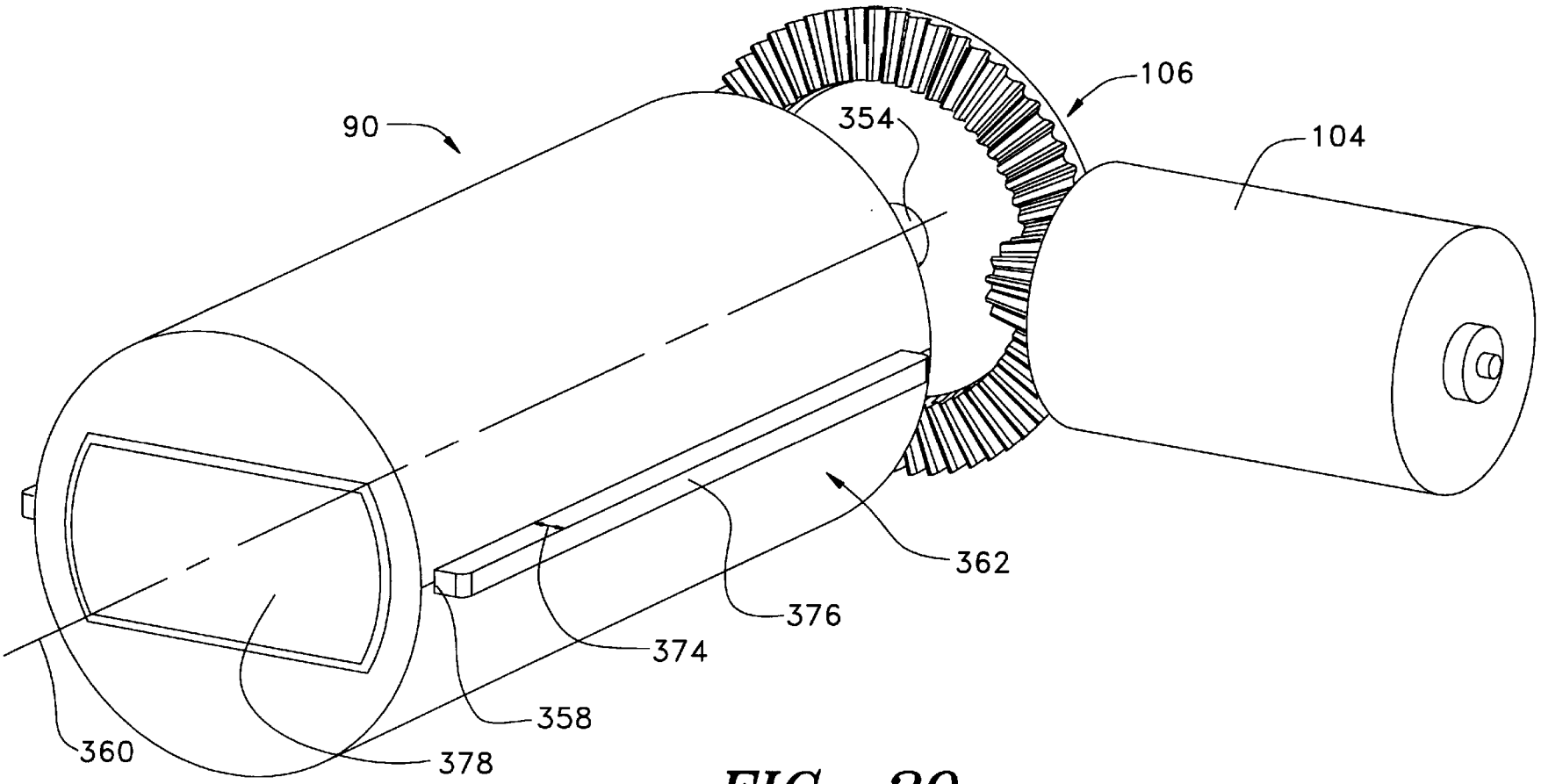
FIG. 29 is an isolated perspective view of a ribbon take-up spindle and associated driving mechanism.
Figure 30:
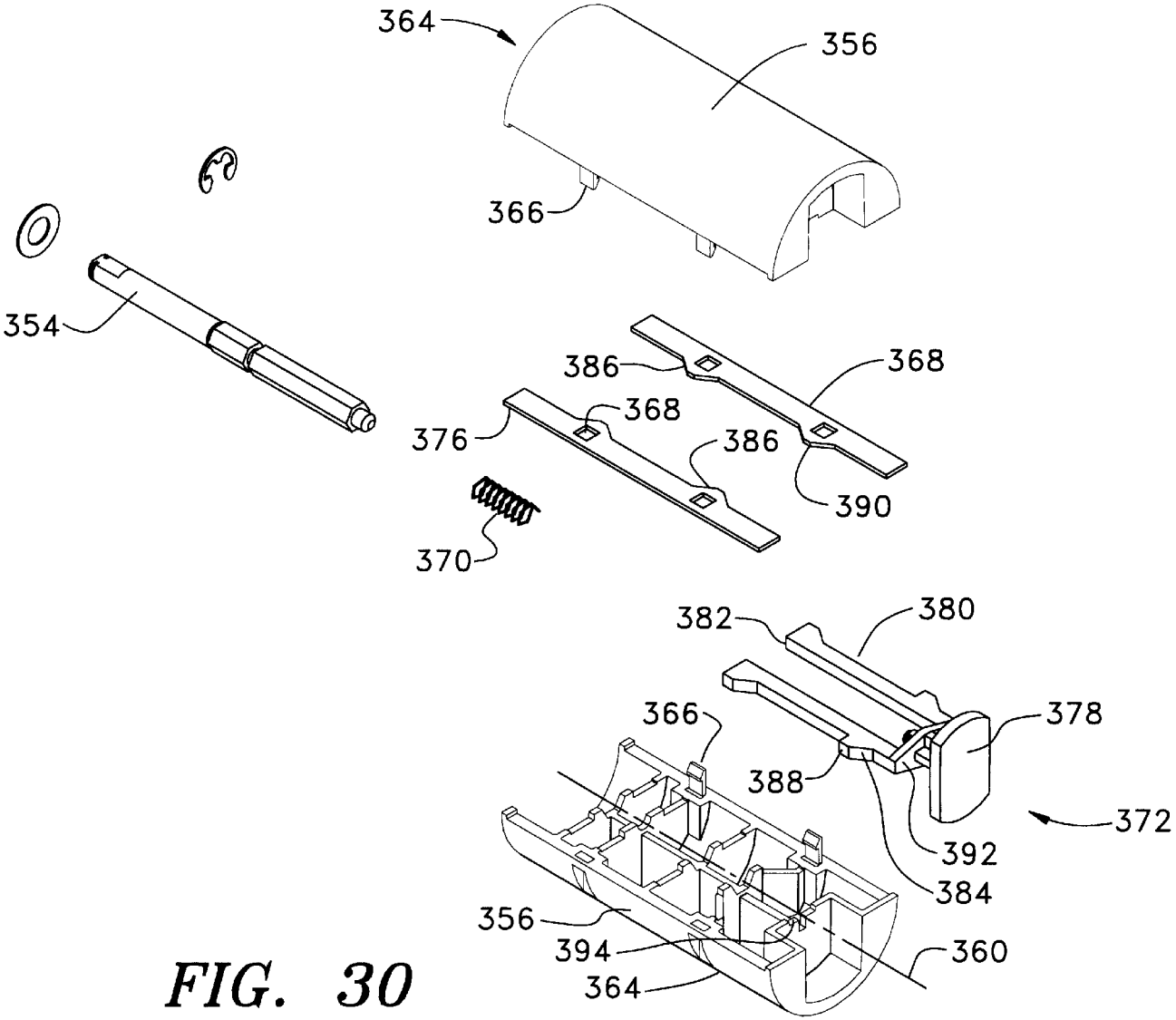
FIG. 30 is an exploded view of a take-up spindle and associated mechanism shown in FIG. 29.

As shown in FIG. 29 and with further reference to FIG. 30, the ribbon take-up spindle 90 has an outside cylindrical surface 356 having at least one protrusion bore 358 formed therethrough. As shown in FIG. 29, two diametrically positioned protrusion apertures 358 are provided on the spindle surface 356. The apertures 358 longitudinally extend parallel to a central spindle axis 360 and define slots through which protruding segments 362 project. The protruding segments 362 are similarly longitudinally extended and define blades projecting through a corresponding slot 358.

As shown in FIG. 30 the spindle 90 is formed of two body halves 364. A portion of each slot 358 is formed in each body half 364. Four engaging pins 366 lock the two halves 364, 364 together to form a unitary spindle body. Additionally, the blades 362 are formed with guide apertures 368 which mate with the engaging pins 366. When the blades 362 are mated with the engaging pins 366 the blades are restricted to movement which is generally radial and perpendicular to the central spindle axis 360 and is limited by the size of the guide apertures 368.

As shown in the exploded view of FIG. 30 the spindle 90 also includes biasing means 370 and means 372 for retracting the blades 362. The biasing means 370 controllably bias and direct the blades 362 outwardly through the corresponding slots 358. The retracting means 372 may be actuated to controllably compress the biasing means 370 to retract the blades 362 into the spindle 90.

When the blades 362 are extended through the slots 358 and spent transfer ribbon 96 is wound around the spindle 90, a space defined in part by a dimension 374 between a face 376 of the blades 362 and the surface 356 of the spindle 90. In other words, as the spent transfer ribbon 96 is wound around the spindle 90 a space is formed between the transfer ribbon wrapping over the face 376 of the blade 362 to the point where the transfer ribbon once again is wrapped around the surface 356 of the spindle 90. When the spent transfer ribbon 96 must be removed from the spindle 90, a retracting button 378 is pushed inwardly along the central axis 360 to actuate the retracting means. 372. As the biasing tension on the blades 362 is released the volume defined by the space between the blade and the spent ribbon is spread out over the entire circumference and surface area 356 of the spindle 90. The additional space between the spent ribbon and the surface 356 of the spindle 90 allows the spent ribbon to be easily removed from the spindle without telescoping the spent ribbon and without using loose components such as wire forms which were used in prior art designs.

The retracting means 372 operates under the influence of the biasing means 370 such that the biasing means axially biases a retracting means body axially coincident with the central spindle axis 360. The retracting means body 380 is operatively retained between the two spindle halves 364, 364. The retracting means body 380 includes two tines 382 which have shaft ramps 84 formed on outwardly facing surfaces thereof. The blades include cooperatively formed blade ramps 386 which move along and engage the shaft ramps 384.

Figure 30A:
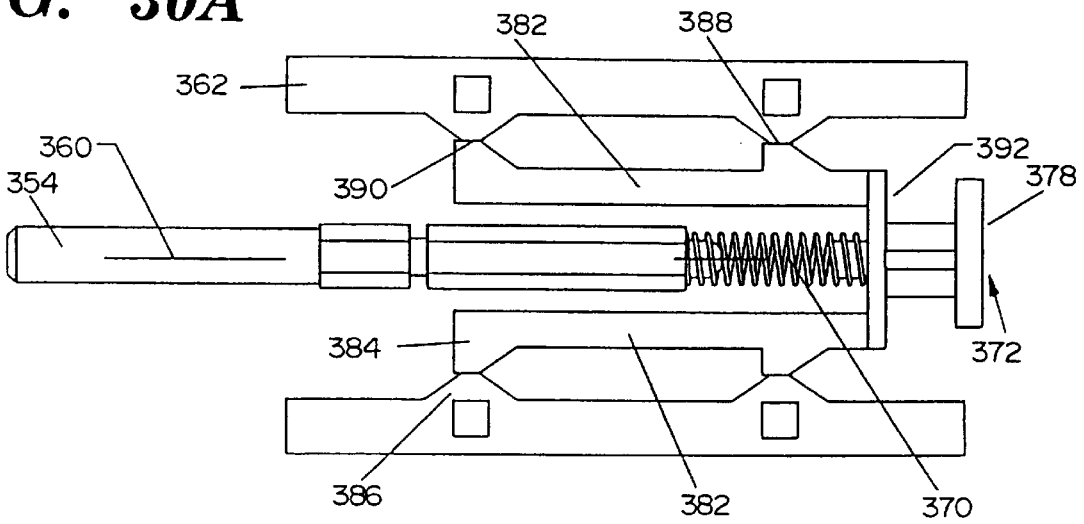
FIGS. 30A and 30B are diagrammatic representations of the operation of the take-up spindle.
Figure 30B:
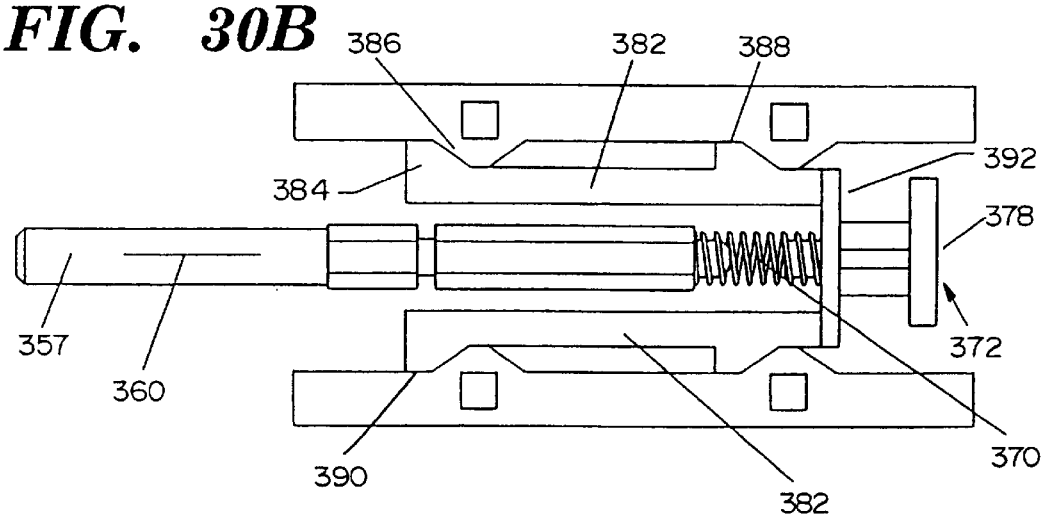
Figure 31A:
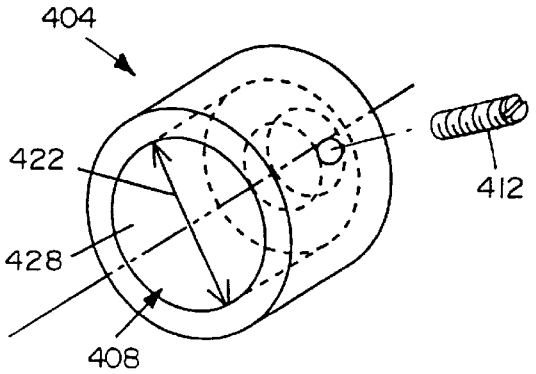
FIG. 31A is an perspective view showing the clutch collar construction.

FIGS. 30A and 30B provide additional clarifying illustrations to show how the retracting means 372 and biasing means 370 function to operate the movement of the blades 362. As shown in the diagrammatic representation of FIG. 30A, the blades 362 are expanded outwardly through the slots 358. The expanded blade condition as shown in FIG. 30A is caused by the biasing means 370, which is retained between the shaft 354 and the retracting means body 380, transferring expanding forces from the biasing means 370 against the retracting means body 380. Since the shaft 354 is fixed and does not move axially along the central spindle axis 360 and since the retracting means body 380 is movably retained in the spindle the biasing means 370 axially displace the retracting means body 380 along the central spindle axis 360. As the body 380 is displaced along the central spindle axis 360 the blade ramps 386 ride upwardly along abutting faces of the shaft ramps 384 and rise to a crest of each shaft ramp 384. When the crests 388 of the shaft ramps 384 abut corresponding crests 390 of the blades 362, the blades are fully extended and will not retract under the influence of ribbon being tightly wound over the face 376 of the blades 362. Further axial movement of the retracting body 380 along the central spindle axis 360 is prevented by a stop collar 392 which abuts an inside surface 394 of the spindle halves 364. In this regard, the biasing means 370 may be selected such that it continues to exert forces on the retracting body 380 when the blades are fully extended. The additional forces created by the biasing means 370 further assures that the blades will remain in the extended position unless electively retracted.

Turning to FIG. 30B, the diagrammatic representation shows the retracting action of the blades when the retracting means body 380 is manually displaced along the central spindle axis 360. When the retracting means body 380 is manually displaced along the central spindle axis 360 the biasing means 370 is compressed between the shaft 354 and the body 380. Release of the biasing force allows the blade ramps 386 to move downwardly along the corresponding shaft ramp 384 allowing inward movement of the blades 362. It should be noted that in both FIGS. 30A and 30B the blades only move radially outwardly along the guide apertures 368. Engagement of the blades 362 with the engaging pins 366 as well as the limited size of the slots 358 prevents displacement parallel to the central spindle axis 360.

Control of the transfer ribbon 96 in the printer 60 is further facilitated by a slip clutch 396 operatively associated with the ribbon dispensing spindle 92. The ribbon feed spindle 92 has a shaft 398 which extends through the central support wall 74. A clutch axis extends longitudinally along the spindle shaft 398. The slip clutch 396 includes a series of ramped teeth 142 spaced around the spindle shaft 398, a coiled torsion spring 402 which is coaxially inserted over the spindle shaft 398 and a clutch collar 404 which houses a portion of the coiled spring 402 and securely attaches to the spindle shaft 398.

When assembling the slip clutch assembly, the spindle shaft 398 is inserted through the central support wall 74 and rotatably secured by a retaining collar 406. The coiled torsion spring 402 is inserted into a spring bore 408 in the clutch collar 404 and the combined torsion spring 402 and clutch collar 404 is positioned over the spindle shaft 398. The clutch collar 404 secured to an end 410 by means of a set screw 412. A leg portion 414 of the coiled torsion spring 402 extends away from the clutch collar 404 and radially extends from the spring 402 to engage sloped circumferential surfaces 416 and vertical walls 418 adjoining the sloped surface 416.

The coiled torsion spring 402 is selected to have a calculated interference fit between an outside diameter of the spring 420 and an inside diameter 422 of the spring board 408 in the clutch collar 404. The amount of diametral interference is directly proportional to the amount of drag the spring 402 provides. The coefficient of friction of the spring 402 and the collar 404, as well as the length of engagement drop out of the calculations for slip torque for all practical purposes. This allows greater flexibility in the design with regards to the geometry and material choice for the coiled spring 402 and the clutch collar 404.

The collar 404 is secured to the shaft 398 so that they rotate as one. As the shaft 398 is rotated (as indicated by arrow 424) i.e., such as the driving force on the take-up spindle 90 applying tension to the ribbon on the dispensing spindle 92, the spring 402 and collar 404 turn together until the extending leg on the spring engages a vertical wall 418 of a corresponding ramp tooth 142. Under the influence of the rotation 424 the spring 402 is twisted or rotatably compressed in the direction of its manufactured wind. This twisting effectively reduces the outside diameter 420 of the spring 402 until it reaches a point where an outside surface 426 of the spring slips against an inside surface 428 of the spring bore 408. A calculated amount of shaft rotation, hence wind-up in the spring, is required before the proper slip situation is achieved. As the shaft 398 continues to be drive in the direction of rotation 424, the spring 402 continues to slip, maintaining a constant drag on the collar and a constant amount of wind-up.

When the driving force is removed or decreased in the direction of rotation 424, the memory in the spring 402 causes it to twist in a reverse direction of its manufactured wind for an angle equal to the slip wind-up. This reverse action or uncoiling of the spring 402 is accompanied by a return to its original manufactured diameter 420. When the spring diameter 420 reaches a predetermined dimension the outside surface 426 of the spring 402 binds against an inside surface 428 of the spring bore 408 in the clutch collar 404 and causes the collar 404 and thus the shaft 398, to turn with it.

Figure 31:
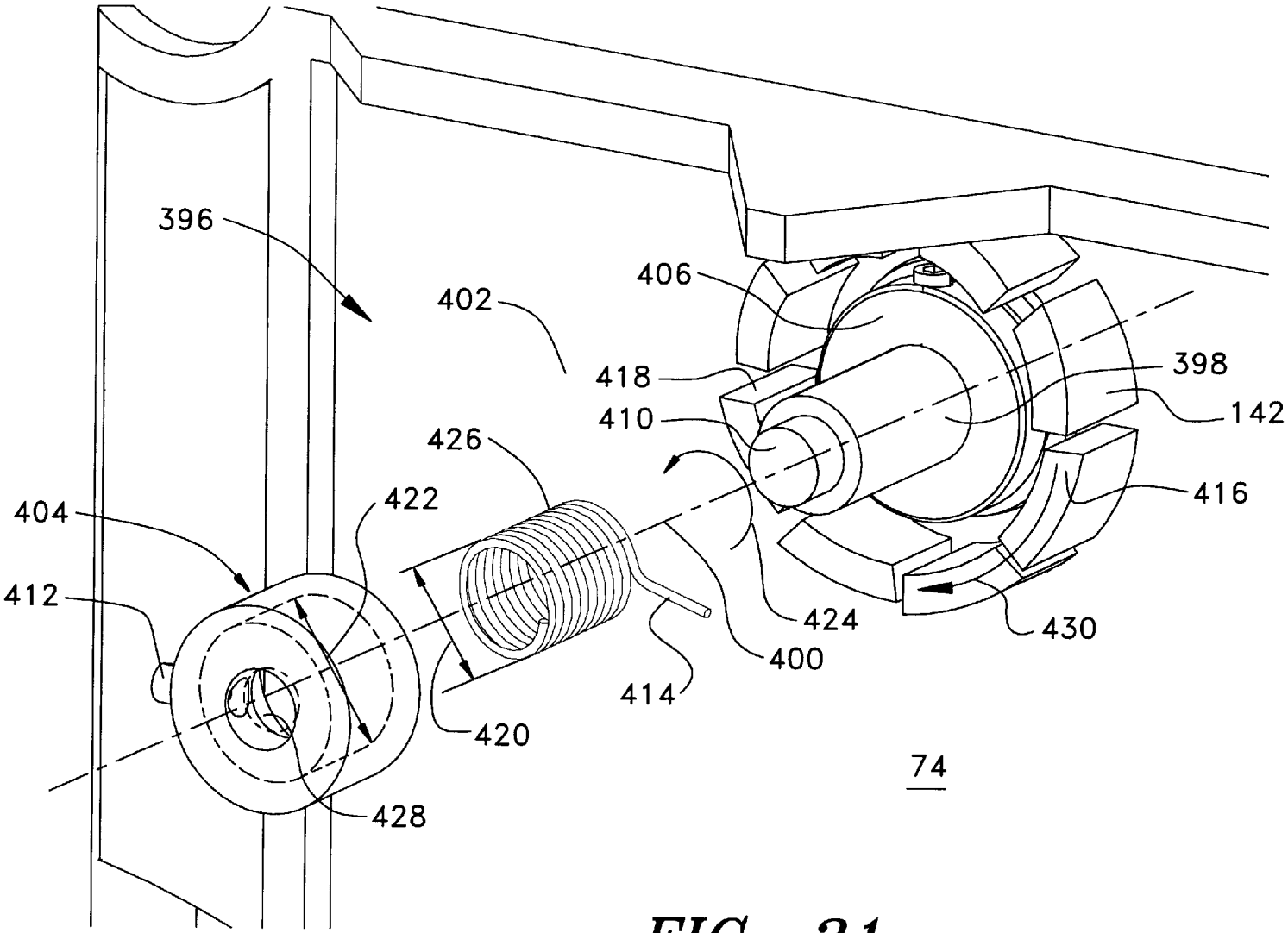
FIG. 31 is an exploded perspective view of a spring clutch component of the invention.

Due to the fact that the spring outside diameter 420 increases when it is turned at opposite the direction of its wind (opposite the direction of rotation 424 as shown in FIG. 31), spring damage may occur if the shaft 398 and collar 404 are forced in the reverse direction with the extended leg 414 trapped in an immoveable position. As it is likely that the user will want to turn the ribbon supply spindle 92 attached to the shaft 398 backwards at times, especially when loading a new roll of ribbon, the sloped surfaces 416 are provided to allow the extended leg 414 to rotate freely backwards while still engaging the spring bore 408 of the clutch collar 404. The array of ramped teeth circumferentially spaced around the clutch axis 400 provides a ratchet-like feature where the extended leg 414 is trapped against a vertical wall 418 in the forward drive direction 424 but is allowed to ride up along the sloped surface 416 and over a ramp 142 indefinitely in a direction 430 opposite the direction of drive rotation 424.

The slip clutch 396 provides a simple and inexpensive device for applying back tension to the ribbon supply spindle 92 in the printer 60 to reduce wrinkles in the ribbon 92 moving through the ribbon supply stream 98. Additionally, the slip clutch 396 also provides wind-back for the ribbon 96 and the ribbon supply stream 98 when the printer 60 backfeeds, or backs-up the media 87 to reposition a front edge of the media during printing or after the removal of a portion of printed media. This wind-back feature is very important to thermal transfer printing as it maintains the back tension on ribbon 96 through the backfeed cycle. If ribbon 96 is not maintained in tension when the printer 60 accelerates forward in a normal printing direction, the inertia of the ribbon roll may cause the ribbon 96 to jerk which may create a smudge on the portion of media being printed. Additionally, the jerking action described above may create wrinkles in the ribbon and therefore create inconsistencies in print quality. These inconsistencies can be extremely detrimental in printing high resolution print such as bar codes or very small type.

SELF-CORRECTING SYSTEM FOR RIBBON TAKE-UP SPINDLE

Another problem that occurs in thermal transfer demand printers is that the tension on the transfer ribbon does not remain consistent during printing. This decrease in tension causes the ribbon to have a tendency to wrinkle during printing operations which can cause the resulting label to have defects, such as inconsistencies in the print quality.

This occurs because as the used ribbon is wound onto the take-up spindle, the radius of the take-up spindle increases as the printer continues to print. As the ribbon take-up spindle's radius increases, the force, i.e. tension, placed on the ribbon decreases if the ribbon take-up spindle torque is not increased. This action is governed by the following equation:

$$\text{Ribbon Force}=(\text{Spindle Torque})/(\text{Spindle Radius})$$

Thus, to minimize this problem, the ribbon take-up spindle torque must be increased when the ribbon spindle take-up radius increases.

This problem is minimized in the present invention by using a self-correcting system that utilizes the properties of a Permanent Magnet Direct Current (PMDC) motor when a constant voltage is applied across its terminals. As shown in FIG. 29, the self-correcting system is generally comprised of a PMDC motor, a gear arrangement including a gear and a ribbon take-up spindle.

The shaft of the take-up spindle, as described herein, is attached to the center of the gear by suitable means. For example, the shaft may be snapped into a hole in the gear reduction and held with a screw. The two components form a tight fit. The gear reduction is circular in shape and has an outer edge that is beveled. The PMDC motor is connected to a suitable power source, through the printed circuit board ("PCB"). The PCB includes appropriate microprocessors to carry out the printer functions as described herein. The PMDC motor may be connected to a standard linear regulator which may be included in the PCB for regulating the amount of voltage supplied to the PMDC motor. A beveled flange that protrudes from an end of the PMDC motor is in contact with the beveled outer edge of the circular gear reduction. The beveled end of the PMDC motor and the beveled outer edge of the gear reduction interconnect so as to form a tight fit between the components. In operation, the PMDC motor drives the gear reduction which, in turn, rotates the take-up spindle. Thus, the used ribbon is wound onto the take-up spindle.

Figure 32A:
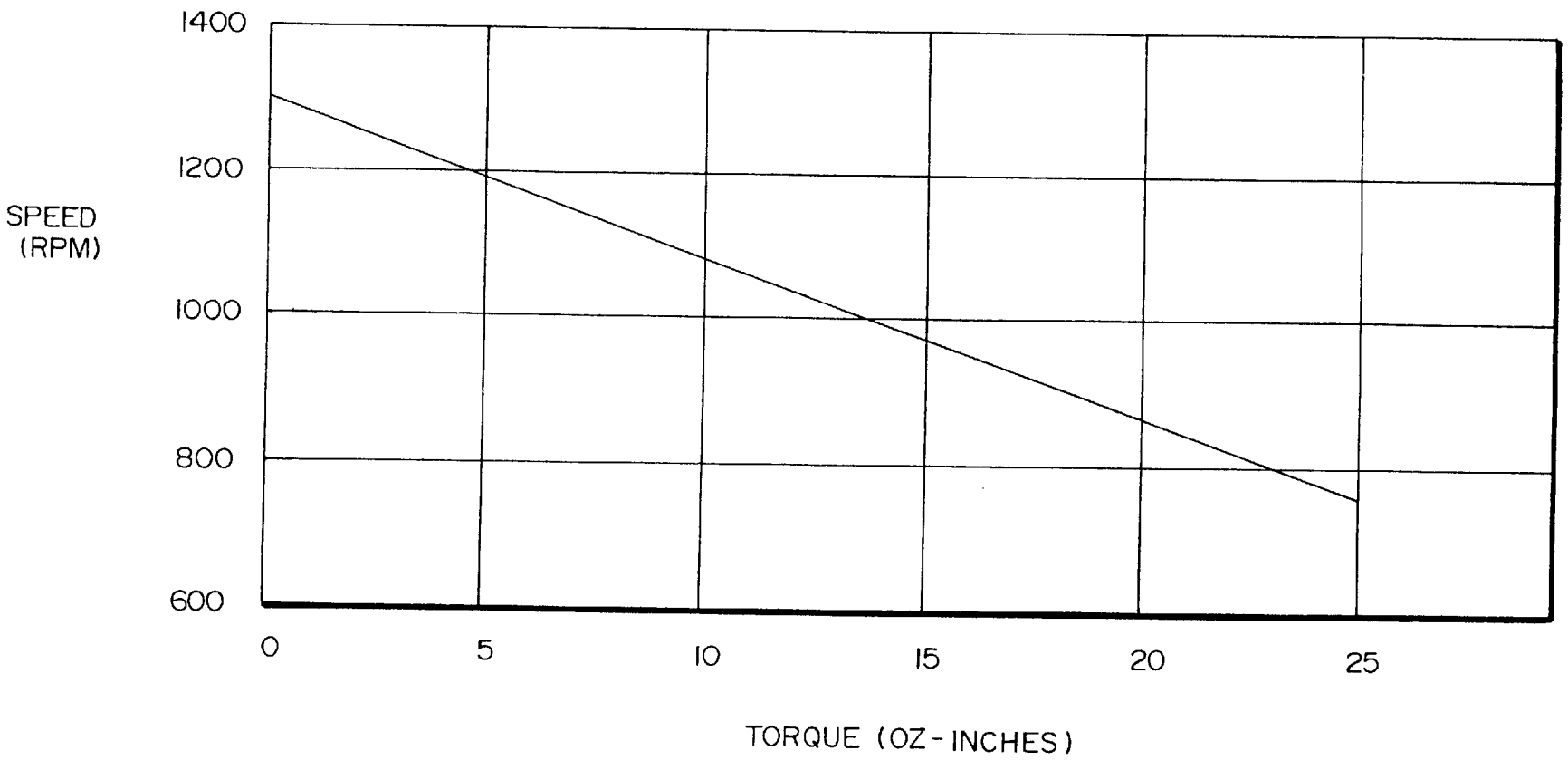
FIG. 32A is a graph representing to the speed vs. torque relationship of a PMDC motor element of the ribbon take-up means component of the present invention.
Figure 32B:
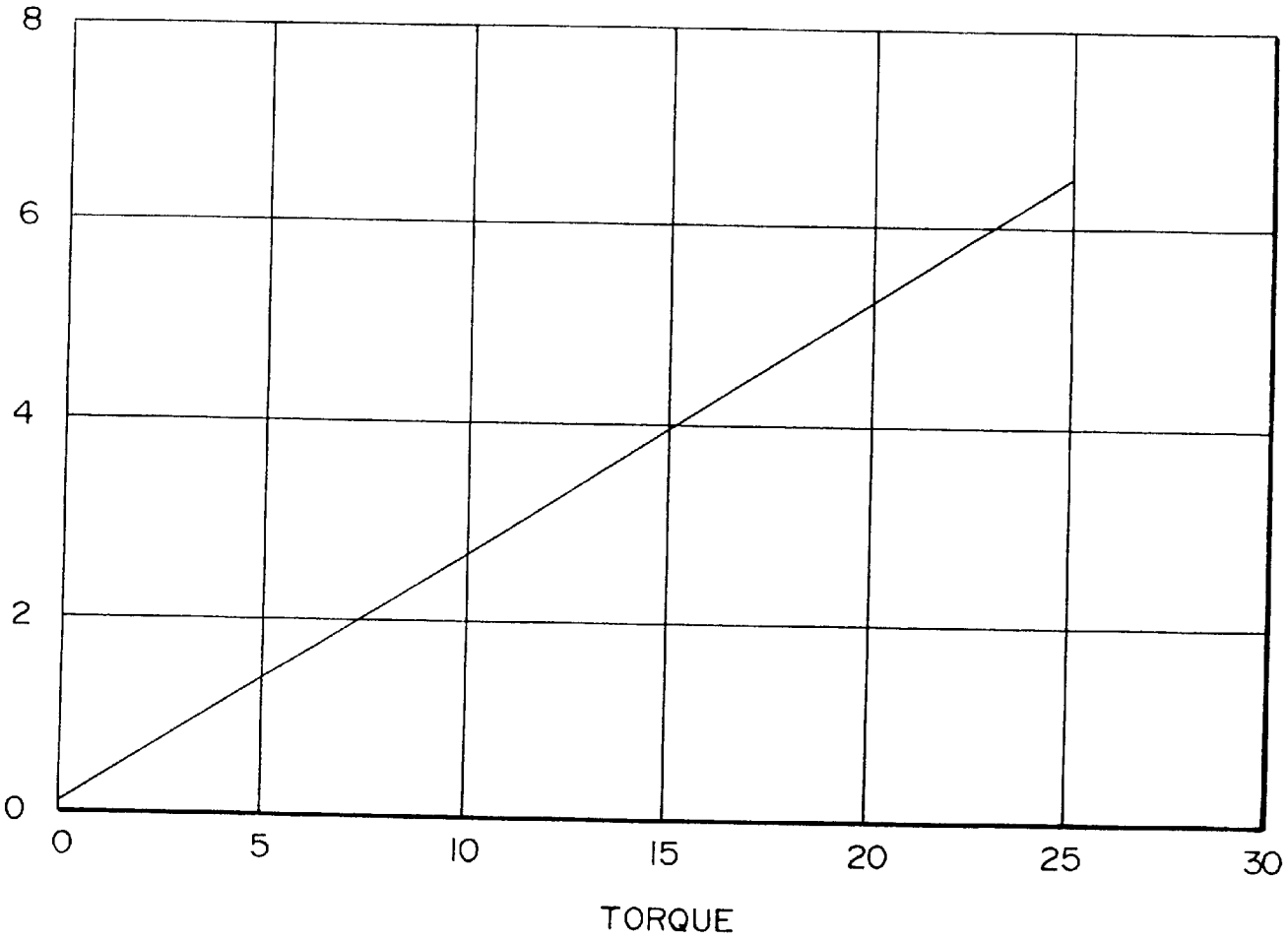
FIG. 32B is a graph representing the motor current vs. torque relationship.

When the PMDC motor has a constant voltage applied across its terminals, the PMDC motor will follow the properties of this speed-torque curve shown in the graph of FIG. 32A. As can be seen from the graph, as the steed of the PMDC motor decreases, its torque output increases. This is advantageous in a ribbon tension system because the system will be self-correcting, as will be described in greater detail hereinafter.

If the printer is printing at a constant print speed, as the take-up spindle increases in diameter, its angular velocity decreases. This decrease in angular velocity causes the speed of the PMDC motor to decrease in proportion. When this occurs, the back EMF generated by the PMDC motor decreases, which causes an increase of current flow in the PMDC motor. As the current flow increases (and speed decreases), the PMDC follows along its speed-torque curve and thus, its torque output increases. The increase in torque causes the force on the ribbon, the tension, to increase. Therefore, the system self-corrects and the ribbon tension will have less variation due to the increase in the ribbon take-up spindle diameter.

Figure 33A:
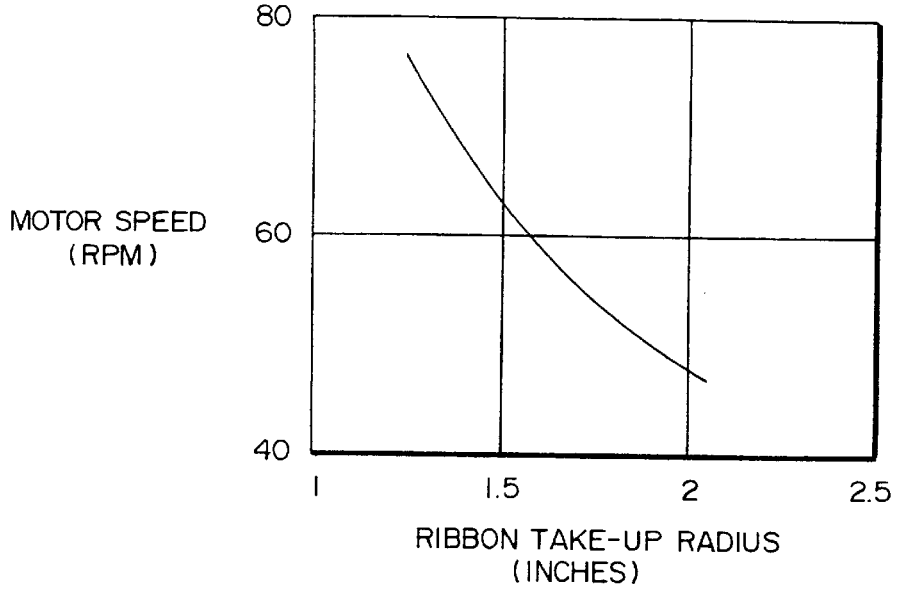
FIG. 33A is a graph representing the motor speed vs. ribbon take-up spindle radius relationship.

In the preferred embodiment, a low gear reduction is used. As shown in FIG. 33A, the graph models a system that uses a gear reduction of 5 to 1 from the PMDC motor to the ribbon take-up spindle. As can be seen, the ribbon take-up spindle radius varies from 1.2 inches to 2.1 inches. As shown in the graph, as the take-up spindle radius increases, the PMDC motor speed decreases. Thus, the PMDC motor will follow along its speed-torque curve as shown in FIG. 32A, and will increase its torque output. If this system is used with a ribbon run at 2 inches per second linear velocity, an effective, self-correcting, ribbon tensioning control system may be constructed. It is to be understood, however, that other low gear reductions may be used in the invention.

Figure 33B:
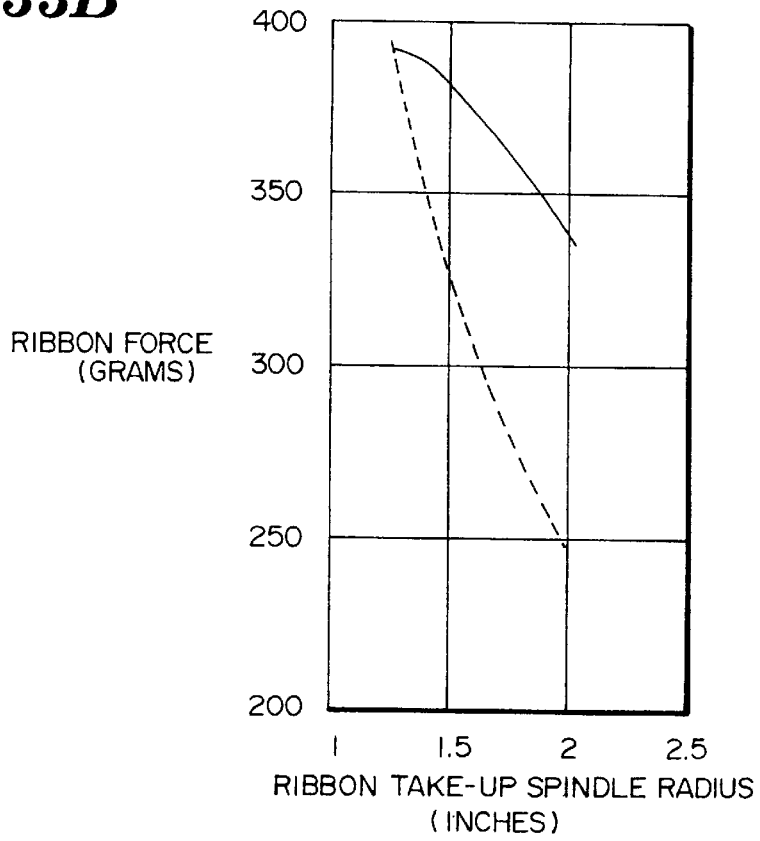
FIG. 33B is a graph representing the ribbon force vs. ribbon spindle radius relationship.
Figure 34:
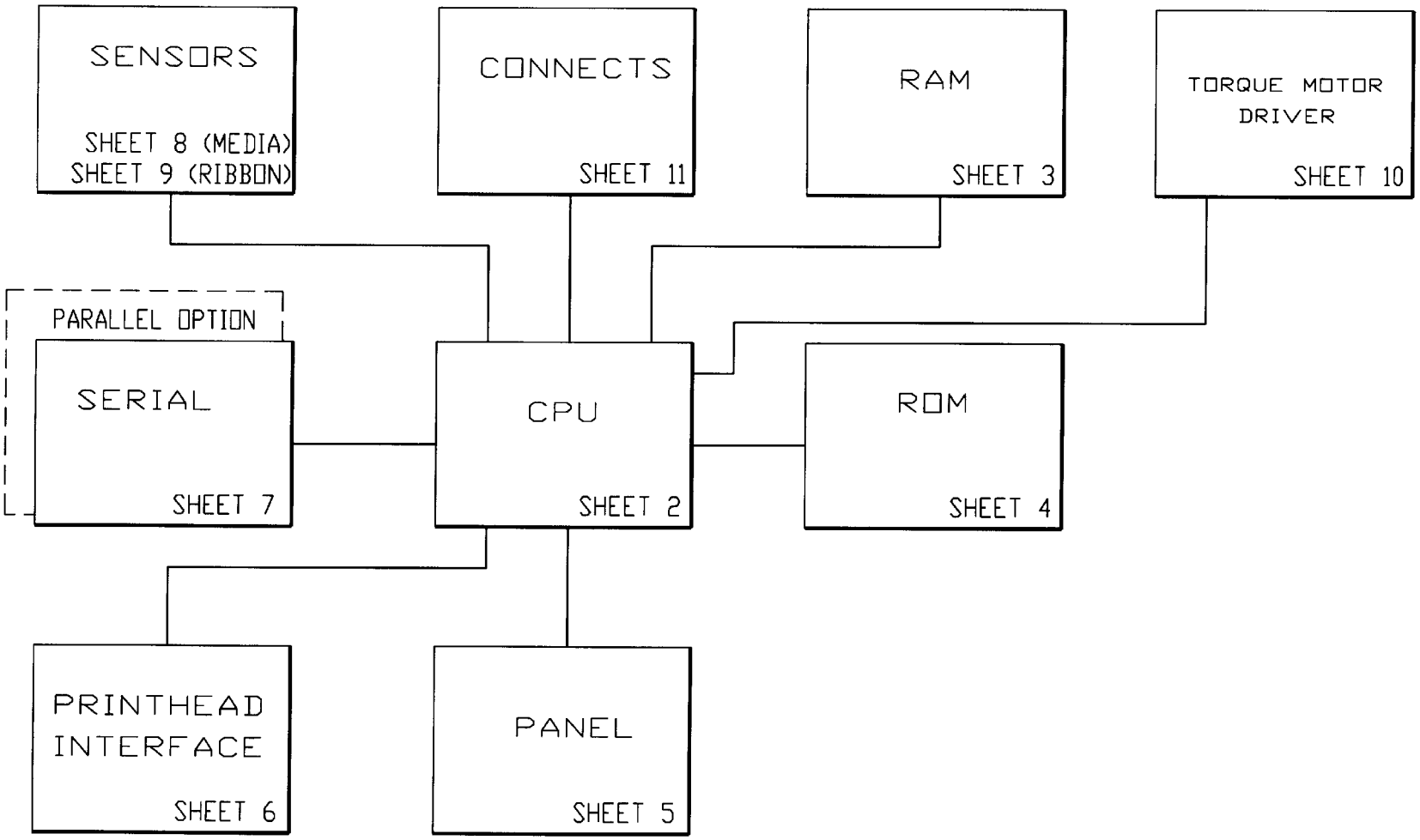
FIG. 34 is a block diagram illustrating the electrical inter-relationships between the various components of the demand printer.

In FIG. 33B, a graph of the ribbon tension versus the take-up spindle radius is shown, and compares a non-correcting system and a self-correcting system. The non-correcting system illustrated could be accomplished by utilizing a slip clutch which is well-known in the prior art. As shown in the graph, the non-correcting system, as shown by the dashed line, starts out with an empty take-up spindle and a ribbon tension of approximately 390 grams. With a full ribbon take-up spindle, the ribbon force decreases to 240 grams because of the increase of the ribbon take-up spindle radius.

When using the self-correcting system, as shown by the solid line, the ribbon tension starts out at approximately 390 grams with an empty spindle and decreases to approximately 340 grams when the ribbon take-up spindle is full. Thus, a substantial improvement is achieved by using the present invention.

If the user wants the printer to operate faster or slower, the user inputs a new print speed. When the print speed is changed, the PMDC motor will operate on a different part of its speed-torque curve. Therefore, it is necessary for the driving circuitry to receive information on the printer's operating speed so the printer can change the PMDC motor's operating voltage.

Another advantage to using a PMDC motor is that is reduces the loading on the stepper motor. Thus, a smaller stepper motor may be used to drive the remaining parts of the printer.

Another feature of the present invention is that the printer can be used with varying widths of ribbon and will still maintain a relatively constant ribbon stress. In thermal transfer printers, it is often desirable to use different width ribbons depending on the width of the label being printed in order to avoid wasted ribbon and therefore minimizing costs. For example, if a two-inch wide label is fed into a thermal printer, it would not be cost effective to use a six-inch wide ribbon in the printer. Therefore, a narrower ribbon would be used.

If narrow ribbon is being used, it is advantageous to lower the ribbon take-up spindle torque so the ribbon stress is kept to a safe level. If it is not, ribbon breakage and stretching can occur. For example, if the user of the thermal transfer printer preset the spindle torque to transmit a proper amount of force on a six-inch wide ribbon and the user loaded a three inch wide ribbon onto the printer, then the ribbon's tensile stress would increase by a factor of two. Thus, the ribbon would be prone to breakage or stretching.

Figure 35:
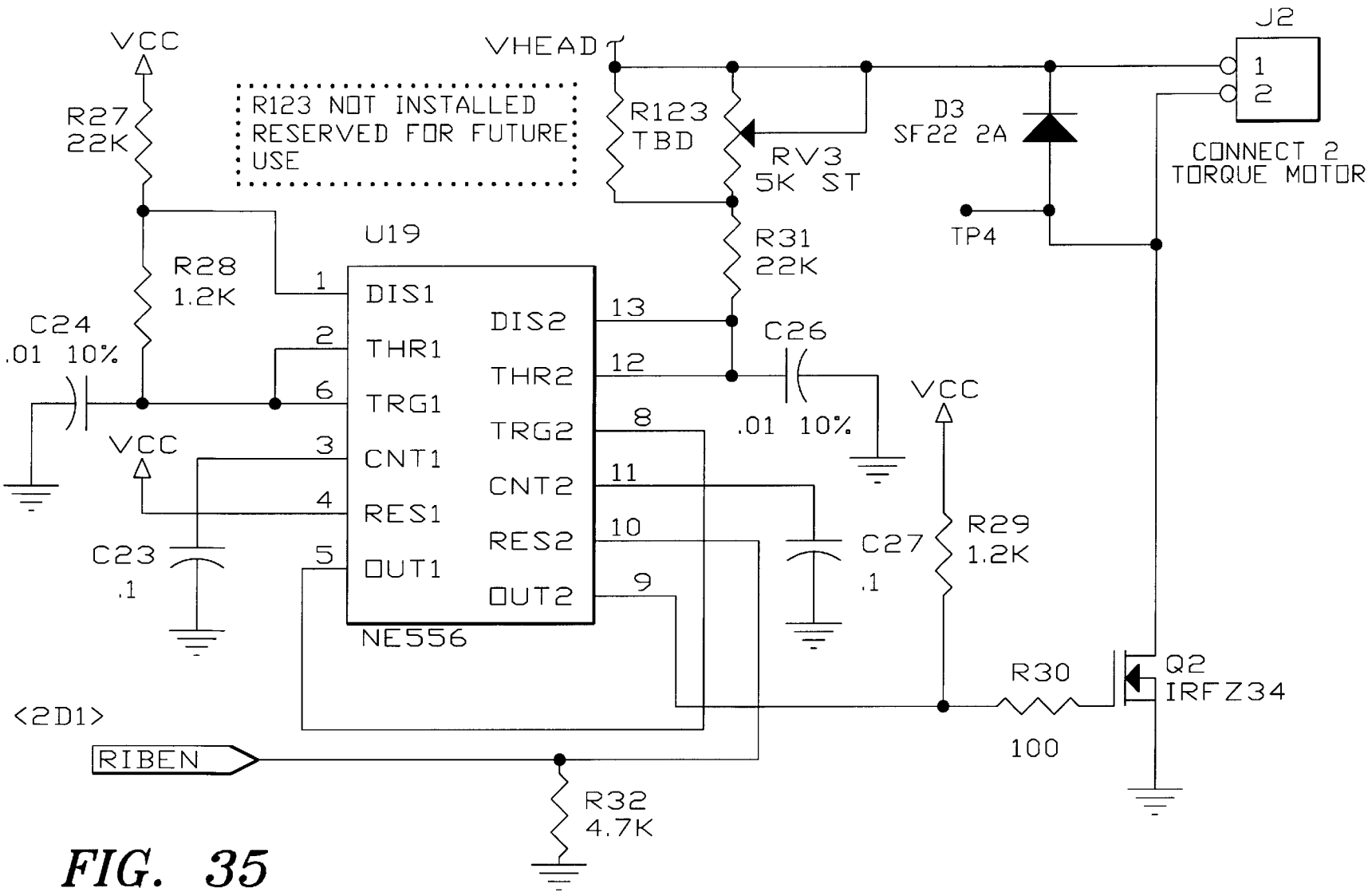

In an alternate embodiment of the present invention, the PMDC motor may be driven by a pulse-width-modulation (PWM) regulator circuit, as shown in FIG. 35, for producing a pulse-width-modulated signal. The PWM regulator circuit will run cooler than a standard linear regulator because it is more efficient when driving an inductive load such as a motor. This PWM regulator circuit allows the user to dial in a desired torque for the PMDC motor. When the circuit is in operation, as will be described in greater detail herein, the PMDC motor's speed/torque characteristics remain relatively constant even with large changes in motor supply voltage ("VHEAD").

In thermal transfer printers, the electronics typically run at +5 vdc except for the thermal printhead which typically runs between 5–40 vdc in order to heat the thermal printhead's elements. During the thermal printhead's manufacturing process, variations in element resistance can occur. This requires the printer to change the voltage applied to the printhead to compensate for this change in resistance. If the voltage is not changed to compensate for the variations in element resistance, then the print quality will suffer.

This PWM regulator circuit enables the PMDC motor to have a relatively constant average voltage applied across the PMDC's terminal regardless of the supply voltage. This will allow the PMDC motor to follow its speed-torque curve and improve the variation in ribbon tension as described hereinabove.

The PWM regulator circuit can be integrated into the PCB, and is also connected by suitable wiring to the PMDC motor. The PMDC motor drives the spindle in the same manner as described hereinabove.

The circuit shown in FIG. 35 consists of a NE556 IC timer. The NE556 IC timer is two NE555 timers in a single package. One of the NE555 timers is configured as an astable multivibrator. In the preferred embodiment, the astable multivibrator is designed to output a square wave at 5.9 KHz with a duty cycle of approximately 81%. The output of the astable is fed into the other NE555 timer that is configured as a monostable multivibrator. As a negative transition occurs on the astable multivibrator, the monostable will be triggered and emit a pulse of a duration governed by the following equation:

$$\text{Pulse Width}=-(R)\ (C)\ (ln(1-3.333/VHEAD))$$

where:

VHEAD=PMDC motor's supply voltage;

R=monostable's timing resistor;

C=monostable's timing capacitor, and 3.333=turn-off threshold value for the NE555 monostable multivibrator.

The resistor and capacitor that determine the time constant for the monostable are connected to the PMDC motor's supply voltage in a manner as shown in FIG. __:

R in the previous equation=(RV3+R31)

and

C in the previous equation=(C26)

The output pulse of the monostable multivibrator is fed into the gate of a mosfet which pulses the PMDC motor with the voltage present at VHEAD. In the preferred embodiment, if a +5 vdc signal is placed on the RIBEN (Ribbon Tension Enable) line from the microprocessor, this signal will enable the monostable multivibrator which, in turn, will cause the PMDC motor to turn on. Likewise, placing a zero voltage signal on the RIBEN line will disable the monostable multivibrator which, in turn, will cause the PMDC motor to turn off. The circuit pulses the PMDC motor at a frequency high enough, approximately 6 KHz, so that print quality is not affected. If slow pulse rates are fed to the PMDC motor, then alternating dark and light bands will occur on the media. This is due to the vibration of the PMDC motor which causes the media and the ribbon to vibrate.

In the preferred embodiment, the elements in the circuit take on the following values:

| ELEMENT | VALUE |
|---|---|
| RV3 | 5K ST OHMS |
| R27 | 22K |
| R28 | 1.2K |
| R29 | 1.2K |
| R30 | 100 |
| R31 | 18K |
| R32 | 4.7K |
| C23 | 0.1 microfarads |
| C24 | 0.01 10% microfarads |
| C26 | 0.01 10% microfarads |
| C27 | 0.1 microfarads |

It is to be understood that other values may be used depending on the application.

This circuit allows ribbon take-up spindle torque to remain relatively constant while being independent of the PMDC motor's supply voltage. If the PMDC motor's supply voltage changes VHEAD, the circuit will compensate to allow the PMDC motor's speed/torque characteristics to remain relatively constant. An additional advantage is that the circuit pulses the PMDC motor to limit the power consumption of the drive circuitry. This causes the circuit to be very efficient and causes little heat to be generated by the electronics.

As can be seen from the foregoing, as VHEAD, the PMDC motor supply voltage, increases in value, the pulse width will decrease in width, keeping the average voltage applied to the PMDC motor's terminals to remain relatively constant. Likewise, as VHEAD decreases in value, the pulse width to the PMDC motor will increase in length, causing the average voltage to remain constant.

Since the PMDC motor must be capable of running near a stall in order to increase the life of the brushes in the PMDC motor, the voltage must be kept to a level below its rated operating voltage to limit the current to a safe level. In other words, the maximum current draw to the PMDC motor is limited by lowering its operating voltage. In the present invention, the PMDC motor is run with a DC voltage below its rated operating voltage, thus, the PMDC motor may not start to rotate. Therefore, it is advantageous to pulse the PMDC motor with narrow pulses of an amplitude that equals the PMDC motor's operating voltage in order to improve the start-up characteristics of the PMDC motor.

The average voltage pulsed to the PMDC motor must equal an equivalent DC voltage that would limit the PMDC current draw, at the motor speeds operated at in this invention, to a safe operating level. The PWM regulator circuit described herein will pulse a PMDC motor at a peak amplitude determined by the voltage present at VHEAD. If VHEAD either increases or decreases, the circuit will compensate for this and increase or decrease the pulse width of the voltage going to the PMDC motor. The pulse width changes in order to keep a relatively constant average voltage to the PMDC motor terminals.

The circuit also allows the ribbon tension to be adjusted by a potentiometer RV3, in order to control the ribbon take-up spindle torque, and ultimately, ribbon tension to compensate for variations in ribbon stress due to changing ribbon widths. By using the potentiometer, the ribbon tension can be easily lowered to avoid damaging of the ribbon. This is an improvement over prior art mechanical clutches that are very difficult to adjust.

When the potentiometer is adjusted, the duty cycle of the pulses controlling the PMDC motor are either increased or decreased in order to change the speed vs. torque characteristics of the PMDC motor. The circuit will continue to adjust the duty cycle according to the motor supply voltage regardless of the position of the adjustment potentiometer. For example, if the motor supply voltage changes, the circuit will automatically vary the duty cycle so that the average voltage applied to the PMDC motor's terminate stays relatively constant.

The ribbon tension could also be adjusted by software control in order to control the ribbon take-up spindle torque, and ultimately, ribbon tension to compensate for variations in ribbon stress due to changing ribbon widths. The software and/or hardware could be modified to change the resistor values for R31 to change the RC time constant on the monostable multivibrator. This will cause a change in pulse width to the motor. By using software control, the ribbon tension can be easily modified to achieve optimum ribbon tension. This is another improvement over prior art mechanical clutches.

The printer in the instant invention could also be modified to be used with a varying print speed if the effective voltage across the PMDC motor varied accordingly. For example, if the motor voltage was increased when the printer changes print speeds from 2 inches per second to 6 inches per second, then there would be less variation in ribbon tension due to an increase in print speed. This could be accomplished by having a microprocessor switch in different resistance values for R31. This would increase or decrease the pulse width voltage across the motor terminals.

Another feature of the present invention is that the life of the PMDC motor is increased. The three major factors that control the life of a PMDC motor are: brush wear, armature life and bearing wear. Both brush wear and bearing life are dependent on the number of rotations that the PMDC motor turns. If the number of rotations that the motor has to turn decreases in some manner, then the PMDC motor life could be increased.

If the PMDC motor is forced to run at a slower speed, i.e., near a stall, the back EMF generated by the PMDC motor will decrease causing an increase in current flow to the PMDC motor. If the current flow is too great, then damage can occur to the armature windings. If the current traveling through the PMDC motor was limited by applying a lower than normal operating voltage to the PMDC motor, then the armature windings life would be increased because excessive current would not be traveling through the PMDC motor.

In the preferred embodiment, a low gear reduction is used, as described herein. This allows the motor to operate slower than if a very large reduction was used. Also, since the ribbon take-up spindle has a large diameter, the angular velocity at which the ribbon take-up motor would have to spin is much slower. Thus, the PMDC motor does not have to rotate as fast as if a small diameter ribbon take-up spindle is used. Therefore, the life of the PMDC motor is increased.

Furthermore, the PMDC motor has the capability of being shut-off by software control, thus, the PMDC motor does not sit in a stalled condition. If the PMDC motor sits in a stalled condition for any length of time, for example, when the printer is sitting idle, the armature winding tend to get hot which decreases their useful life, even though the current traveling through the armature windings was limited to a safe value by the operating voltage.

Another feature of the present invention is that the demand printer described in this patent is capable of printing in thermal-transfer mode which requires ribbon. This demand printer is also capable of printing in direct thermal mode which does not require ribbon. In prior art, where ribbon take-up spindles were driven by mechanical clutches, there was not an easy way for the ribbon-take-up spindle to become disabled and stop rotation when the ribbon-take-up spindle was not being used as in direct thermal application.

When a PMDC motor is used to drive the ribbon take-up spindle it can be easily disabled in direct thermal applications by using the "RIBEN" line described in this invention.

It is desirable to disable the ribbon-take-up spindle when it is not used because it wastes energy and causes the ribbon take-up component to wear unnecessarily.

Another feature of the present invention is that the printer is capable of reversing the flow of the media and the ribbon from the printing direction as described hereinabove. This feature is called backfeeding.

When a backfeed operation takes place, it is essential that the force required to pull the ribbon in the opposite direction is not excessive. If the required force is too excessive, then the ribbon may not unwind from the ribbon take-up spindle because the components of the printer that control the backfeed process may not have the capability of transmitting the required amount of ribbon force in the backfeed direction to unwind the ribbon. This is done in two ways.

First, the gear reduction from the ribbon tension motor to the feed spindle is minimized. This is done to limit the reflected inertia from the PMDC motor to the ribbon take-up spindle. Reflected inertia is governed by the following equation:

$$\text{Reflected Inertia} = \text{Motor Inertia} \times \text{Gear Reduction}^2$$

The reflected inertia increases by the square of the gear reduction. Thus, it is essential that the gear reduction is kept to a minimum to avoid an increase in ribbon take-up spindle inertia. If the reflected inertia to the ribbon take-up spindle is too high, then the initial force to unwind the ribbon from the ribbon take-up spindle will become too great.

Second, the PMDC motor can be driven by the PWM regulator circuit which has the capability of disabling the PMDC motor from a control signal as described hereinabove. This prevents the PMDC motor from supplying torque to the ribbon take-up spindle. The PMDC motor must be disabled in order to allow the ribbon to backfeed at the same rate that the media is backfeeding. If the PMDC motor is not disabled, then the ribbon will not backfeed and will cause smudging of the ribbon on the media. Thus, since the PMDC motor can be disabled, the amount of force needed to backfeed the ribbon is minimized.

Figure 17:
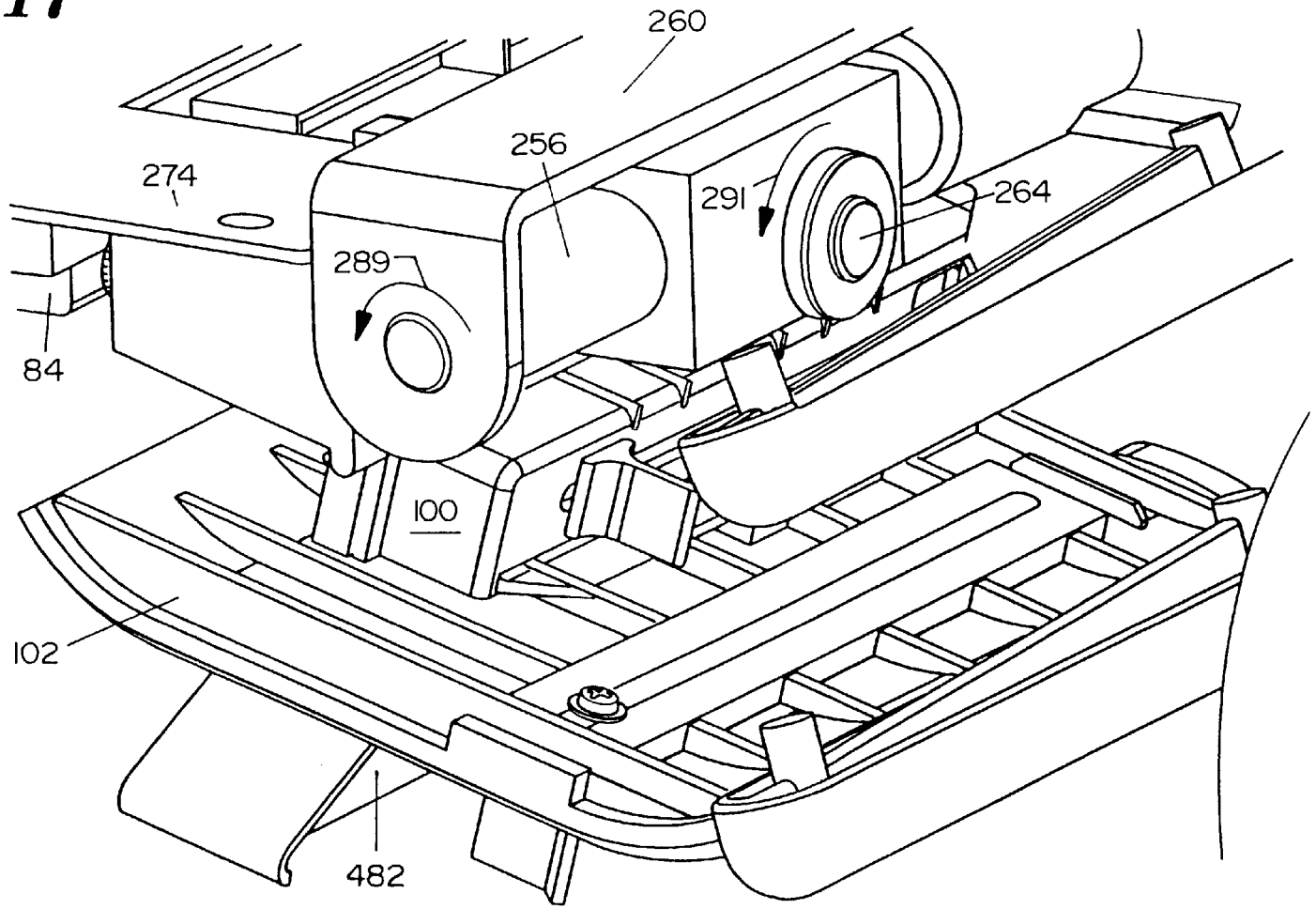
FIG. 17 is a perspective view of the media sensor and guide plate components of the invention.
Figure 18:
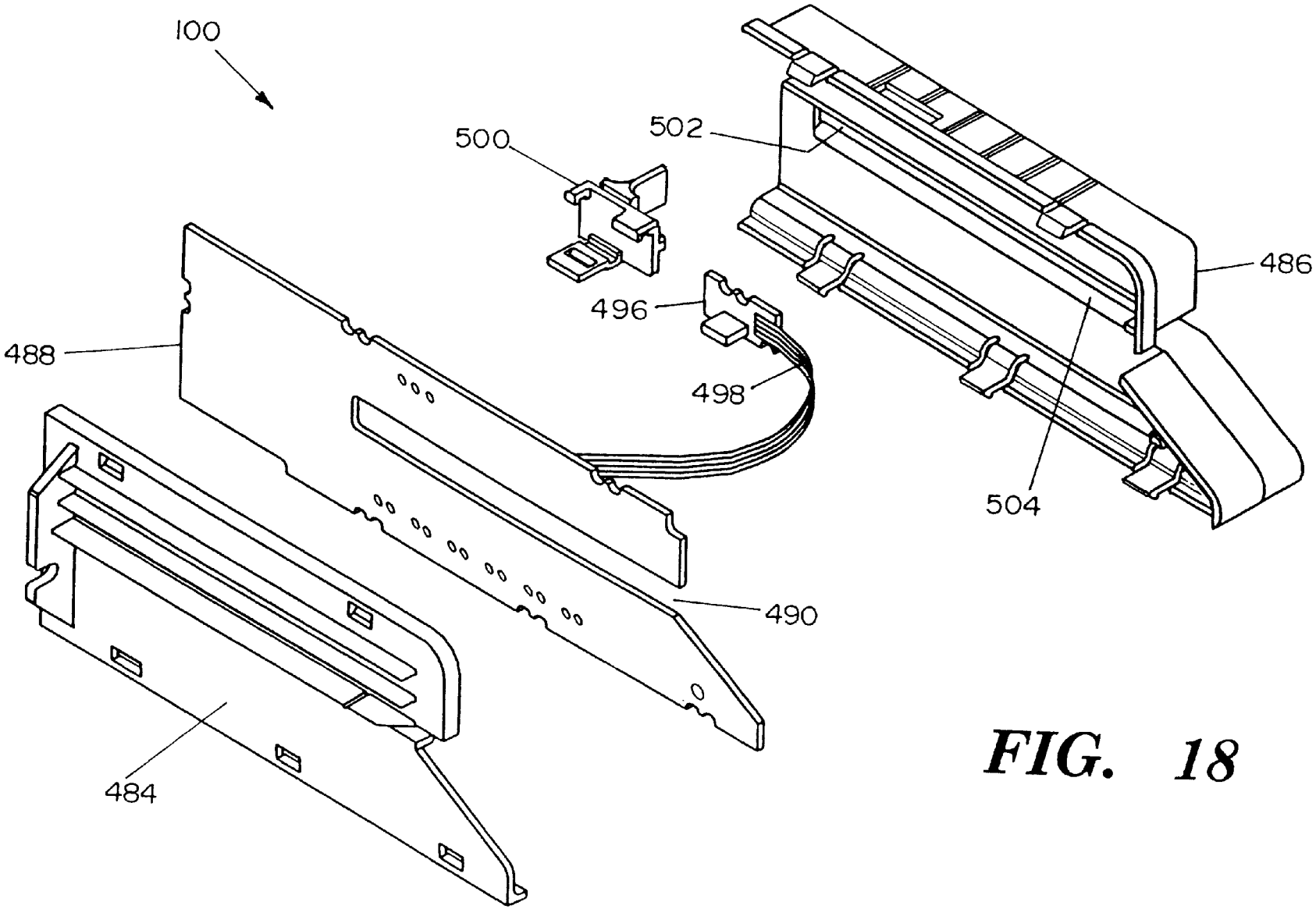
FIG. 18 is an exploded perspective view of the media sensor component of the invention.

In accordance with another important aspect of the present invention, a media sensor 100 is provided for monitoring and adjusting media location within the demand printer, thereby ensuring accurate printing operations. In FIG. 17, the media sensor 100 is shown in operative association with a media guide 102 which leads the web of media past the media sensor 100 thereby allowing the sensor 100 to perform its intended function. In FIG. 18, the media sensor 100 is illustrated apart from the media guide 102, as well as the remaining components of the printer 60, and as shown in exploded form. A close inspection of FIG. 18, reveals that the media sensor 100 includes a housing 482 having a cover 484 and a base 486 for enclosing a media sensor circuit board 488. The cover 484, base 486, and circuit board 488 all have a corresponding slot 490 formed therein allowing the media 87 to pass through the media sensor 100.

Figure 19:
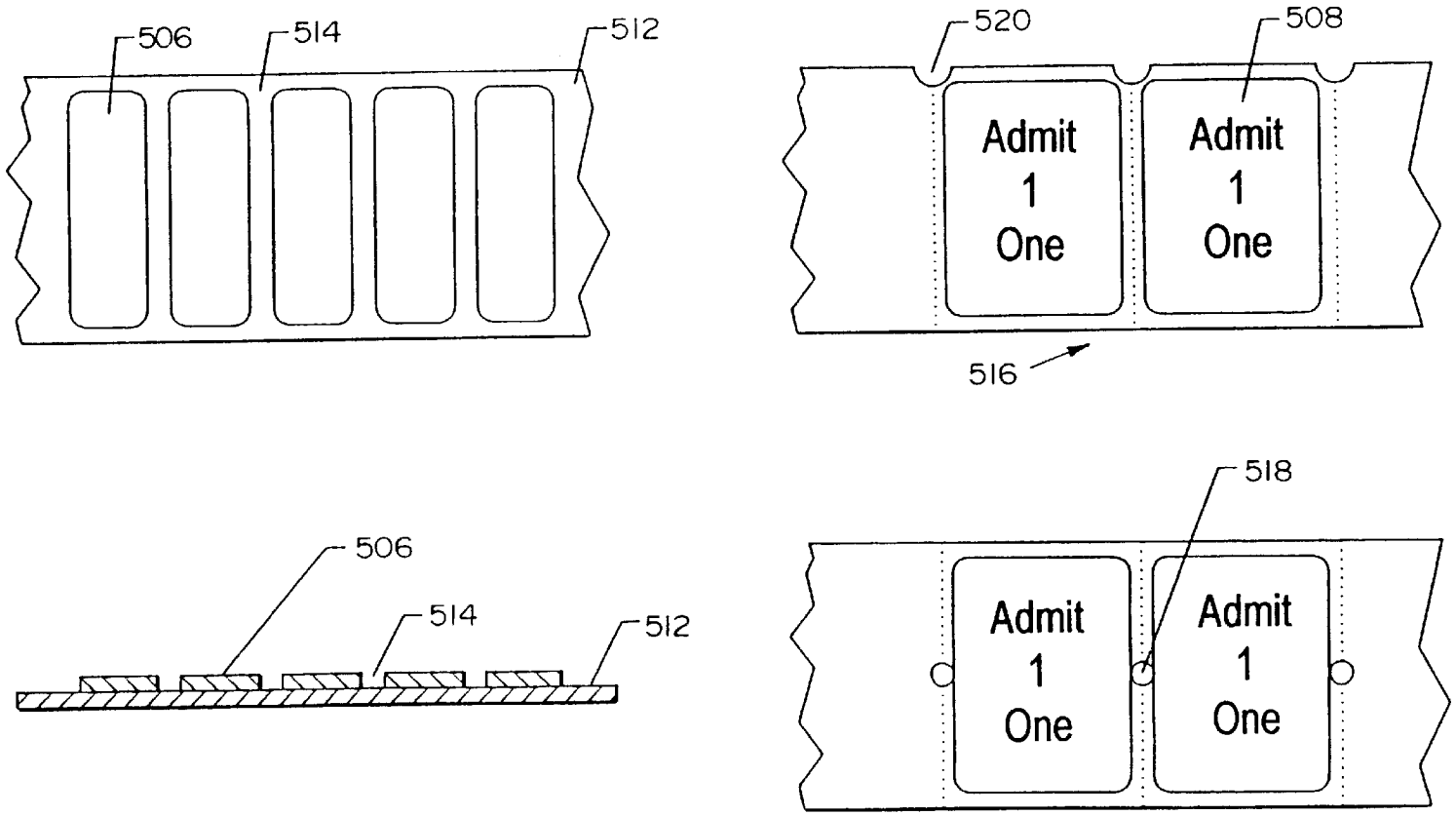
FIG. 19 illustrates some of the types of media which can be utilized with the demand printer of the present invention.

By way of background, it should be noted that the demand printer 60 must be adapted to printing individual pressure sensitive labels 506 and tickets or tags 508 such as are shown in FIG. 19. Pressure sensitive label media 510 is usually in the form of a continuous web of paper backing 512 consisting of wax or silicone-impregnated paper having a thickness range between 0.002 and 0.008 inches and having multiple labels 506 of paper, polyester, synthetic paper, or similar material having similar thickness removably affixed with a rubber or acrylic adhesive. Successive labels 506 are separated by an interlabel gap 514, typically 0.125" wide. The web may be supplied from a roll or alternately from a fanfold. Tickets or tags 508 may similarly be presented in a continuous web 516 with individual tickets or tags 508 defined by a printed eye mark, or by punched holes 518 or notches 520. Ticket or tag 516 media usually ranges in thickness between 0.007 and 0.018 inches.

A media sensor 100 is generally used to align a printed image with the leading edge of each label 506, ticket or tag 508. As noted above, the optical media sensor 100 usually comprises an illumination source, such as a LED 492, and a photo detector, such as a photo transistor or photo diode 494. The illumination source 492 and the photo detector 494 typically, but without limitation, function at 940 nM, an infrared wavelength.

In a preferred embodiment, the circuit board 488 includes an illumination source in the form of one or more light emitting diodes (LEDs) 492 such as an LED IR 950 NN shown in (FIG. 20) located below the slot 490. Further, the board 488 preferably includes a photo detector means located above the slot 490 having a photo transistor or photo diode 494 (FIG. 20) coupled to the board 488 in an adjustable fashion by way of a mount 496 and a wire ribbon 498. The diode mount 496 is then connected to an adjustment arm 500 which is accessible through an opening 502 in the base 486, and rides on a track 504 provided at the bottom of opening 502 thereby allowing the diode mount 496 to be repositioned depending on the type of media used. When properly assembled with the remaining components of the printer 60, the media sensor board 488 is connected to the main control circuit 108 through a suitable opening in the central support wall 74.

In operation, the illumination source 492 is shone through the web of label media 510 so as to respond to the change in relative opacity of the paper backing 512 and individual labels 506 at the interlabel gap 514, and to respond to the hole 518 or notch 520 separating the tickets or tags 508. In an alternative embodiment (not shown), the illumination source 492 reflects light off one side of the media web 87 and the photo detector 494 is disposed on the same side of the media to respond to a printed eye mark on the media. Upon review of the description below, the manner and process of making and using this alternative embodiment will be clear to anyone skilled in the art and it is intended that either embodiment fall within the scope of the appended claims.

The photo detector 494 converts the received light into a variable voltage. The presence of the gap 514, hole 518 or notch 520 produces a signal voltage distinctly different from that of the balance of the media web 87. Known methods of processing this signal voltage include comparison to a DC voltage, and analog-to-digital (A/D) conversion.

Processing by comparison to a DC voltage is simpler, less expensive, and requires no software processing. The signal voltage is applied to one input of an analog comparator. A fixed threshold voltage having a value between the gap 514 and label media 510 voltages is applied to the remaining comparator input. The output state of the comparator is indicative of the label 506 location, with the occurrence of a transition interpreted as the passing of a label 506 edge. The comparison method, however, is susceptible to interference, DC offset errors, temperature affects, and parts aging. It also requires manual adjustment in the event of changes in opacities or reflectivities in the web materials which vary significantly among manufacturers and production lots. This causes the media sensor 100 to be potentially unable to locate the interlabel gap 514 unless the illumination level and the sensing threshold are adjustable to adapt to such variations. In the past, this has been accomplished with a series of rheostat adjustment of the current through the LEDs 492, or with a potentiometer adjustment of the comparator threshold voltage.

Adapted software can make processing by A/D conversion more immune to DC offset errors, temperature affects, and parts aging. The photo detector voltage is converted to a numerical value by an A/D convertor for interpretation by a central processing unit (CPU). Processing is similar to the comparator operation discussed above, with the further step of continuously monitoring the gap 514 and label media 510 voltages and computing the optimum threshold value. This adaptive behavior can reduce several errors common to media sensing, however, limitations in the dynamic range of available photo transistors 494 may still necessitate manual adjustment of the LED current for some media materials.

Figure 20:
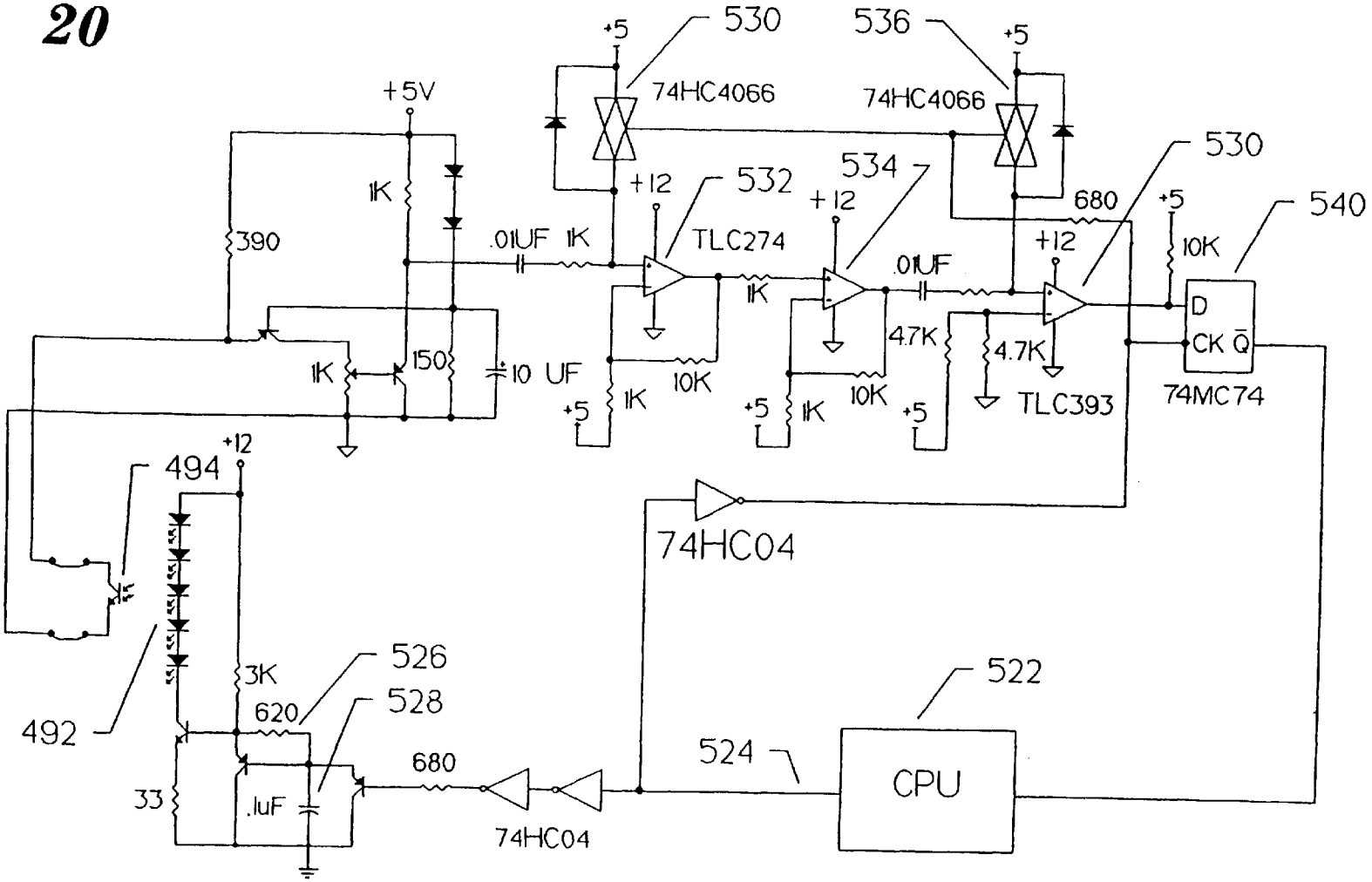
FIG. 20 is an electrical schematic diagram of a circuit related to the media sensor component of the invention.

With the present invention, the illumination source 492 is automatically adjusted by the media sensor control circuit board 488 utilizing pulse width modulation so as to compensate for web opacity and reflectivity variations. The voltage response to transmitted or reflected illumination is independent of ambient light and changes in the radiating efficiency of the illumination source 492 and the photo detector 494 operating point due to temperature change or component aging. Accordingly, accuracy comparable to A/D conversion, at a cost closer to simple comparison, is achieved. Specifically, the illumination source 492 is modulated so as to provide a reference light intensity, and a peak light intensity. Chopper stabilized circuity is used with the photo detector 494 output for offset error compensation and immunity to interference. Referring to FIG. 20, a microprocessor 522 includes a timer output capable of generating a clock 524 having a frequency and duty cycle which are determined by software. A minimum current is allowed to flow through an array of LEDs 492 during the OFF-TIME of the clock 524.

During the ON-TIME of the clock, a charging network formed of a resistor 526 and a capacitor 528 controls the current in the LEDs 492 so that their light input increases steadily during the ON-TIME. The LED 492 current and the light output return to the minimum level at the ON-TO-OFF transition of the clock 524.

Photo transistor 494 converts the total light received, including any ambient light and light from the LEDs 492 passing through the web into an electrical signal. A first analog transmission gate 530 (such as a Opto Tran 870 nn) is turned ON to clamp the electrical signal to a fixed voltage during the OFF-TIME of the clock 524. This has the effect of cancelling any DC offset of the photo transistor circuits and offset due to ambient light. The clamped signal is amplified by first 532 and second 534 operational amplifiers (such as a TLC274) and then clamped again by a second analog transmission gate 536 (such as a Opto Tran 870 nn) to eliminate any DC offset error introduced by the amplifiers. The clamped and amplified wave form is then applied to one input of an analog comparator 538 (such as a TLC393). A fixed DC threshold voltage is applied to the other input of the comparator 538. The comparator output state is a logic ONE whenever the total light received exceeds the reference established during the OFF-TIME by an amount proportional to the DC threshold voltage.

A flip-flop 540 latches the output state of the comparator 538 at the ON-to-OFF transition of the clocks. The latched state of the flip-flop 540 is then returned to the central processing unit 522 as an indication of whether a gap 514, hole 518 or notch 520 is present. The peak light level emitted by the LEDs 492 increases as the ON-TIME of the clock is increased. The peak photo detector 494 voltage excursion from the OFF-TIME reference is similarly greater when the light path passes through backing 512 alone, than when the light path passes through backing 512 and a label 506. When label media 510 is changed, a test is run in which labels 506 are fed past the media sensor 100 to evaluate the signal voltage. The ON-TIME of the clock is then selected by the software such that the comparison threshold falls equally between the gap 514 and the label media 510. When ticket or tag media 516 is utilized, the media sensor 100 must be aligned with the notch 520 or hole 518 such that an LED 492 can directly transmit light to the photo detector 494. This is accomplished by relocating the sensor adjustment arm 502 until said direct transmission is established. The calibration operation then proceeds in the same manner as described with label media 516.

Figure 21:
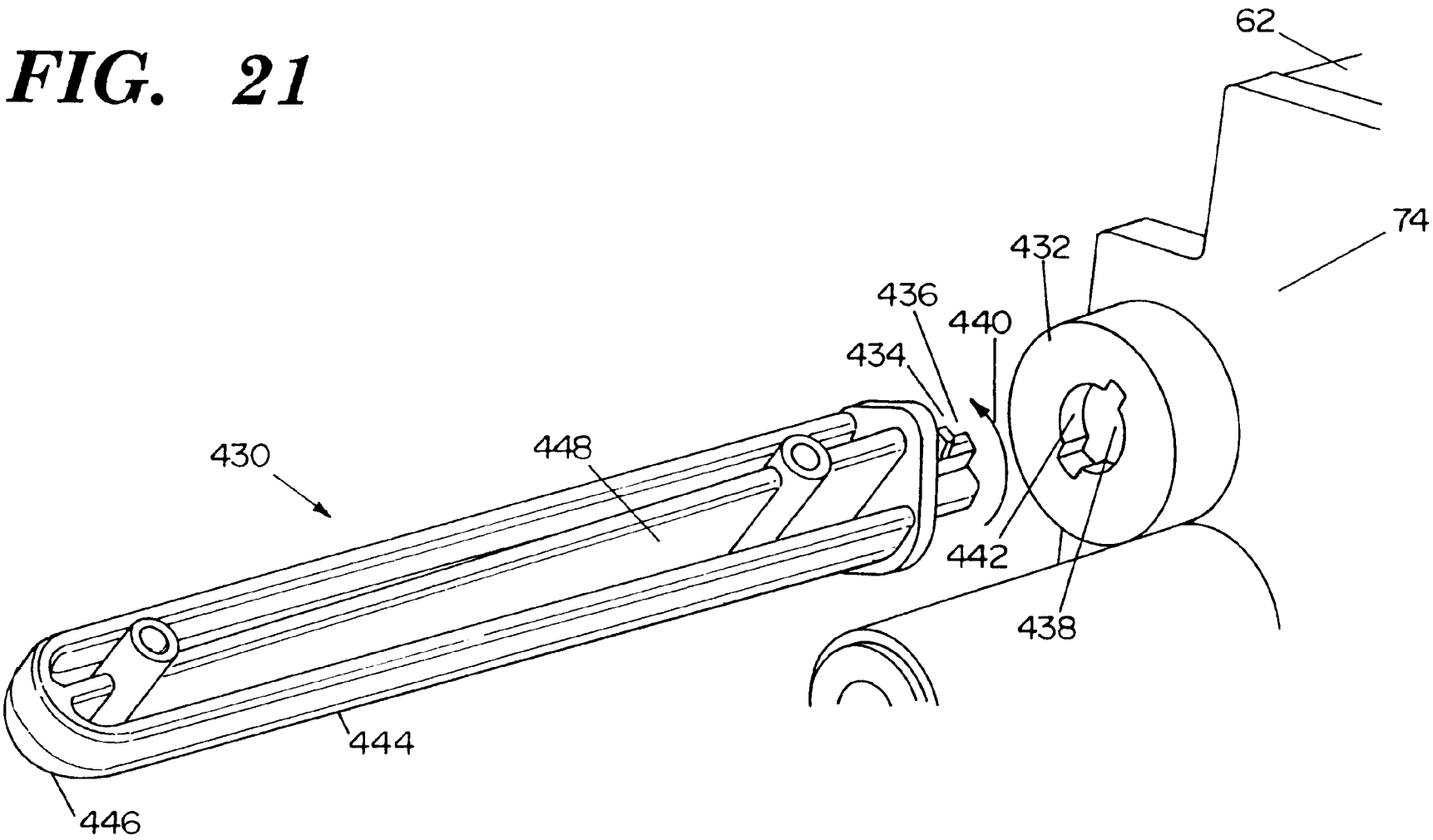
FIG. 21 is an exploded perspective view of a guide post component of the invention.

Turning now to FIG. 21, a guide post 430 is shown removed from a cooperative formed guide boss 432. An engaging end 434 of the guide post 430 is formed with keyed lugs 436 for engaging a cooperatively formed boss keyhole 438 formed in the boss. The engaging end 434 of the guide post 430 is inserted into the boss keyhole 438 and rotated (as indicated by arrow 440) to engage the lugs 436 behind a boss flange 442 inside the boss keyhole 438.

The guide post 430 is integrally formed with the engaging end 434 as a single piece unitary body of plastic material. A convex surface 444 is formed on one side of the guide post 430 with a smooth finish to facilitate movement of media 87 or transfer ribbon 96 there against. An end 446 of the guide post engaging end 434 is formed with a partially spherical surface. A reinforcing buttress 448 is formed on a longitudinal side opposite the convex surface to provide support and resistance against flexing when media 87 or ribbon 96 move over the convex surface 444.

A number of guide posts 430 are employed throughout the printer 30 to guide and direct the media stream and the ribbon during a printing operation. The posts 430 are quickly insertable and removable for ease in manufacturing as well as ease in reconfiguring the printer for different types of media or ribbon.

Figure 22:
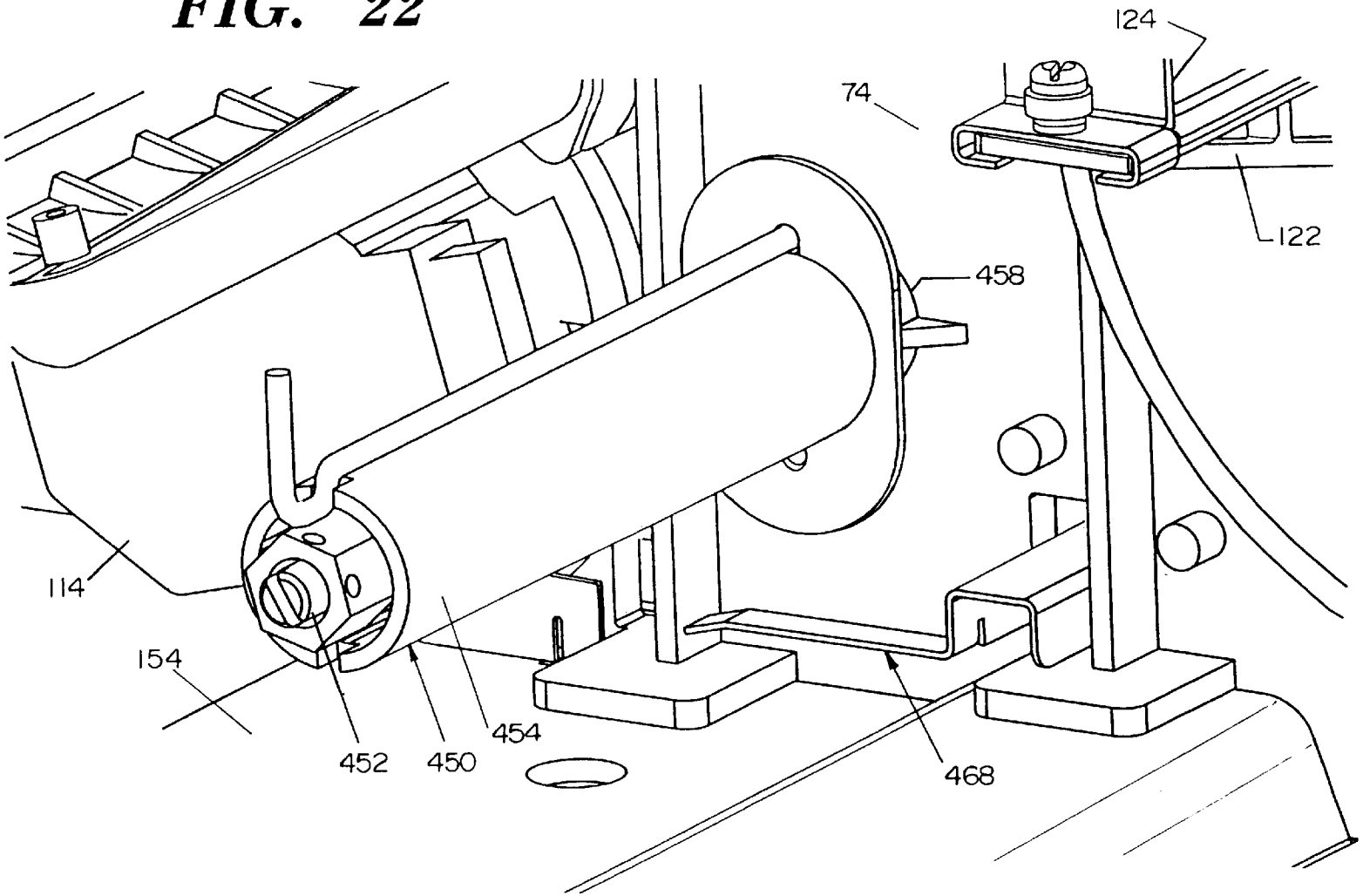
FIG. 22 is a perspective view of backing rewind take-up spindle.

A media backing rewind take-up spindle or rewind spindle 450 is shown in FIG. 22. The spindle 450 includes a shaft 452 which extends through a spindle body 454 and through the central support wall 74. On the opposite side of the wall 74 as shown in FIG. 22, a rewind pulley is attached to the shaft 452 and operatively associated with the drive belt driven by the stepper motor 114. In this regard, the rewind spindle 450 is driven at a faster rate than as the roller platen 88 since they are driven by the same source but the rewind drive has a smaller reduction or stepper motor 114. While the other figures includes herein do not specifically show the rewind pully, or even the shaft 452 from the other side of the wall 74, it can clearly be seen that a boss 458 has been provided through the wall 74 to accommodate the shaft 452. Additionally, it can also be seen that accommodations have been made through the ribs in the wall 74 so that an appropriately sized drive belt can be extended along the wall 74 to drive the shaft 52.

In operation a portion of media is wound over the spindle so that the medial overlaps itself to hold the media to the spindle body 454. A wire form spacer 460 extends over the surface of the spindle body 454 to provide a gap between the spindle body surface 462 and the media wound thereagainst. When the spent media is to be removed from the rewind spindle, a retaining end 464 is disengaged from a retaining hole 466 and slid axially out from underneath the wound spent media. Removal of the wire form 460 allows the spent media to be easily removed from the spindle 450.

A spindle full switch 468 is positioned underneath the spindle 450 to indicate when the spindle must be emptied to prevent potential binding due to excessive spent media wound around the spindle 450. The spindle full switch 468 includes a sensing arm 470 which is coupled to a micro-switch connected to the control circuit means 108. While the micro-switch is not specifically shown herein, a micro-switch of known construction and mechanical operation couplable with a mechanical lever may be used for this purpose. As spent media is wound around the spindle body 454. The diameter of the roll of spent media increases. When the diameter of the spent media roll increases to a point that it impinges upon the sensing arm 470 the arm is displaced thereby tripping the micro-switch and sensing a full condition. An appropriate indicator is provided on the printer 60 to indicate to a user that the rewind spindle 450 must be empty before further operation. Additionally, the signal created by the micro-switch tripped by the sensing arm 470 can also be processed by the control circuit means 108 to prevent further operation of the printer 60 until the rewind spindle 450 is emptied.

SIMPLIFIED PRINTHEAD CONTROL USING DOUBLE DATA LOADING

Referring now to FIGS. 50 and 51, in accordance with a further feature of the invention, a method and apparatus are provided for using double data loading in a thermal printhead so as to provide improved control of the heating of the thermal printhead. In accordance with this feature of the invention, data is loaded into the printhead's serial input twice for each print row or print line; that is, twice for each line of information or indicia to be printed on the media. This results in two heating element energizing cycles for each printed line. The heating elements are selectively energized with some elements being energized during both cycles and some being energized for only one of the cycles.

In accordance with this feature of the invention, data from the last printed line is used to determine whether a heating element is to be energized during the first of these two cycles. Importantly, the printhead's existing serial data shift register holds the data corresponding to the last line of information or indicia printed, thereby eliminating the need for any external memory to accommodate this feature of the invention, such that this feature can be provided at minimal cost.

Generally speaking, the printhead commonly used in thermal printing comprises a line of resistive heating elements spanning the width of the intended print media. A single printhead may contain hundreds of these heating elements with linear densities as high as 12 heaters per millimeter. Digital circuity which is often mounted on the printhead substrate allows for the selective activation or energization of the individual resistive heating elements.

When these heating elements are energized to a predetermined temperature, they produce an image in the form of a dot on the media, either directly in the case of a heat sensitive media or by way of a heat sensitive ribbon in the case of thermal transfer printing. As the printer advance mechanism or media delivery means moves the media relative to the printhead, the line of heaters is repeatedly loaded with data and activated to produce a printed image by repeatedly forming the image from one line of dots at a time. Thus, for a single alphanumeric character, for example, as many as 12 lines of information per millimeter of character height may be printed to form the final character or other information.

The image or indicia information for a given line comprises binary data, usually in the form of a logic 1 indicating heater element energization and logic 0 indicating the heater element is not to be energized. This data is loaded into a shift register which forms a part of the thermal printhead. Referring initially to FIG. 50, a simplified schematic of a typical thermal printhead is shown, and is designated generally by the reference numeral 610. The thermal printhead 610 includes a plurality of resistive heating elements 612 which, as described above, span the width of the intended print media. The heating elements may be energized by way of a logic circuit, which is illustrated in FIG. 50 as a series of corresponding AND gates 614. The AND gates 614 have one input connected to receive a strobe signal at an input terminal 616 and have a second input connected to received data from a shift register 618. This shift register forms a part of the printhead, and is often integrated into the printhead circuity and/or mounted on the printhead substrate. As illustrated in FIG. 50 an additional inverter buffer 620 is provided intermediate each AND gate 614 and its corresponding heating element 612.

In operation, a given heating element 612 will be energized if a logic 1 is present at the corresponding data position of the shift register 618 simultaneously with the arrival of a strobe signal at input 616. Thus, the data in the shift register in effect controls energization of the heating elements 612. The energy applied to the heaters 612 is controlled by the length of the strobe signal and by the voltage applied at a common positive voltage input terminal 622. It will be noted that each of the energized heating elements receives the same amount of energy, because all are connected to the same positive voltage source and all receive the same strobe signal when enabled by the data in the shift register.

However, in some cases it is desirable to have some of the heating elements 612 receive more energy than others. For example, if a particular heating element has been energized in the previous print line, it will retain some of the energy and therefor require less energy to produce a well-printed dot or image in the immediately succeeding print line. On the other hand, a heating element that has not been energized recently will in effect be "cold" and will require somewhat more energy to produce the same dot or image. With increasing printing speeds, less time is available between print lines, and the different energy requirements of the heating elements, depending on past history, become greater. Moreover, overheating an element not only can degrade the quality of the image, but can cause destruction of the heating element. Thus, individual control of the amount of energy applied to each of the heating elements 612 is desirable, but is quite difficult because of the design of the thermal printhead as shown in FIG. 50, such that all of the elements receive the same voltage and the same strobe signal.

One prior art control approach involves multiple strobe cycles per print line. That is, a "hot" element (one that has recently been energized) may be activated for only a single strobe cycle, while a "cold" heating element (one that has not been recently energized) may be energized on multiple strobe cycles. Such an arrangement requires additional digital memory to store the data from previous print lines as well as data for each of the multiple strobe cycles. The stored data is used to determine how long it has been since a given heating element has been energized and from this information to determine for how many strobe cycles the heating element should be energized to achieve optimum heating. However, the complexity and cost of such additional digital memory circuity and decision making circuity can be considerable.

In accordance with a feature of the invention, and referring now also to FIG. 51, a system of double data loading utilizing only the existing printhead shift register 618 is provided. Advantageously this feature avoids the high cost of additional digital memory and complex decision making circuity necessary with the prior art approach described above. In accordance with this feature of the invention, for each line of indicia to be printed, data ("print line data") is loaded into the printhead shift register twice. The first load is referred to as the compensation load and the second is referred to as the print load. In accordance with the preferred form of this feature illustrated herein, in the compensation load a digital or logic 1 is loaded into the shift register for heating elements that were not printed on the previous printed line, but are to be printed on the next print line. Since these heating elements were not energized on the previous print line they are considered "cold." A strobe pulse is then applied which will result in energization and warming of these "cold" heating elements.

The second data or print load then follows immediately. For the print load, the incoming data for the next print line, or print line data, is loaded into the shift register, such that a digital or logic 1 is loaded for each element that is to be printed on this print line. A strobe pulse is then applied again, so as to energize each of the elements for which a logic 1 has been loaded, resulting in the desired printed image for this print line. This second load or print load is identical to the data which would be loaded into the shift register if no additional thermal control were utilized.

The media is then advanced to the next print line position and the foregoing process is repeated to create the desired image or indicia upon the media.

An advantage of this feature of the invention is that the shift register already present in the printhead is used to store the necessary data. Thus, when the data for the compensation load is shifted into the printhead, the last line data is shifted out. This data is available from the printhead's "data out" terminal 624. This output is commonly provided to test the integrity of the shift register 618. In accordance with this feature of the invention, as the last line of data is shifted out it is combined with the new or incoming print line data in order to produce the desired compensation load data. The circuity necessary to combine this data to produce the compensation load is relatively simple and inexpensive.

One embodiment of this feature is illustrated in FIG. 51 for purposes of example. It will be understood that other embodiments may be utilized without departing from the invention in this regard. In accordance with the invention, the compensation load comprises serial data which is formed in accordance with a rule which states:

> Produce a data bit for causing energization of a heating element upon application of a strobe signal only if a bit in the print line data corresponding to the last line printed in a given bit position comprises a bit for not causing energization of a heating element in response to application of a strobe signal and a bit of incoming print line data in a bit position corresponding to the given bit position of shift register data is a bit for causing energization of a heating element in response to a strobe signal.

In the embodiment illustrated, this rule can be stated somewhat more simply:

Produce a logic 1 bit if a bit of serial data in said shift register in a given bit position is a logic 0 and a bit of incoming data in a bit position corresponding to the given bit position of the shift register is a logic 1, and otherwise produce a logic 0 bit.

As illustrated in FIG. 51, a switch or switching means 626 is utilized to select the serial data to be fed to a data input port 628 of the shift register 610. For simplification of illustration a mechanical switch has been shown in FIG. 51; however, in practice, a switching means utilizing digital gating circuitry is preferred. This circuit may be implemented utilizing discrete logic, programmable logic, relays or any other desired means.

The foregoing simplified rule is implemented in the illustrated embodiment by the use of an inverter buffer 630 for receiving the data from the data output 624 of the shift register 618 and an AND gate 632 for receiving the data from the inverter buffer 630 and also the incoming serial data stream which contains the print line data or information for the next print line. Thus, the AND gate 632 combines inverted data from the last print line as stored in the shift register with the serial incoming data for the next print line to form the compensation load in accordance with the above rules. The switch or switching means 626 is then used to select the compensation load for one cycle and the print load which is identical to the incoming data, for the second cycle of the dual cycle or double data loading cycle in accordance with this feature of the invention. Briefly, the following is the preferred sequence of operation.

Before printing, the printhead shift register is initialized by clocking in logic 0's to completely load the shift register with logic 0's. The print process then starts, following these steps:

1. The switch or switching means 626 is put into the compensation load position, that is, switched to the output of AND gate 632 in the illustrated embodiment.

2. The incoming data is then combined at the AND gate 632 with data being shifted out of the shift register 618 and inverted, and the resultant data comprising the compensation load is simultaneously shifted into the shift register 618.

3. The strobe signal is activated to thereby energize each heating element for which the appropriate logic is present in the corresponding bit of the compensation load in the shift register.

4. The switching means 626 is moved to te print load position for directly receiving the incoming serial date. The incoming serial data is shifted into the data shift register to become the print load.

6. The strobe signal is activated thereby energizing the heating elements in accordance with the information or data in the print load.

7. The print media is advanced by one line and these steps 1–7 are repeated until the printed image or indicia is complete.

The foregoing method and apparatus offers a number of advantages over existing methods and apparatus, generally as follows:

Better print quality is possible at higher speeds than single load methods. Costs are lower than existing multiple load methods. No external memory components are required. No high speed data calculations are required. The compensation and print load cycles may be independently adjusted through adjustment of the strobe timing. Only relatively simple and inexpensive digital logic circuity is required to implement this feature, with the memory requirements being accommodated by the existing printhead shift register.

IMPROVED PRINT QUALITY IN AREAS OF ACCELERATION AND DECELERATION

The amount of energy needed to print one line or row of an image on a media varies with the speed of the media relative to the printhead and also with the printhead temperature in the case of a thermal printhead. Software control packages have heretofore used multiple equations for determining the correct length of the pulse width of the strobe signal for acceptable printing based upon a given media speed and printhead temperature. These equations have generally taken the form of a series of simultaneous equations of the form:

Pulse Width BPWn*Kn (Instantaneous Printhead Temperature)

where BPWn is the base pulse width (in units of time) for a given instantaneous media speed relative to the printhead and Kn is a gain constant which determines how much to increase or decrease the base pulse width based on the instantaneous printhead temperature. Most applications use one equation per constant velocity of media relative to printhead. This method produces acceptable results while the velocity remains constant. However, the print quality in regions of acceleration or deceleration of the media may be unacceptable because the equations calculate pulse widths based on desired constant velocities rather than on the instantaneous velocity during acceleration or deceleration.

Attempts have been made to remedy this problem by reducing the size of acceleration and deceleration regions in the media, however, this also reduces the amount of the printable area on the media due to mechanical limitations. Also, the smaller these regions of acceleration and deceleration the more media slippage and tracking problems will occur. These problems become more acute with the decreasing sizes of media, i.e., where relatively small labels, tickets, tags, etc. are to be printed.

In accordance with the present invention, an individual base pulse width (BPW) and head temperature gain constant (K) value is established for each instantaneous velocity of the media relative to the printhead. This results in the creation of a separate pulse width equation of the above general form for each possible instantaneous velocity. Because the pulse width can now be tuned for each instantaneous velocity, the print quality in areas of acceleration and deceleration can be made to approach or equal that in areas of constant velocity. Accordingly, the size of these regions of acceleration and deceleration can be increased without loss of print quality, thereby eliminating many of the mechanical problems caused by reducing the size of these areas and the attendant problems, especially with relatively small sizes of tickets, tags, labels or other media as noted above.

However, two serious limitations have prevented this type of solution from being implemented in the past. A first limitation involves the use of floating point mathematics to get the resolution needed for each equation. If the pulse width for each step must be calculated while the printer is printing, there is not enough time for a processor of reasonable size and cost to carry out the required floating point calculations. The second problem relates to the amount of development time required to "fine tune" the values to be used in each equation. Past experience has shown that an experienced engineer can take about one day's time to fine tune a single equation for constant print speeds as noted above. However, the proposed method may require from five to ten times the number of equations used in the case of constant print speeds.

In accordance with the present invention, a table of base pulse width (BPW) values and head temperature gain constant (K) values is created, each value corresponding to a constant velocity supported by the printer. These values correspond generally to those used in the equation described above. The BPW values are in units of time and the Kn values are in units of percent BPW per unit temperature.

| SPEED | | STOP | 1 | 2 | 3 | n |
|---|---|---|---|---|---|---|
| BPW_VALS | = | BPWO, | BPW1, | BPW2, | BP23, | . . . BPWn |
| K_VALS | = | KO, | K1, | K2, | K3, | . . . Kn |

Upon initially applying power to the printer and prior to commencing the printing process, the above two tables of BPW and K values are created using floating point math. This then avoids the problem of attempting to calculate values during the printing operation. The number of values in each table is equal to one more than the number of incremental steps of velocity which the media delivery mechanism of the printer will support up to and including its maximum velocity. Floating point math is then utilized to interpolate the values in each table, taking care to scale the values as necessary to avoid loss of precision.

Upon commencing the printing operation a test printing run can be utilized to fine tune the print quality. During this test run the print quality is monitored. The values in the above BPW and K tables are varied during printing at least at one constant velocity, until the monitored print quality is acceptable. Thereupon, a floating point math routine calculates values for the remainder of the table entries.

Thereafter, during actual printing, the pulse width of the strobe signal is calculated using the equation:

$$\text{Pulse Width}=\text{BPW_TABLE}[i]*\text{K_TABLE}[i]*\text{Head_Temperature},$$

where i is a given increment of instantaneous velocity en route to some constant velocity supported by the printer.

SEGMENT COMMAND FEATURE

Figure 52:
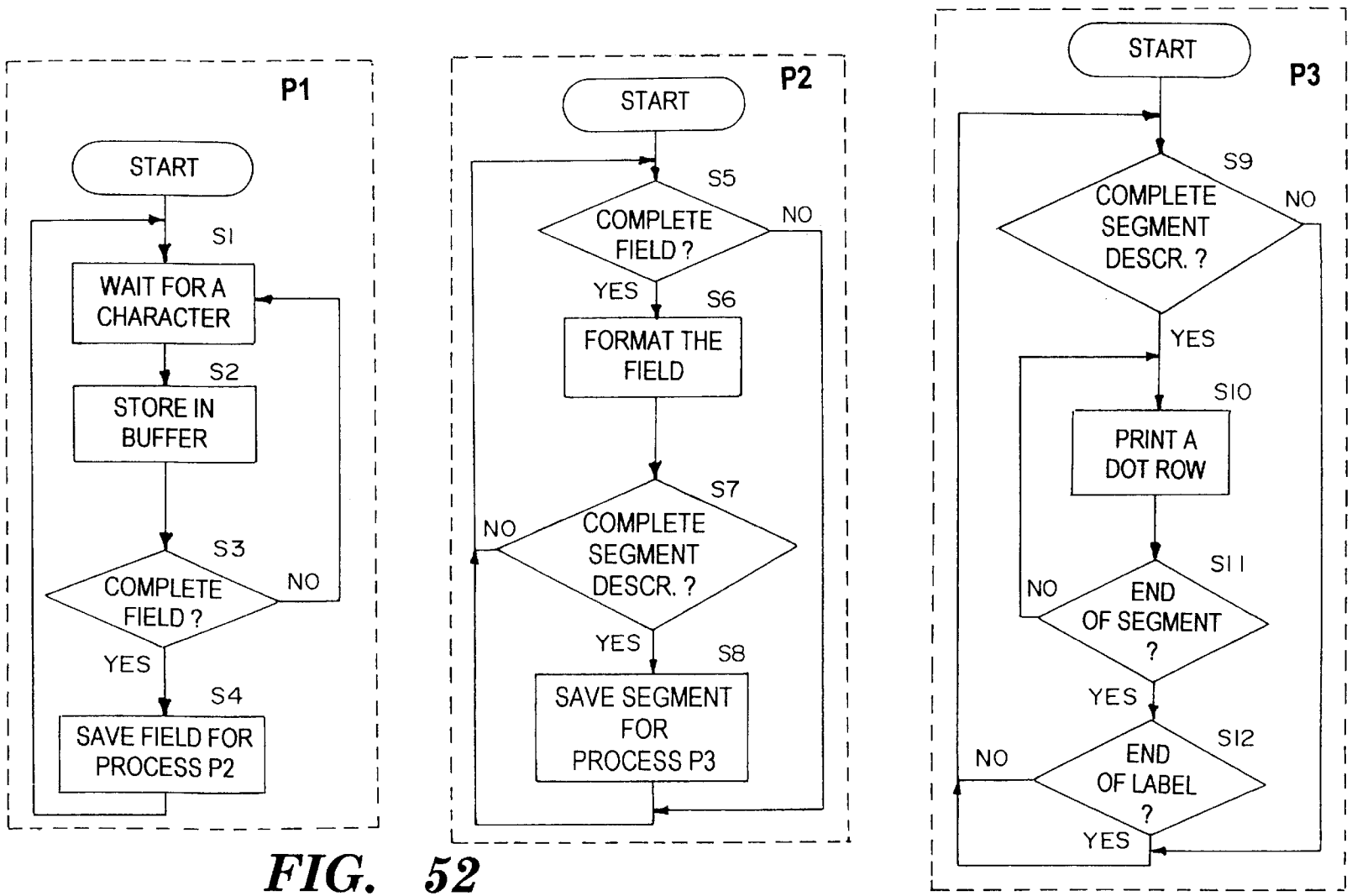
FIG. 52 is a block diagram illustrating the process of printing a label.
Figure 53:
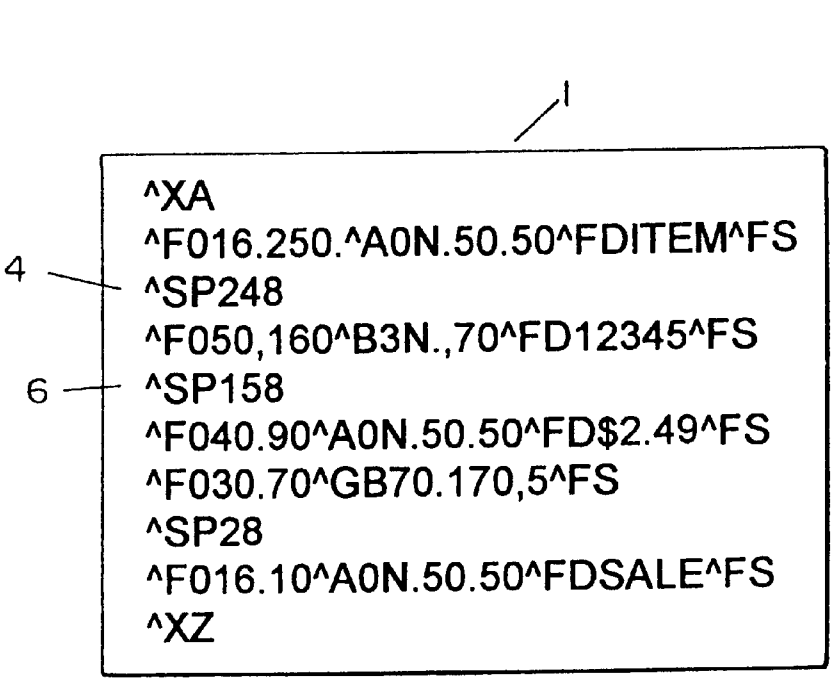
FIG. 53 illustrates a typical label, including typical label features.
Figure 53:
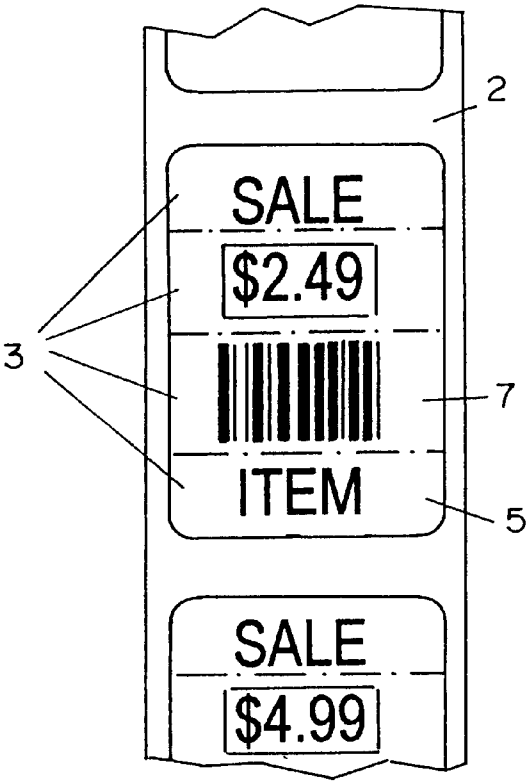

The process of printing a label is illustrated by the block diagram of FIG. 52. The process comprises three subprocesses, P1, P2, and P3. A typical label and some typical features are shown in FIG. 53.

A prior art multitasking technique used by the CPU permits the three subprocesses of FIG. 52 to be executed concurrently. Each process is successively executed for a maximum time interval called a slice. When the slice expires, the process is stopped and saved for later resumption in the same state it was upon expiration of the slice.

When a process executes, its flow of execution is shown by the solid lines of FIG. 52 in the usual manner. The processes operate on data stored by one of the other processes in a prior art RAM memory common to both.

The process of printing a label begins with receipt of characters from a host computer. These are processed when process P1 next executes its step S1. The characters comprise interspersed commands and data written in a label description language which is recognized by the printer.

The characters are saved in a prior art buffer memory at step S2. A loop between step S3 and step S1 repeats until step S3 determines that the contents of the buffer comprise a field which completely describes a text, bar code, graphic, or other object to be printed. The contents of the field include without limitation, the location, size, data content, and other information required to define the object. Each time step S3 detects a complete field, it is passed as data input to process P2.

When process P2 is next executed step S4 determines if a field has been input from process P1. If so, the dot image of the specified object is written into a prior art bitmap memory at the desired location.

With reference to FIG. 53, the commands in the label description 1 may include one or more occurrences of a segment command which divides the corresponding label 2 into one or more segments 3. The first such segment command 4 defines a first segment 5 of the label 2 which the printer is free to print upon receipt of the first segment command 4. The first segment command 4 signals that the prior commands and data sent to the printer completely define the objects in first segment 5, that no other commands affecting objects in the segment are to be expected, and that the printer may begin to print segment 5 or continue with that segment when it is reached.

The second segment command 6 defines a second segment 7 of the label 2 which the printer is free to print upon receipt of the second segment command 7 in a subsequent manner. The label description 1 may contain a plurality of segment commands within the scope of the claims.

With reference to FIG. 52, process P2 writes dot images of fields into bitmap memory for as many fields as are available from process P1 or until a segment command is reached. When a segment command is found, the complete segment is sent as input data to process P3.

When process P3 is next executed, step S9 determines if a complete segment has been reached. If so, the printing process begins at step 810 and continues to the end of the segment or the end of label, whichever is encountered first.

Figures 36, 36A, 36B, 36C, 36D, 36E, 36F, 36G, 36H, 36I:
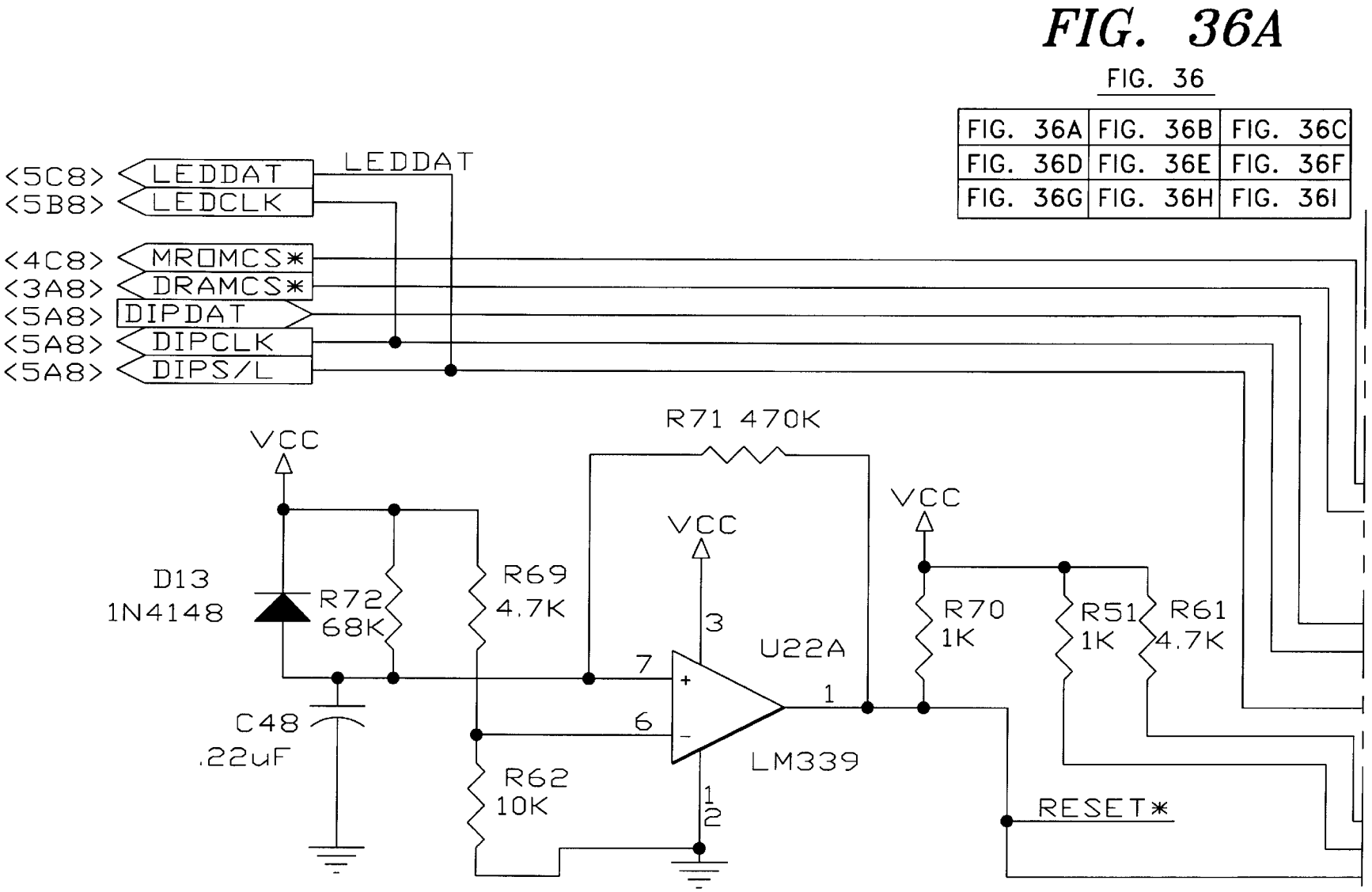
Figure 36B:
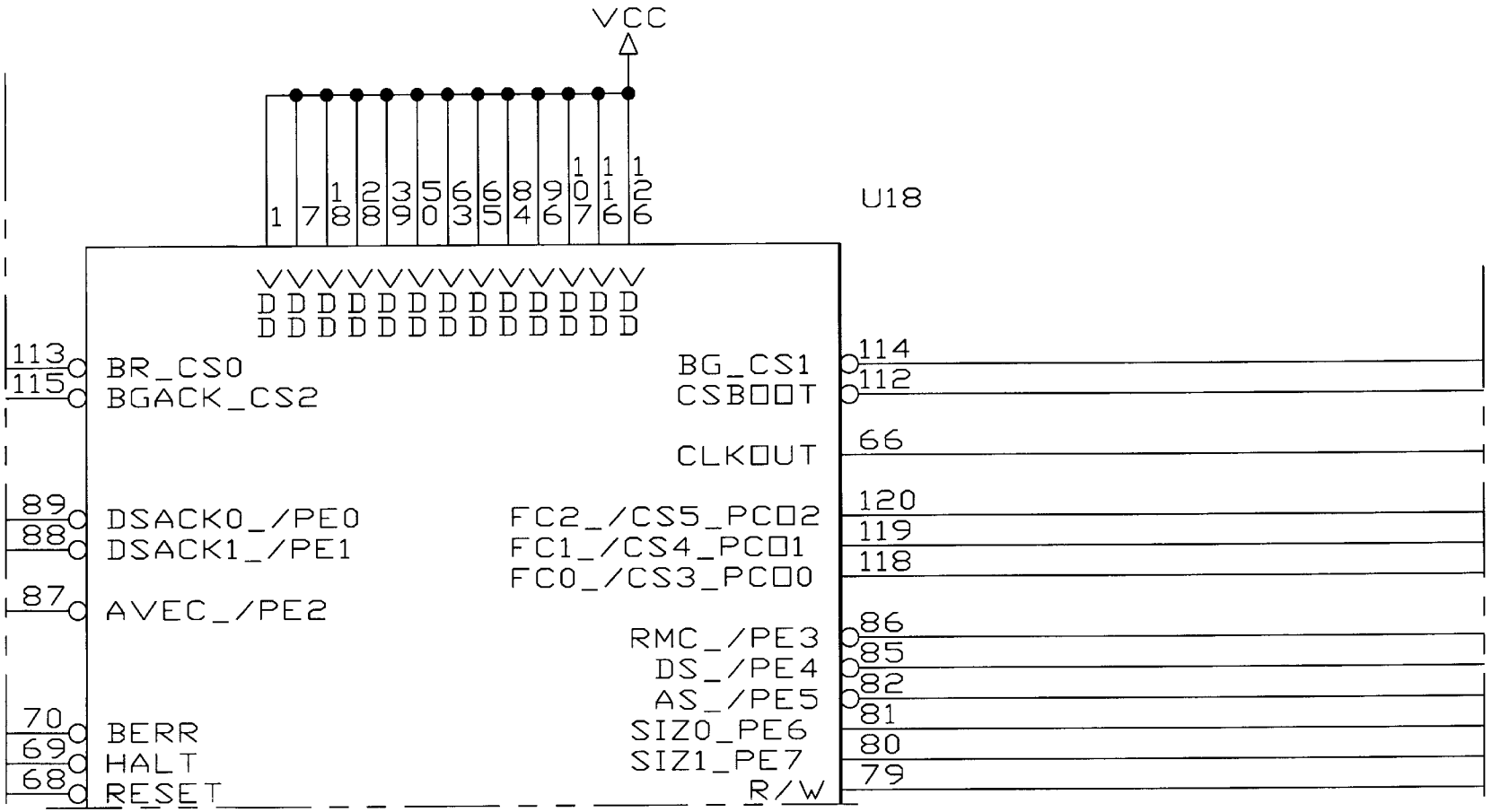
Figure 36C:
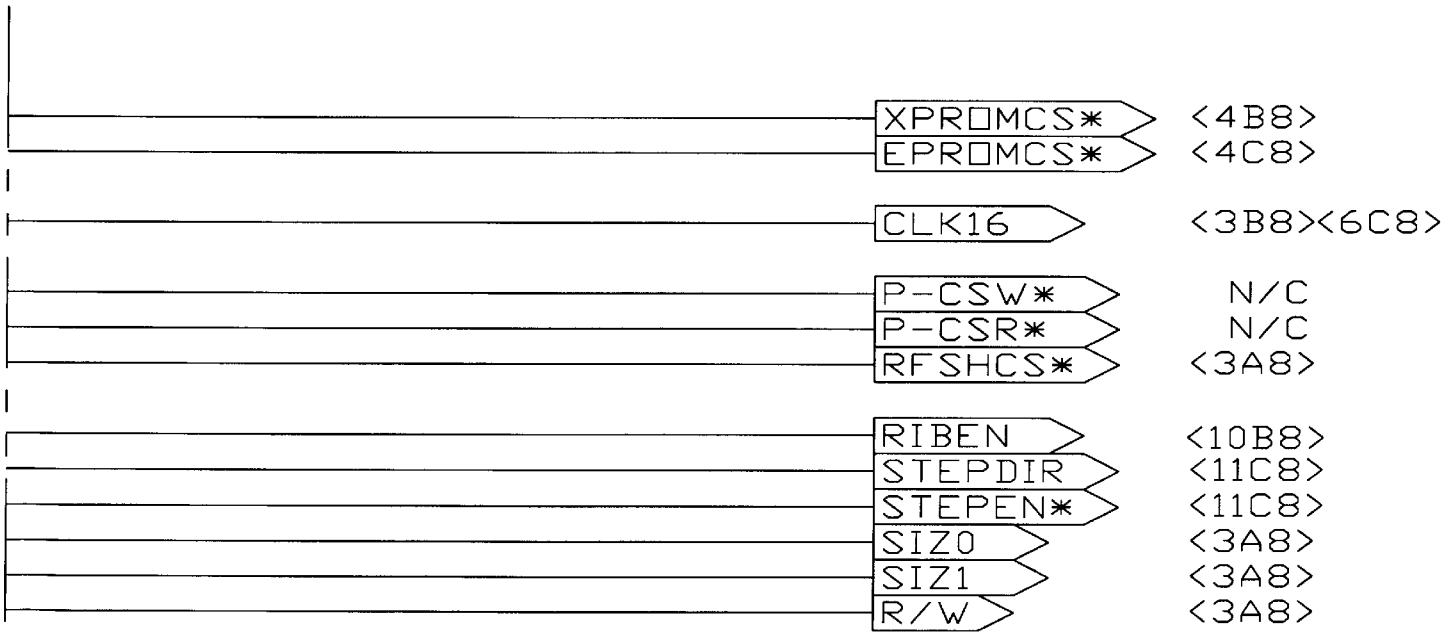
Figure 36D:
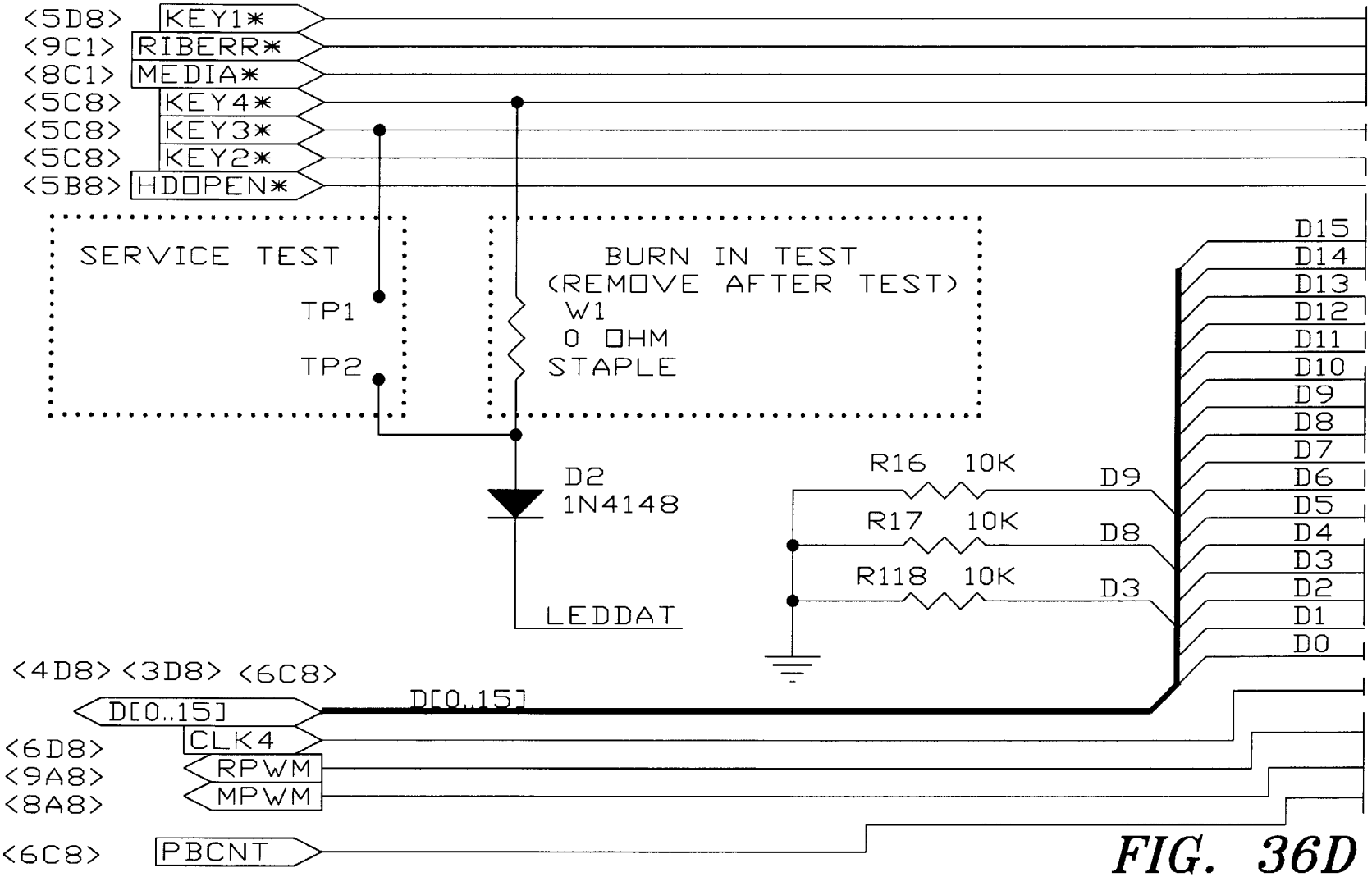
Figure 36E:
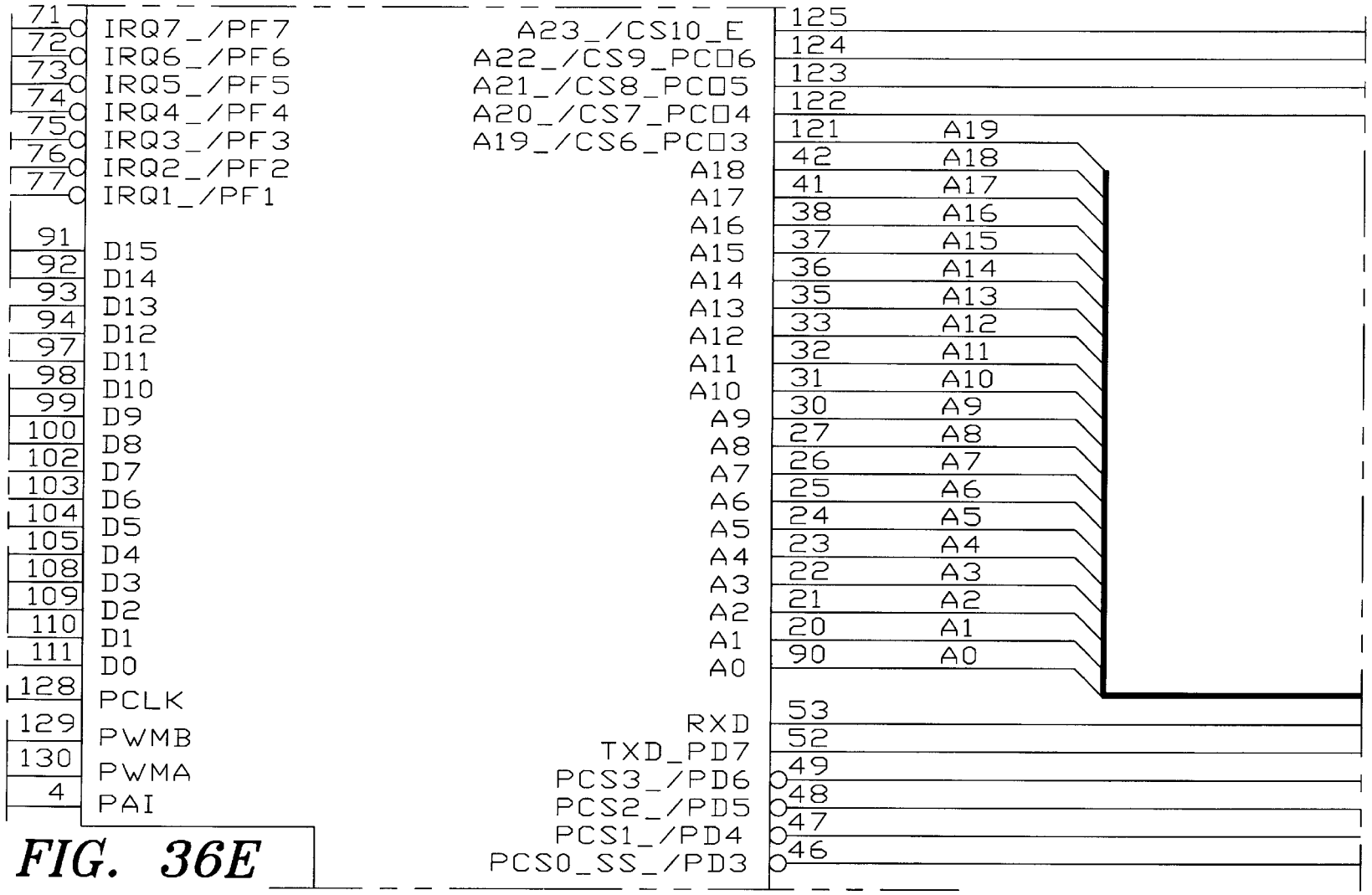
Figure 36F:
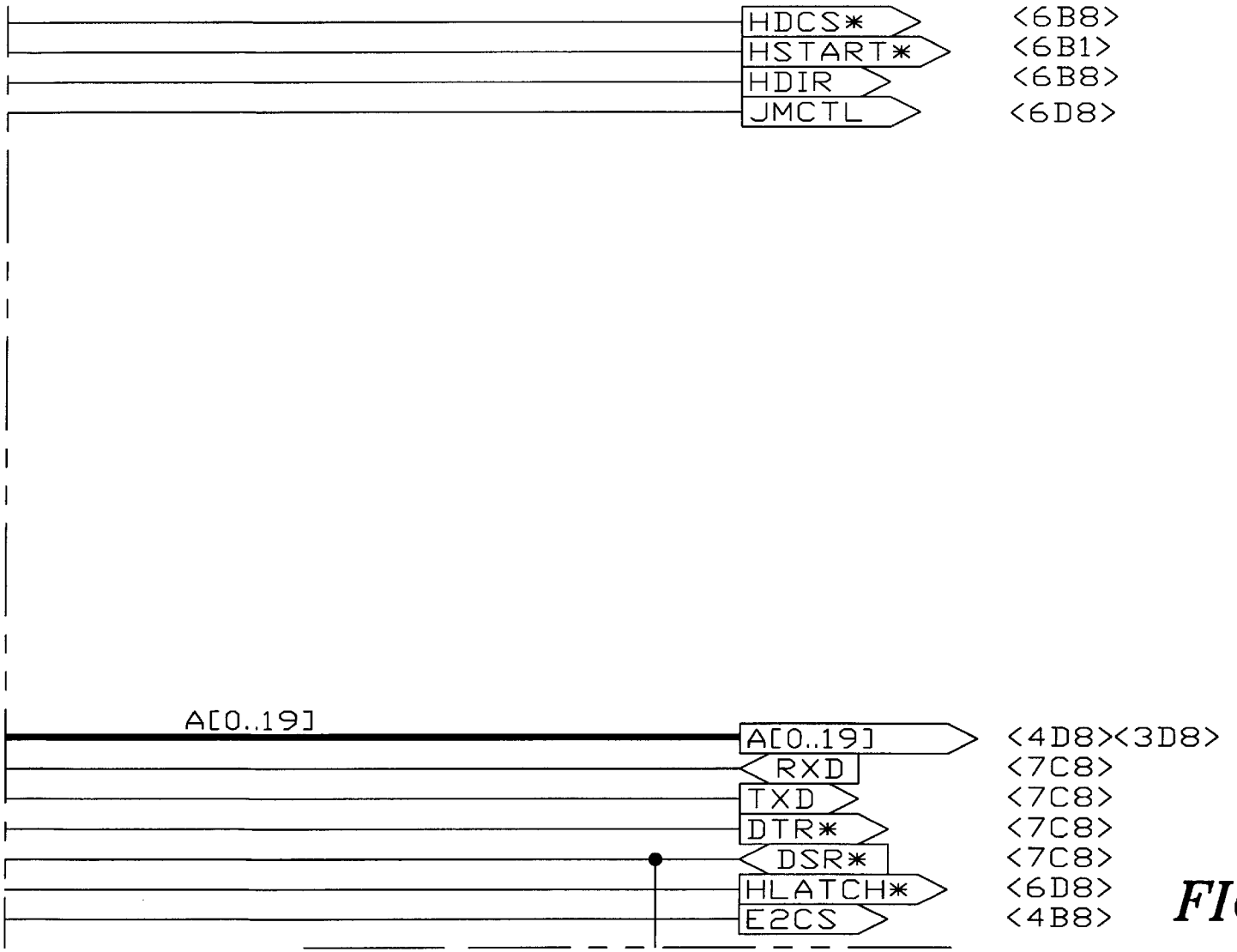
Figure 36G:
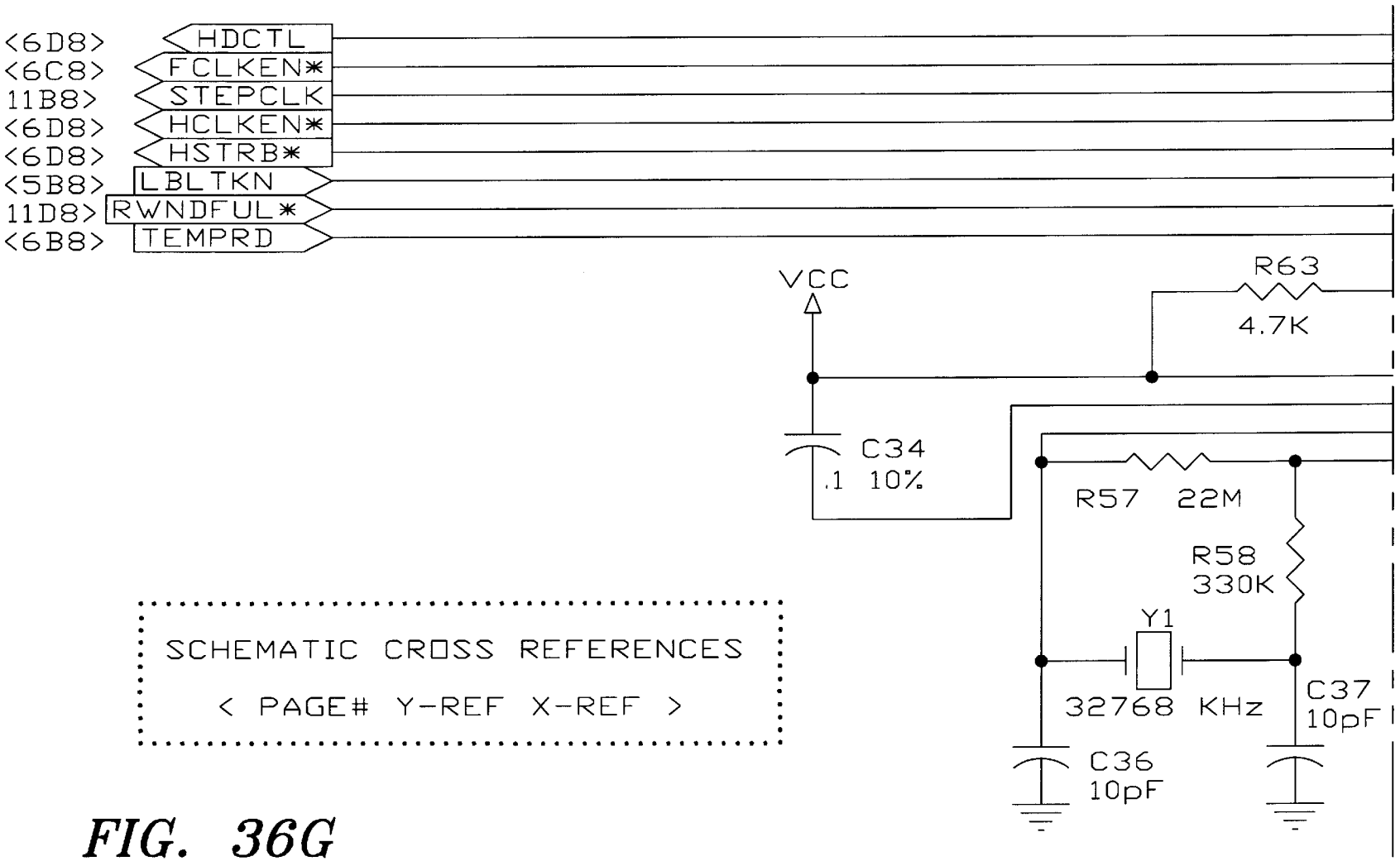
Figure 36H:
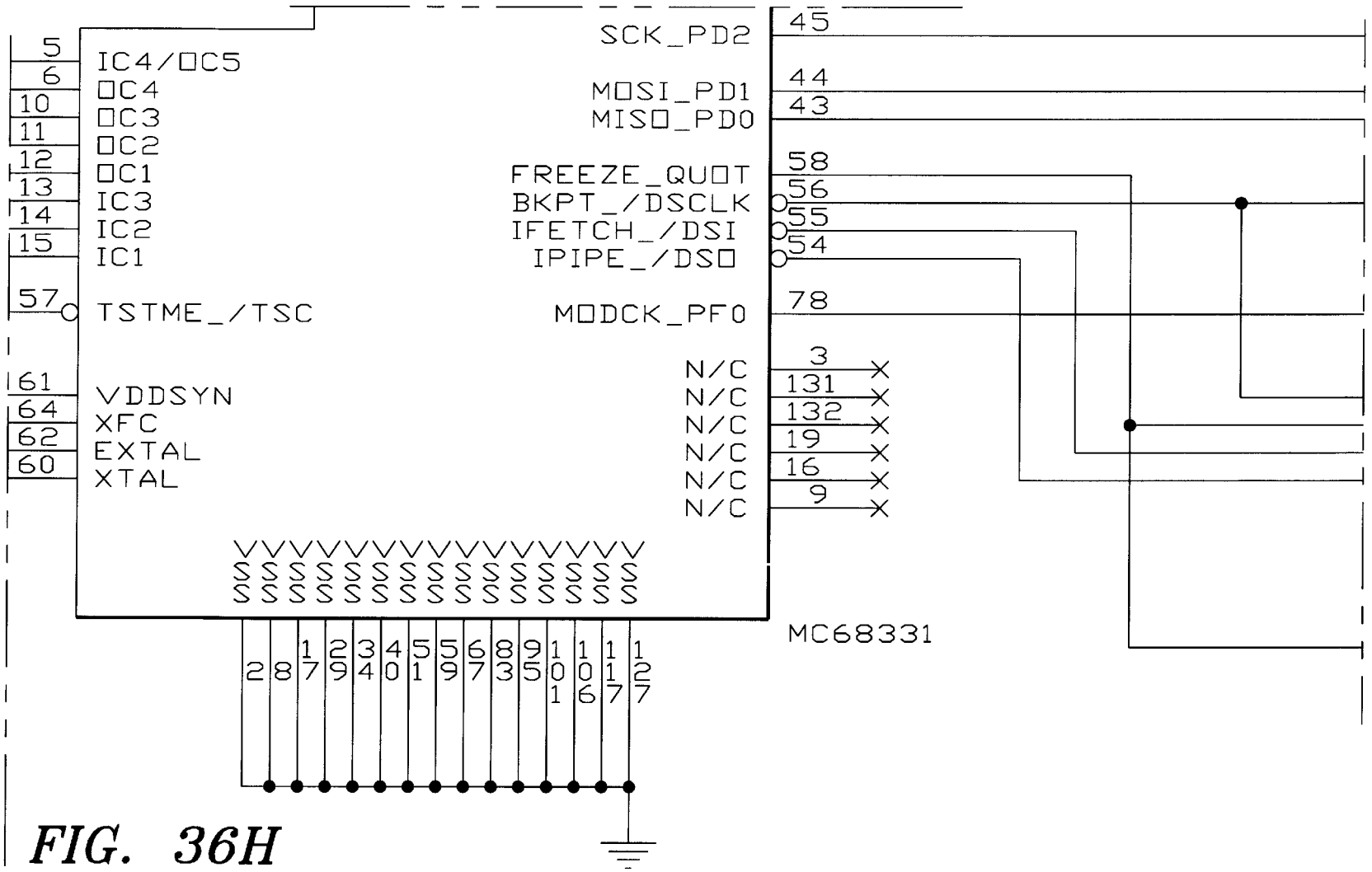
Figure 36I:
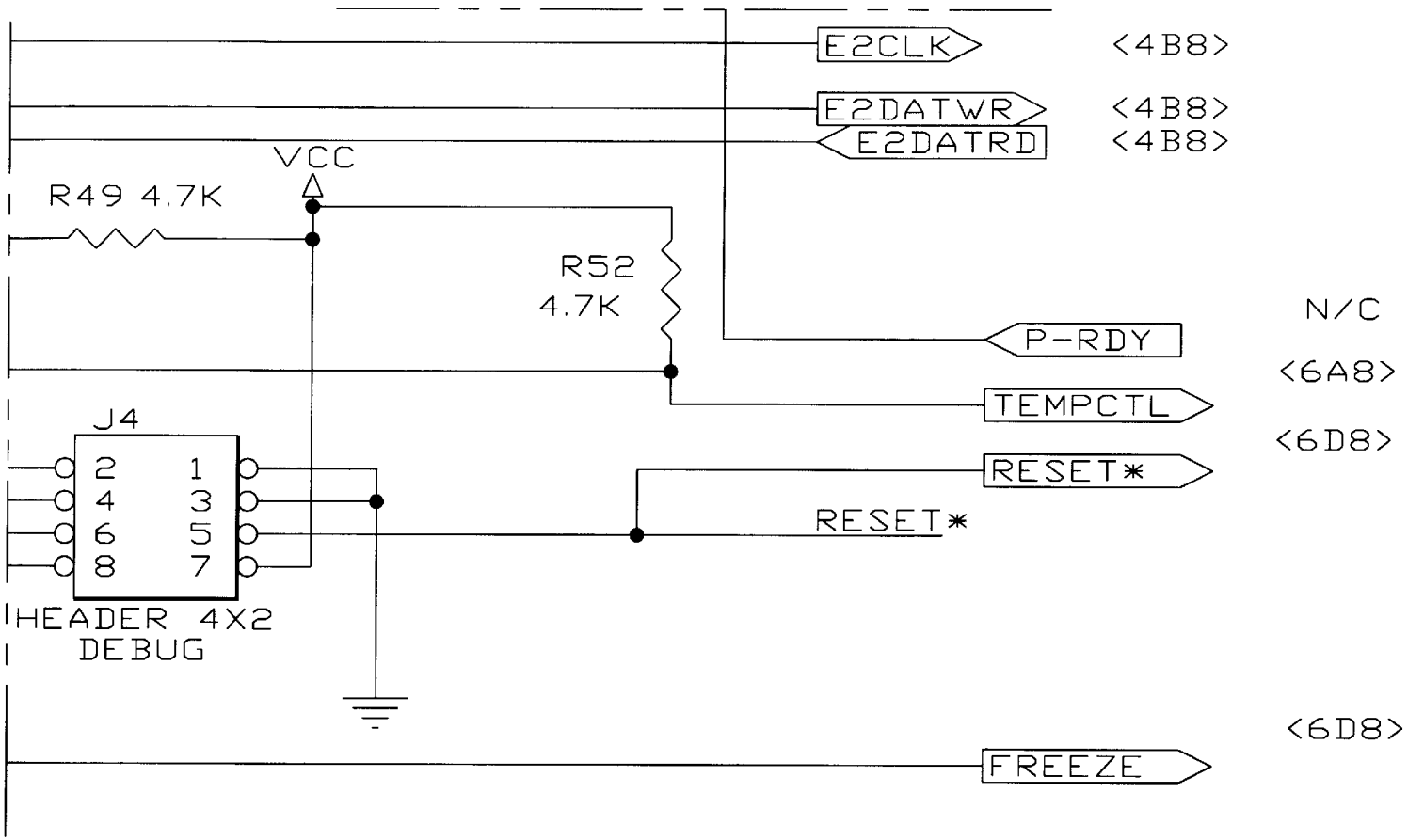

With regard to FIG. 36, the printer is controlled by a single MC68331 microprocessor. It is a 32-bit surface mounted device containing a 32020 computer core, interrupt controller, counter/timers and programmable chip select lines. Basic DRAM control functions are also included. The processor uses a 32.768 KHz watch crystal for reference. An internal synthesizer multiplies the reference to obtain the 16 MHz operating clock.

The reset circuit (2D7) provides an active LOW state for 15 mS after power is applied. This allows the clock to stabilize and internal registers to be initialized. The RESET* line is an open collector type which is also driven by the processor to implement a software initiated reset.

The system firmware contains Service Test routines helpful in debugging and adjusting the printer. The test mode is enabled by powering ON with TP1 and TP2 jumpered together (2C8).

Jumper W1 is used only during PCB manufacture to enable burn in tests. W1 should not be installed in the field.

Figures 37, 37A:
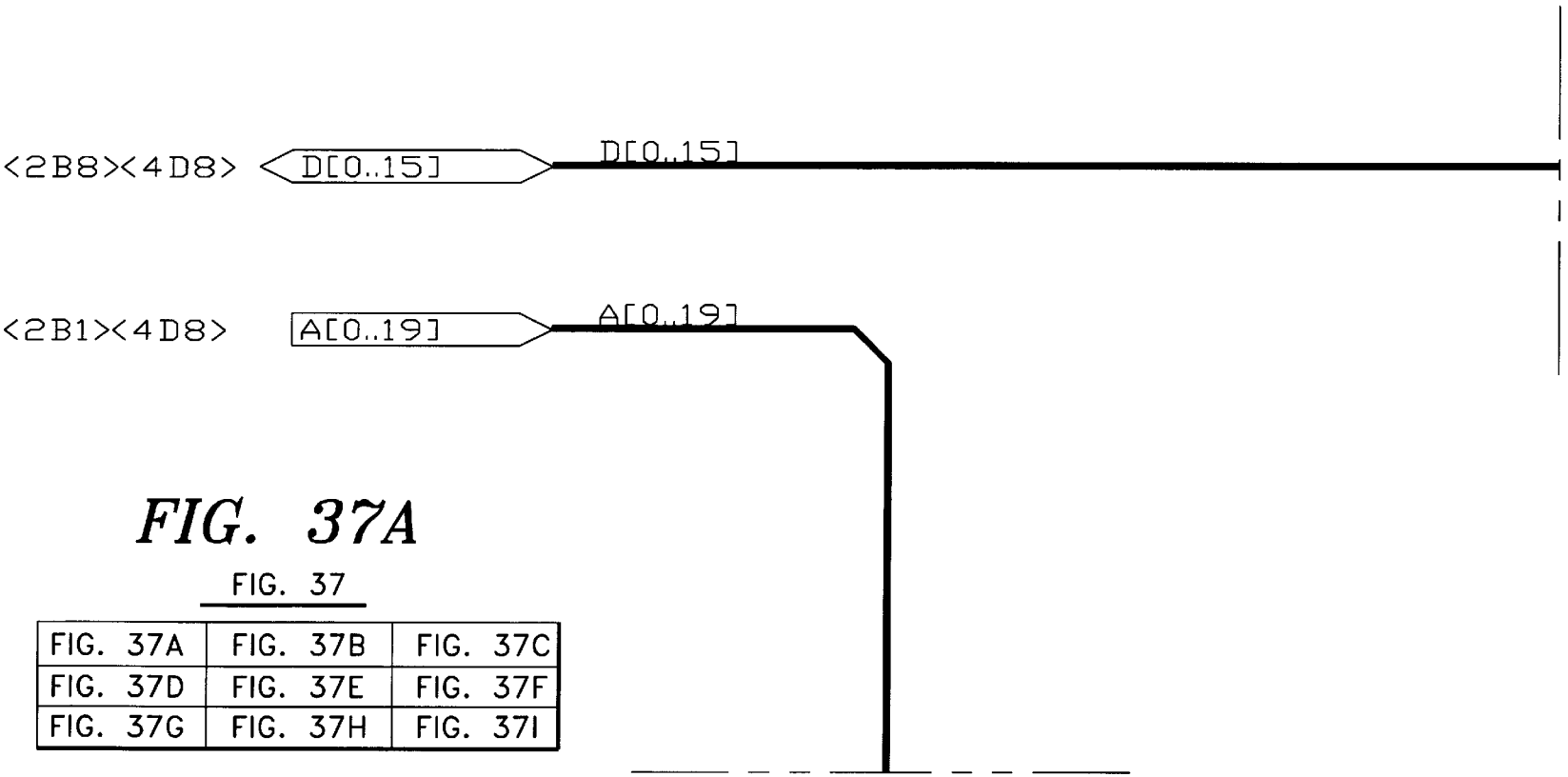
Figure 37B:
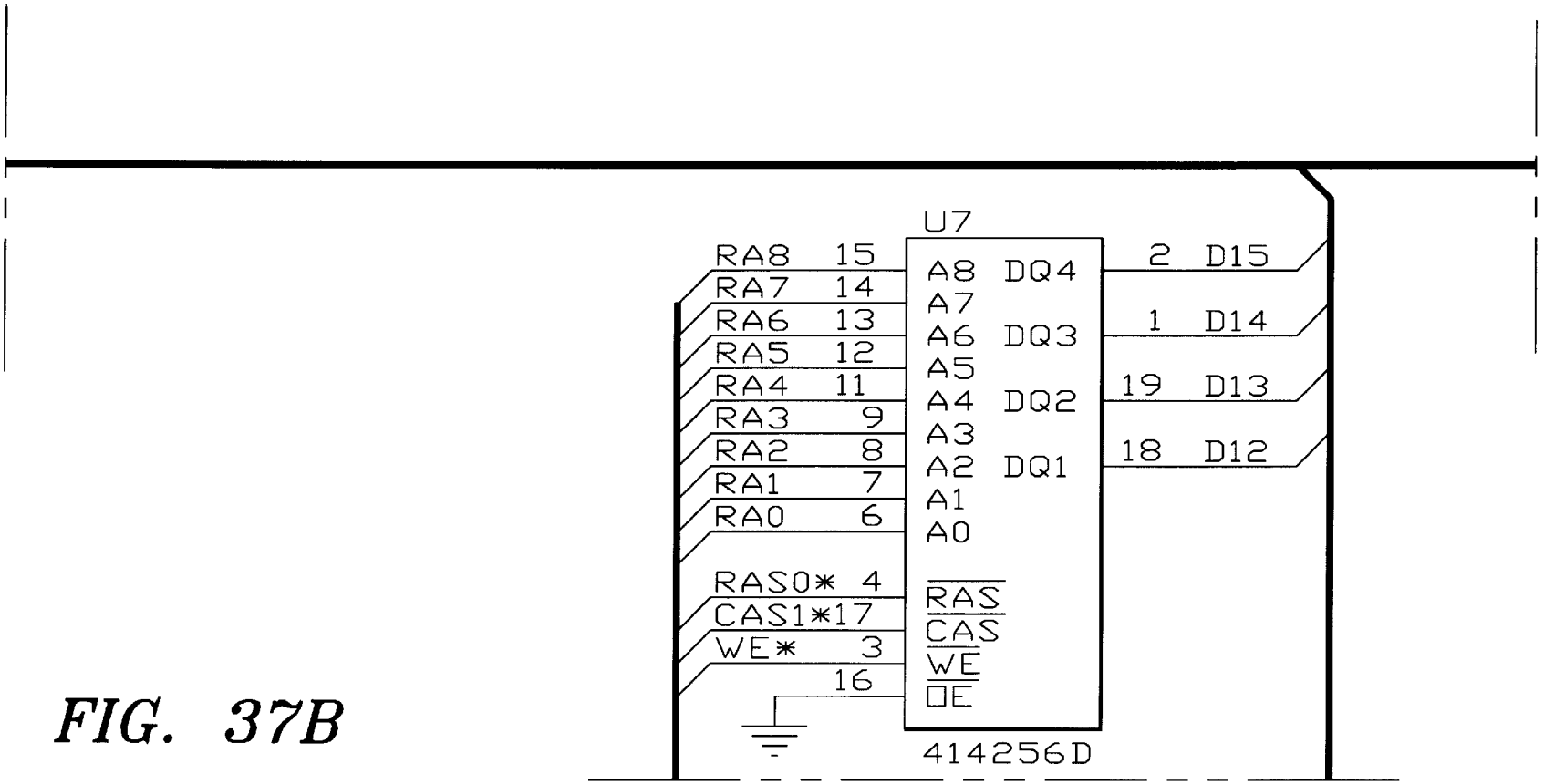
Figure 37C:
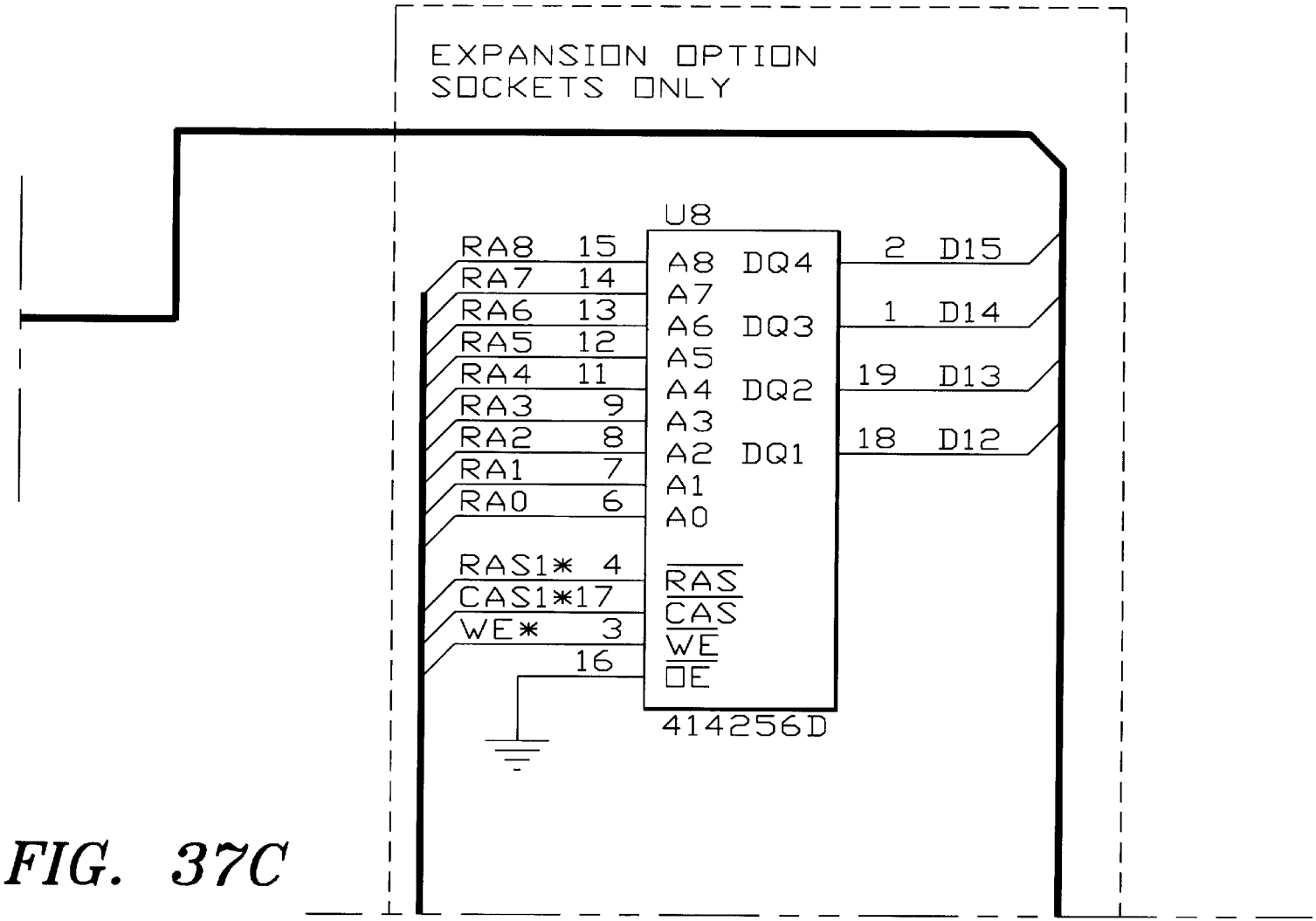
Figure 37D:
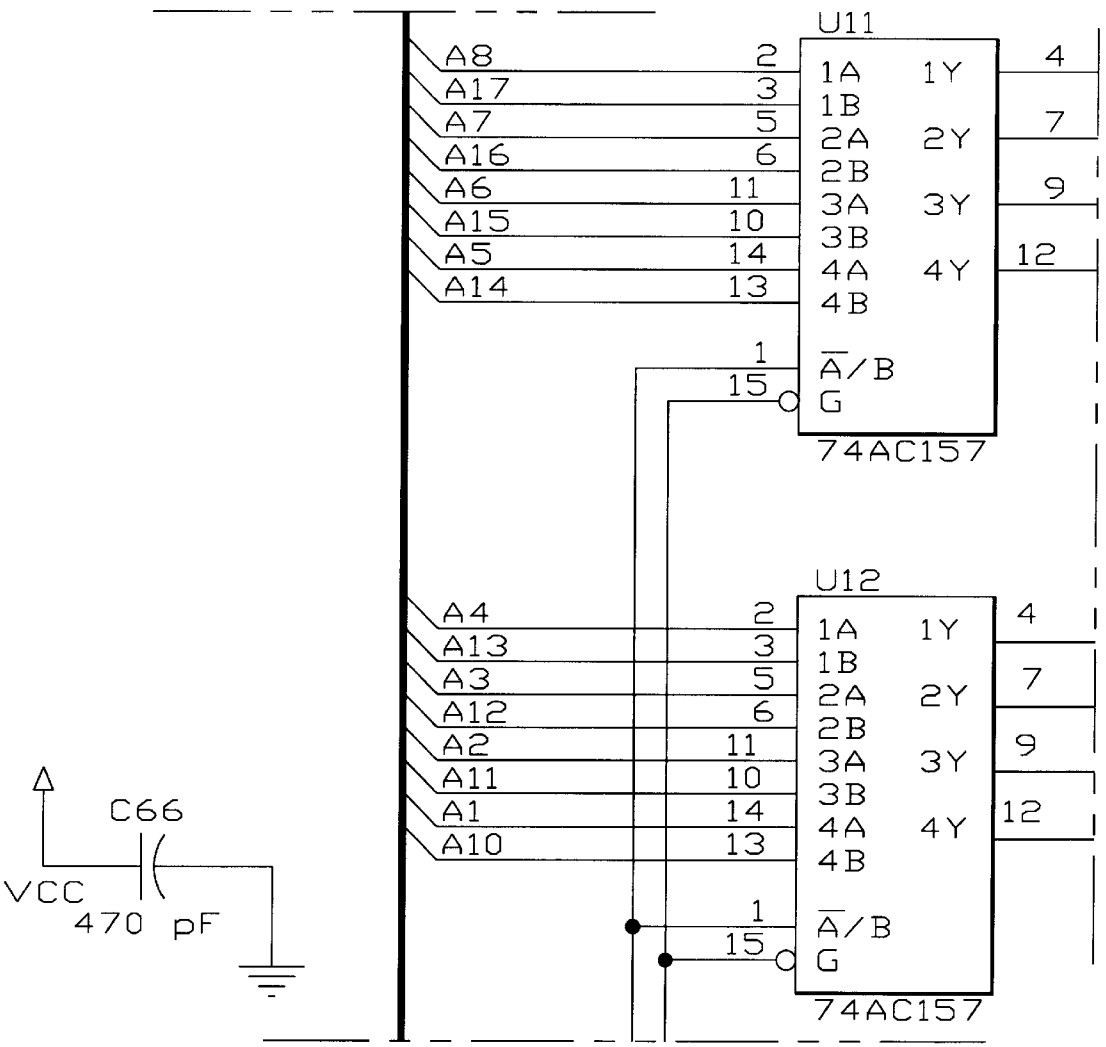
Figure 37E:
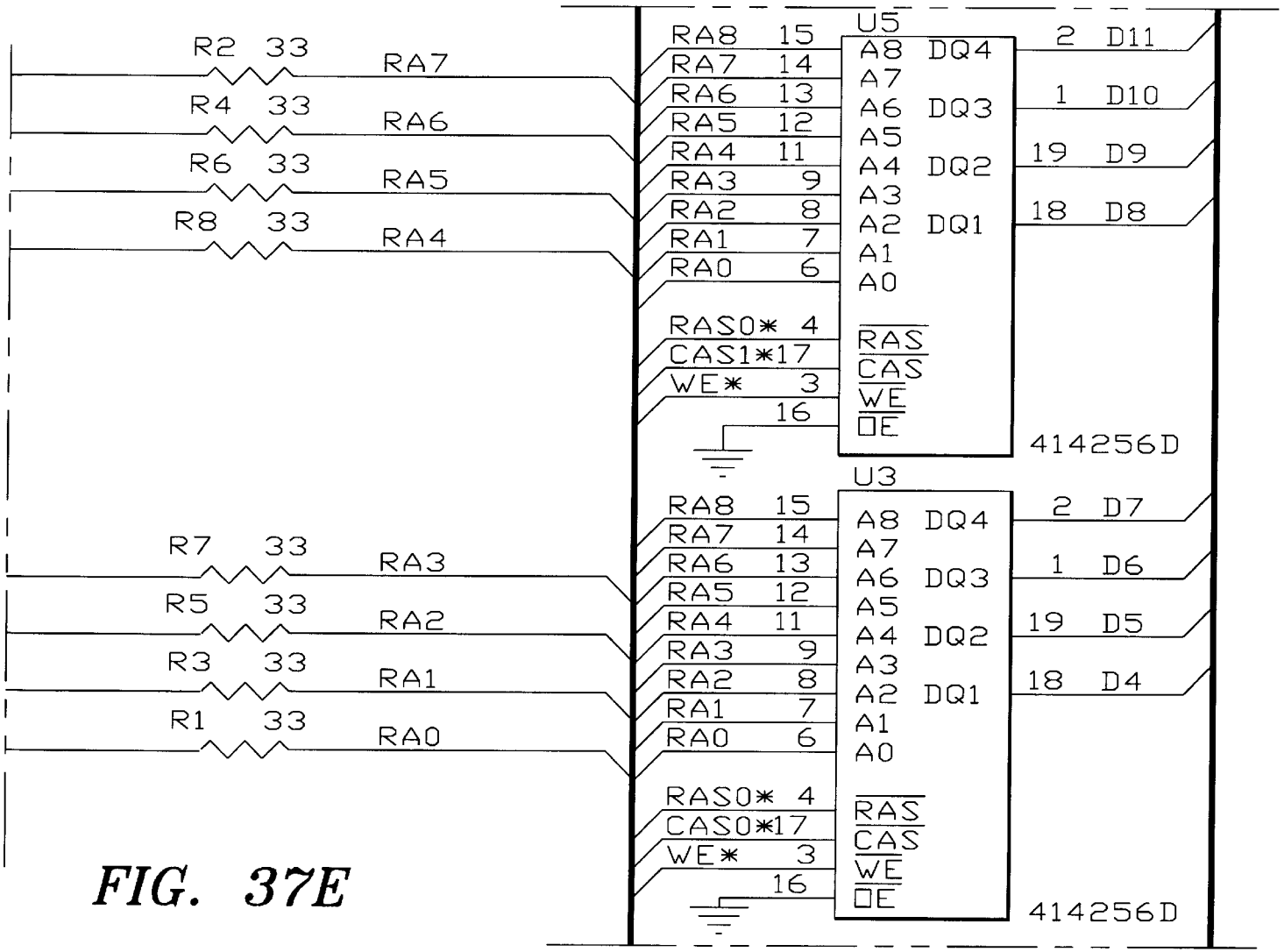
Figure 37F:
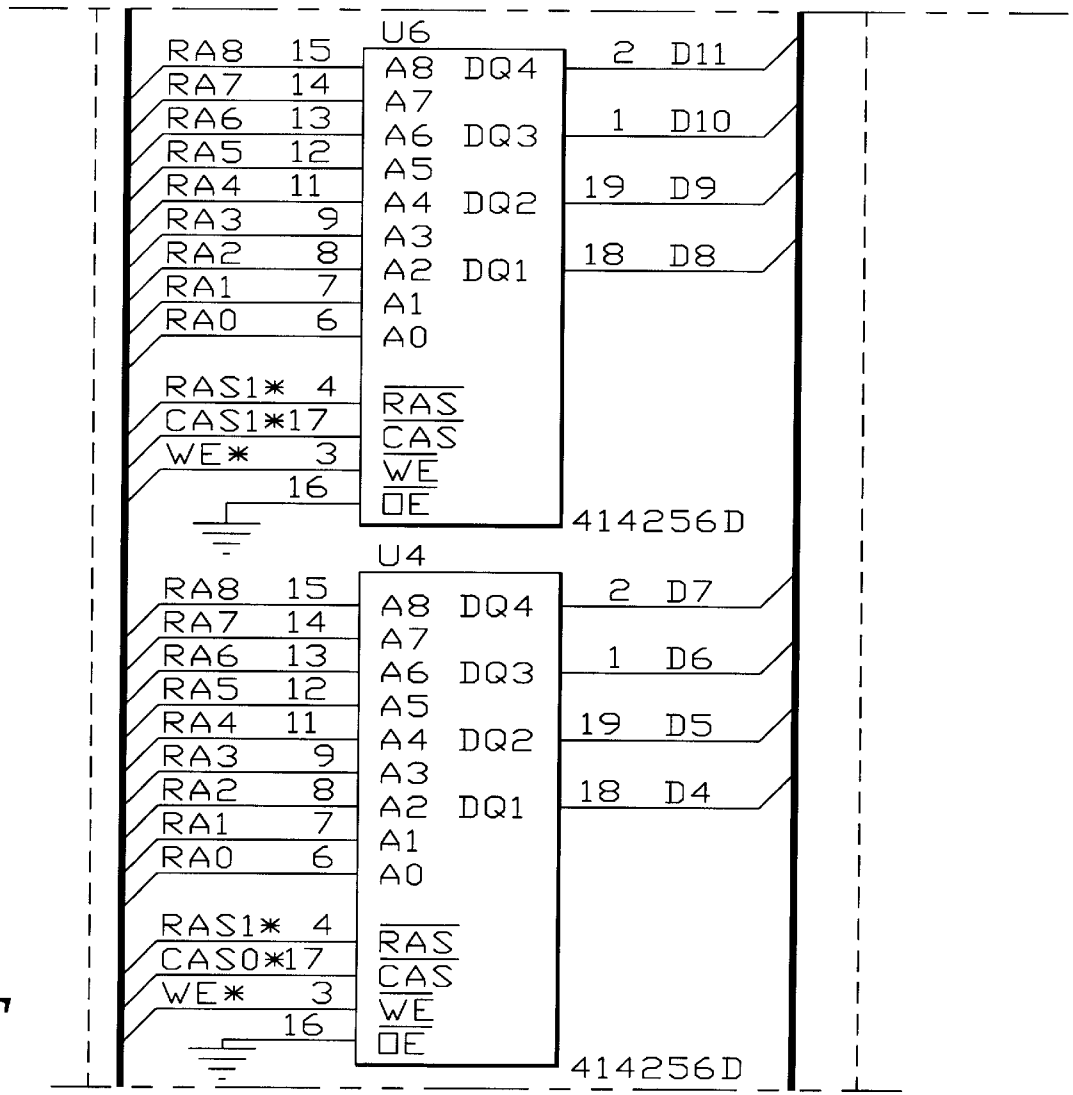
Figure 37G:
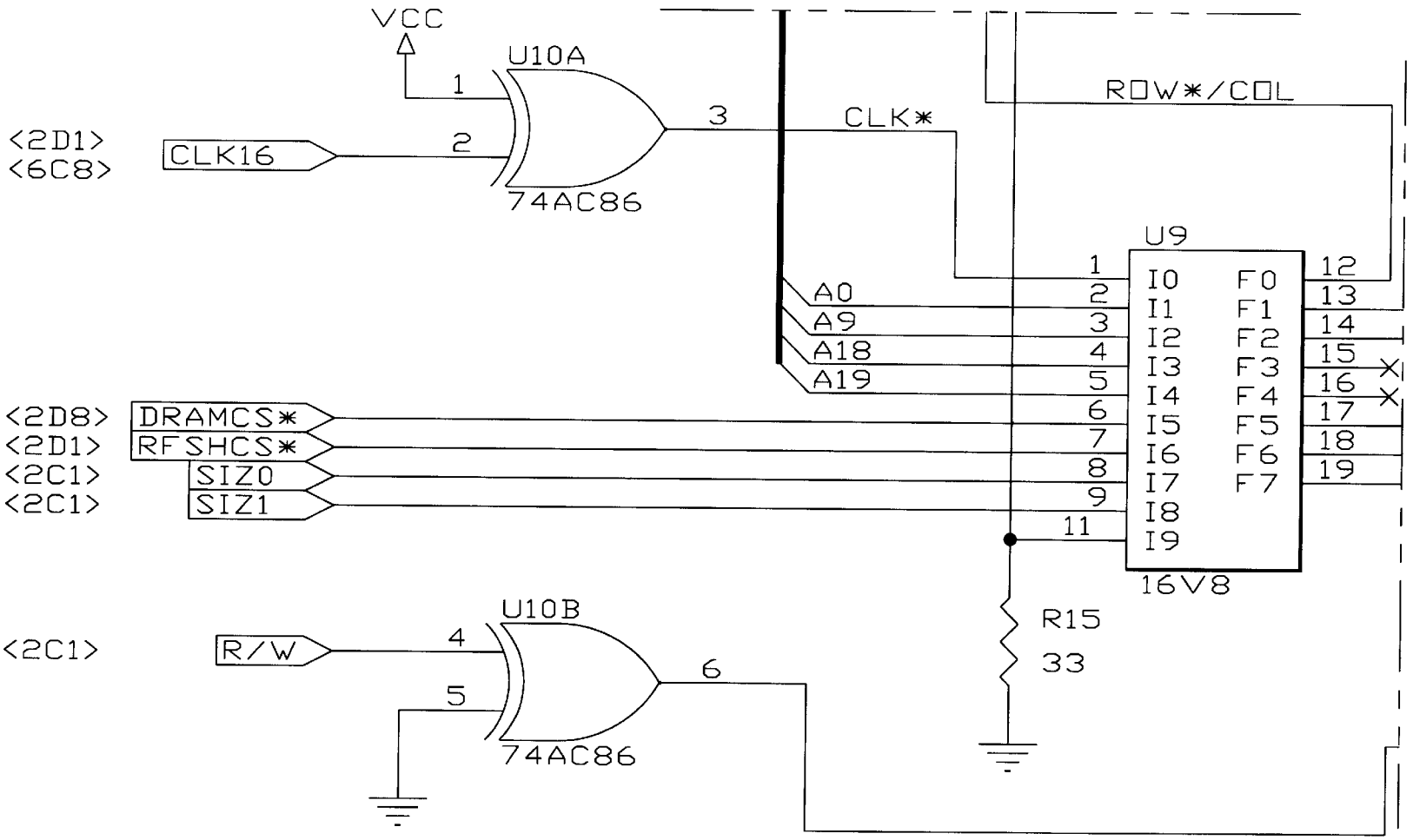
Figure 37H:
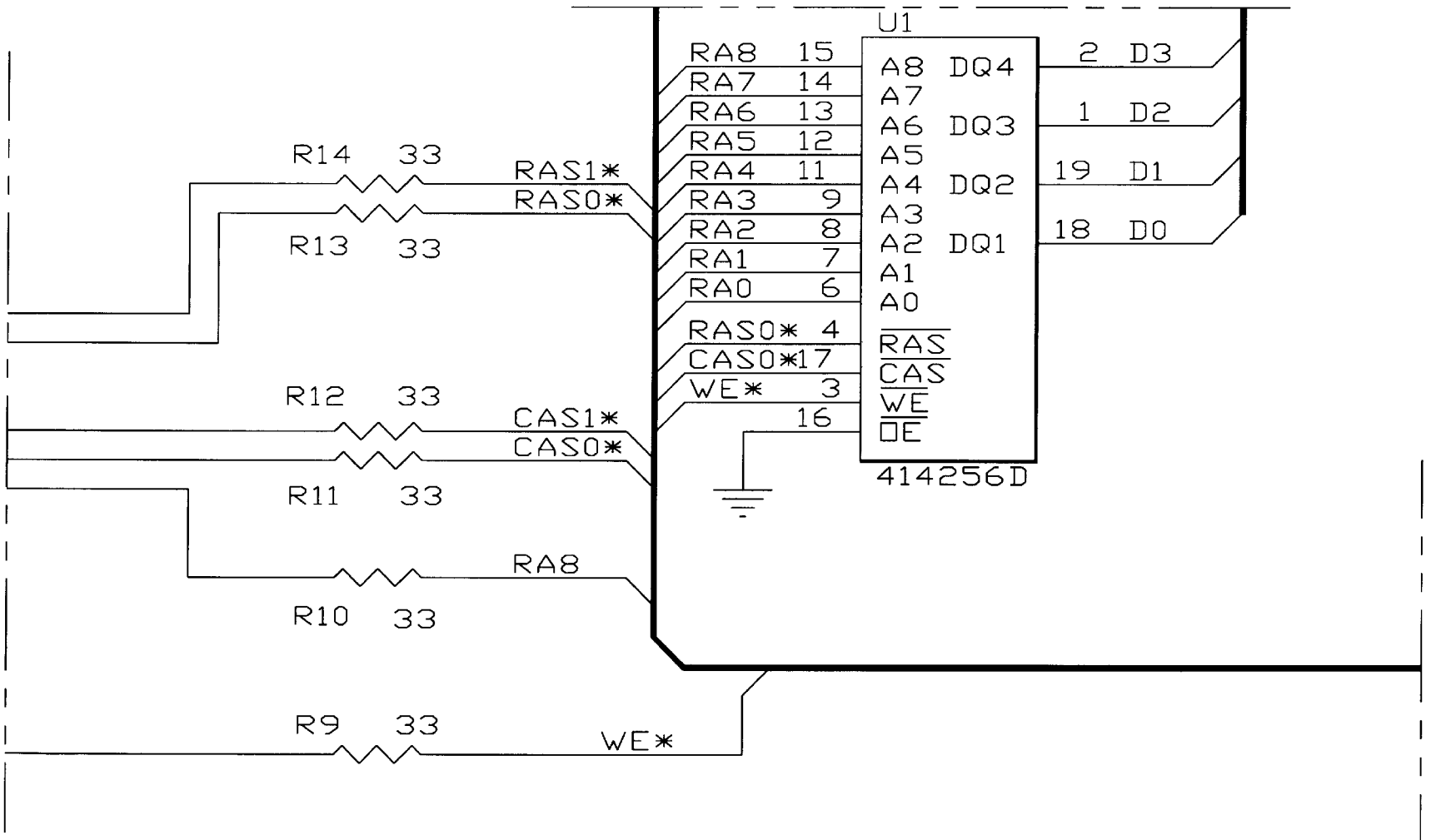
Figure 37I:
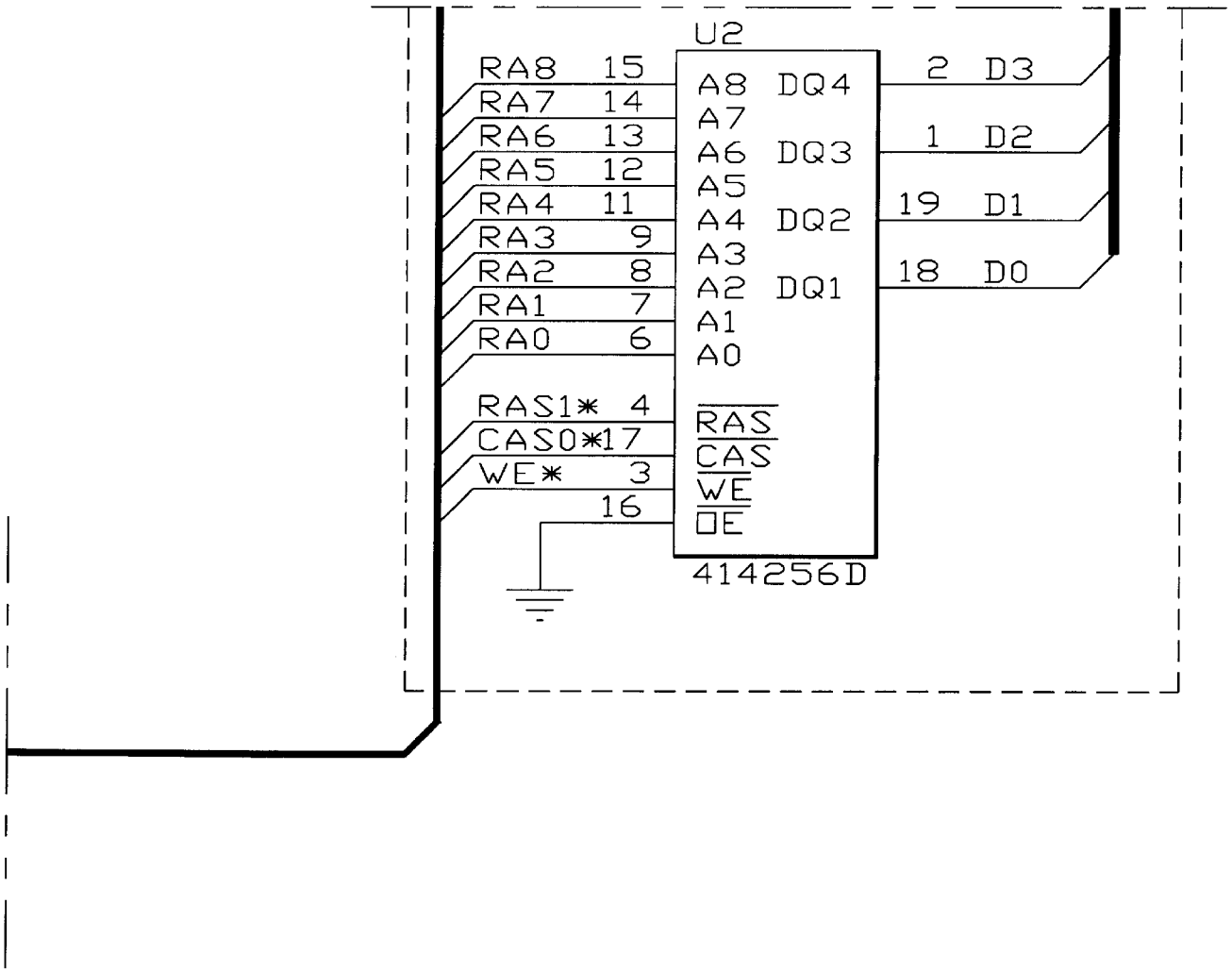

As shown in FIG. 37, the standard printer contains 4 256 K×4 DRAM ICs for a total of 512 KB. The ICs are soldered in locations U1, U3, U5 and U7. An additional 512 KB may be installed in sockets U2, U4, U6 and U8. The DRAM control lines are programmable output lines on the processor (2C1), (2D1), (2D8). GAL U9 decodes the DRAM control lines to generate the RASX* and CASX* signals as well as the ROW*/COL line for multiplexers U11 and U12.

Figures 38, 38A:
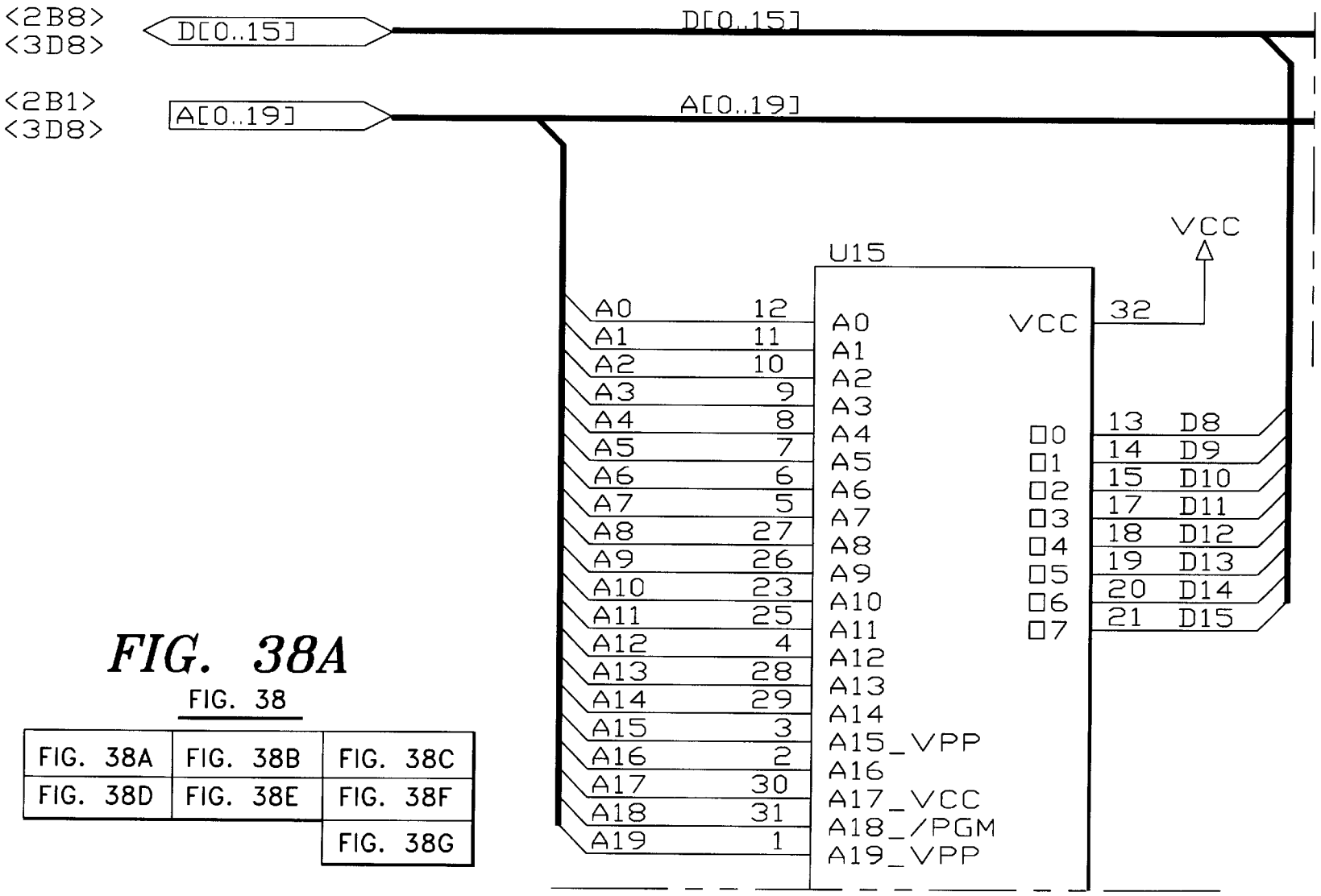
Figure 38B:
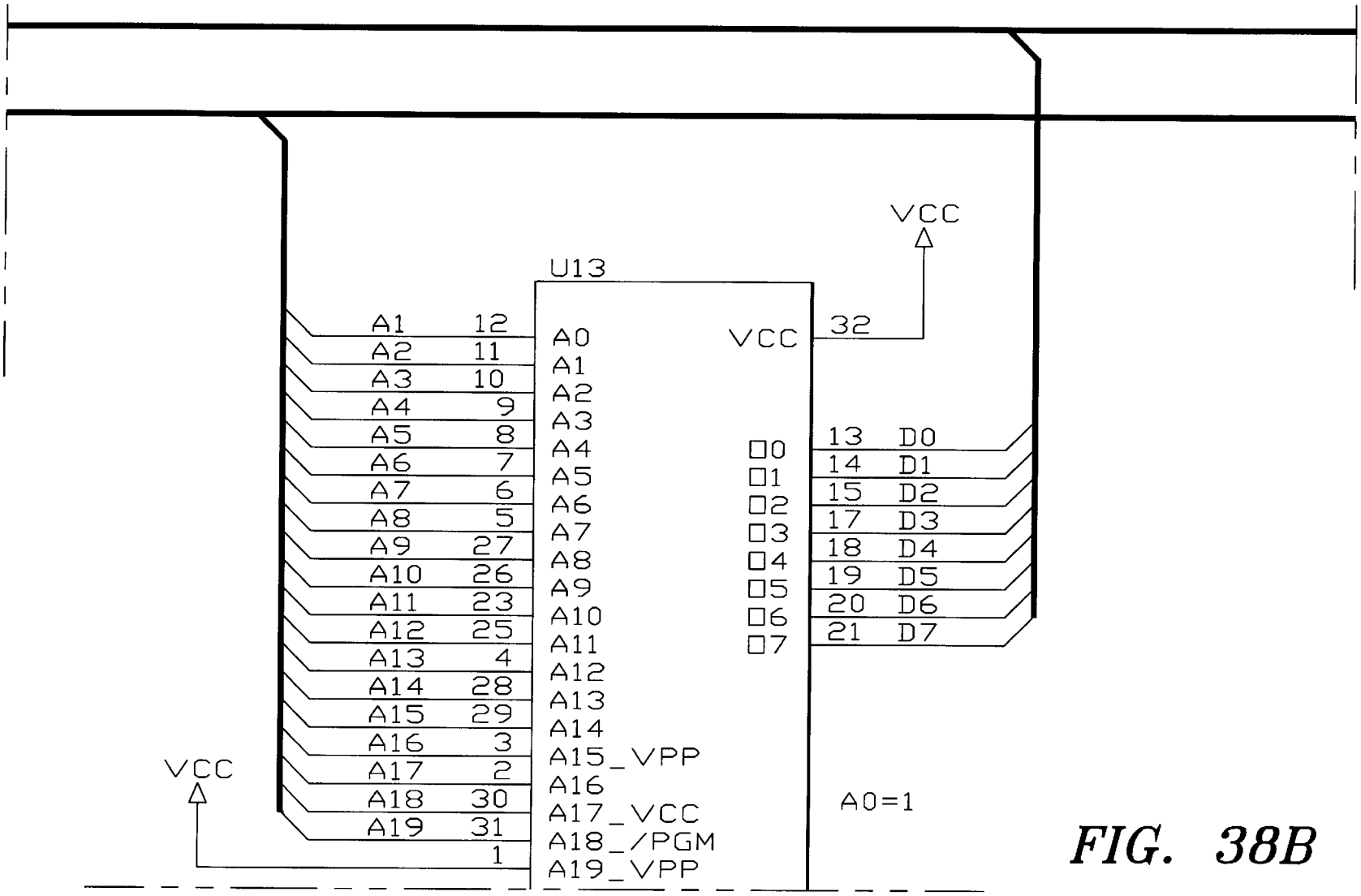
Figure 38C:
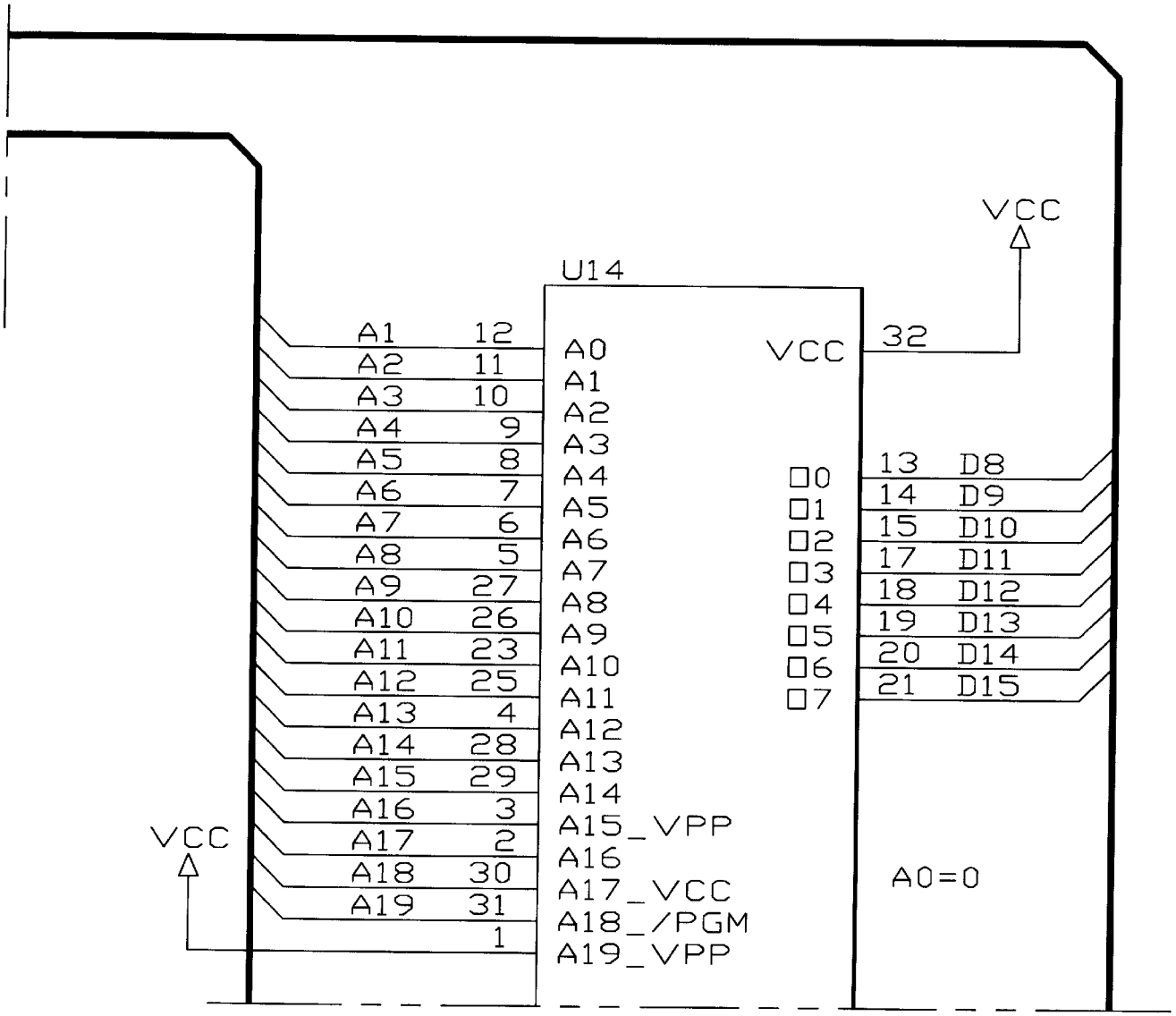
Figure 38D:
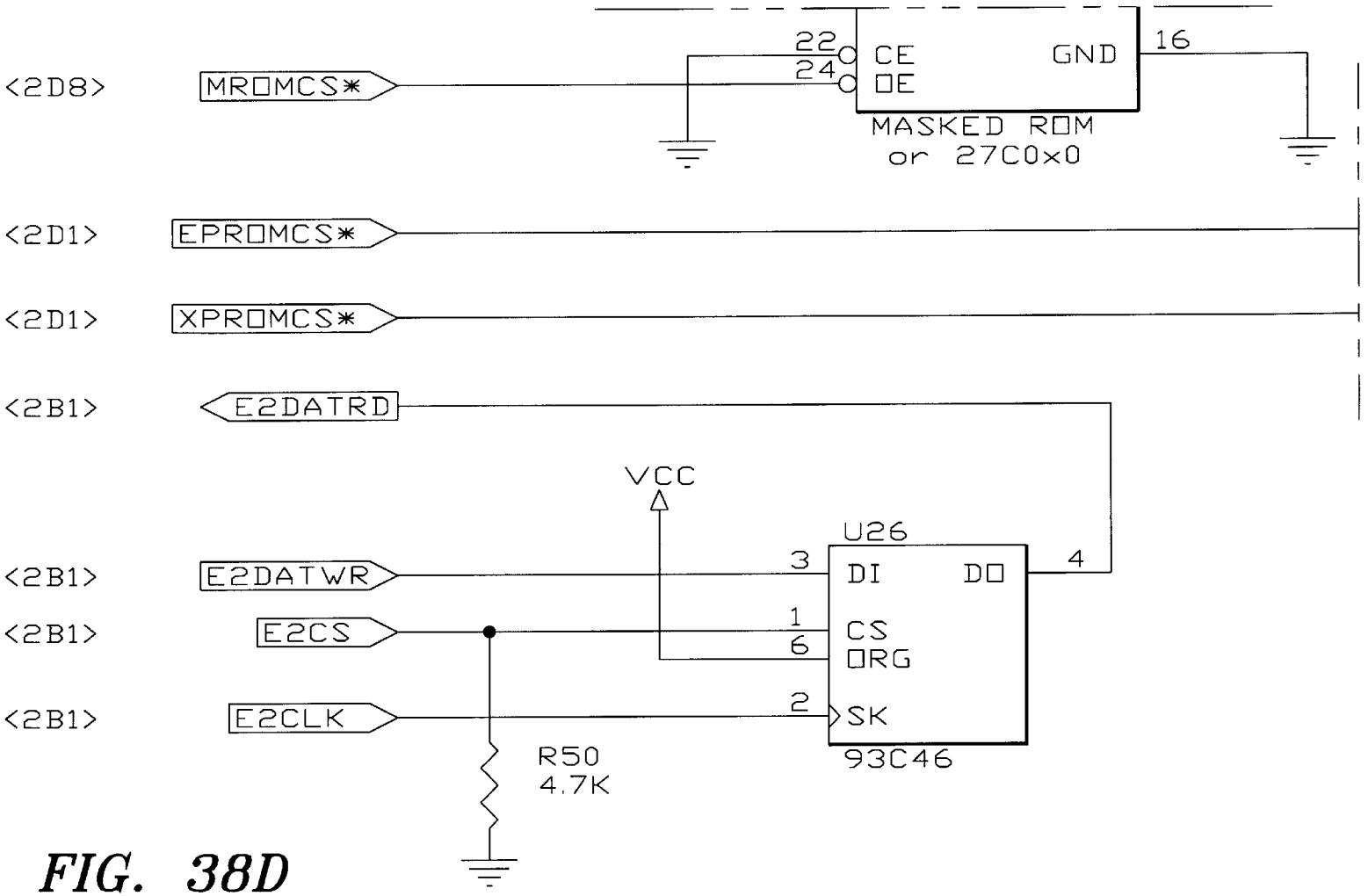
Figure 38E:
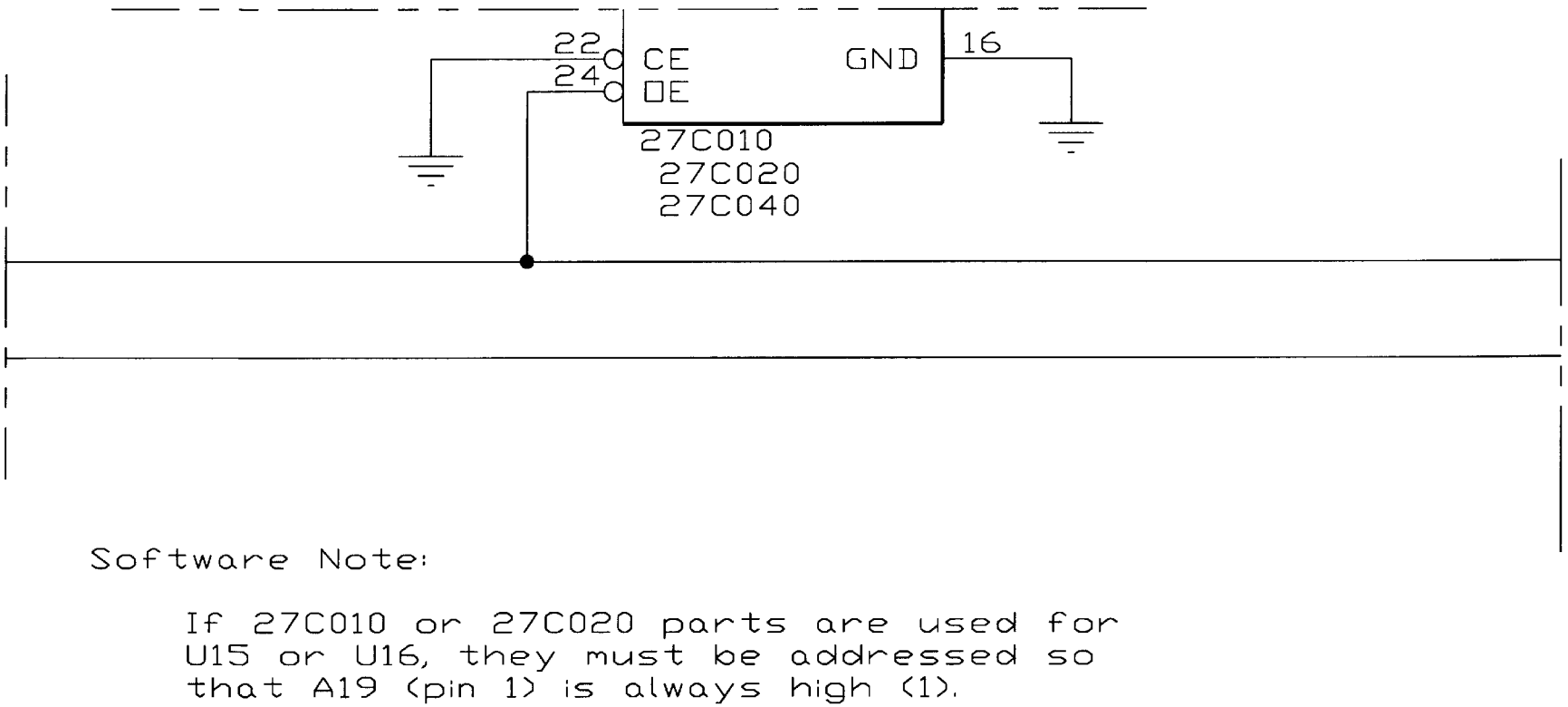
Figure 38F:
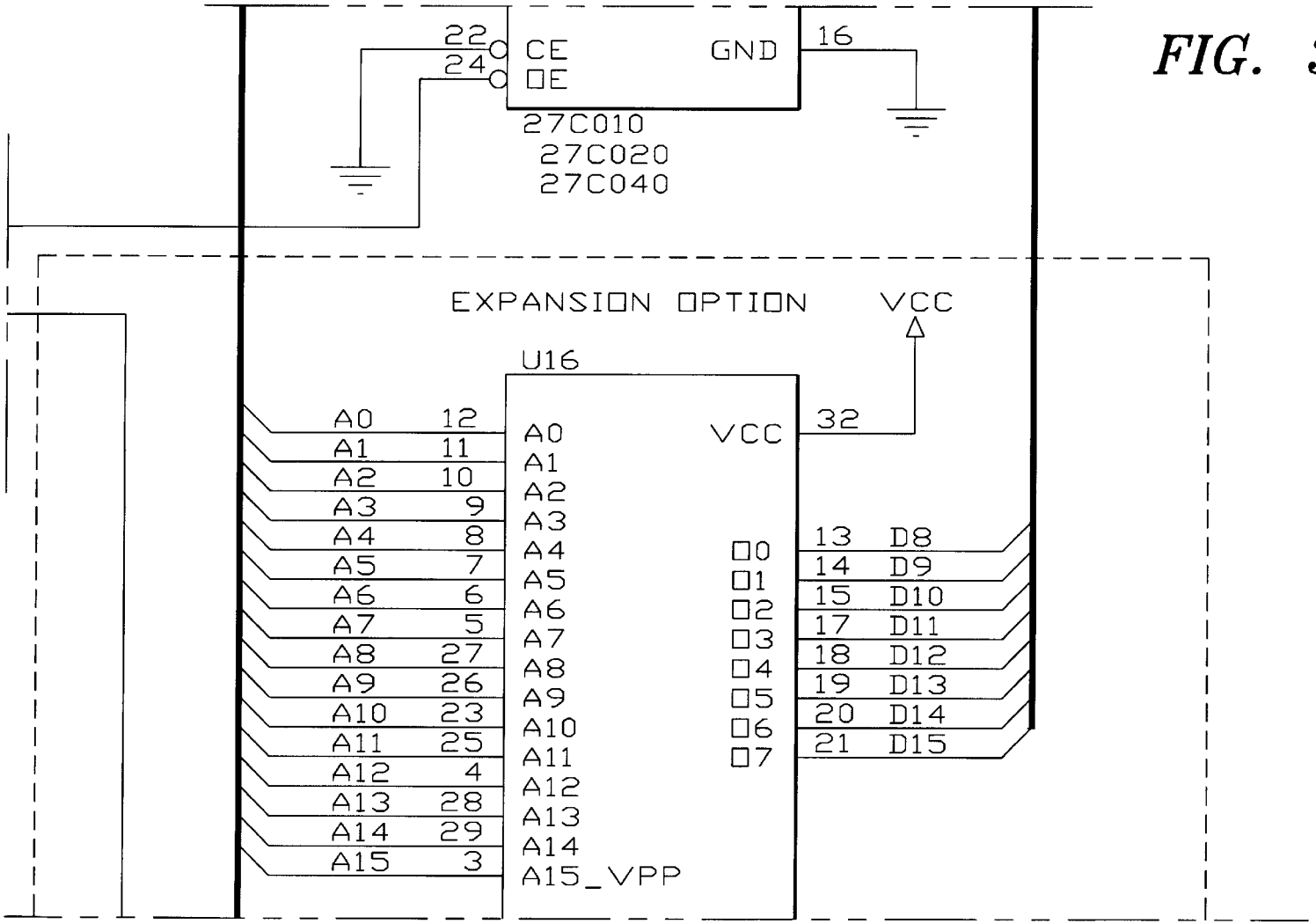
Figure 38G:
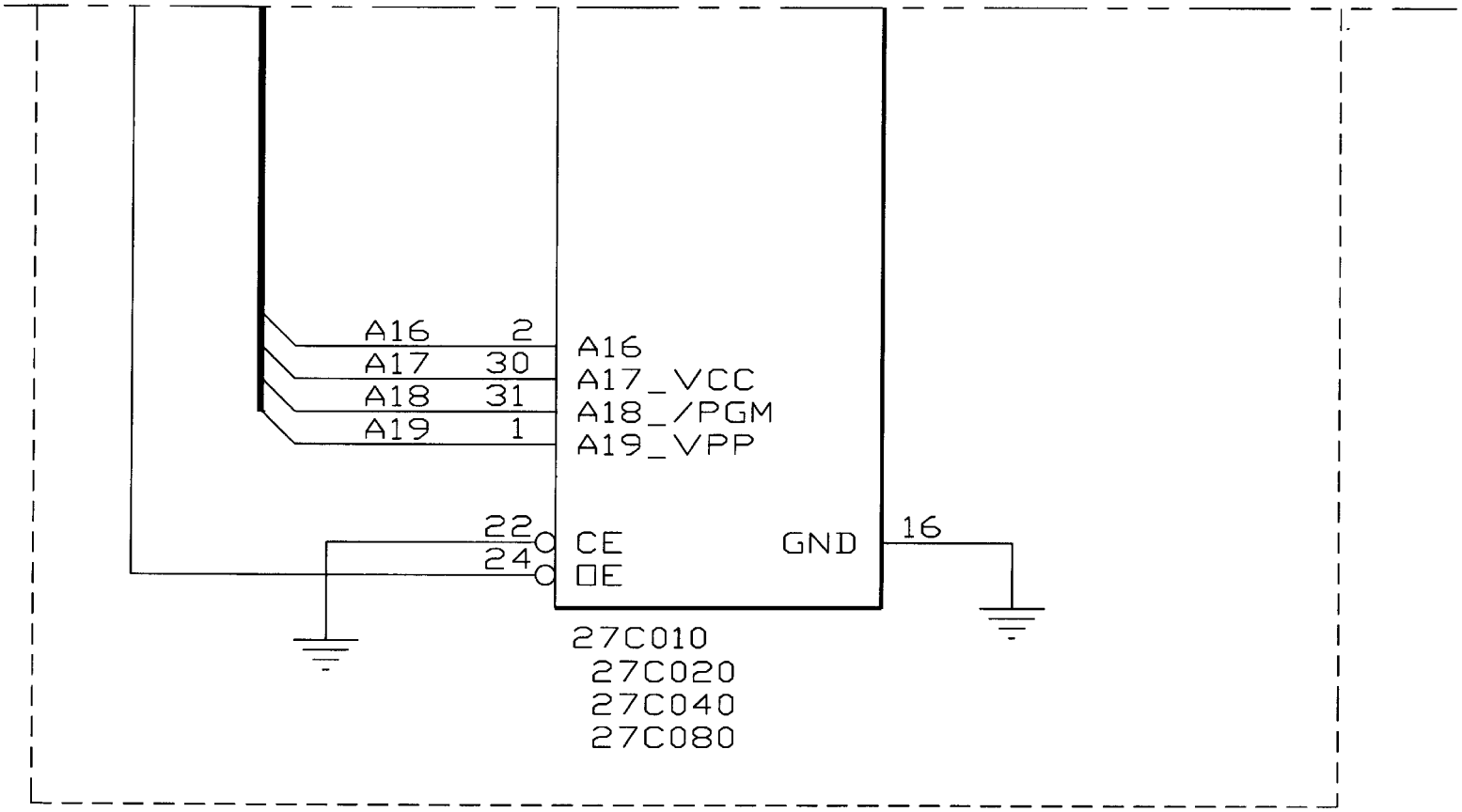

Referring to FIG. 38, the system firmware is located in EPROMS or mask ROMs in sockets at locations U13–U16.

The chip selects are provided by programmable chip select outputs on the processor (2D1). System configuration is stored in the EEPROM U26 (4B7). The EEPROM interfaces directly to I/O lines from the processor.

Figures 39, 39A:
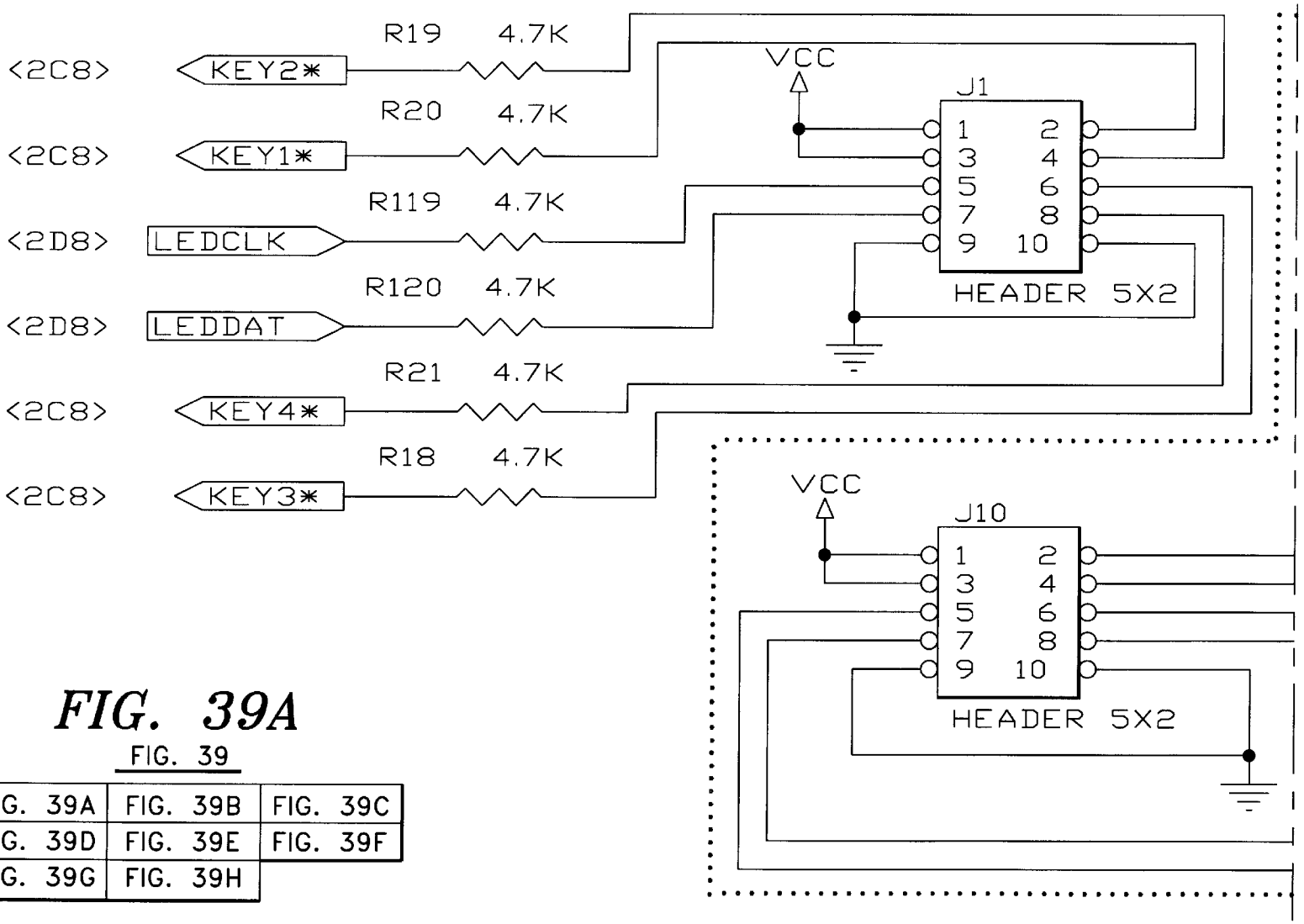
Figure 39B:
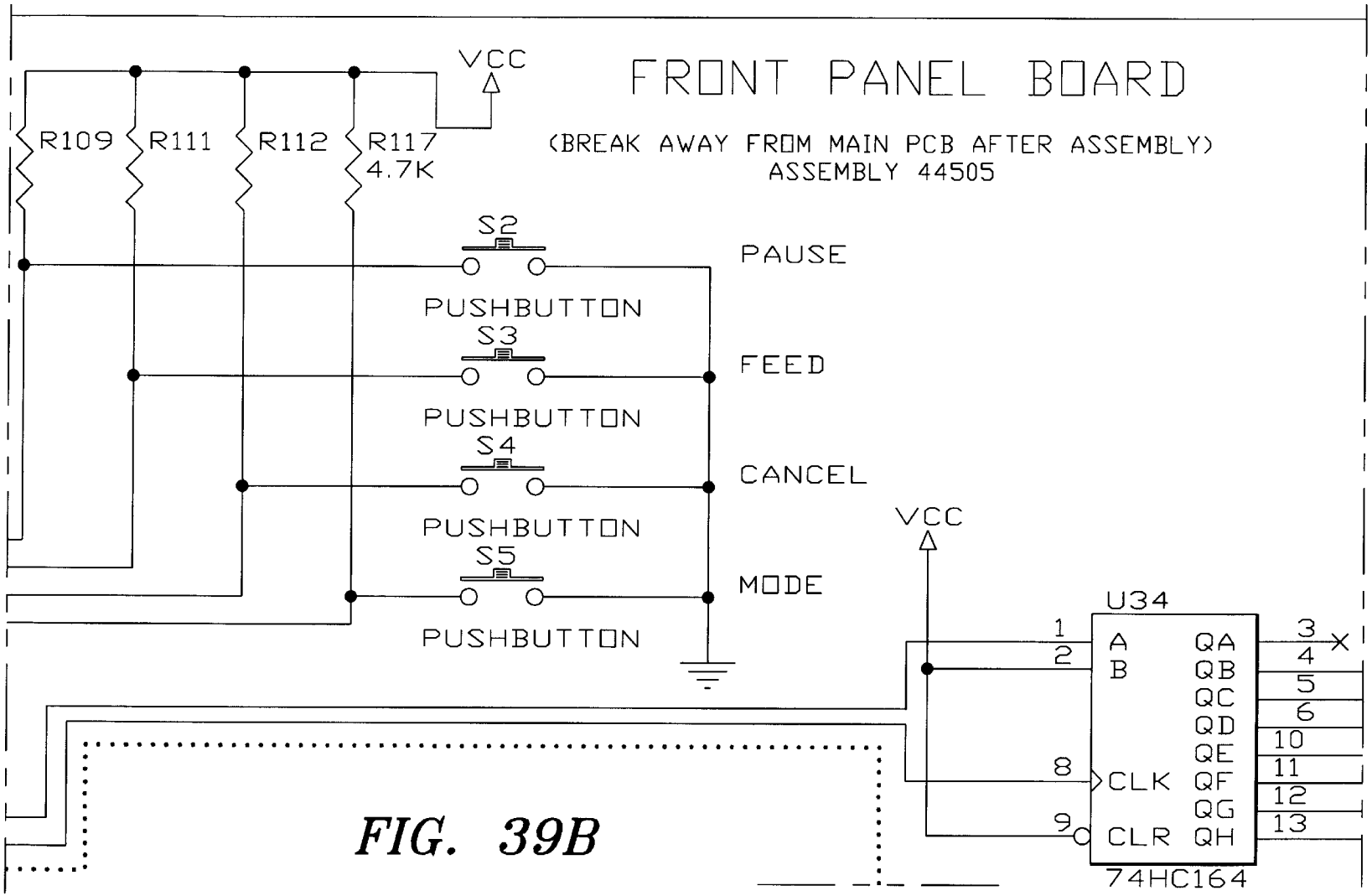
Figure 39C:
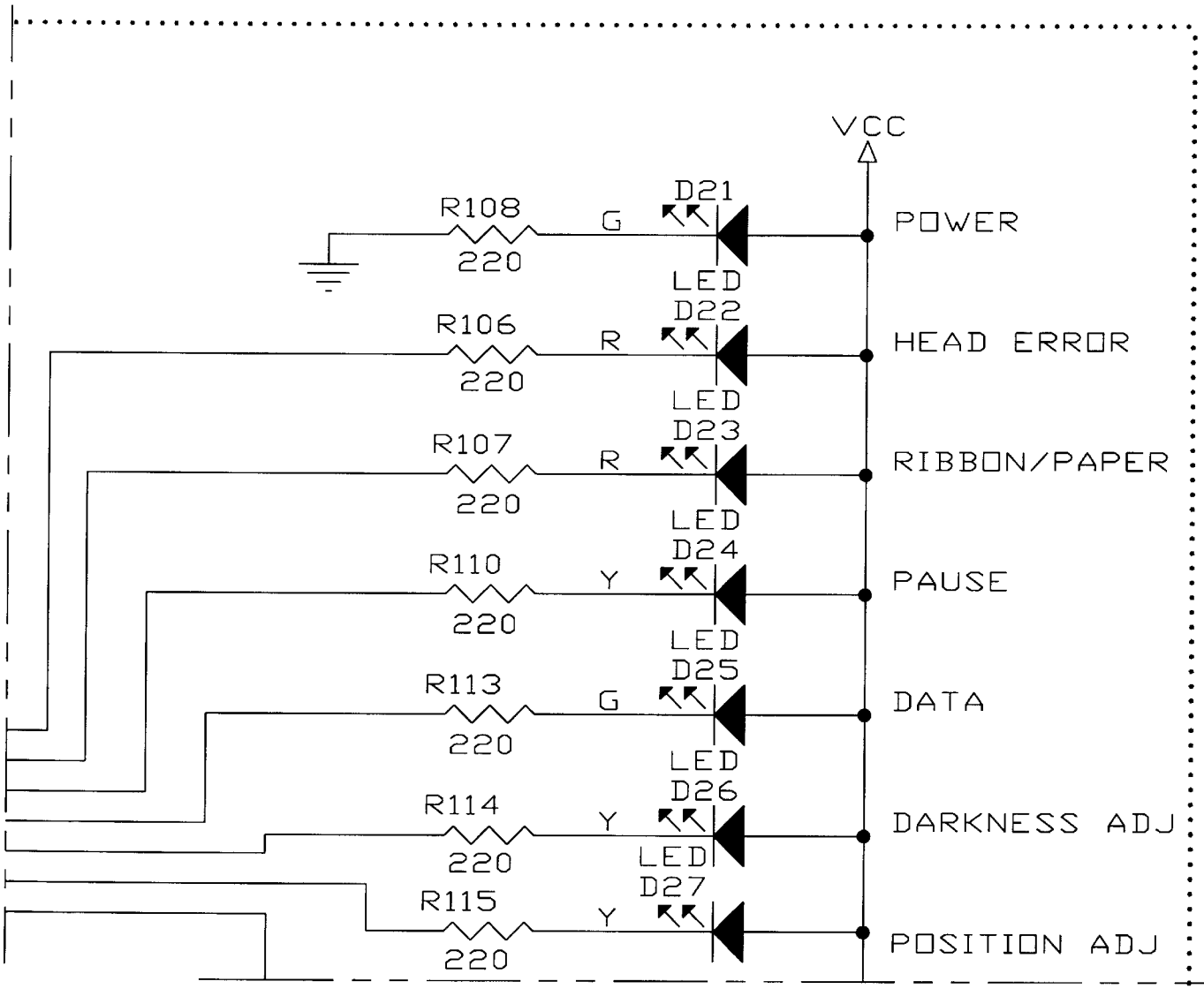
Figure 39D:
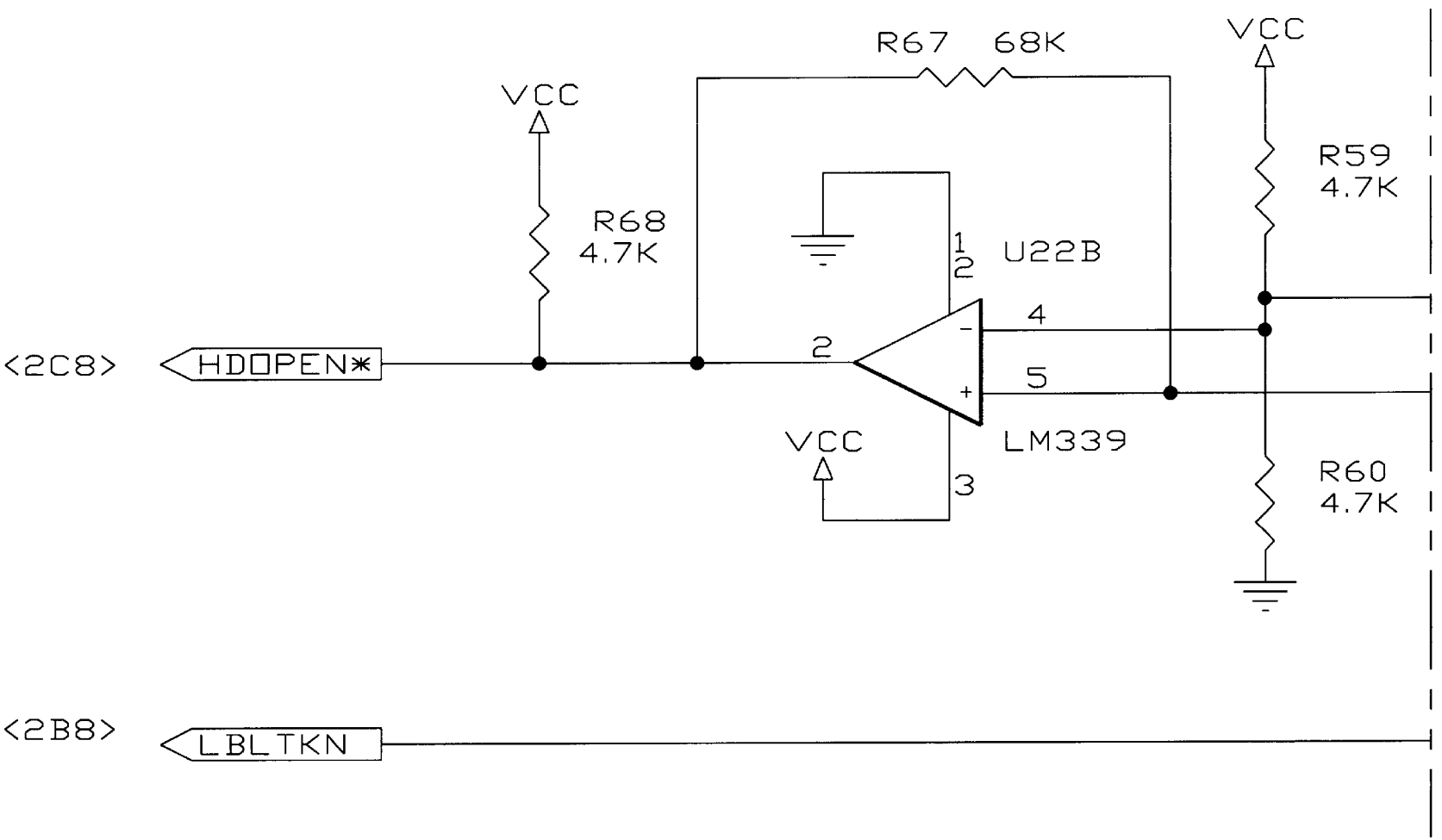
Figure 39E:
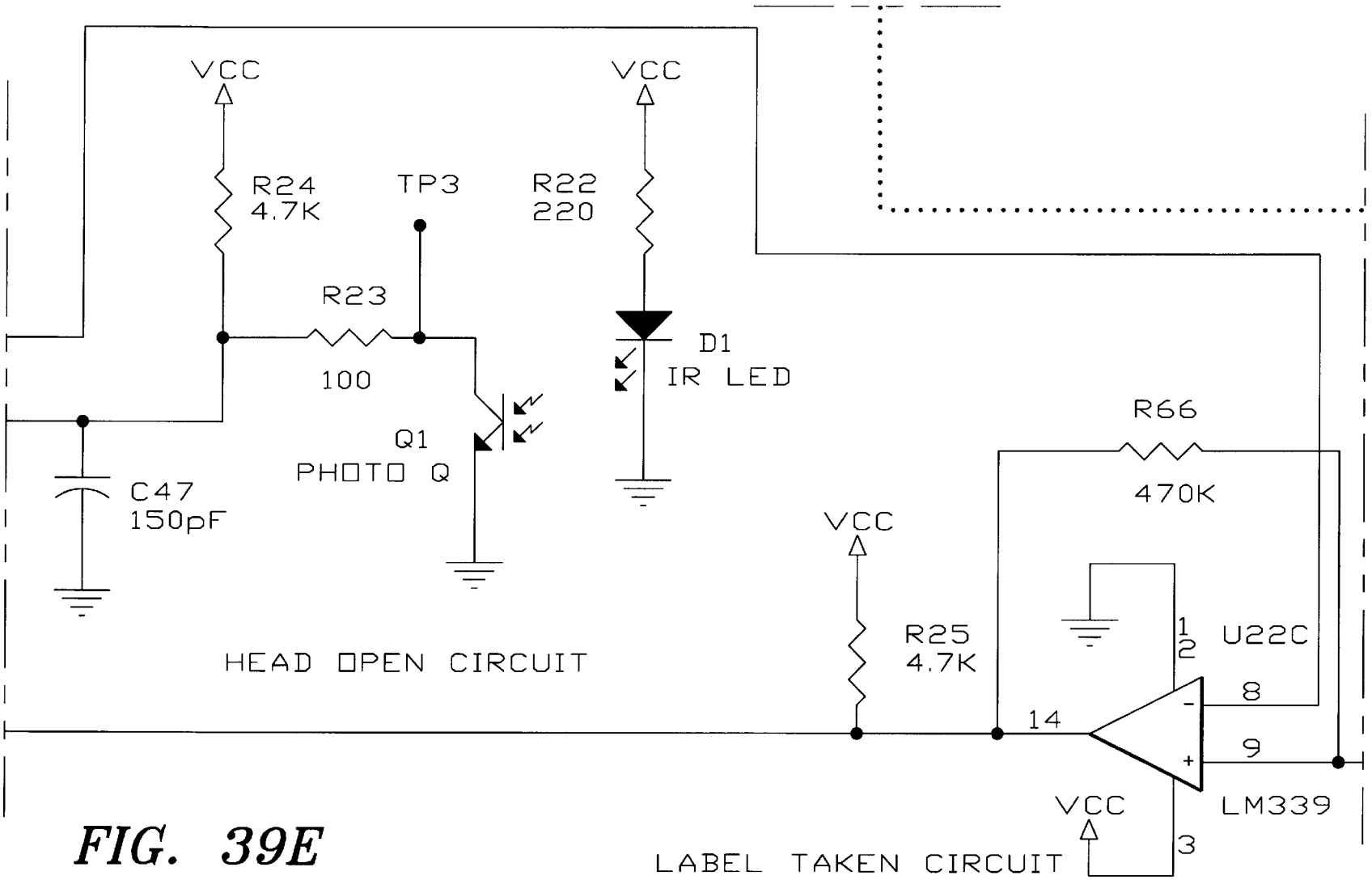
Figure 39F:
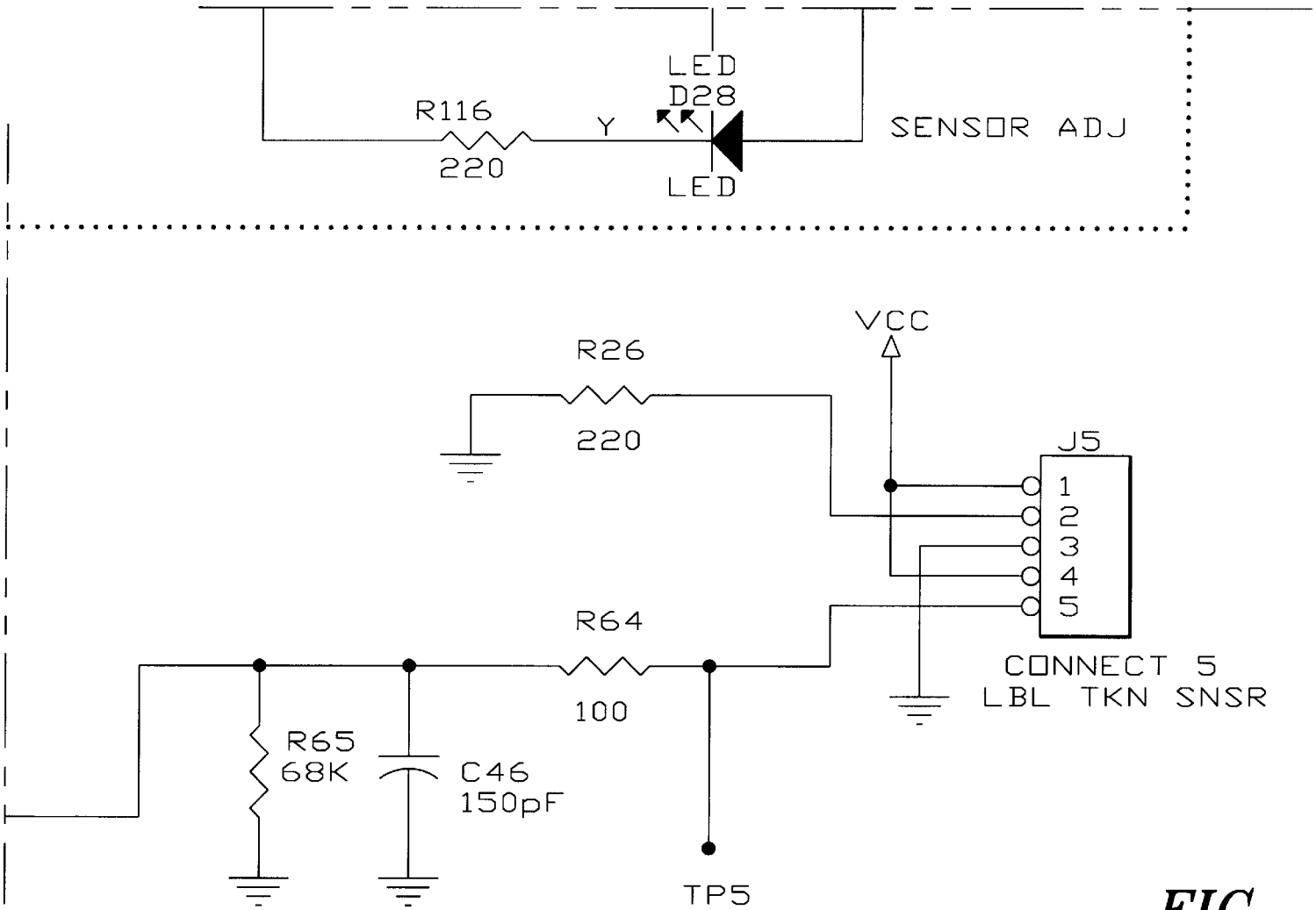
Figure 39G:
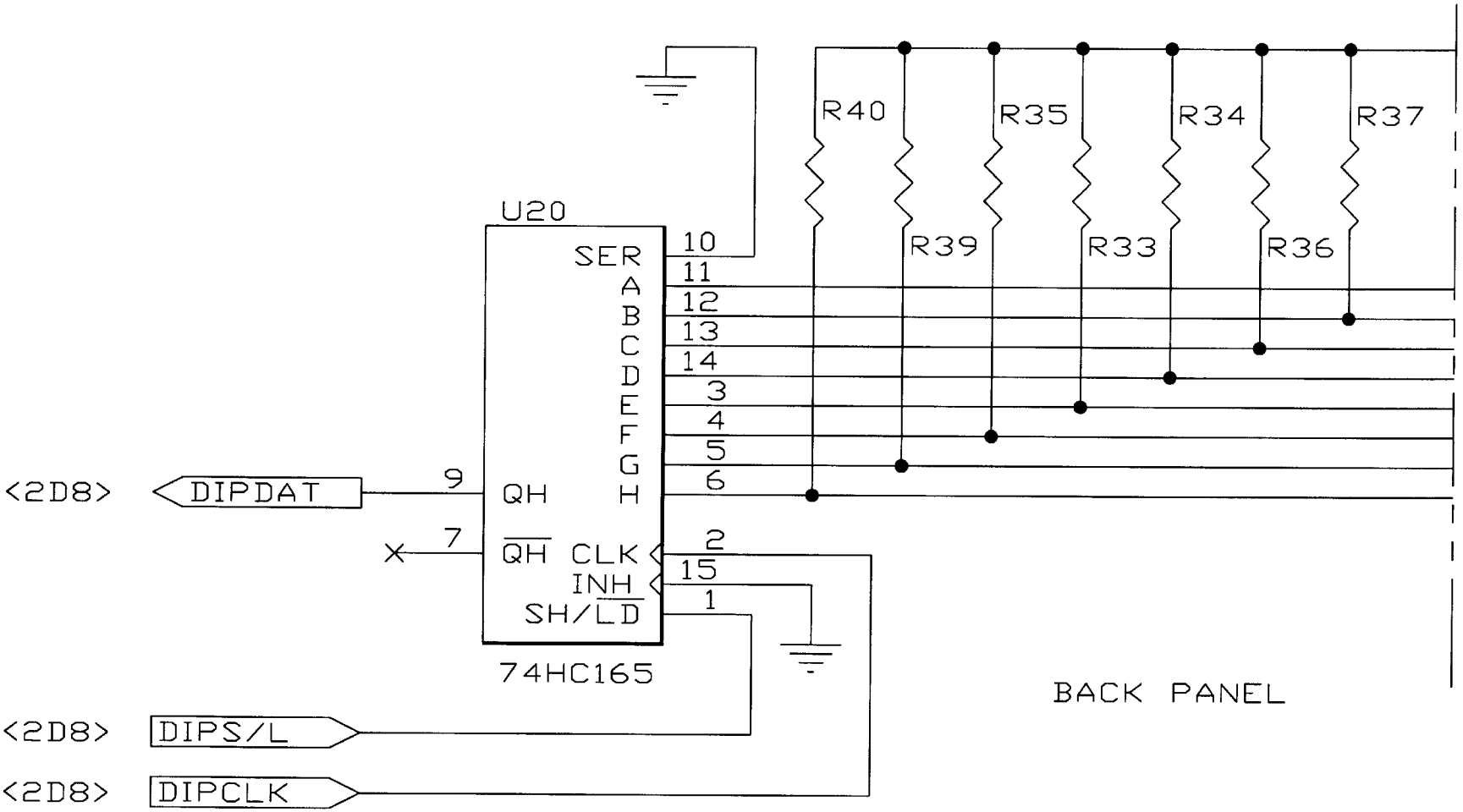
Figure 39H:
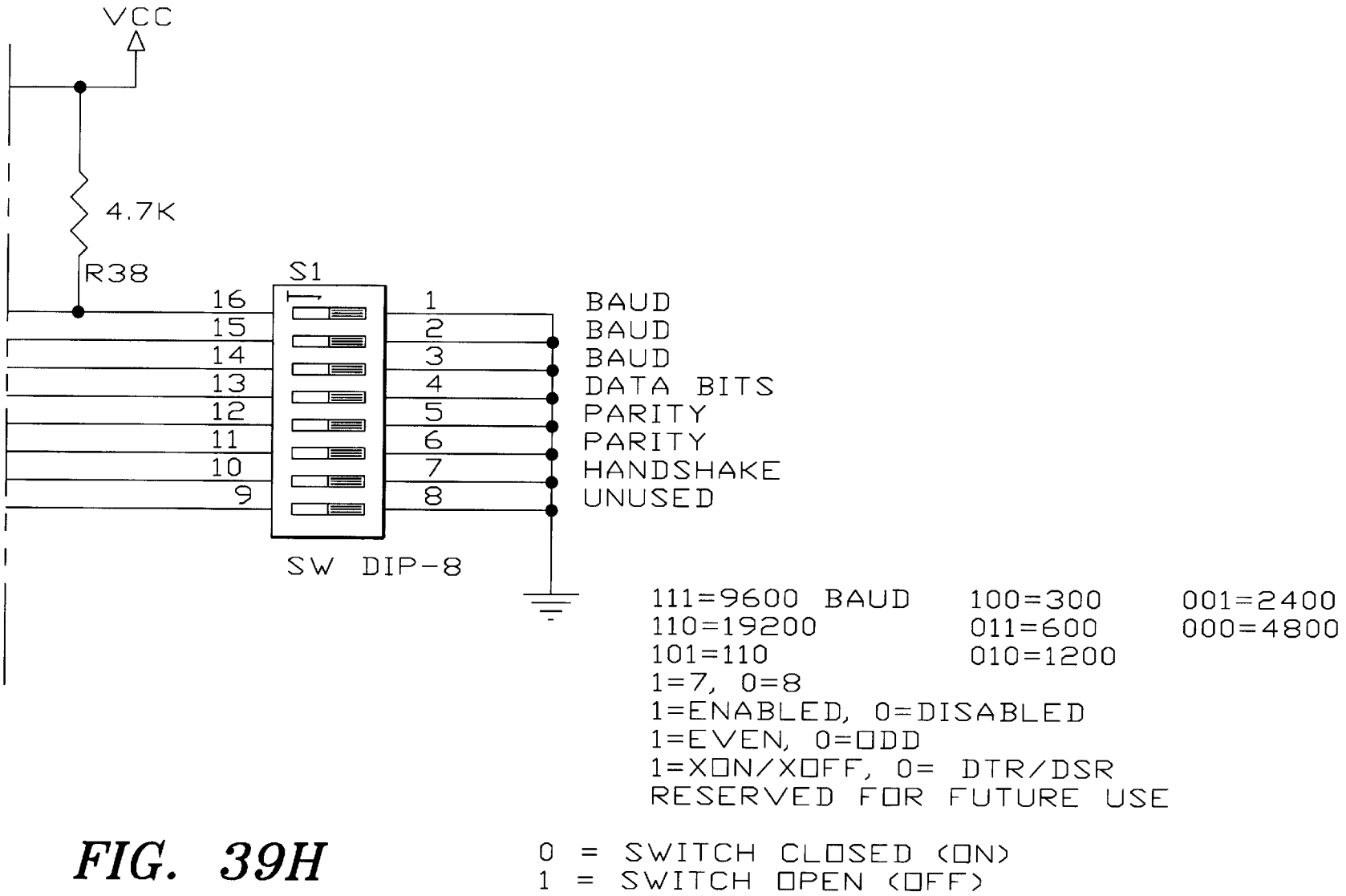

A head-open circuit is shown in FIG. 39. As shown in FIG. 39, the main board contains a phototransistor (Q1) facing an IR LED (D1) (5B5). The head mechanism has an opaque mask which breaks the light path when the head is latched. The collector voltage of Q1 is sensed by comparator U22B. The comparator's reference is set to 2.5 V by R59 and R60. The comparator output, HDOPEN*, is connected to an interrupt input of the processor (2C8). When the head is unlatched light from D1 saturates Q1. Q1's collector drops to a few tenths of a volt driving HDOPEN* LOW. R67 provides some positive feedback to eliminate switching noise.

The label taken sensor, as shown in FIG. 39, consists of a phototransistor facing an IR LED. They are mounted just outside the tear off bar so that a dispensed label breaks the light beam. The sensor connects to J5 (5B1). The NPN phototransistor is connected with the collector at Vcc and emitter to R64. The signal is applied to comparator V22C (5B3). The comparator's reference is set to 2.5 V by R59 and R60. The comparator output, LBLTKN, is applied to an input of the processor (2B8). When a label is dispensed the light beam is broken turning the phototransistor OFF. The emitter voltage is less than 1 V. As the label is removed the phototransistor turns ON forcing LBLTKN HIGH. R66 provides positive feedback to eliminate switching noise.

The serial port configuration and other operating modes are set by an 8-position DIP switch next to the DB-25 connector. The processor reads the switch setting as a serial bit stream from the parallel-in/serial-out shift register V20. The serial switch data (DIPDAT) and shift clock (DIPCLK) are driven by the processor (2D8). The DIP switch shifter shares the I/O pins with the LED display shifter. Because the DIP switch is read only at power-on no conflicts arise.

The front panel board contains 8 LEDs and 4 pushbutton switches. It connects to the logic board via 10 conductor ribbon cable. The pushbuttons (5D5) are connected to individual polled inputs on the processor (2C8). The LEDs are driven by a serial-in/parallel-out shift register U34. The serial LED data (LEDDAT) and shift clock (LEDCLK) are driven by the processor (2D8).

Figures 40, 40A:
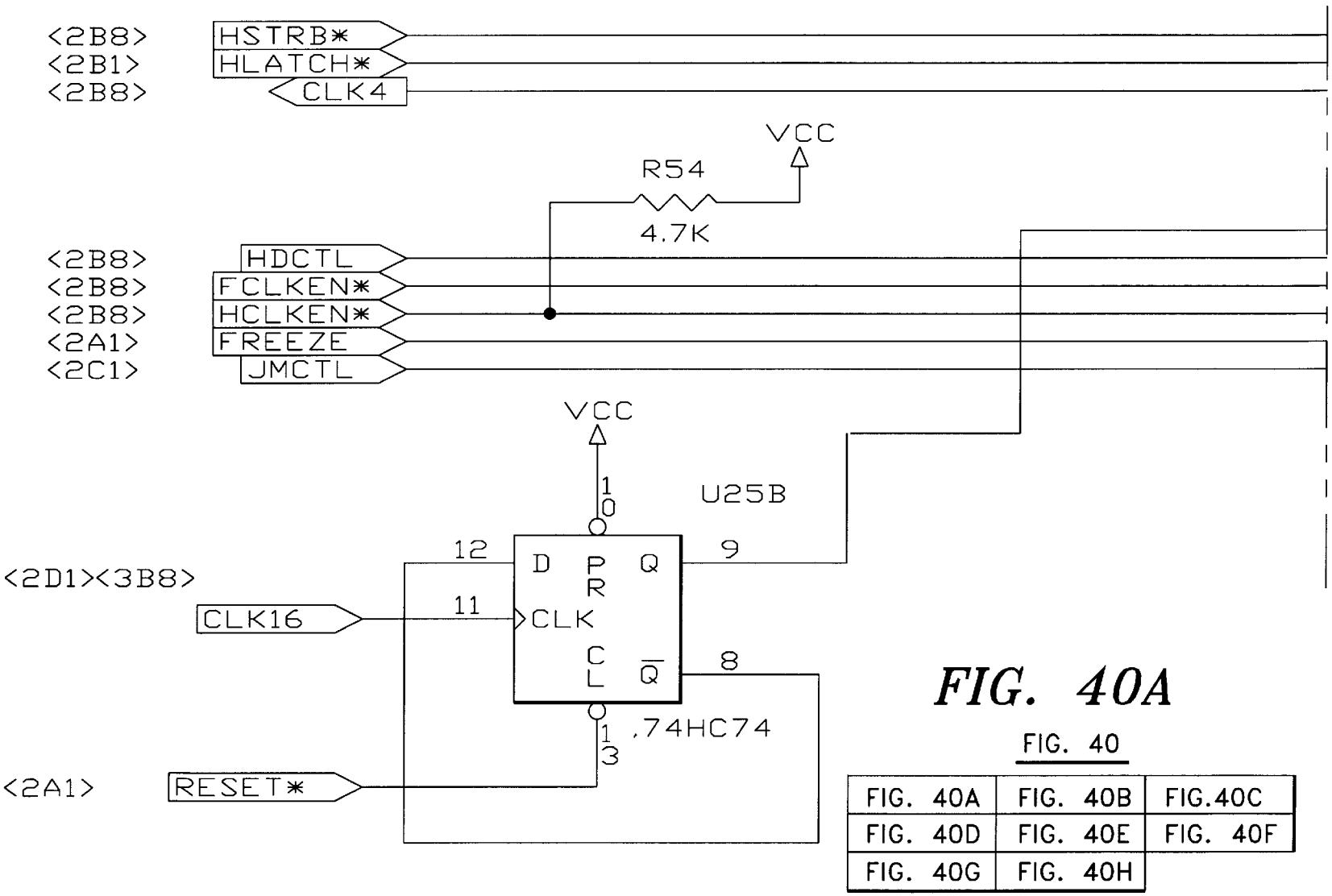
Figure 40B:
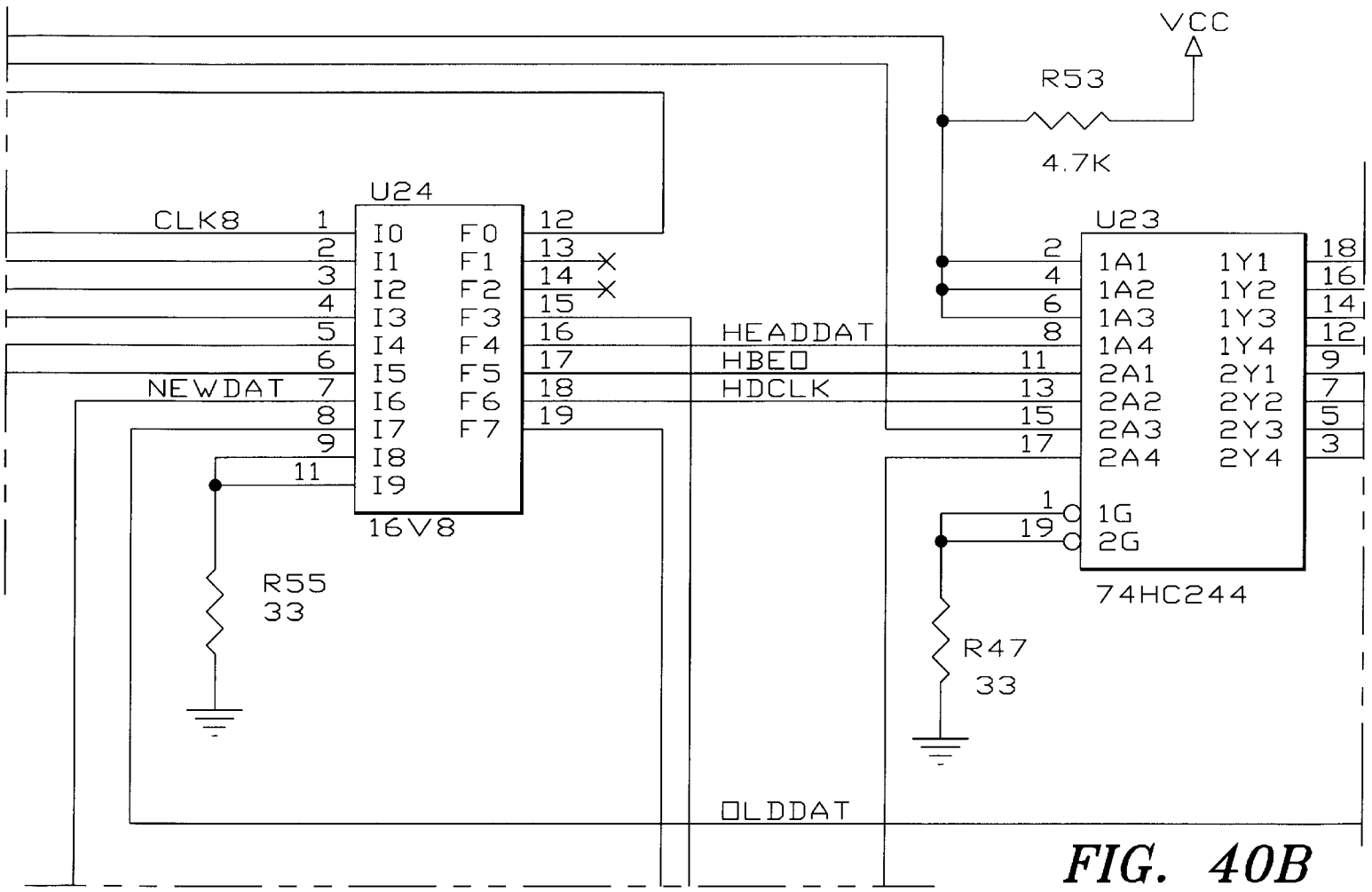
Figure 40C:
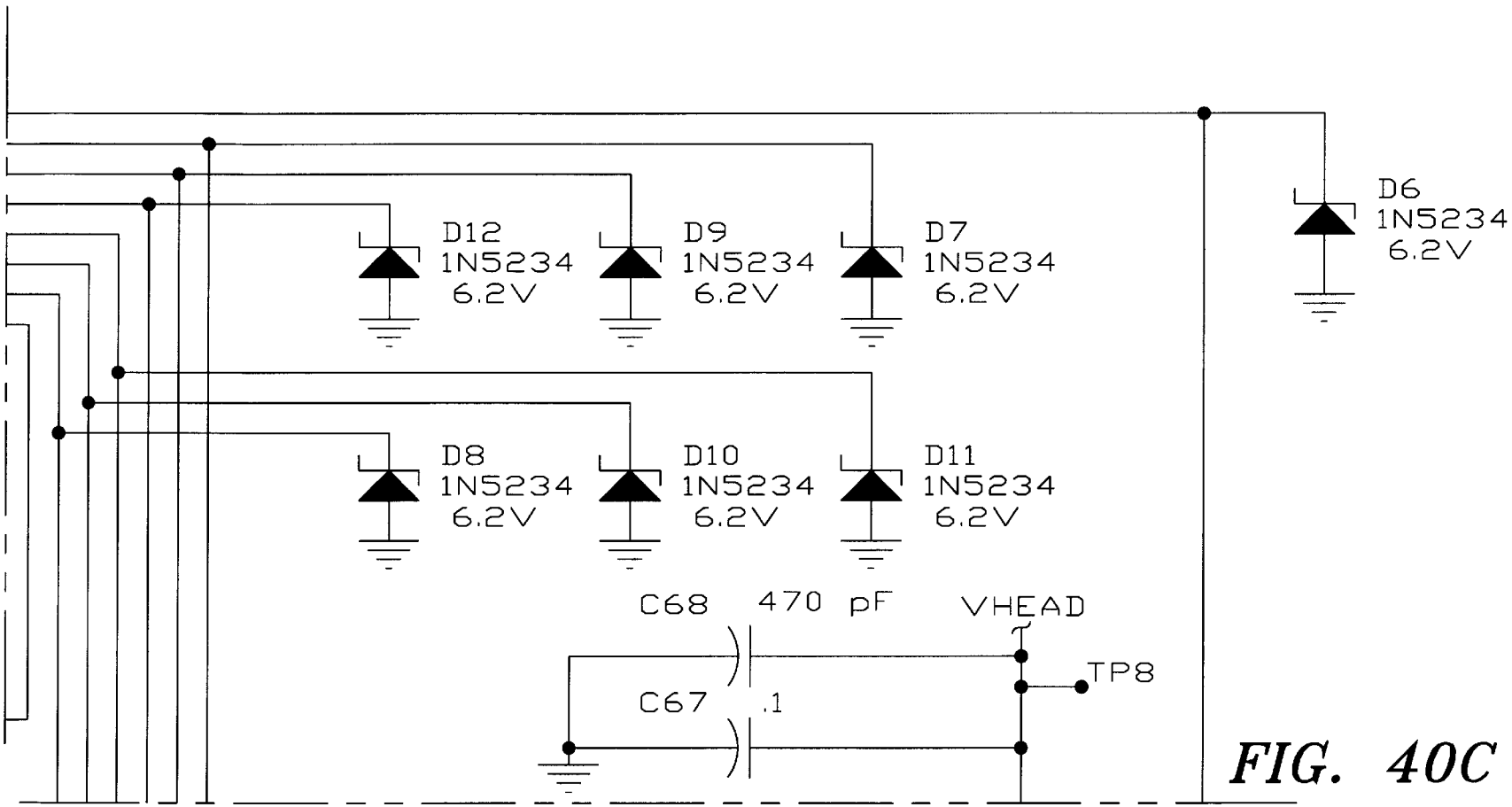
Figure 40D:
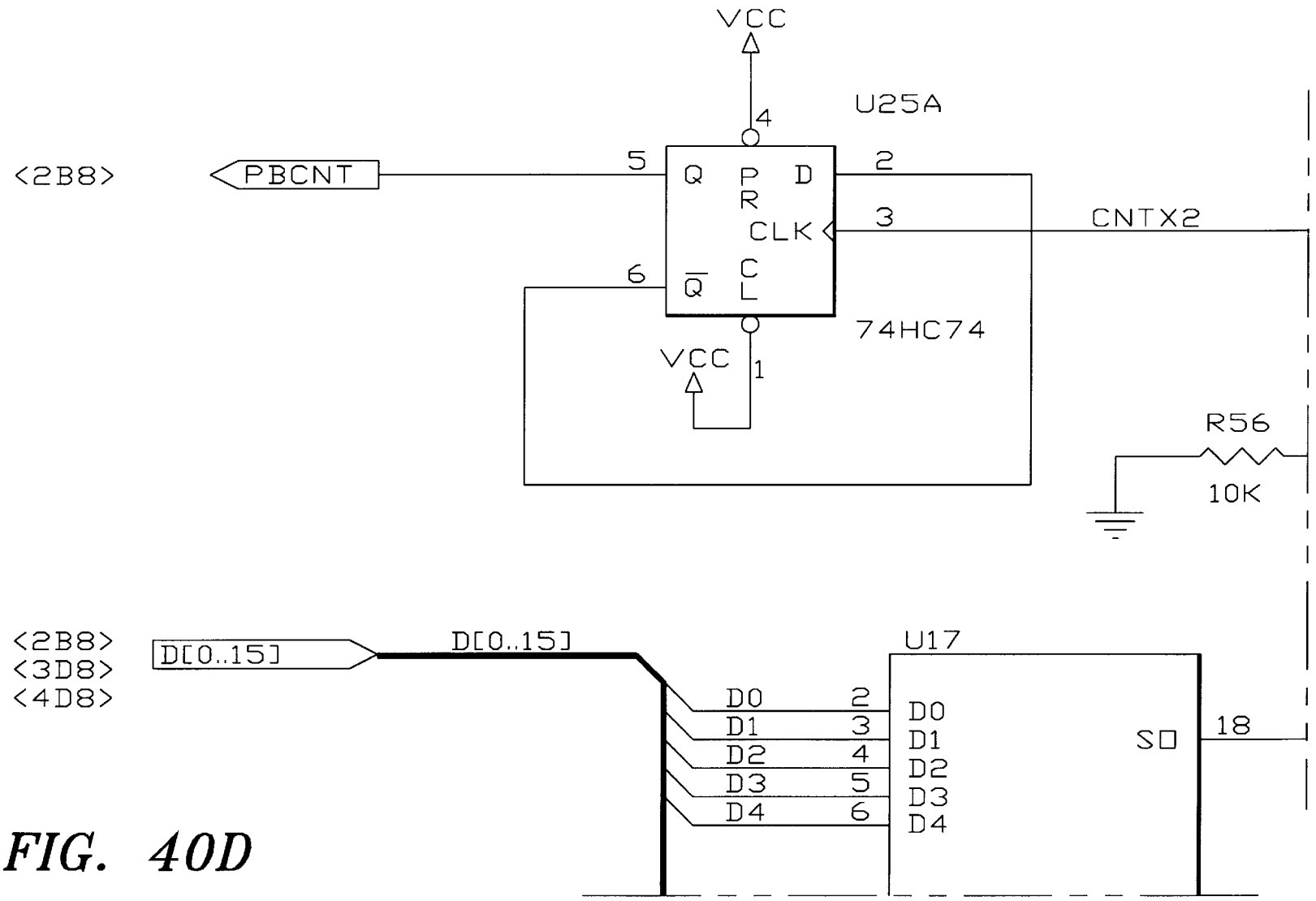
Figure 40E:
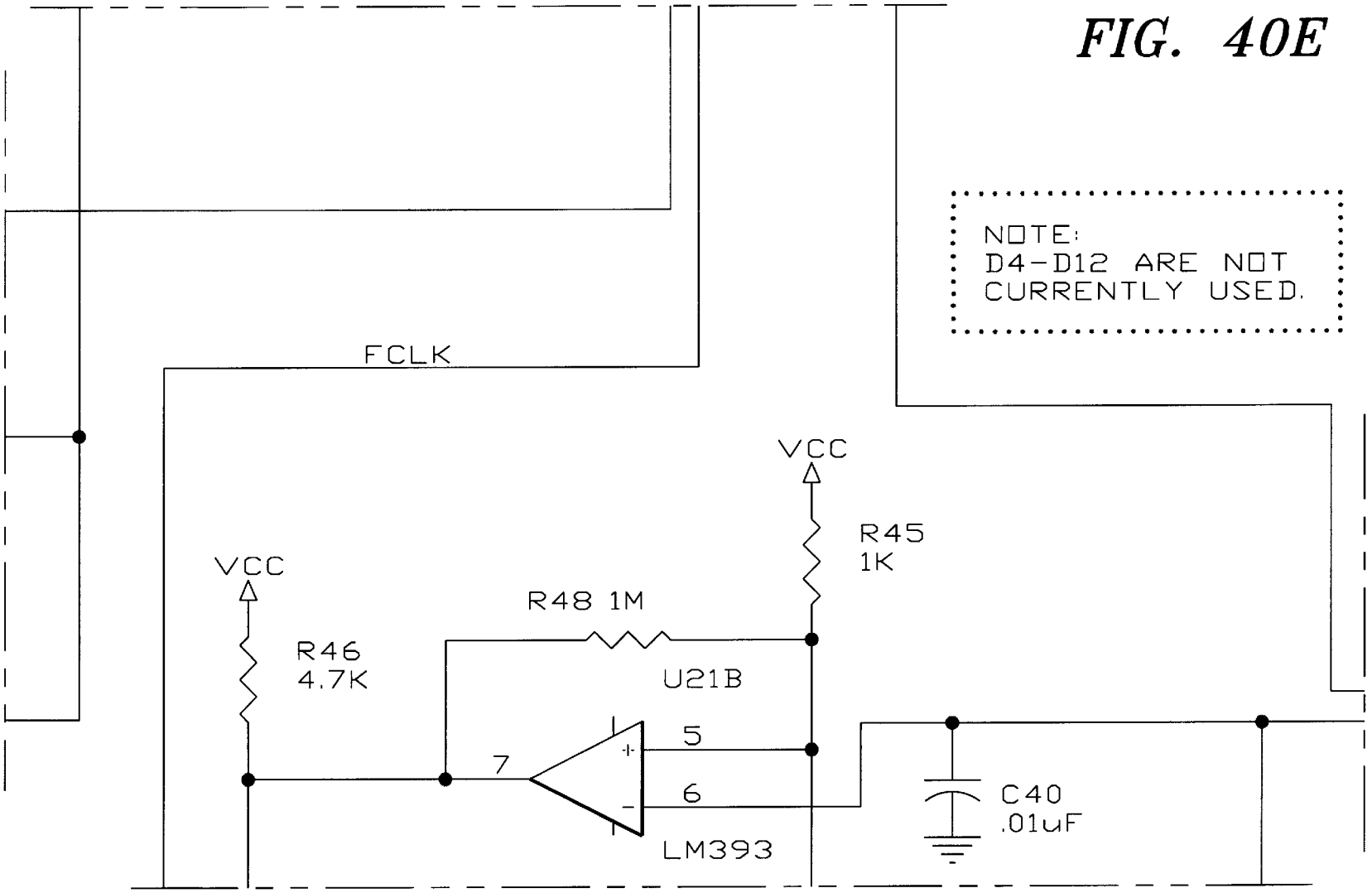
Figure 40F:
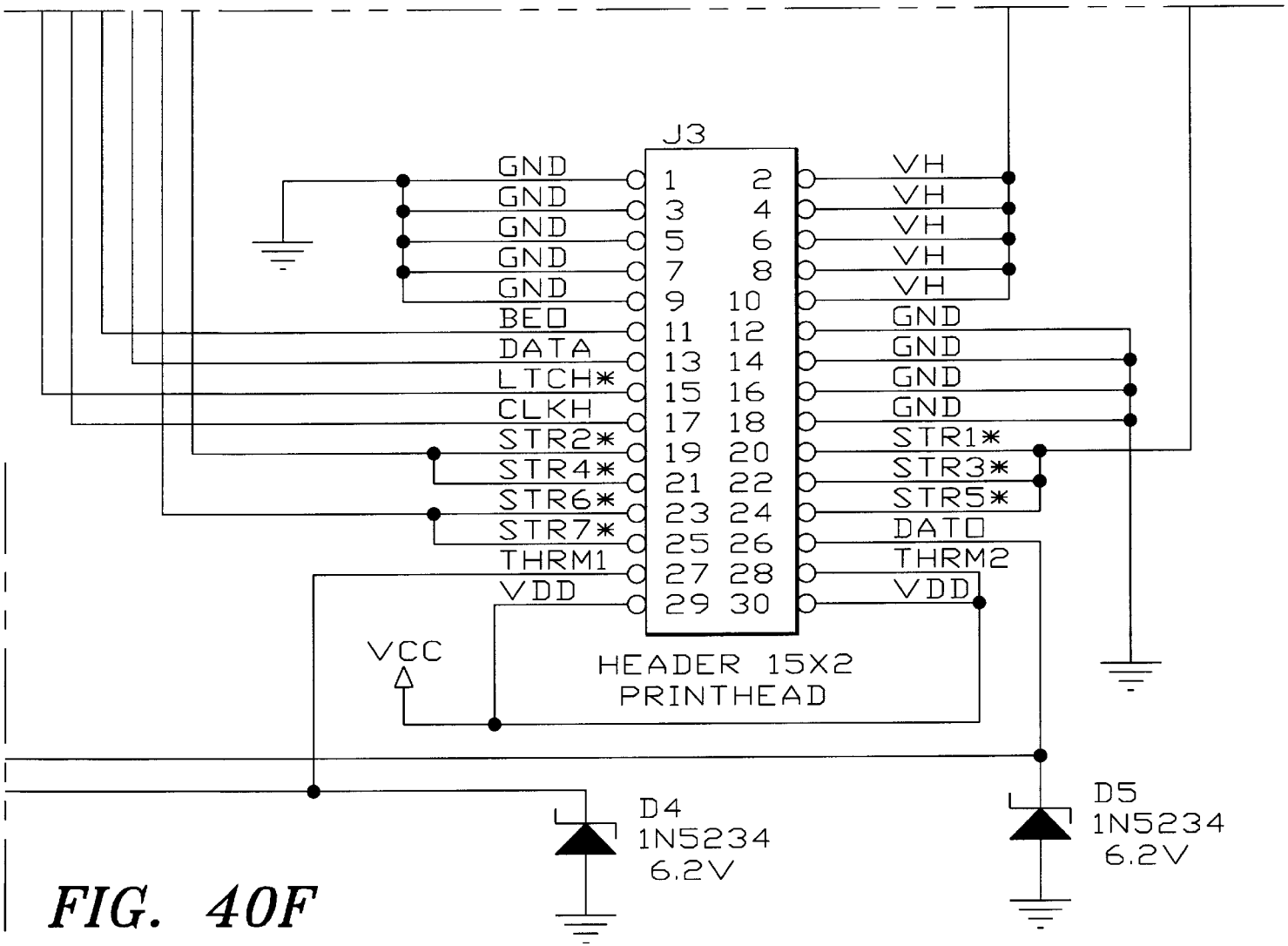
Figure 40G:
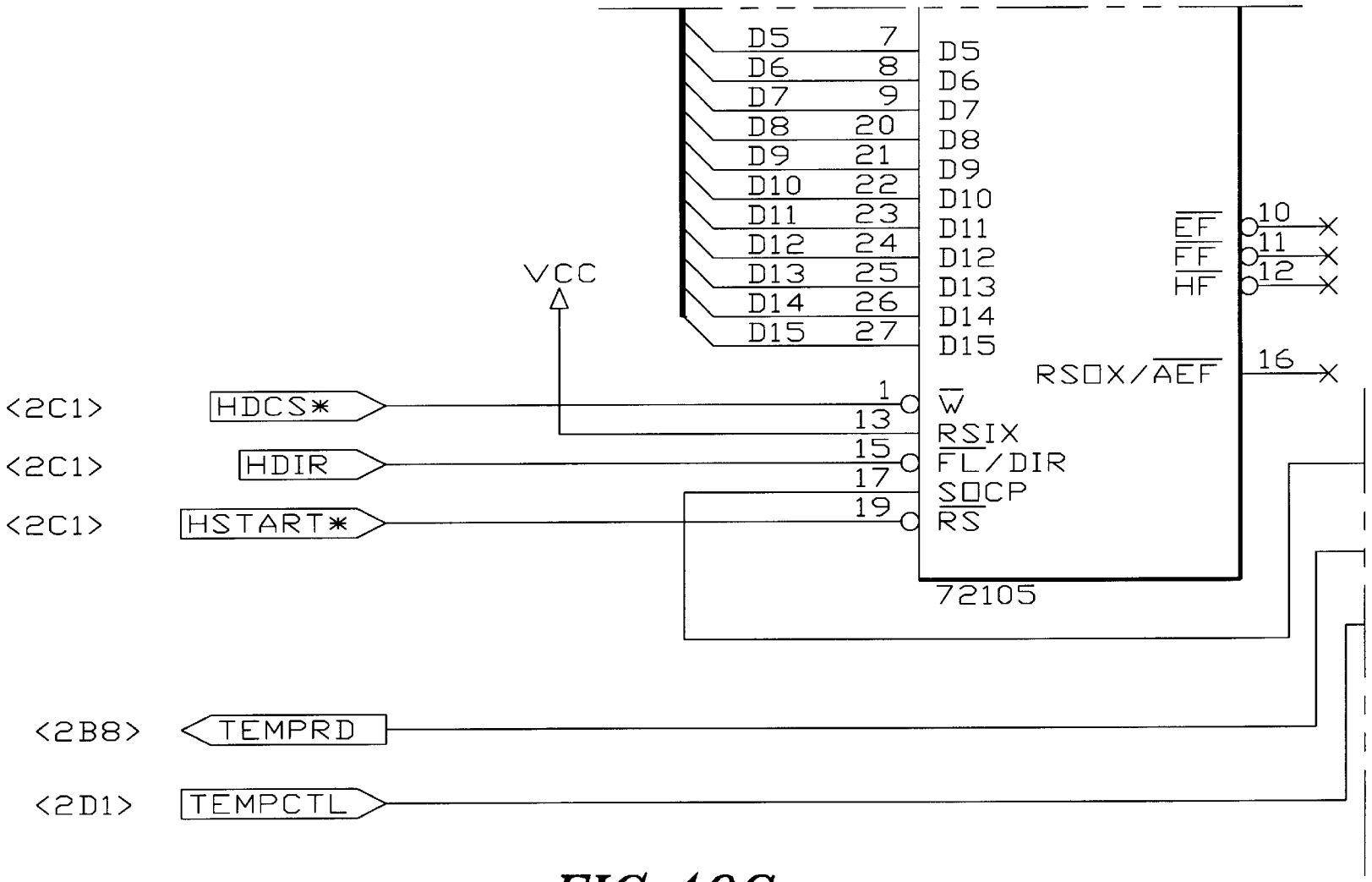
Figure 40H:
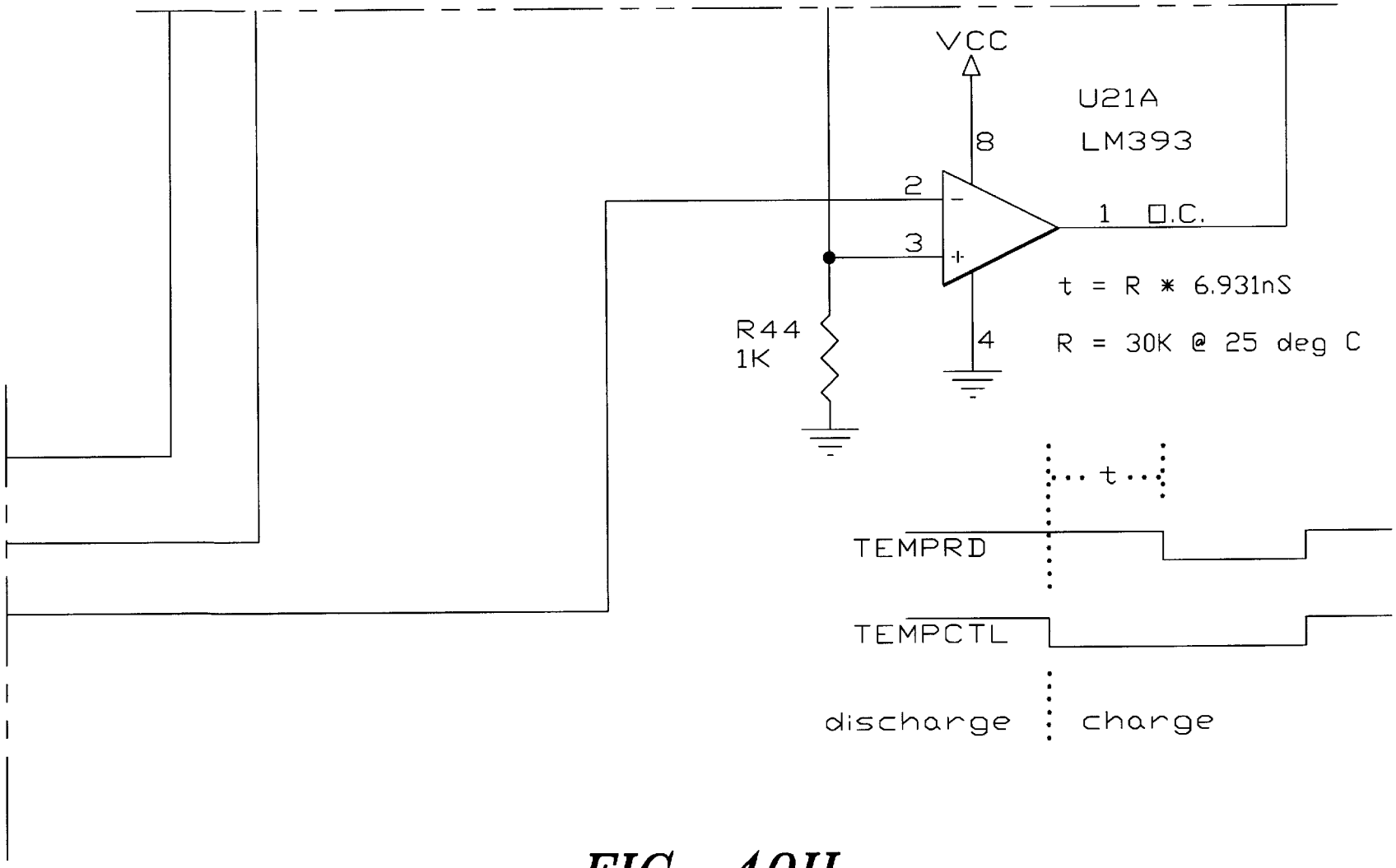

Turning now to FIG. 40, the printhead drive circuitry consists of a FIFO (U17) to serialize the data, a GAL (U24) and flip-flop (U25) for control and a buffer (U23) to drive the head lines. The head cable mates to J3.

The printhead load and strobe cycle is synchronized to each half-step of the motor. Two half-steps are performed for each print line. Therefore, the printhead is loaded and strobed twice per print line.

At the start of a load cycle U17 (6B6) is loaded with 52 words of print data (832 bits) through it's parallel port. HDCTL (6D8) is set LOW for the first load cycle. FCLKEN* is set LOW followed one clock later by HCLKEN*. Printhead data (NEWDAT) is shifted out of U17 and combined with previous data from the head (OLDDAT). The data streams are combined in U23 (6D5) and sent to the printhead (HEADDAT) along with the shift clock (HDCLK) via U23 (6D4). The latch line (HLATCH*) is pulsed LOW followed by the print strobe (HSTRB*). The length of HSTRB* determines the darkness of the print. The entire process is repeated for the second half-step except HDCTL is held HIGH causing HEADDAT to be processed differently.

Timing is controlled by counters in the processor. The counters operate from a 4 MHz clock CLK4 (6d8). The 16 MHz clock (CLK16) is divided by two by U25B (6C7) to make CLK8. U24 further divides CLK8 to make CLK4.

The processor compensates forhead and supply losses when many dots are fired in a line. The head data is applied to a 1-bit counter in U24. Each count at the output, CNTX2, represents two dots turned ON. CNTX2 is divided by two again in U25A to make PBCNT which is applied to a counter in the processor (2B8). The processor adjusts the HSTRB* pulse according to the count accumulated during the head load.

The printhead heatsink temperature is sensed by a thermistor. The thermistor has a negative temperature coefficient with a resistance of 30 KOhms at 25 degrees Celsius. The temperature of the heat sink is determined by measuring the time required to charge a capacitor through the thermistor resistance. The TEMPCTL (6A8) is normally HIGH which turns the open collector output of U21A ON (6A4). U21A keeps C40 discharged (OV). The processor starts a measurement by setting TEMPCTL LOW and activating an internal timer. U21A is turned OFF and C40 charges through the thermistor. The comparator U21B stops the processor timer when the voltage on C40 reaches 2.5 V. The processor reads the elapsed time and calculates the temperature. Higher temperatures yield shorter charge times.

Figures 41, 41A:
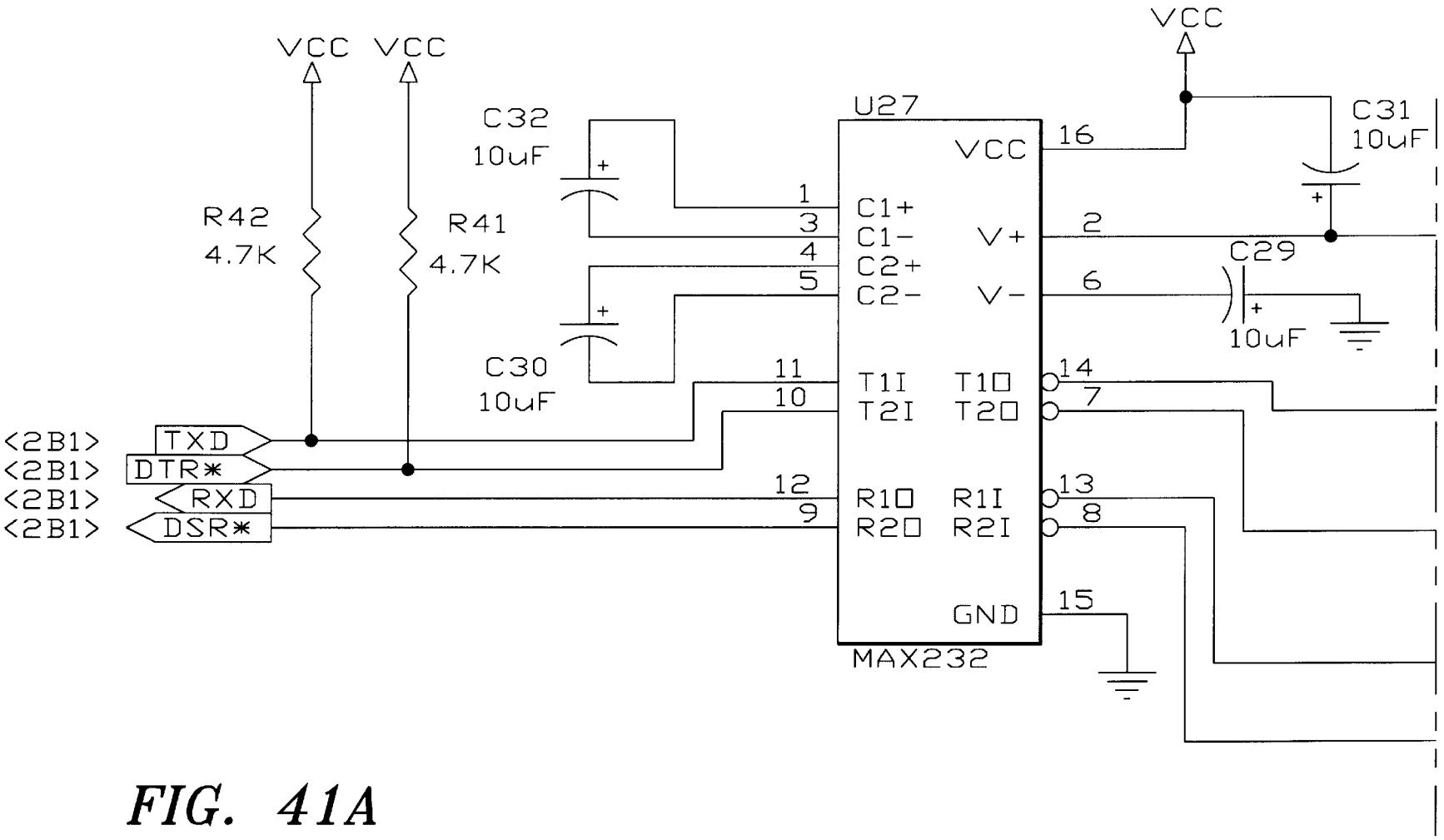
Figure 41B:
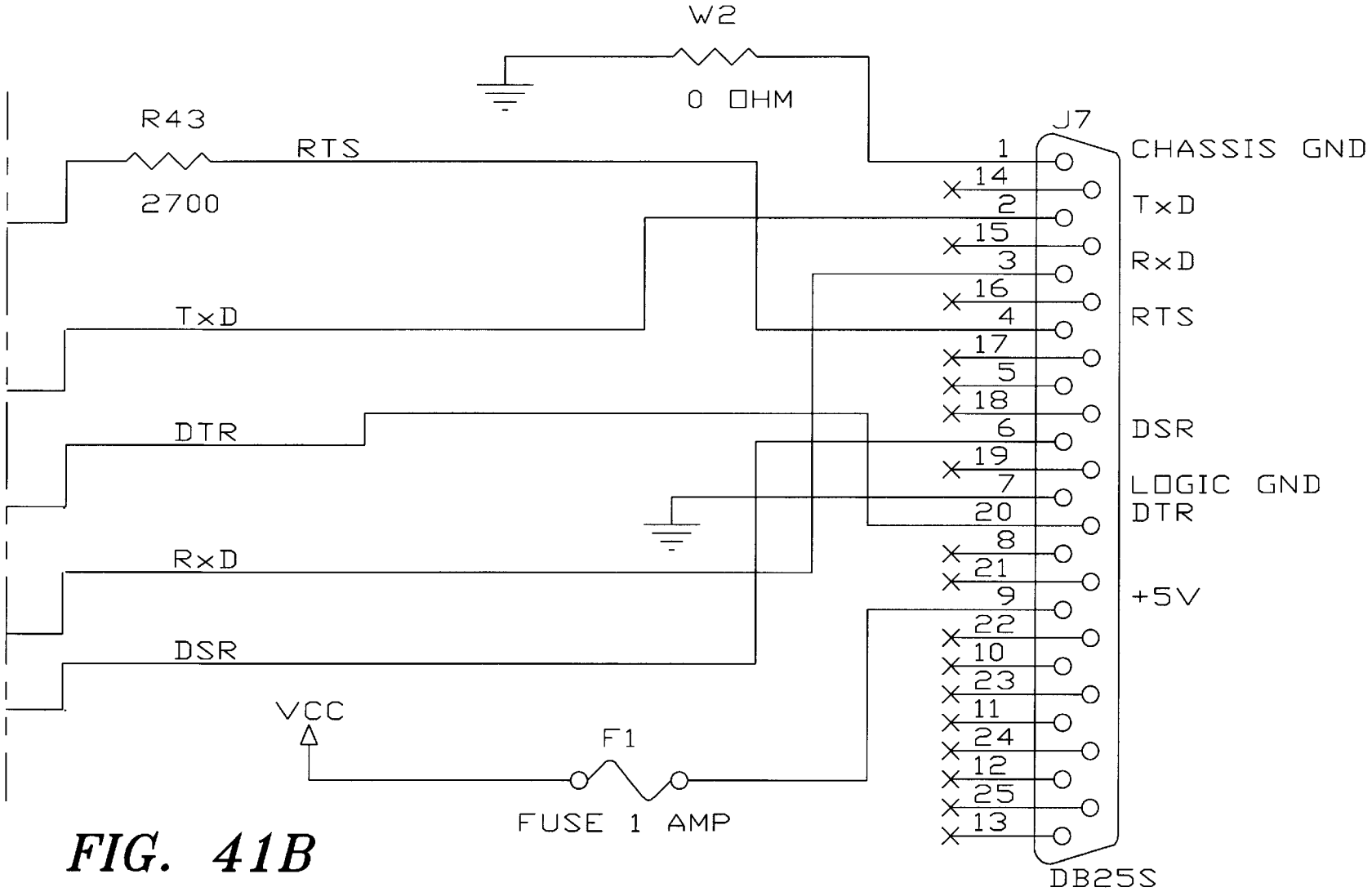

With reference to FIG. 41, the serial interface port is built into the processor. It provides a standard UART interface with hardware handshake at TTL signal levels. U27 converts the TTL signals to RS232 standards. The chip contains charge pumps to generate +/−10 v from the Vcc supply. R43 forces RTS to be active always. Hardware handshaking is controlled with DTR and DSR.

The sensors use a chopper-stabilized design that provides stability, wide operating range and resistance to ambient light. The sensitivity of the sensor is set by adjusting the LED light source. The adjustment is made through software control of a PWM (Pulse Width Modulation) signal from the processor. The PWM repetition, rate controls the chopping action while the duty cycle controls sensitivity. See FIG. 54.

The media and ribbon sensors are located on a separate PC board and are described hereinbelow.

The sensor amplifiers and detectors reside on the logic board and are described herein. Because the MEDIA and RIBBON circuits are similar, only the MEDIA circuit is treated.

Figures 42, 42A:
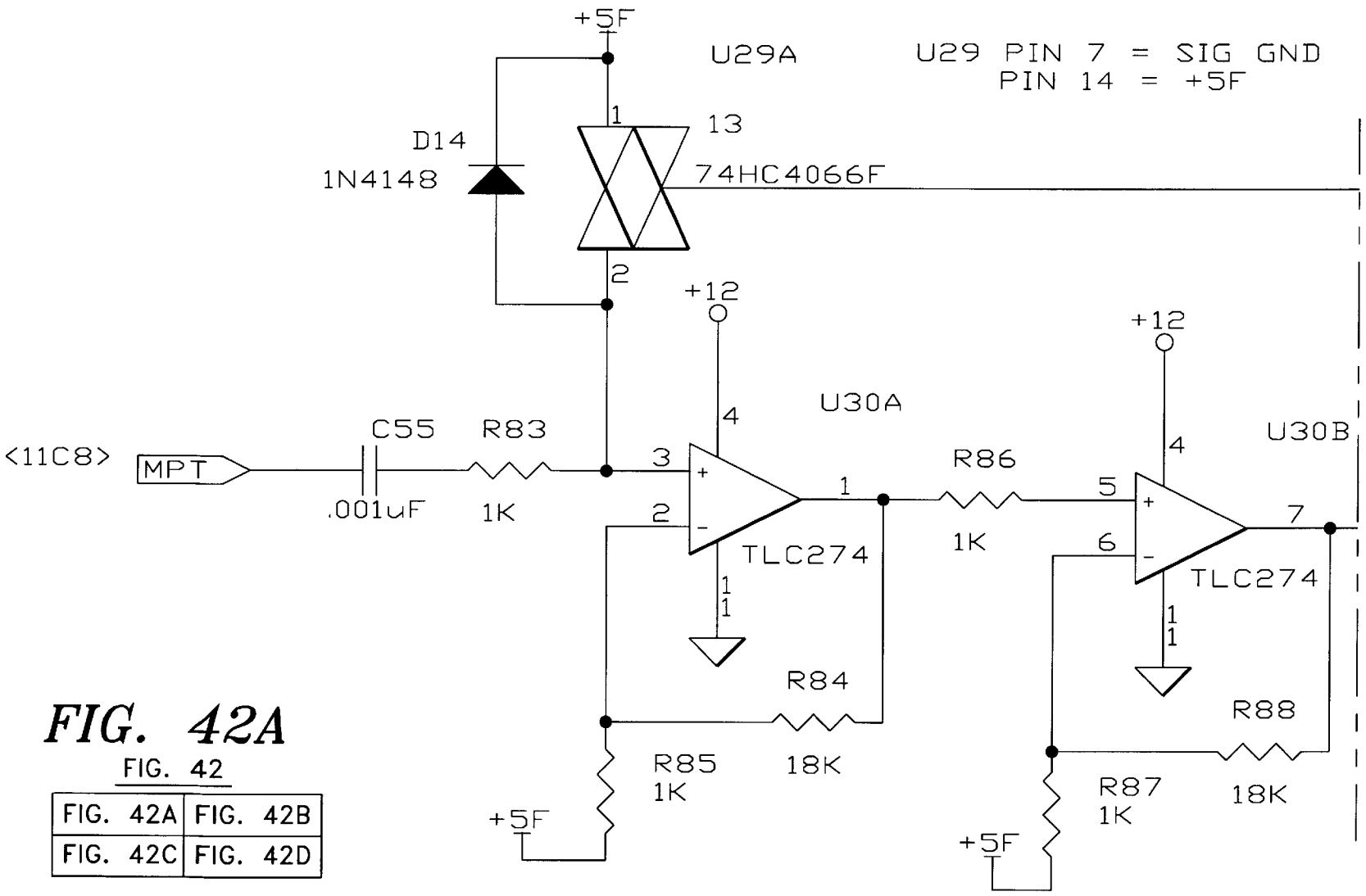
Figure 42B:
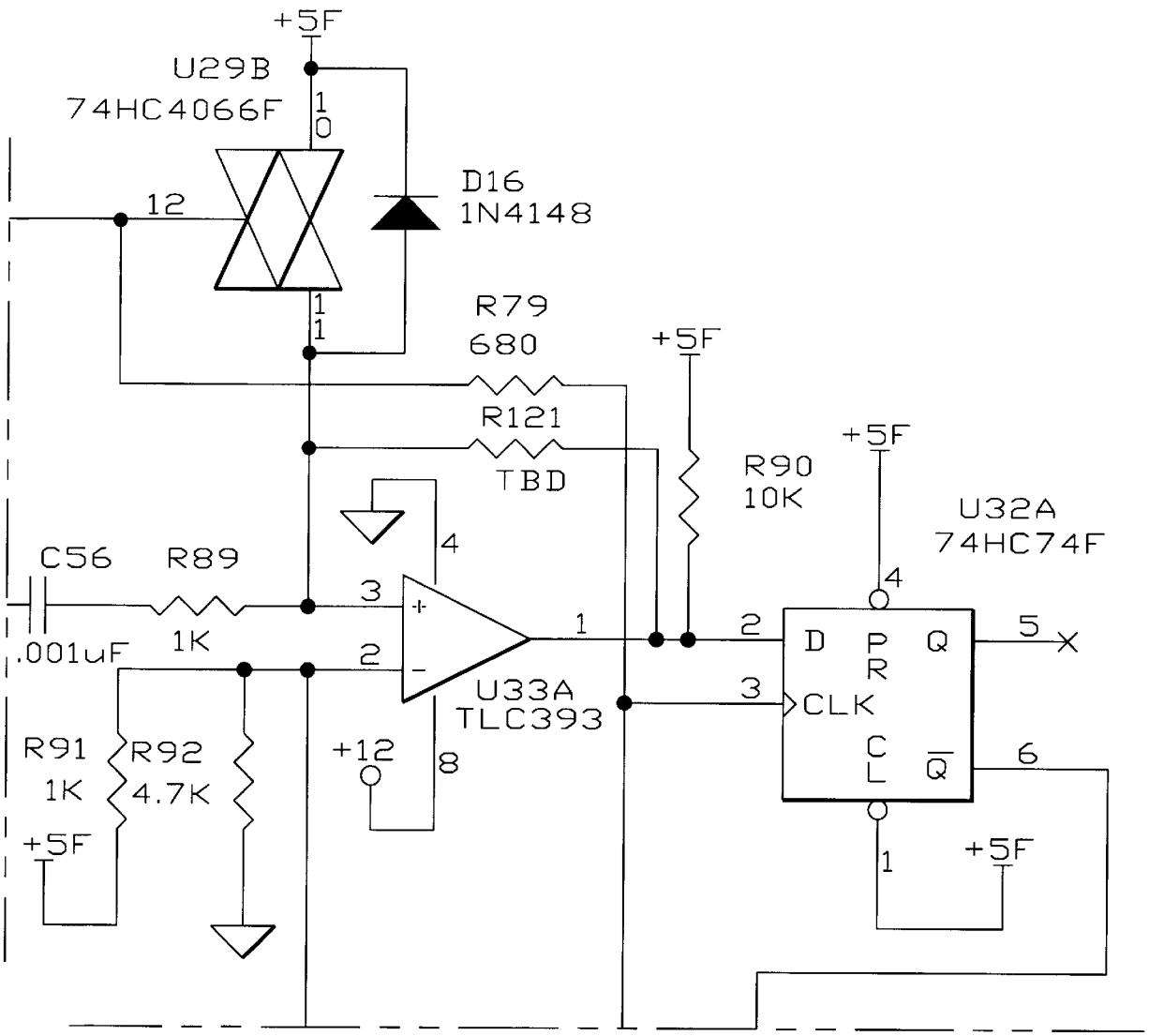
Figure 42C:
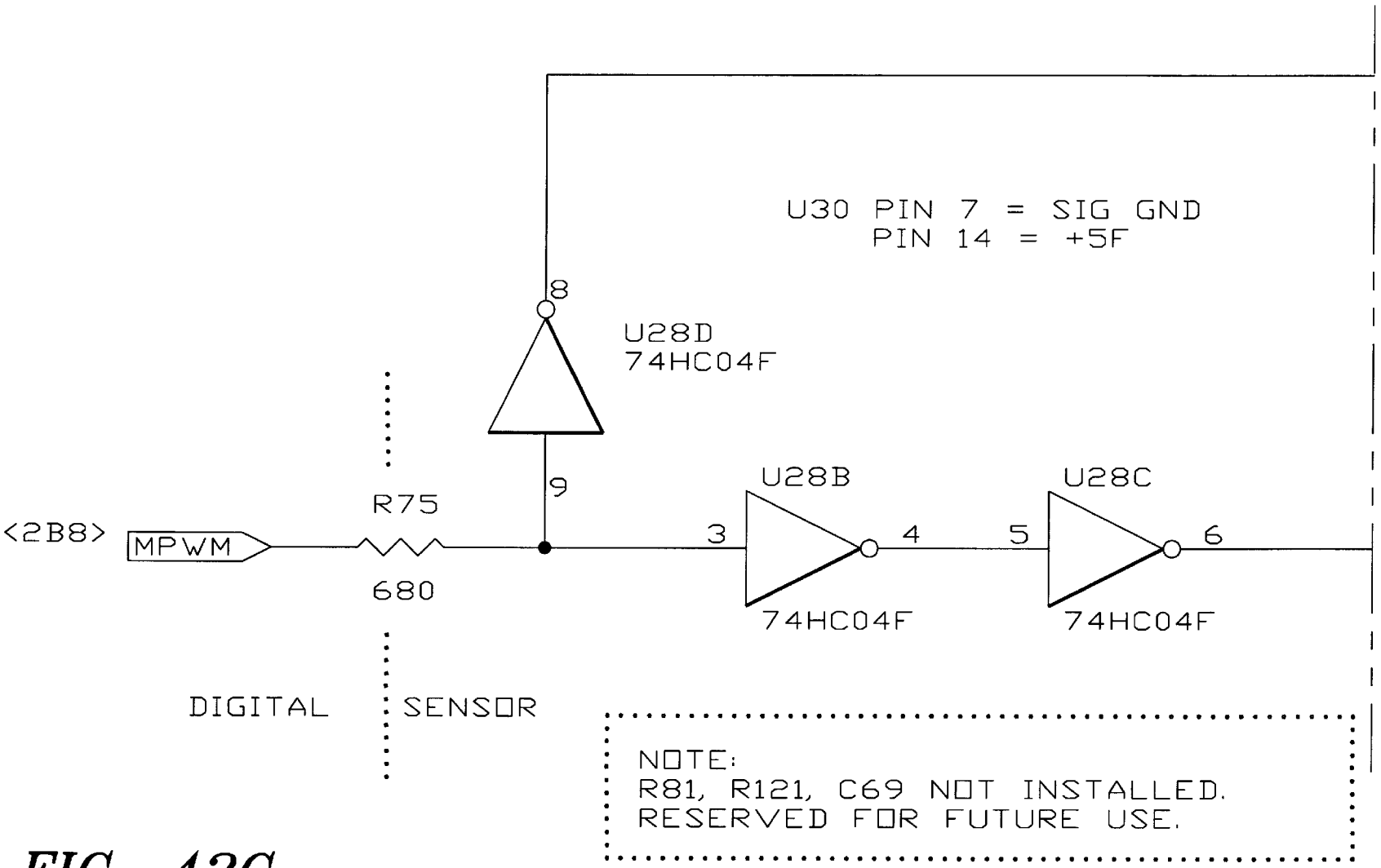
Figure 42D:
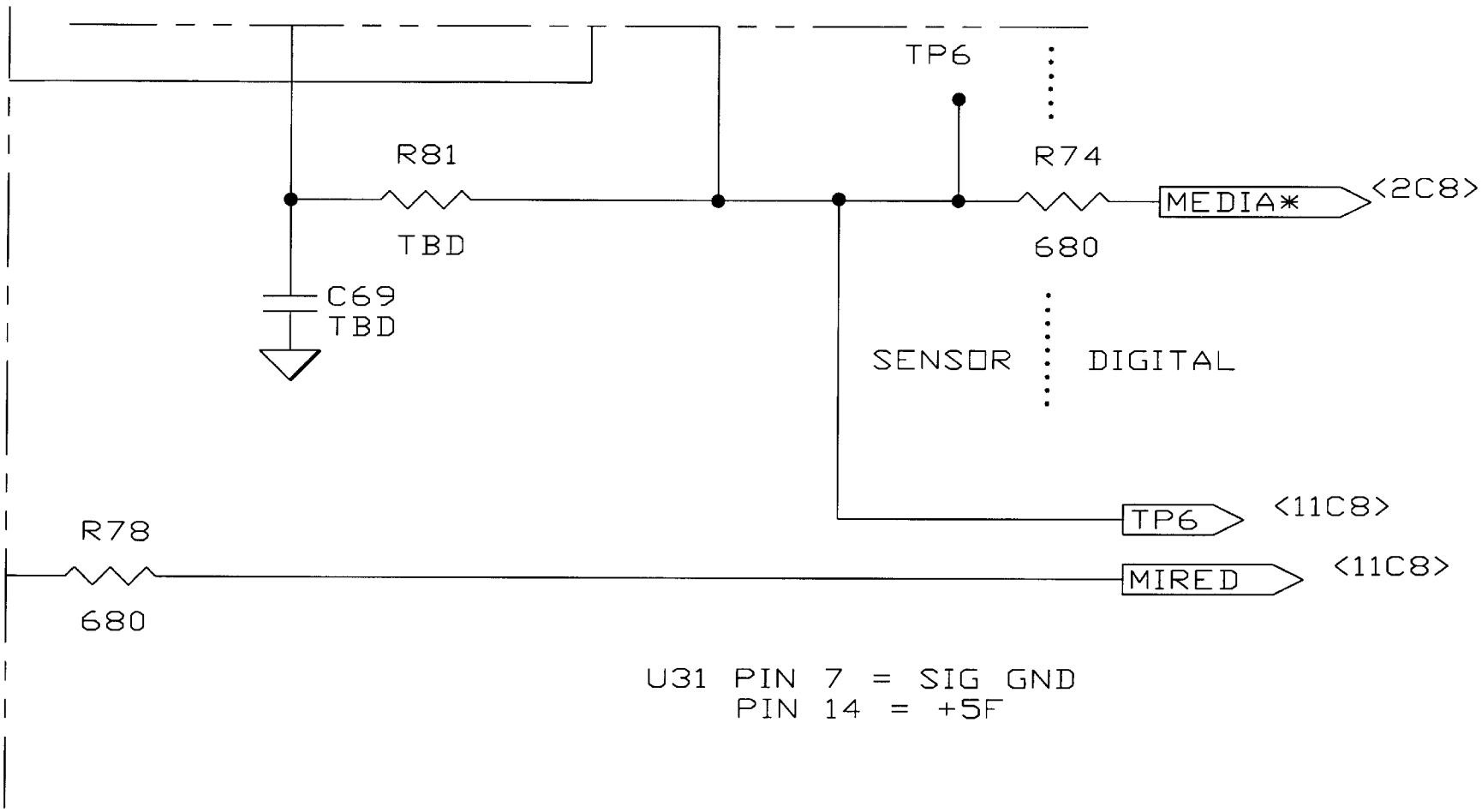
Figures 43, 43A:
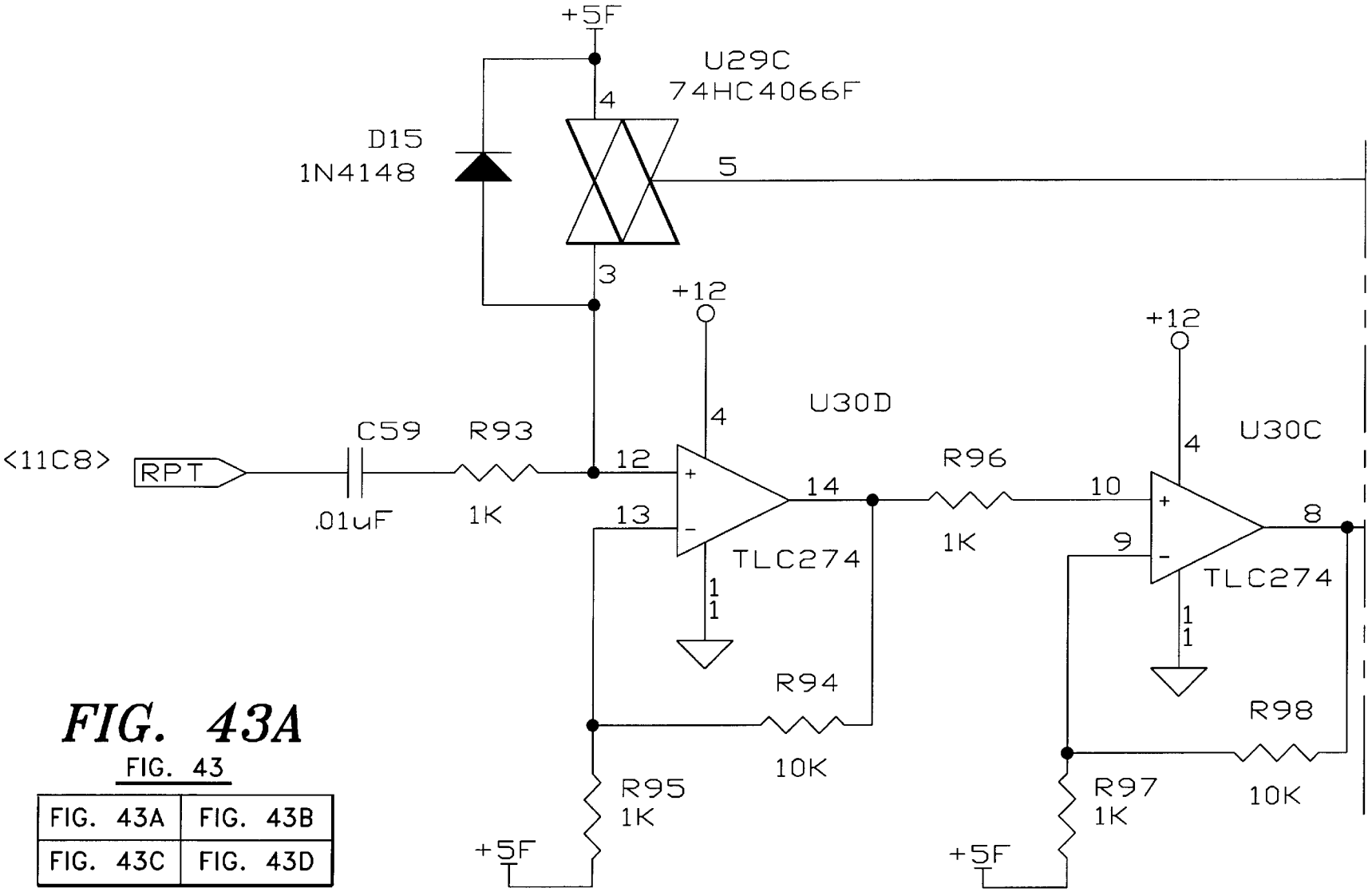
Figure 43B:
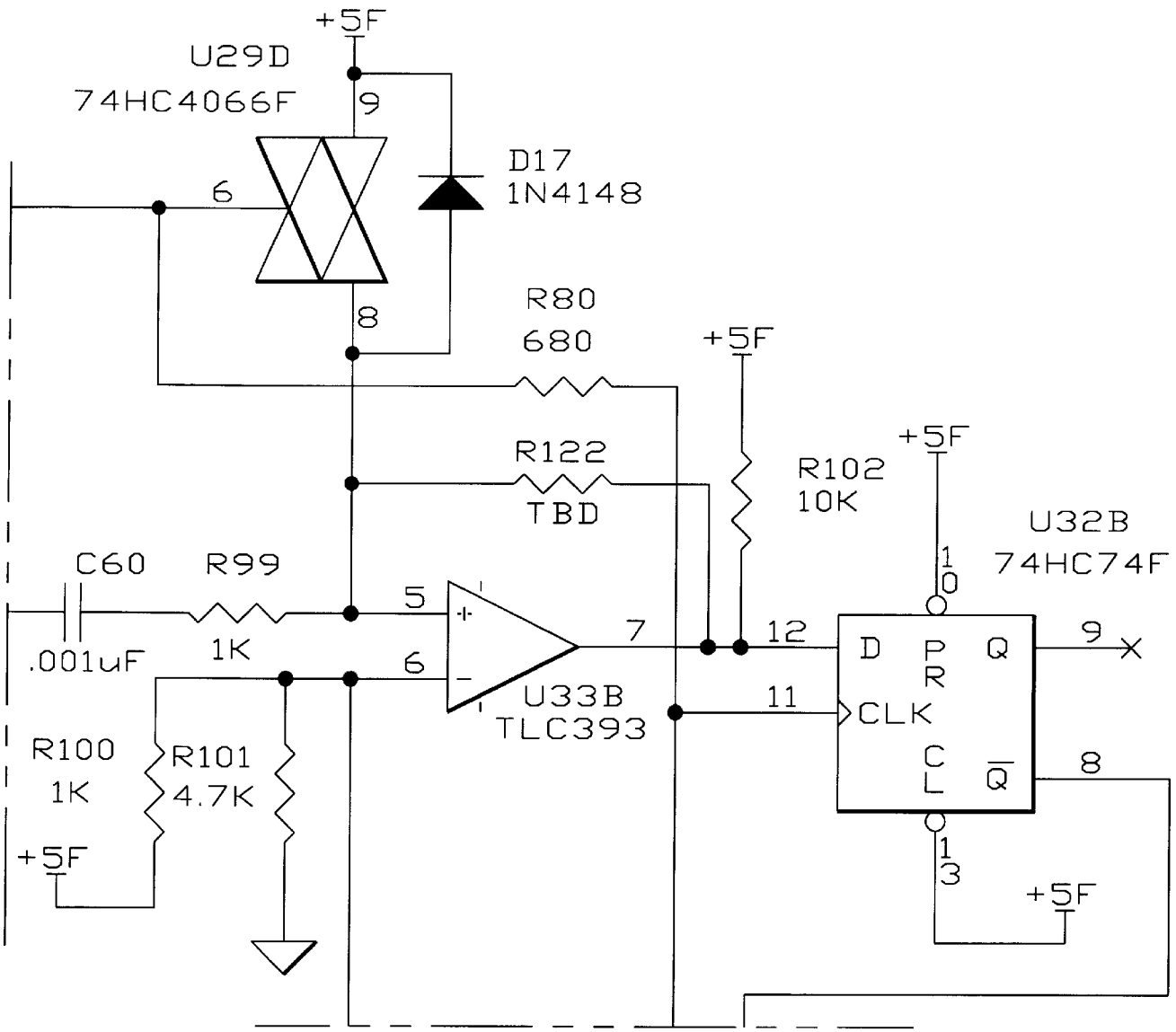
Figure 43C:
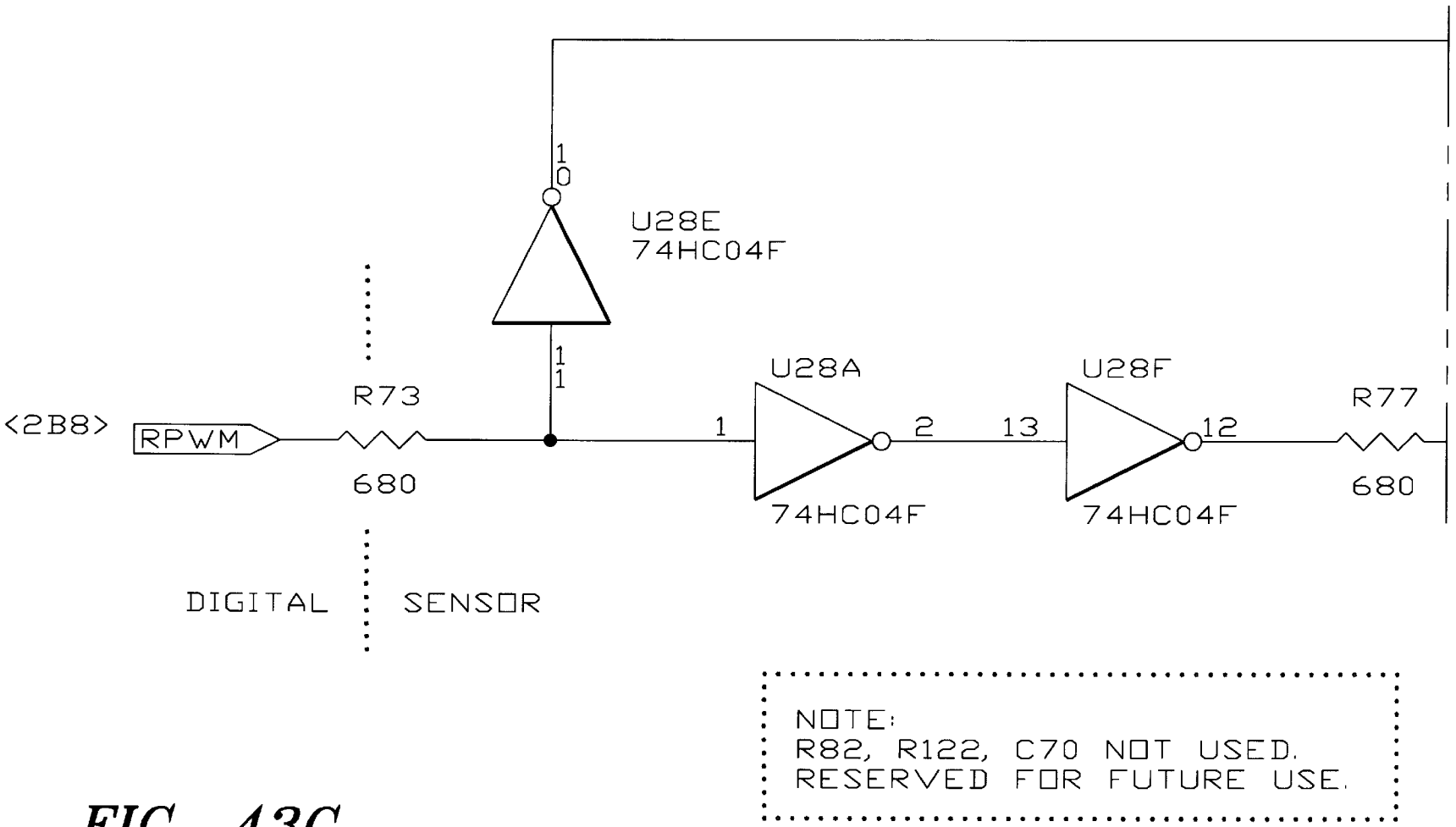
Figure 43D:
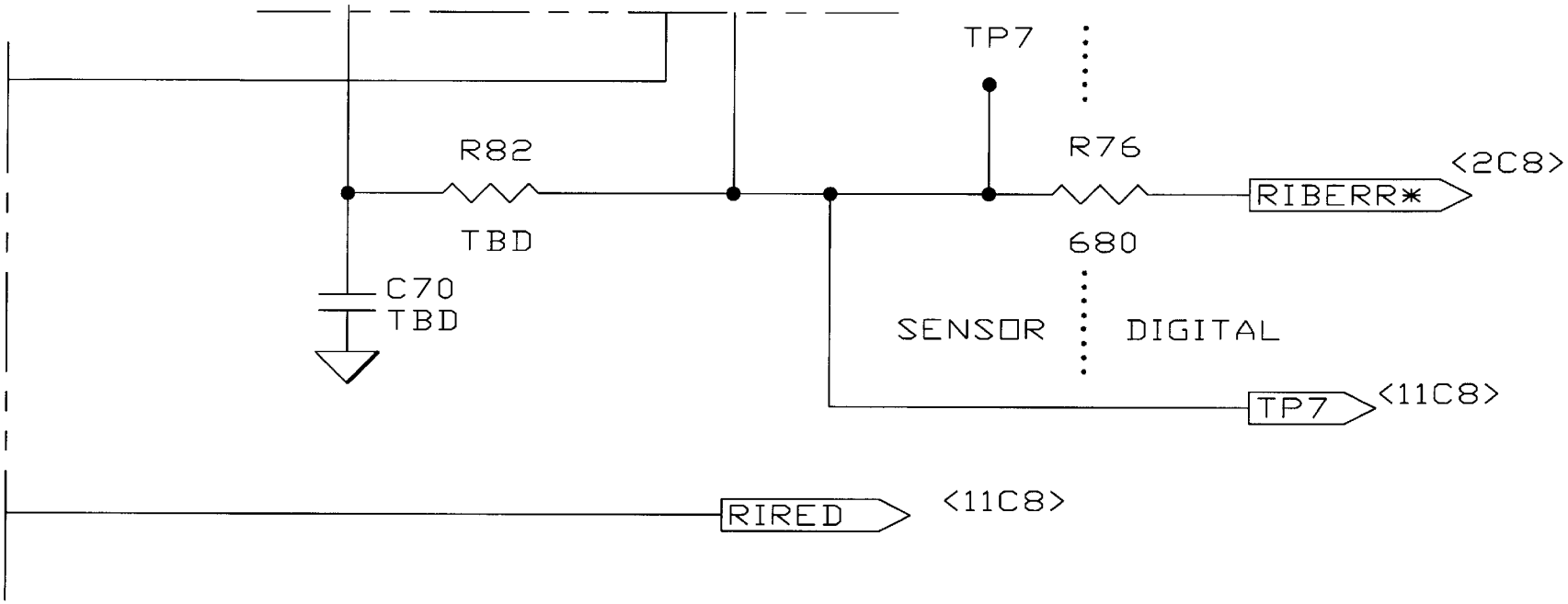
Figures 45, 45A, 45B, 45C, 45D, 45E, 45F:
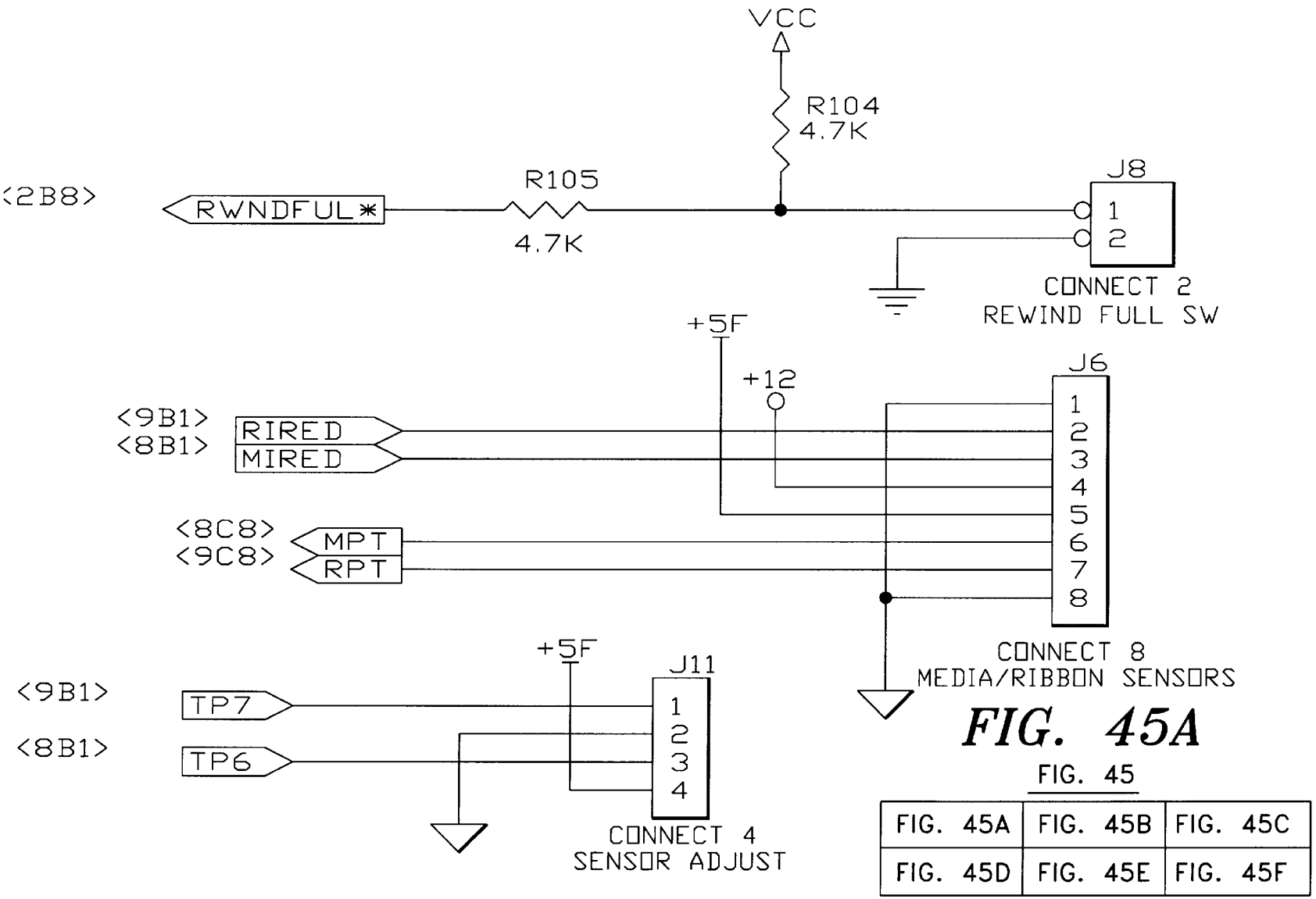
Figure 45B:
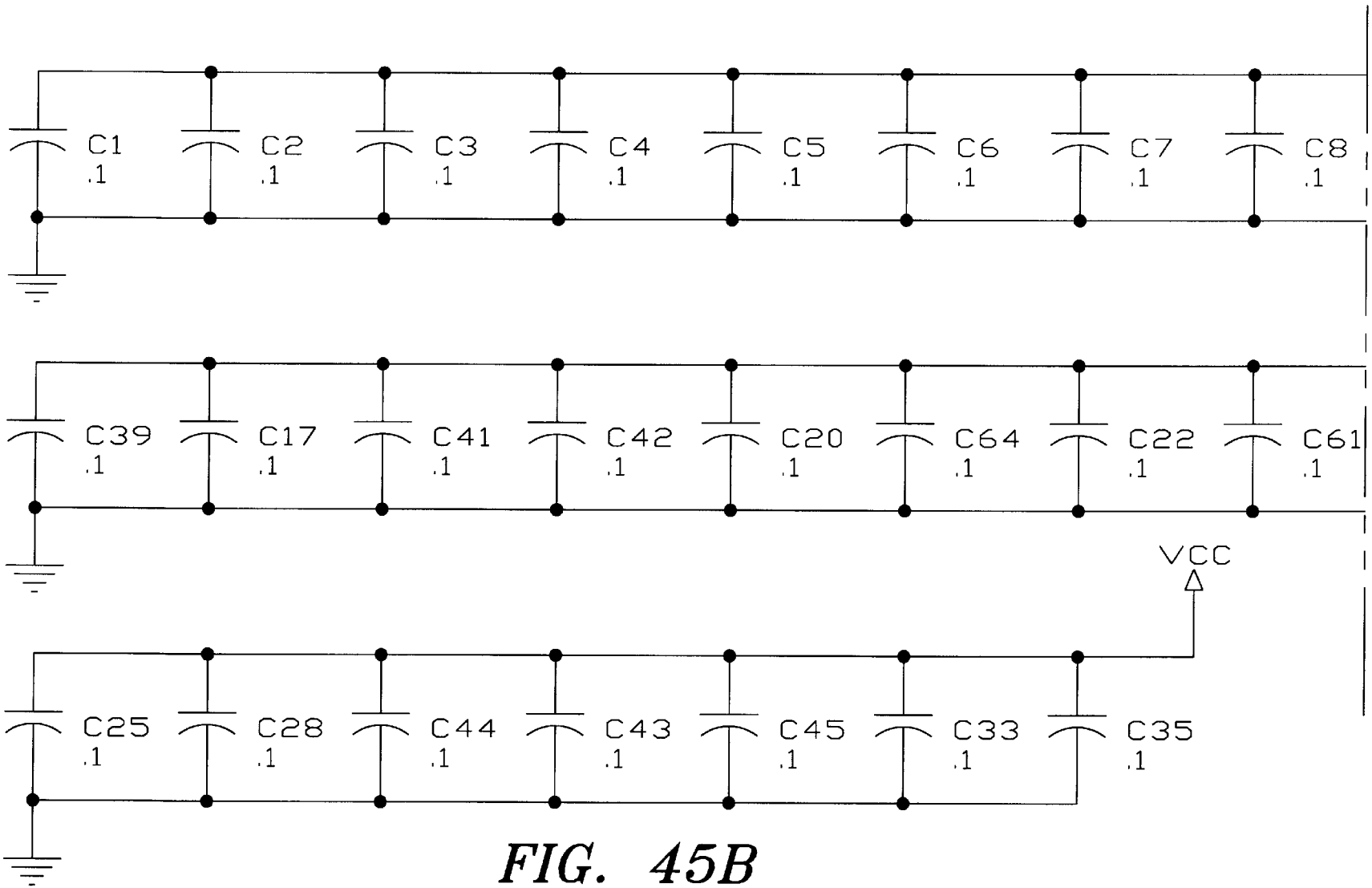
Figure 45C:
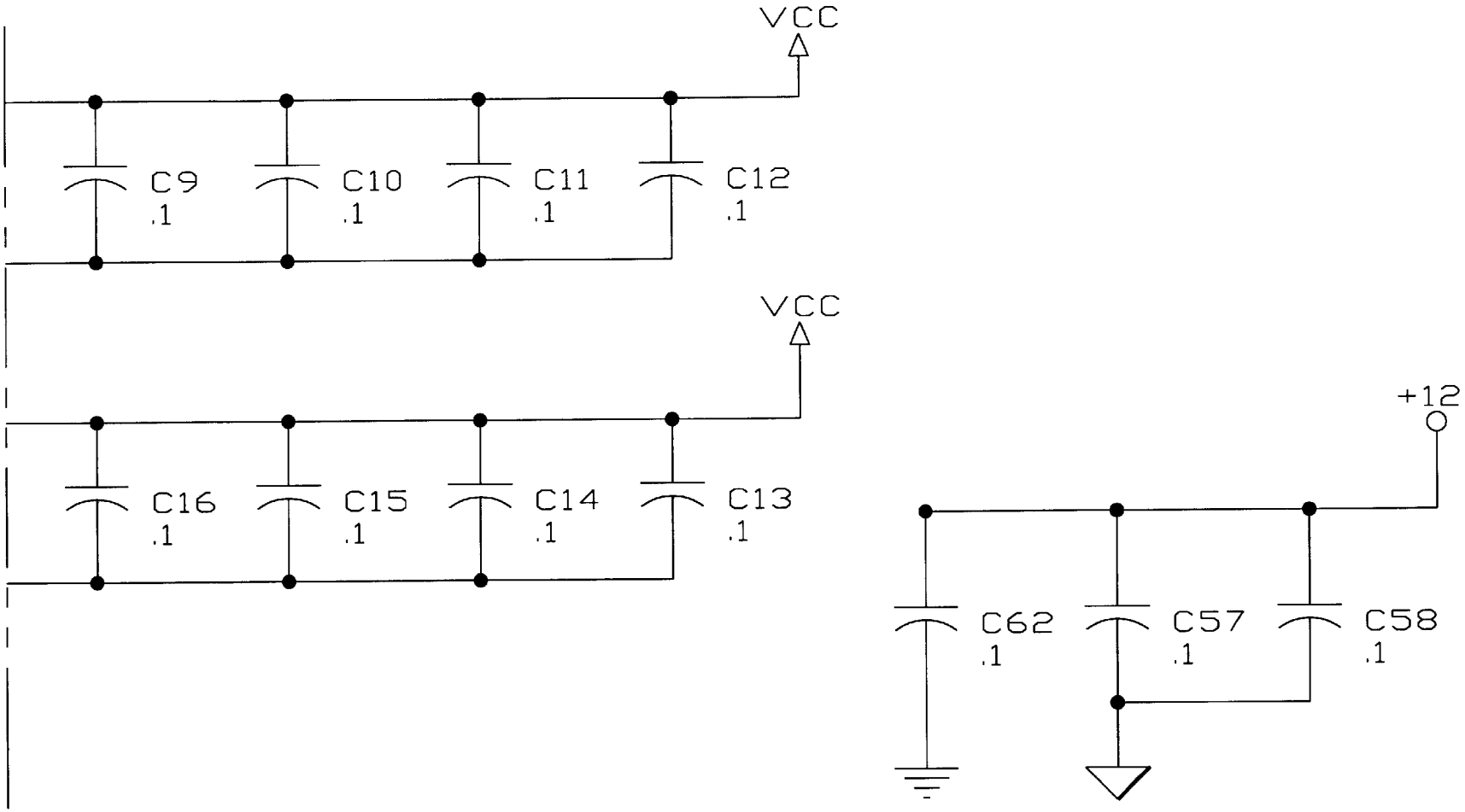
Figure 45D:
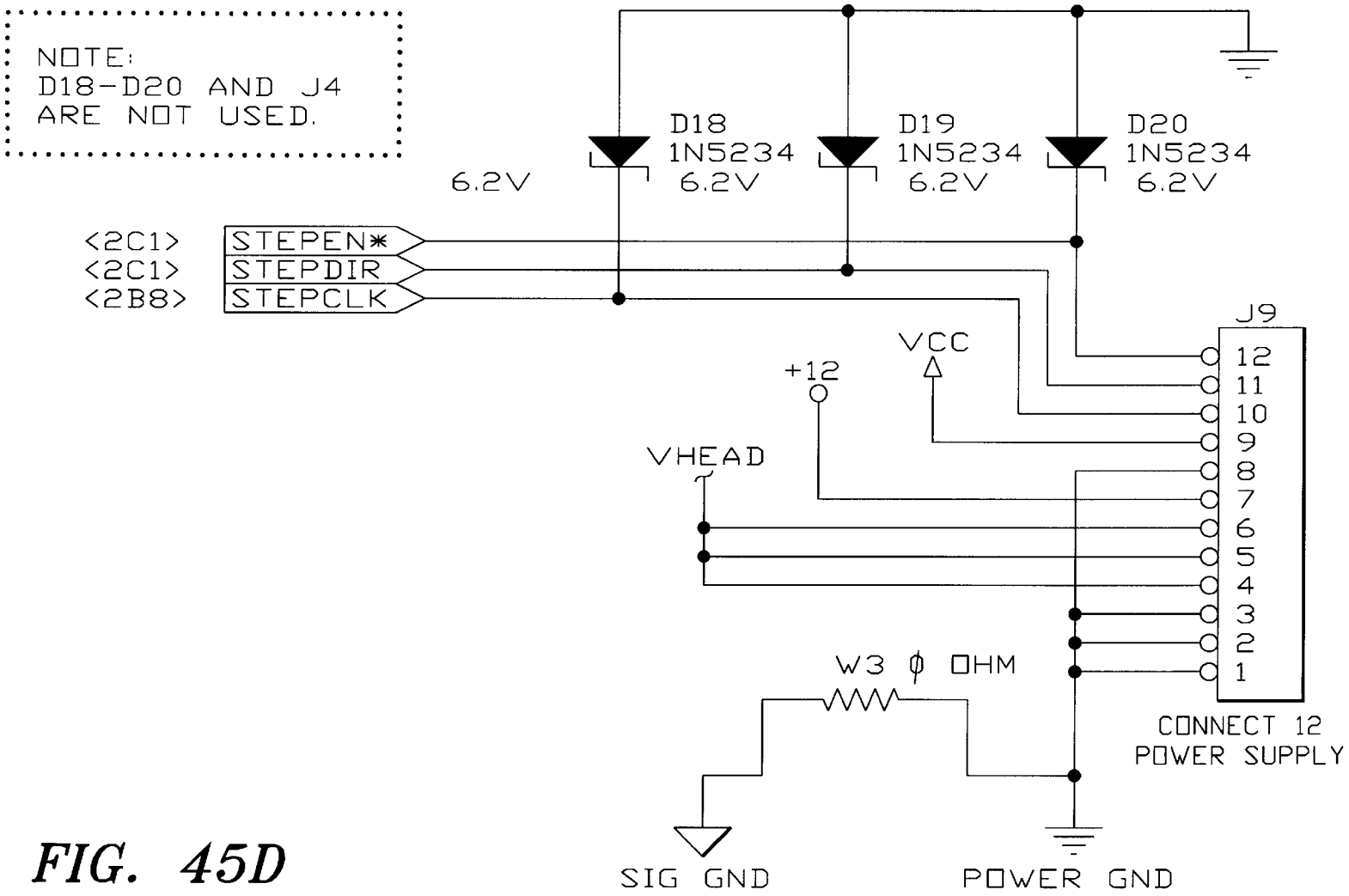
Figure 45E:
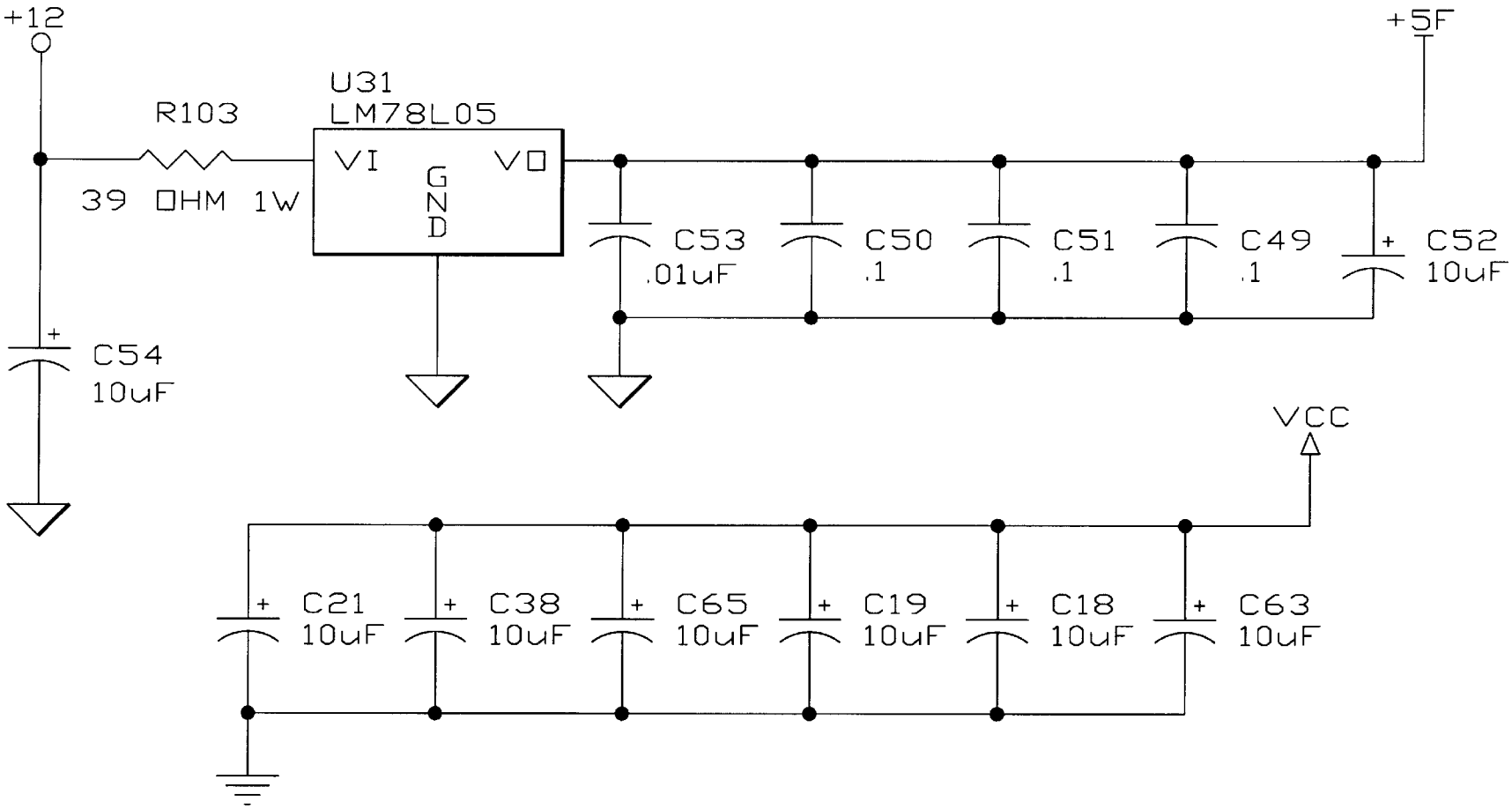
Figure 45F:
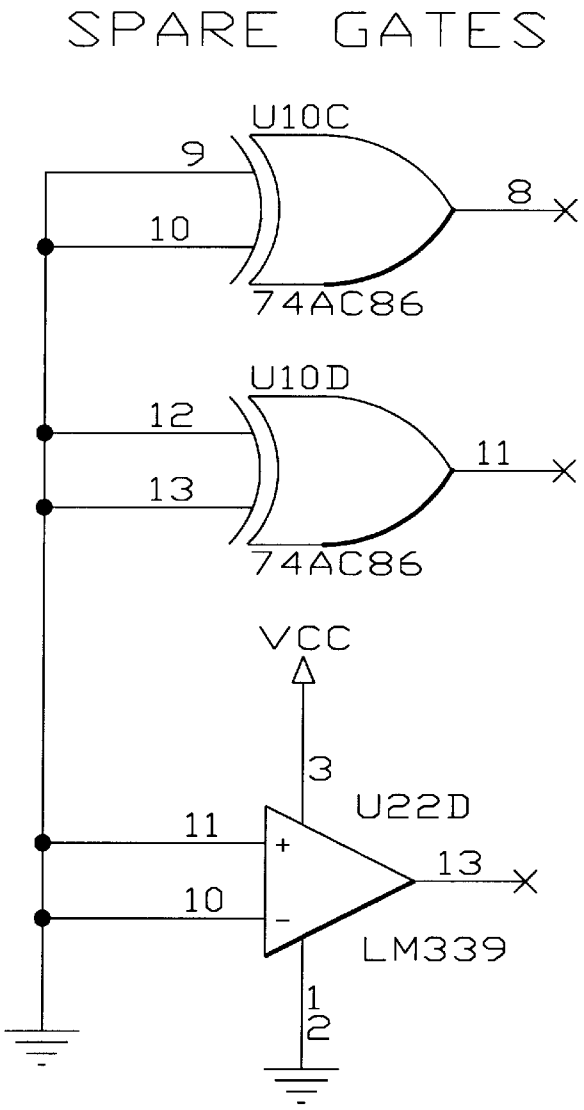

Referring to FIGS. 42 and 45, the high gain sensor amplifiers use an isolated ground plane on the logic PCB and a separate (+5 F) supply to eliminate noise. The sensor ground is tied to the logic ground by W3 (11A7). The +5 F supply is regulated by U31 (11B4). The Sensor assembly connects to the logic board at J6 (11C6).

The sensor output is a sawtooth waveform of 7.8 KHz at roughly 15 mV peak amplitude when a web is detected. The sensor amplifier consists of two cascaded op-amps, U30A and U30B, each having a voltage gain of 19 for a total gain of 361 (51 dB). The ribbon sensor amplifier gain is 121 (42 dB). The amplified signal is applied to comparator U33A. The comparator output is sampled at the end of each PWM cycle by U32A to provide a stable signal to the processor. The comparator input voltage (U33A pin 3) is +5 V with zero light through the media. The comparator threshold is set to 4.1 V by R91 and R92. Increasing light causes the comparator input to decrease. When the light intensity drives the comparator input below 4.1 V the comparator output goes LOW. The output is registered by the flip-flop causing MEDIA* to go HIGH at the end of the cycle. The MEDIA* line is read through a polled input on the processor (2C8).

The amplifiers are stabilized by auto zeroing during the time that MPWM is LOW. The transmission gates U29A and U29B are turned ON connecting U30A pin 3 and U33A pin 3 to the +5 F supply. The input capacitor, C55, charges according to the ambient light level (LEDs at minimum output). The output capacitor, C56, discharges to zero holding the comparator input at the +5 F supply. When MPWM goes HIGH the transmission gates turn OFF allowing the amplifiers to operate. The LED output ramps up until MPWM goes LOW again. The ramping waveform from the sensor output is amplified.

Figure 44:
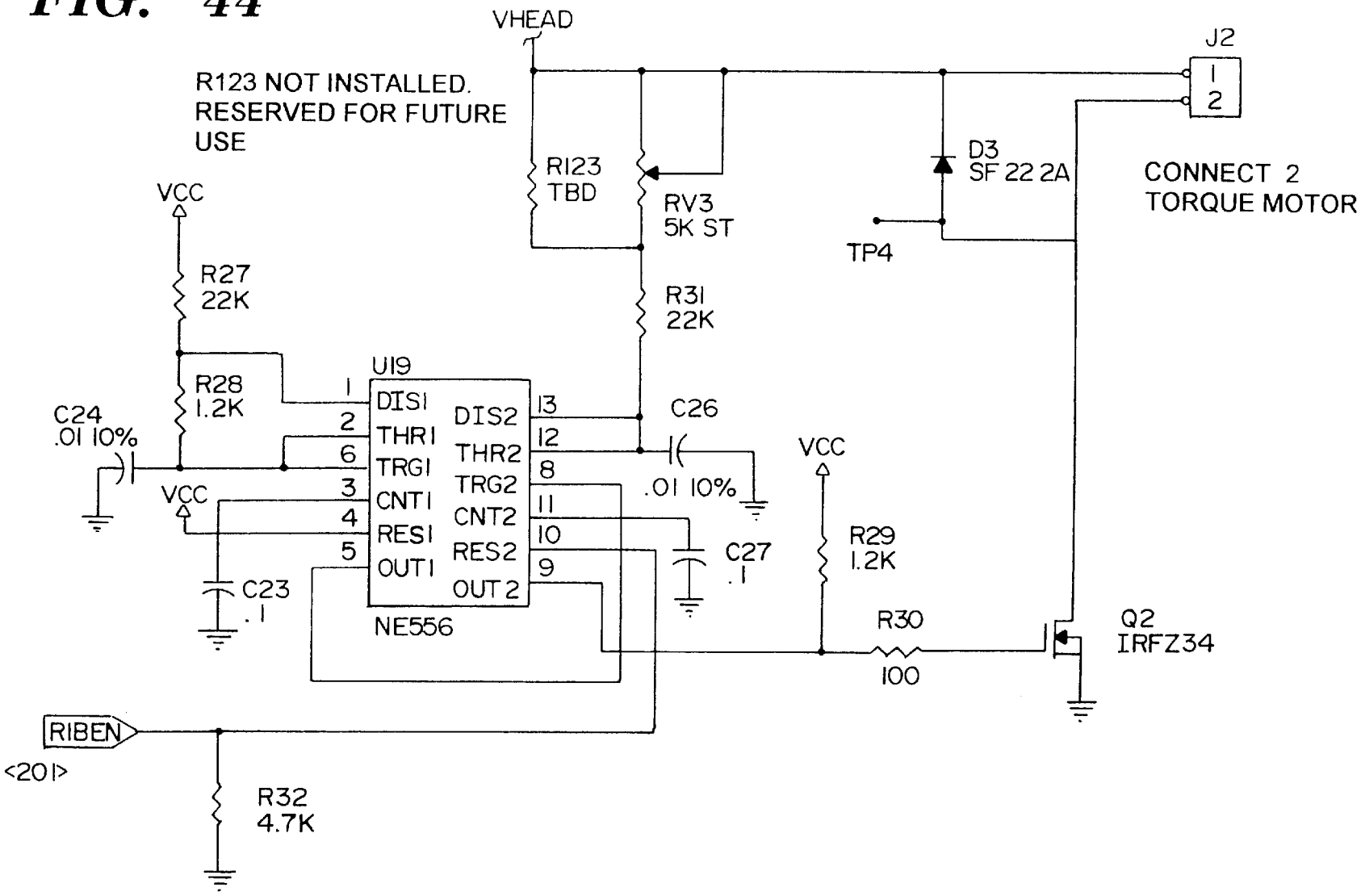

A ribbon torque motor circuit is shown in FIG. 44. The ribbon take-up spindle is driven by a DC motor whose torque is electronically adjusted. The motor is driven by an adjustable switching DC voltage regulator. Section 1 of dual timer U19 operates as a 6 KHz oscillator. Section 2 is a one-shot triggered by the oscillator. The output of section 2 is a continuous pulse train whose duty cycle is adjustable from 15% to 25%. Section 2 drives power FET Q2 providing current to the motor. The free wheeling current continues to flow through D3 when Q2 turns off. Regulation occurs because the timer components of section 2 are driven by VHEAD, not Vcc. As VHEAD is increased the duty cycle of the FET is decreased correspondingly.

Figure 54:
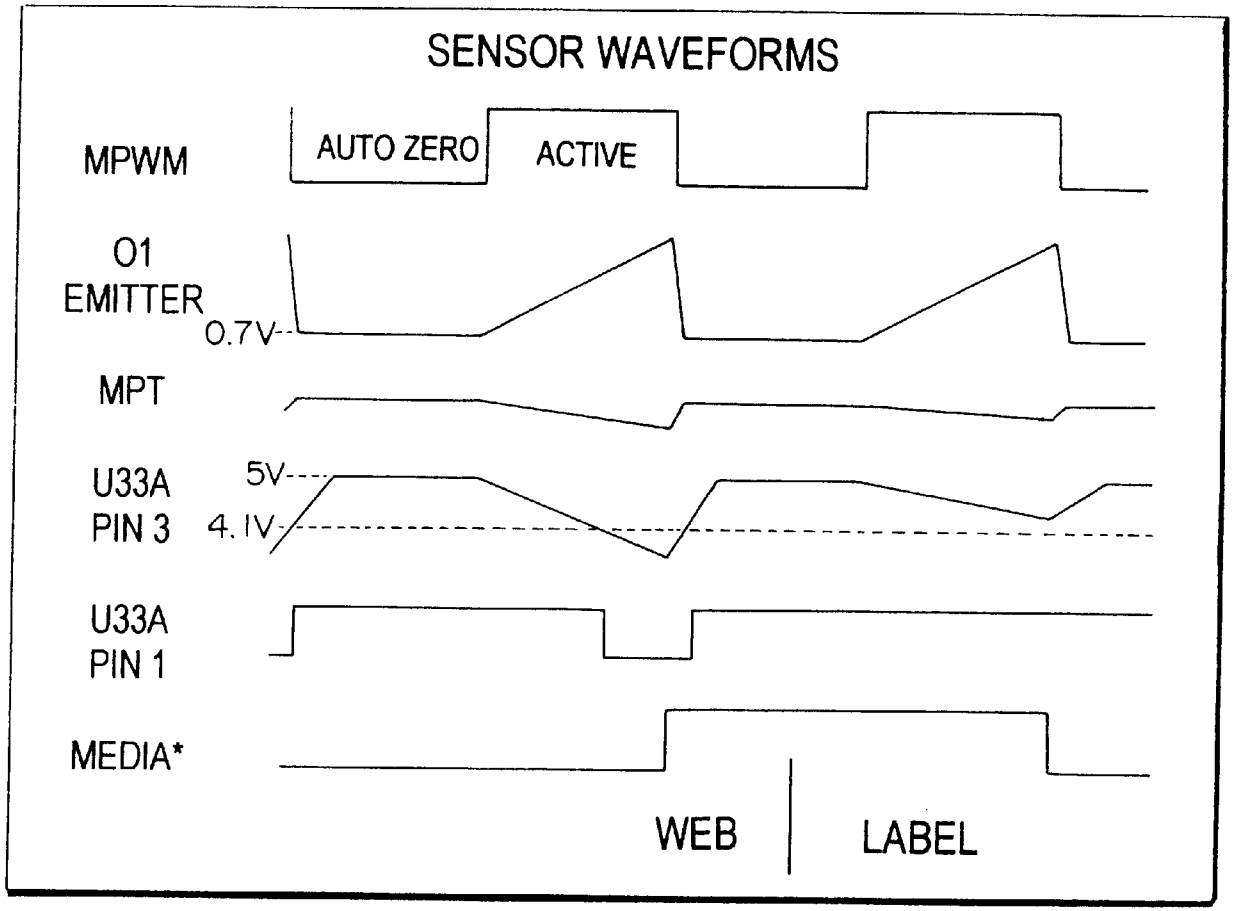
FIG. 54 is a graphical representation of sensor wave forms.

With reference to FIGS. 41 and 54, the sensor board is described. The LEDs are driven by a ramp generator consisting of Q1 and Q2. Q3 holds the ramp generator off and LED current to minimum while MPWM is LOW. The sensor sees a low level reference light while the amplifiers auto zero. When MPWM goes HIGH the LED current, and brightness, increases linearly. The processor sets the LED brightness by controlling the duty cycle (ON time) of MPWM.

The phototransistor, PT1, senses the LED light passing through the media. PT2 is not used. Q7 and diodes D1 and D2 set the operating bias for PT1. Potentiometer RV1 allows gain adjustment. The sensor output is buffered by Q8. The output waveform is a small sawtooth (tens of mV) on a large DC bias (up to 2 V depending on the setting of RV1). The sawtooth portion is amplified and used. The DC portion, including ambient light, is rejected by the sensor amplifiers.

Figure 46:
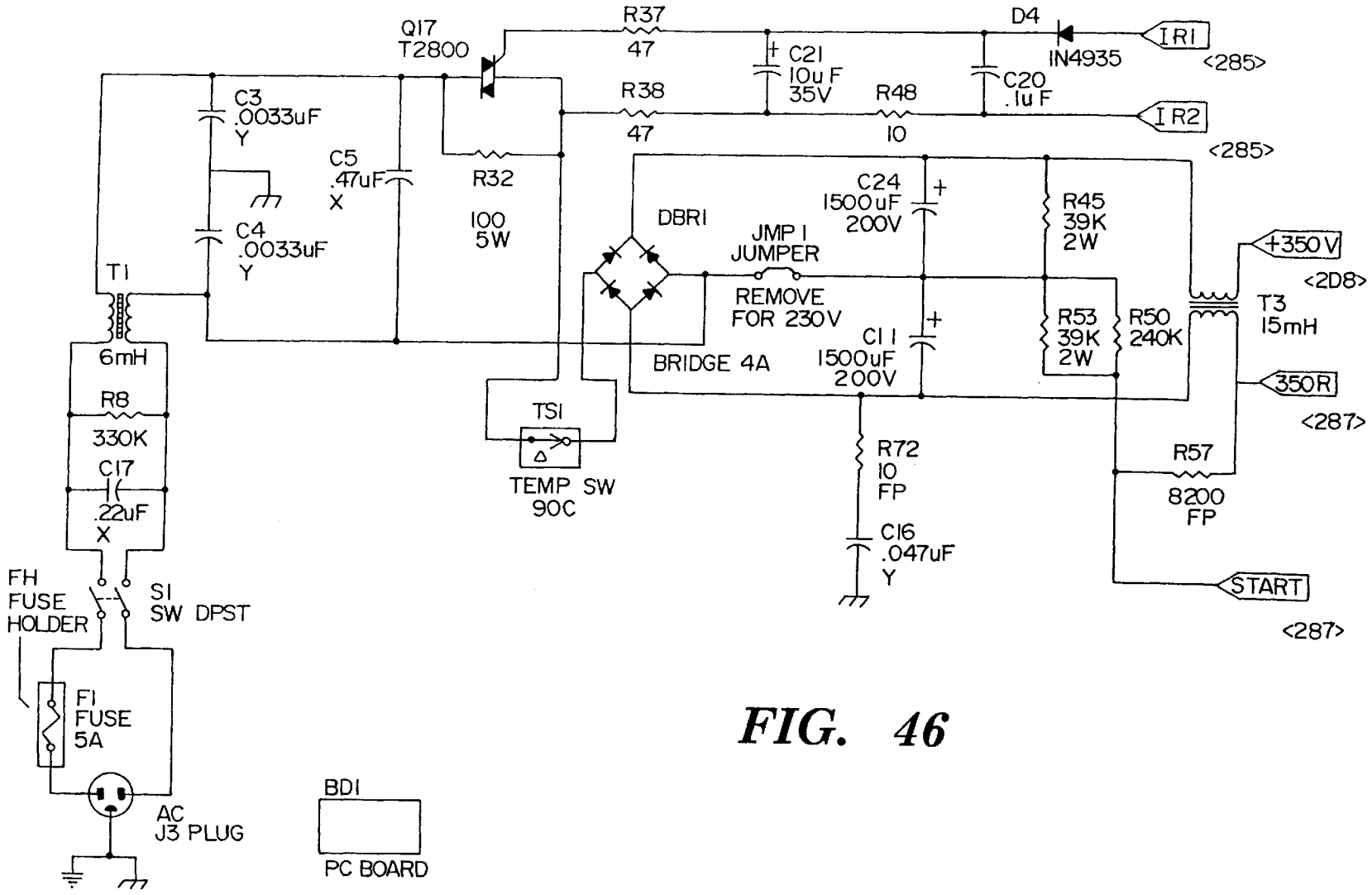
Figures 47, 47A:
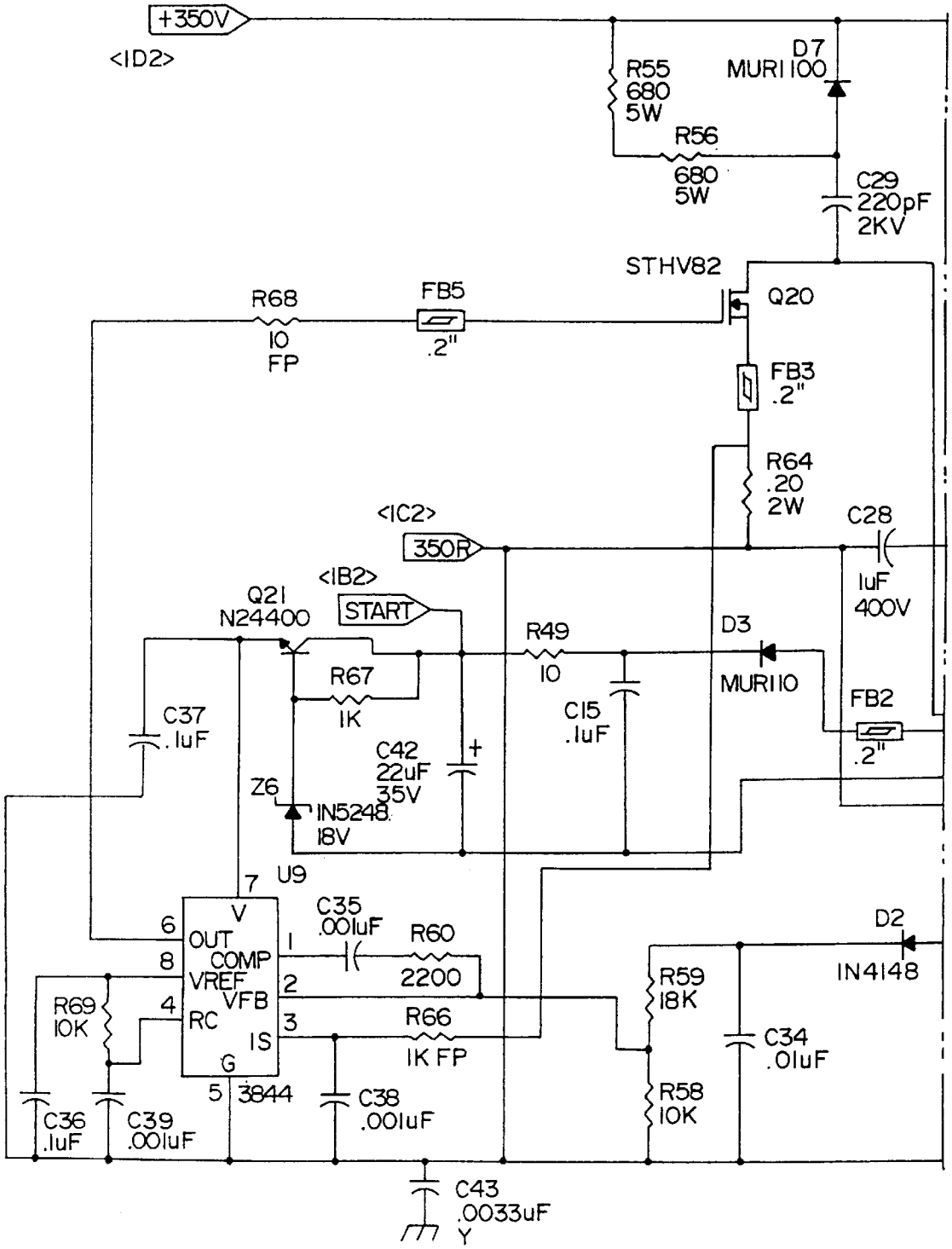
Figure 47B:
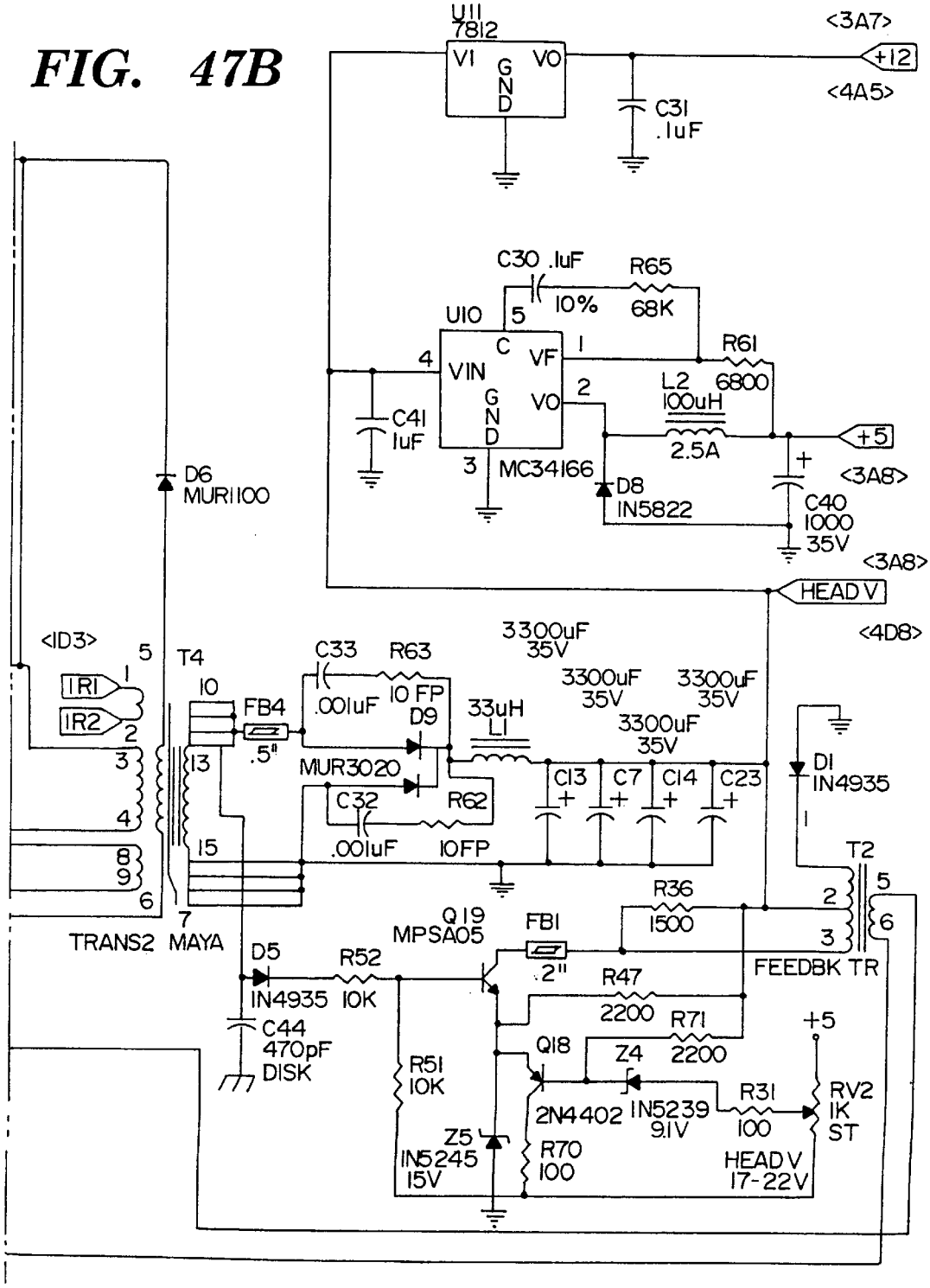
Figure 48A:
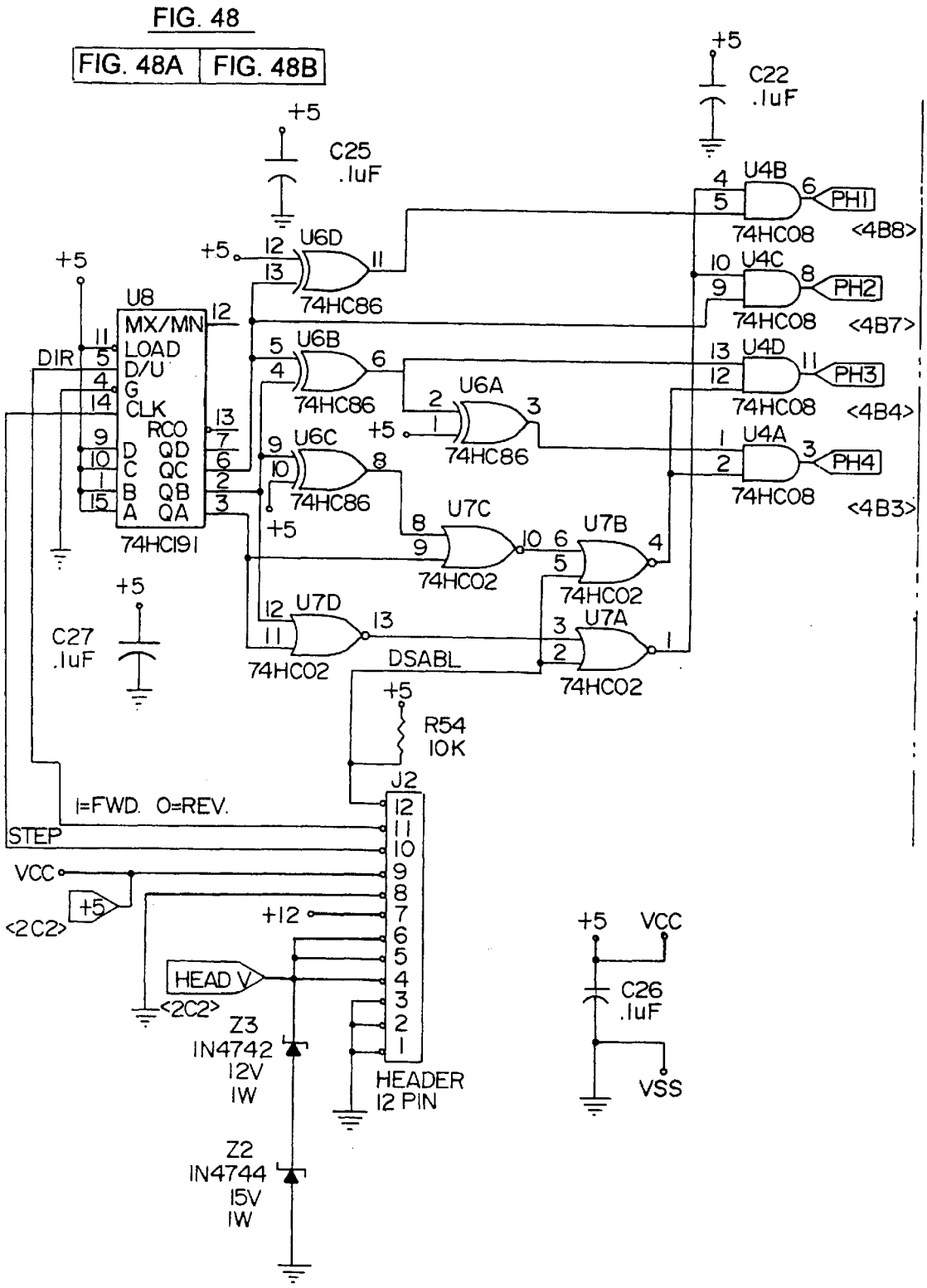
Figure 48B:
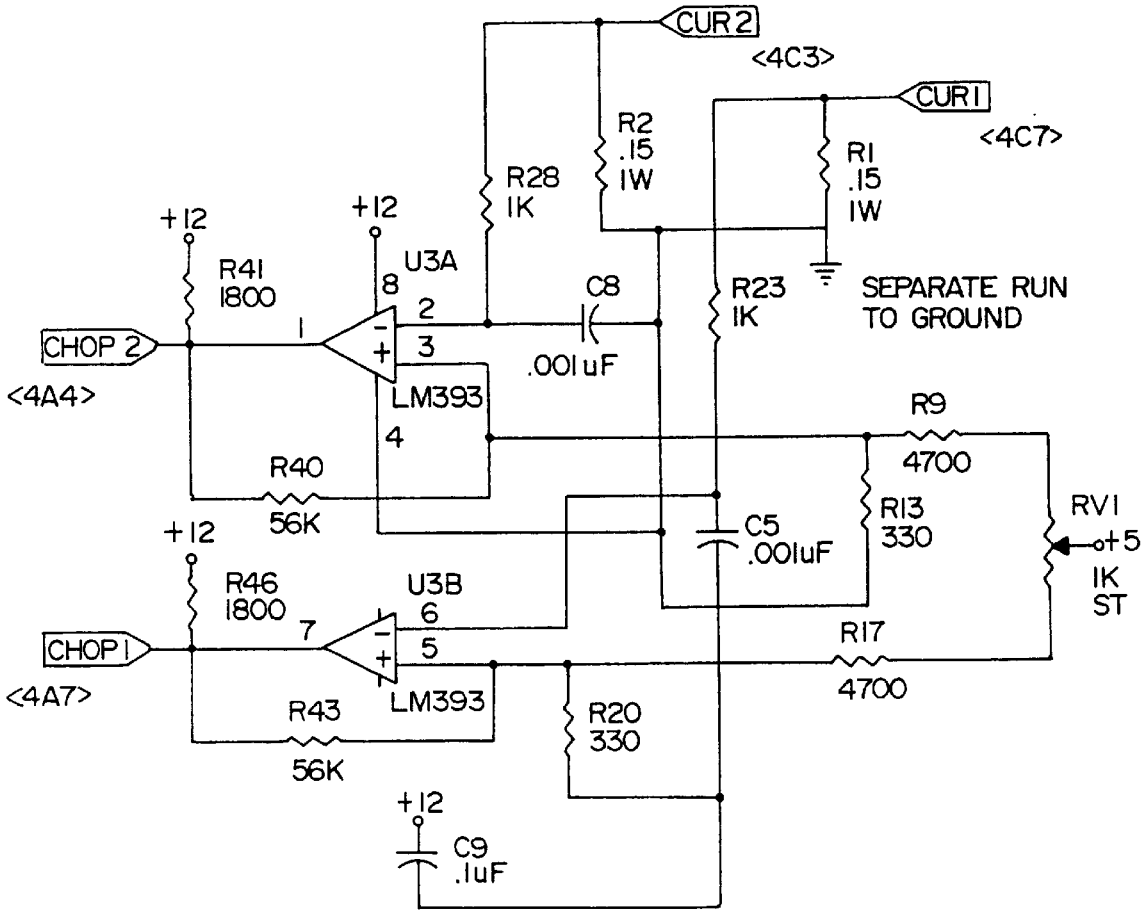
Figure 49A:
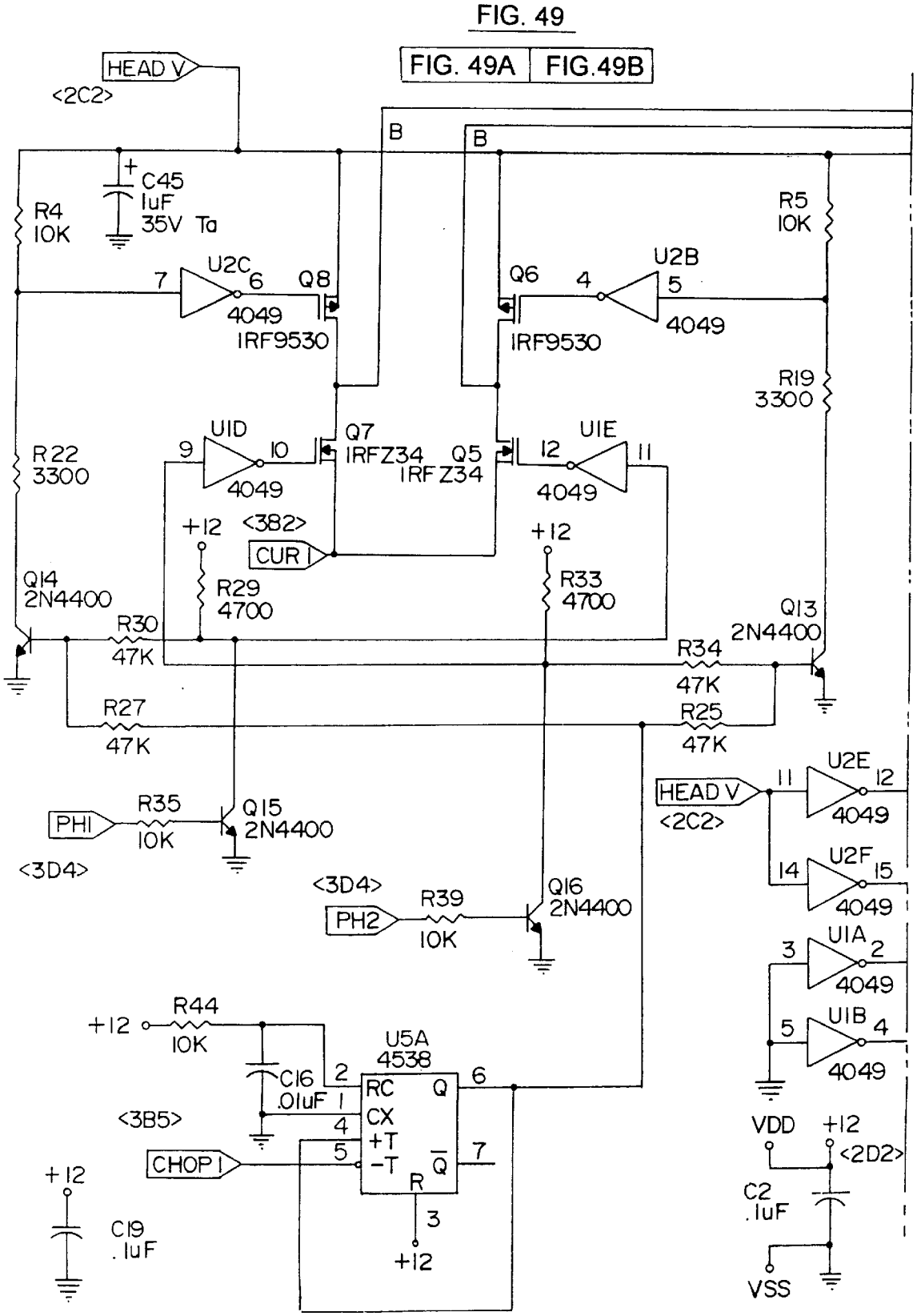
Figure 49B:
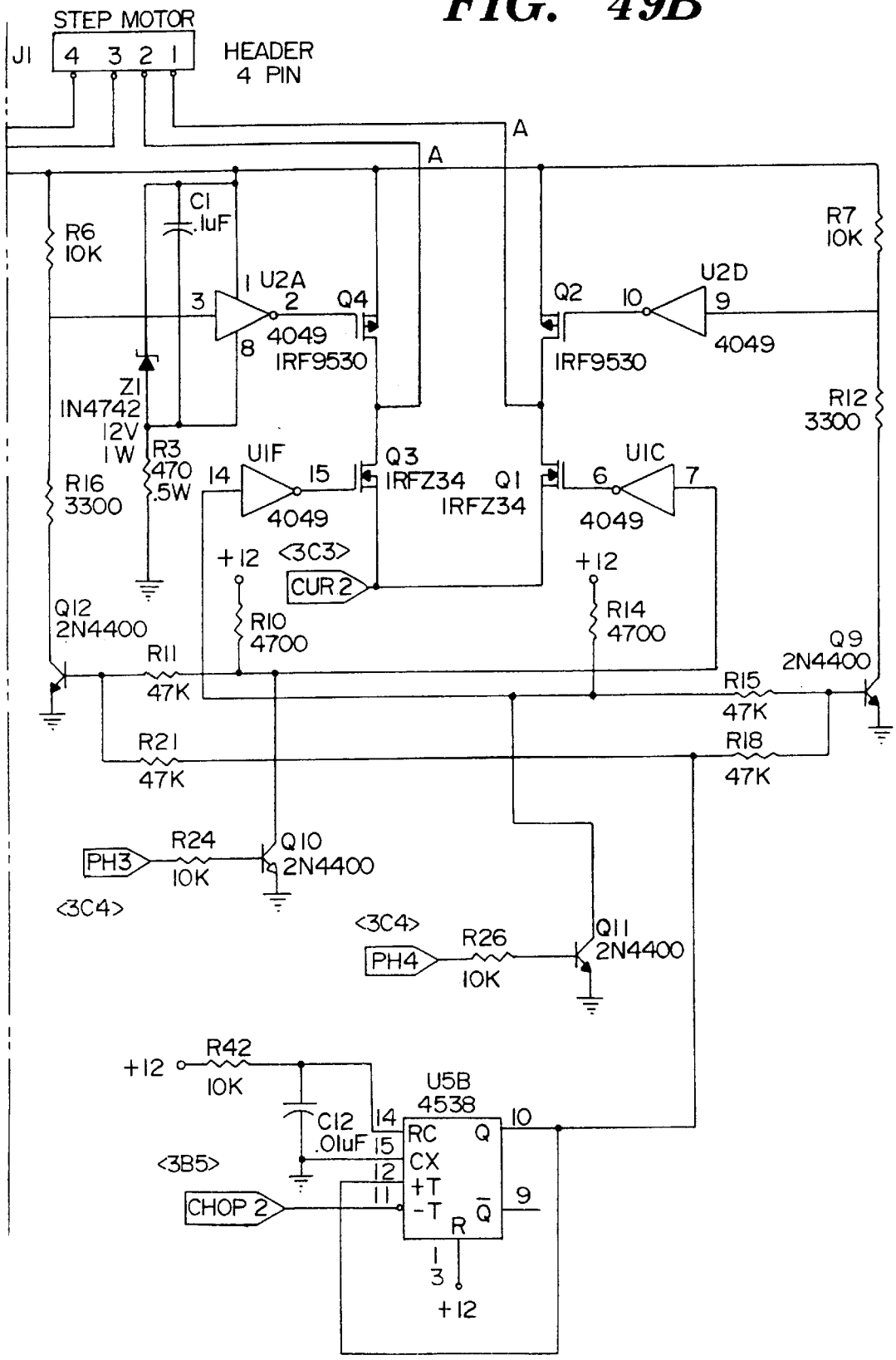
Figure 55:
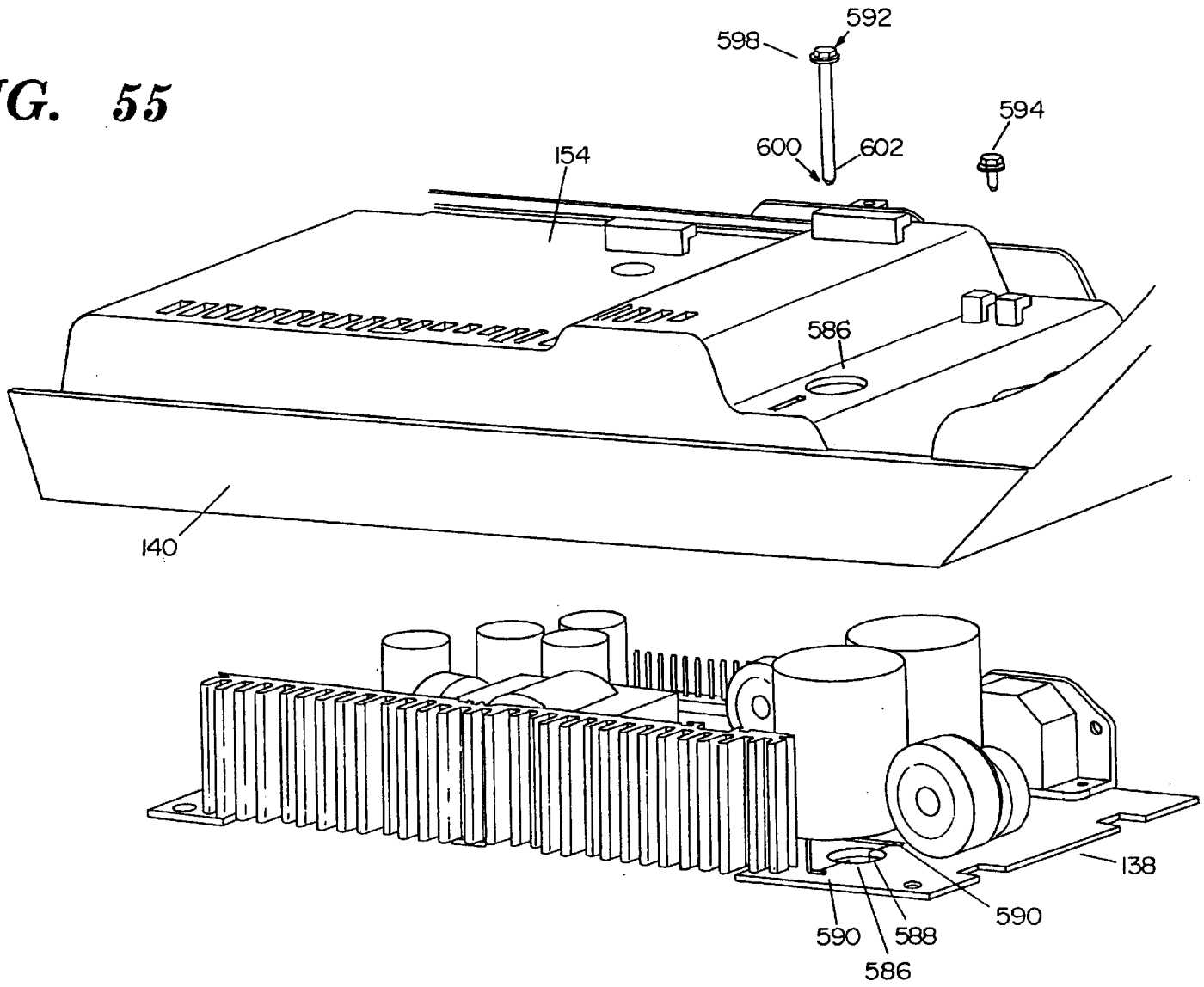
FIG. 55 is an exploded perspective view of a power supply circuit removed from a base cavity of a printer illustrating means for converting the voltage setting of the printer.

FIG. 55 is a perspective view of power supply circuit 128 exploded from base cavity 140. Power supply circuit 128 further includes circuit board aperture 586, having a switch circuit line or wire jumper 588 soldered across it. Wire jumper 588, which is also shown as Jumper JMP1 on power supply circuit of FIG. 46 is soldered to at least a first and second point or printed circuit pads 590 on the power supply circuit 128 and forms a part of the voltage selection circuit of power supply circuit 138.

Figure 56:
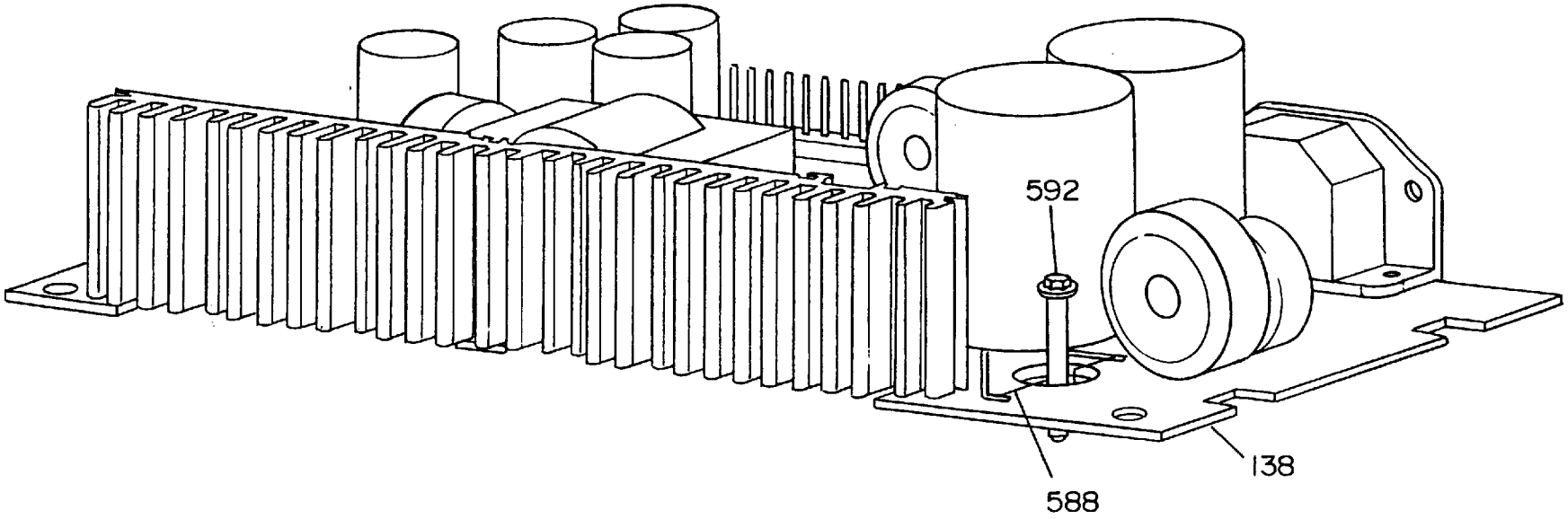
FIG. 56 provides additional detail showing a severing means inserted between a jumper wire to convert the voltage setting of the printer.

FIG. 56 further shows means for severing 592 and a short plug 594, made of plastic or equivalent electrically insulative material, one or the other of which is inserted into aperture 586 in deck 154. The severing means 592 includes a head end 598 and a severing end 600. The severing end 600 has a retaining segment 602 such as outwardly extending barbs which engage an inside surface of the base foundation 140 surrounding the control aperture 596. The severing means 592 and plug means 594 are shaped for a snap-in interference fit with a control aperture 596 and are designed to make removal of the severing means 592 difficult once it has been inserted and snapped into place.

The plug 594 does not extend below deck 154 when inserted in the aperture 586 and does not contact power supply circuit 138. It serves to prevent probes or tools from being inserted into aperture 586 and coming into contact with wire jumper 588 or other electrical components.

The severing means 592 is dimensioned to reach through aperture 586 in power supply circuit 138 thereby breaking jumper 588 and permanently changing the voltage setting of the circuit 138. The severing means 592 further remains in a gap created when the jumper 588 is severed to insulate the broken ends of jumper 588 from each other.

FIG. 56A is a detail view of power supply circuit 138 after insertion of the severing means 592.

The invention is claimed as follows:

1. A demand printer of the type used for printing on tickets, tags, pressure sensitive labels and other media, said printer having various components and comprising:

a structure for supporting said components;

a power supply circuit for receiving power from an external source and conditioning said power for the operation of said printer;

input means for receiving command signals related to the operation of said printer;

control circuit means mounted on said structure and coupled to said input means and said power supply circuit for processing said command signals and generating corresponding control signals for controlling the operation of said printer;

printhead means for receiving said control signals from said control circuit means and printing indicia onto said media;

media delivery means operatively associated with said printhead means and coupled to said control circuit means for moving said media to said printhead means in response to said control signals;

a ribbon take-up spindle of said media delivery means for accumulating spent printing ribbon and facilitating removal of said ribbon from said spindle, said spindle having a surface with a protrusion bore formed therethrough;

at least one protruding segment extending through said protrusion bore in said spindle, said protruding segment controllably projecting away from said spindle surface for maintaining a space between a portion of said spindle surface and said spent ribbon accumulated on said spindle;

biasing means operatively associated with said spindle and said protruding segment for controllably biasedly directing said protruding segment through said protrusion bore in said spindle;

means for retracting said protruding segment operatively associated with said biasing means, said retracting means controllably compressing and expanding said biasing means for controllably moving said protruding segment through said protrusion bore.

2. A demand printer as recited in claim 1, wherein:

said spindle having a central axis; said protrusion bore defining a slot through said surface of said spindle parallel to said central spindle axis;

said at least one protruding segment defining at least one blade radially projecting from said central spindle axis through said slot;

a shaft of said retracting means disposed in said spindle and movable along said central spindle axis;

shaft ramps of said retracting means radially extending from said shaft;

blade ramps of said retracting means formed on said at least one blade for cooperatively abutting said shaft ramps moving said least one blade in a radial direction relative to said central spindle axis; and said biasing means operatively associated with said shaft for biasing said shaft ramps against said blade ramps to bias said least one blade through said slot, movement of said shaft compressing said biasing means for allowing movement of said least one blade towards said central spindle axis.

* * * * *

UNITED STATES PATENT AND TRADEMARK OFFICE

CERTIFICATE OF CORRECTION

PATENT NO. : 6,020,906
DATED : February 1, 2000
INVENTOR(S) : Vincent C. Adams, Michael K. Platt, David S. Zubriski and Thomas P. Zwier.

It is certified that error appears in the above-identified patent and that said Letters Patent is hereby corrected as shown below:

On the title page, item [75]:

Inventors: " Vincent C. Adams
Jeffrey R. Kaufman
Dan E. Monnier
Michael K. Platt
David L. Poole
David A. West
David S. Zubriski
Thomas P. Zwier
Daniel F. Donato
James W. Ensinger
William J. Hamman
Kenneth V. Naegele "

Inventors should read as follows:

-- Vincent C. Adams
Michael K. Platt
David S. Zubriski
Thomas P. Zwier --

Signed and Sealed this

Twelfth Day of December, 2000

*Attest:*

Q. TODD DICKINSON

*Attesting Officer*

*Director of Patents and Trademarks*